US011045017B2

(12) United States Patent
Padvoiskis et al.

(10) Patent No.: US 11,045,017 B2
(45) Date of Patent: Jun. 29, 2021

(54) SHELF-MOUNTED TRAY AND METHODS RELATING TO SAME

(71) Applicant: Retail Space Solutions LLC, Milwaukee, WI (US)

(72) Inventors: Julia Padvoiskis, Milwaukee, WI (US); Matt Wills, Grafton, WI (US); Dan Kaczmarek, Lisbon, WI (US)

(73) Assignee: Retail Space Solutions LLC, Milwaukee, WI (US)

( * ) Notice: Subject to any disclaimer, the term of this patent is extended or adjusted under 35 U.S.C. 154(b) by 0 days.

(21) Appl. No.: 16/498,169

(22) PCT Filed: Apr. 27, 2018

(86) PCT No.: PCT/US2018/029868
§ 371 (c)(1),
(2) Date: Sep. 26, 2019

(87) PCT Pub. No.: WO2018/200997
PCT Pub. Date: Nov. 1, 2018

(65) Prior Publication Data

US 2020/0037784 A1 Feb. 6, 2020

Related U.S. Application Data

(60) Provisional application No. 62/490,760, filed on Apr. 27, 2017, provisional application No. 62/663,147, filed on Apr. 26, 2018.

(51) Int. Cl.
*A47F 1/12* (2006.01)

(52) U.S. Cl.
CPC ..... *A47F 1/126* (2013.01)

(58) Field of Classification Search
CPC ..... A47F 1/125; A47F 1/126; A47F 1/128
See application file for complete search history.

(56) References Cited

U.S. PATENT DOCUMENTS

| | | | |
|---|---|---|---|
| 153,227 | A | 7/1874 | Walkee |
| 159,940 | A | 2/1875 | Levebich |
| 431,373 | A | 7/1890 | Mendenhall |
| 436,704 | A | 9/1890 | Green |
| 452,673 | A | 5/1891 | Hunter |

(Continued)

FOREIGN PATENT DOCUMENTS

| | | | |
|---|---|---|---|
| BE | 906083 | A2 | 4/1987 |
| BE | 1013877 | | 11/2002 |

(Continued)

OTHER PUBLICATIONS

International Preliminary Report on Patentability in corresponding PCT Application No. PCT/US2018/029868, dated Oct. 29, 2019.

(Continued)

*Primary Examiner* — Stanton L Krycinski
(74) *Attorney, Agent, or Firm* — Andrus Intellectual Property Law, LLP

(57) ABSTRACT

A product display comprising a rail having a channel and a tray. The tray comprises a first sidewall, a second sidewall, and a product support surface. The tray further comprises an engagement portion having at least one protrusion configured to engage the channel.

12 Claims, 121 Drawing Sheets

(56) References Cited

U.S. PATENT DOCUMENTS 551,642 A 12/1895 Kleine
607,890 A 7/1898 Smith
632,231 A 5/1899 Blades
607,891 A 9/1899 Smith
808,067 A 12/1905 Briggs
847,863 A 3/1907 Watts
927,988 A 7/1909 Massey
1,030,317 A 6/1912 Middauge
1,271,508 A 7/1918 Hall
1,282,532 A 10/1918 Bochenek
1,674,582 A 6/1928 Wheeler
1,703,987 A 3/1929 Butler
1,786,392 A 12/1930 Kemp
1,910,516 A 5/1933 Besenberg
1,964,597 A 6/1934 Rapellin
1,971,749 A 8/1934 Hamilton
2,013,284 A 9/1935 Michaud
2,076,941 A 4/1937 Farr
2,079,754 A 5/1937 Waxgiser
2,110,299 A 3/1938 Hinkle
2,129,122 A 9/1938 Follett
2,218,444 A 10/1940 Vineyard
2,284,849 A 6/1942 Schreyer
2,308,851 A 1/1943 Anderson
2,499,088 A 2/1950 Brill
2,516,122 A 7/1950 Hughes
2,538,908 A 1/1951 Mckeehan
2,555,102 A 5/1951 Anderson
2,652,154 A 9/1953 Stevens
2,678,045 A 5/1954 Erhard
2,730,825 A 1/1956 Wilds
2,738,881 A 3/1956 Gino
2,750,049 A 6/1956 Hunter
2,775,365 A 12/1956 Mestman
2,889,907 A 6/1959 Sullivan
2,893,596 A 7/1959 Gabrielsen
2,934,212 A 4/1960 Jacobson
3,083,067 A 3/1963 Holtz
3,089,675 A 5/1963 Lozier
3,110,402 A 11/1963 Mogulescu
3,121,494 A 2/1964 Berk
3,161,295 A 12/1964 Taylor
3,166,195 A 1/1965 Taber
3,182,945 A 5/1965 Sedo
3,248,079 A 4/1966 Kennedy
3,308,961 A 3/1967 Chesley
3,339,746 A 9/1967 Mccabe
3,405,716 A 10/1968 Cafiero
3,452,899 A 7/1969 Libberton
3,501,016 A 3/1970 Eaton
3,501,019 A 3/1970 Armstrong
D219,058 S 10/1970 Kaczur
3,550,979 A 12/1970 Protzmann
3,587,867 A 6/1971 Fenwick
3,698,568 A * 10/1972 Armstrong ..... A47F 5/005 211/184
3,751,129 A 8/1973 Dean
3,776,388 A 12/1973 Mattheis
3,780,876 A 12/1973 Elkins
3,814,490 A 6/1974 Dean
3,815,519 A 6/1974 Meyer
3,832,957 A 9/1974 Mendenhall
3,848,745 A 11/1974 Smith
3,868,021 A 2/1975 Heinrich
3,873,195 A 3/1975 Otto
3,893,739 A 7/1975 Bernard
3,949,880 A 4/1976 Fortunato
3,960,273 A 6/1976 Weston
3,987,384 A 10/1976 Bohlke
4,007,841 A 2/1977 Seipel
4,015,886 A 4/1977 Wickenberg
4,042,096 A 8/1977 Smith
4,084,703 A 4/1978 Hossalla
4,106,668 A 8/1978 Gebhardt
4,168,780 A 9/1979 Parrott
4,200,201 A 4/1980 Collins
4,205,763 A 6/1980 Merl
4,239,099 A 12/1980 Brown, Jr.
4,239,100 A 12/1980 Corey
4,269,326 A 5/1981 Delbrouck
RE30,706 E 8/1981 Bustos
4,300,693 A 11/1981 Spamer
4,303,162 A 12/1981 Suttles
4,351,439 A 9/1982 Taylor
4,357,439 A 11/1982 Blumel
4,372,451 A 2/1983 Rasmussen
4,394,910 A 7/1983 Miller
4,397,606 A 8/1983 Bruton
4,405,052 A 9/1983 Spiros
4,416,380 A 11/1983 Flum
4,448,653 A 5/1984 Wegmann
4,453,641 A 6/1984 Rasmussen
4,454,948 A 6/1984 Spamer
4,454,949 A 6/1984 Flum
4,460,096 A 7/1984 Ricci
4,462,854 A 7/1984 Wenstrom
D275,058 S 8/1984 Flum
4,463,854 A 8/1984 MacKenzie
4,470,943 A 9/1984 Preis
4,478,337 A 10/1984 Flum
4,482,066 A 11/1984 Dykstra
4,488,653 A 12/1984 Belokin
4,525,882 A 7/1985 Stenberg
4,531,311 A 7/1985 Howard
4,590,696 A 5/1986 Squitieri
4,593,823 A 6/1986 Fershko
4,610,413 A 9/1986 Pedersen
4,615,276 A * 10/1986 Garabedian ..... A47F 5/005 108/61
4,629,072 A 12/1986 Loew
4,651,883 A 3/1987 Gullett
4,685,574 A 8/1987 Young
4,688,341 A 8/1987 Castel
4,705,175 A 11/1987 Howard et al.
4,706,821 A 11/1987 Kohls
4,712,694 A 12/1987 Breslow
4,724,968 A 2/1988 Wombacher
4,730,741 A 3/1988 Jackle
4,735,324 A 4/1988 Wilcek
4,742,936 A 5/1988 Rein
4,762,235 A 8/1988 Howard
4,762,236 A * 8/1988 Jackle, III ..... A47F 1/126 211/59.3
4,765,493 A 8/1988 Kinney
4,771,898 A 9/1988 Howard
4,775,058 A 10/1988 Yatsko
4,801,025 A 1/1989 Flum
4,809,855 A 3/1989 Bustos
4,826,115 A 5/1989 Novitski
4,830,201 A 5/1989 Breslow
4,836,390 A 6/1989 Polvere
4,887,737 A 12/1989 Adenau
4,896,779 A 1/1990 Jureckson
4,899,893 A 2/1990 Robertson
4,901,869 A 2/1990 Hawkinson
4,907,707 A 3/1990 Crum
4,923,070 A 5/1990 Jackle
4,934,645 A 6/1990 Breslow
4,944,924 A 7/1990 Mawhirt
4,958,739 A 9/1990 Spamer
RE33,515 E 1/1991 Fershko
4,997,094 A 3/1991 Spamer
5,012,936 A 5/1991 Crum
5,024,336 A 6/1991 Spamer
5,069,408 A 12/1991 Bessinger
5,085,154 A 2/1992 Merl
5,088,607 A 2/1992 Risafi
5,111,942 A 5/1992 Bernardin
5,123,546 A 6/1992 Crum
5,150,885 A 9/1992 Leone
5,159,753 A 11/1992 Torrence
5,161,704 A 11/1992 Valiulis
5,185,948 A 2/1993 Markson
5,190,186 A 3/1993 Yablans

(56) References Cited

U.S. PATENT DOCUMENTS 5,197,215 A 3/1993 Torsleff
5,197,610 A 3/1993 Bustos
5,203,463 A 4/1993 Gold
5,263,269 A 11/1993 Tjarnlund
5,265,738 A 11/1993 Yablans
5,265,740 A 11/1993 Hodsden
5,295,596 A 3/1994 Squitieri
5,322,668 A 6/1994 Tomasso
5,366,099 A 11/1994 Schmid
5,390,802 A * 2/1995 Pappagallo ..... A47B 45/00 211/187
5,397,006 A 3/1995 Terrell
5,397,016 A 3/1995 Torrence
5,405,193 A 4/1995 Herrenbruck
5,413,229 A 5/1995 Zuberbuhler
5,427,255 A 6/1995 Nook
5,439,122 A 8/1995 Ramsay
5,450,968 A 9/1995 Bustos
5,450,969 A 9/1995 Johnson
5,469,976 A 11/1995 Burchell
5,505,315 A 4/1996 Carroll
5,570,811 A 11/1996 Wittern
5,582,376 A 12/1996 Thompson
5,597,150 A 1/1997 Stein
D378,888 S 4/1997 Bertilsson
5,634,564 A 6/1997 Spamer
5,638,963 A 6/1997 Finnelly
5,641,082 A 6/1997 Grainger
5,645,176 A 7/1997 Jay
5,655,670 A 8/1997 Stuart
5,657,702 A 8/1997 Ribeyrolles
5,671,851 A 9/1997 Johnson
5,673,801 A 10/1997 Markson
D386,363 S 11/1997 Dardashti
5,682,824 A 11/1997 Visk
5,685,664 A 11/1997 Parham
5,685,864 A 11/1997 Shanley
5,690,038 A 11/1997 Merit
5,695,076 A 12/1997 Jay
5,695,077 A 12/1997 Jay
5,707,034 A 1/1998 Cotterill
5,711,432 A 1/1998 Stein
5,720,230 A 2/1998 Mansfield
5,738,019 A 4/1998 Parker
5,749,478 A 5/1998 Ellis
5,749,616 A 5/1998 Steever
5,839,588 A * 11/1998 Hawkinson ..... A47F 1/126 211/59.3
D402,490 S 12/1998 Parham
5,848,709 A 12/1998 Gelphman
5,855,283 A 1/1999 Johnson
D405,632 S 2/1999 Parham
5,865,324 A 2/1999 Jay
5,873,473 A 2/1999 Pater
5,873,489 A 2/1999 Ide
5,887,732 A 3/1999 Zimmer
5,904,256 A 5/1999 Jay
5,944,201 A 8/1999 Babboni
5,970,887 A 10/1999 Hardy
5,971,173 A 10/1999 Valiulis
5,975,318 A 11/1999 Jay
5,992,652 A 11/1999 Springs
6,006,678 A 12/1999 Merit
6,021,908 A 2/2000 Mathews
6,026,984 A 2/2000 Perrin
6,029,833 A 2/2000 Yeh
6,041,720 A * 3/2000 Hardy ..... A47B 96/02 108/60
6,044,982 A 4/2000 Stuart
6,062,399 A 5/2000 Henry
6,068,142 A 5/2000 Primiano
6,082,556 A 7/2000 Primiano
6,082,557 A 7/2000 Leahy
6,129,218 A 10/2000 Henry
6,131,748 A 10/2000 Kawasaki
6,142,316 A 11/2000 Harbour
6,142,317 A 11/2000 Merl
6,164,462 A 12/2000 Mumford
6,189,734 B1 2/2001 Apps
6,209,731 B1 4/2001 Spamer
6,227,385 B1 5/2001 Nickerson
6,237,784 B1 5/2001 Primiano
D445,615 S 7/2001 Burke
6,253,954 B1 7/2001 Yasaka
6,299,004 B1 10/2001 Thalenfeld
6,305,559 B1 10/2001 Hardy
6,308,839 B1 10/2001 Steinberg
6,311,852 B1 11/2001 Ireland
6,325,221 B2 12/2001 Parham
6,325,222 B1 12/2001 Avery
6,330,758 B1 12/2001 Feibelman
6,357,606 B1 * 3/2002 Henry ..... A47F 1/126 211/184
6,375,015 B1 4/2002 Wingate
6,382,431 B1 5/2002 Burke
6,389,991 B1 5/2002 Morrisson
6,394,470 B1 5/2002 Shirai
6,398,044 B1 6/2002 Robertson
6,401,942 B1 6/2002 Eckert
6,405,880 B1 6/2002 Webb
6,409,026 B2 6/2002 Watanabe
6,409,028 B2 6/2002 Nickerson
6,419,100 B1 7/2002 Menz
6,428,123 B1 8/2002 Lucht
6,435,359 B1 8/2002 Priminano
6,439,402 B2 8/2002 Robertson
6,464,089 B1 10/2002 Rankin, VI
6,471,053 B1 10/2002 Feibelman
6,474,484 B1 11/2002 Miller
6,481,133 B1 11/2002 DeSena
6,497,326 B1 * 12/2002 Osawa ..... A47F 7/28 211/59.2
6,505,747 B1 1/2003 Robertson
6,511,082 B2 1/2003 Shirai
6,523,702 B1 2/2003 Primiano
6,527,127 B2 3/2003 Dumontet
6,527,129 B2 3/2003 Osawa
6,533,131 B2 3/2003 Bada
D472,411 S 4/2003 Burke
6,554,143 B1 4/2003 Robertson
6,598,754 B2 7/2003 Weiler
6,604,638 B1 8/2003 Primiano
6,615,995 B2 9/2003 Primiano
6,622,874 B1 9/2003 Hawkinson
6,629,617 B2 10/2003 Osawa
6,637,604 B1 10/2003 Jay
6,648,151 B2 11/2003 Battaglia
6,659,293 B1 12/2003 Smith
6,666,533 B1 12/2003 Stavros
D485,699 S 1/2004 Mueller
6,679,033 B2 1/2004 Hart
6,679,389 B1 1/2004 Robertson
6,691,891 B2 2/2004 Maldonado
6,695,152 B1 2/2004 Fabrizio
6,702,127 B2 3/2004 Primiano
6,715,621 B2 4/2004 Boron
6,722,509 B1 4/2004 Robertson
6,726,039 B2 4/2004 Boron
RE38,517 E 5/2004 Pfeiffer
6,739,461 B1 5/2004 Robinson
6,745,905 B2 6/2004 Bernstein
6,756,975 B1 6/2004 Kishida
6,758,349 B1 7/2004 Kwap
6,766,911 B2 7/2004 Higgins
6,769,552 B1 8/2004 Thalenfeld
6,779,670 B2 8/2004 Primiano
6,786,341 B2 9/2004 Stinnett
6,796,445 B2 9/2004 Cyrluk
6,799,523 B1 10/2004 Cunha
6,820,754 B2 11/2004 Ondrasik
6,824,046 B2 11/2004 Brexel
6,843,382 B2 1/2005 Kanouchi
6,860,046 B1 3/2005 Squitieri
6,867,824 B2 3/2005 Eiraku

(56) References Cited

U.S. PATENT DOCUMENTS 6,874,646 B2 4/2005 Jay
6,886,699 B2 5/2005 Johnson et al.
6,889,855 B2 5/2005 Nagel
D506,623 S 6/2005 Ohkubo
6,902,285 B2 6/2005 Eiraku
6,918,495 B1 7/2005 Hoy
6,918,736 B2 7/2005 Hart
6,919,933 B2 7/2005 Zhang
D508,350 S 8/2005 Higuchi
6,923,330 B1 8/2005 Nagel
6,929,133 B1 8/2005 Knapp
6,955,269 B2 10/2005 Menz
6,957,941 B2 10/2005 Hart
6,962,260 B2 11/2005 Jay
6,963,386 B2 11/2005 Poliakine
6,964,235 B2 * 11/2005 Hardy ..... A47F 1/126 108/61
6,964,344 B1 11/2005 Kim
6,976,598 B2 12/2005 Engel
6,981,597 B2 1/2006 Cash
7,004,334 B2 2/2006 Walsh
7,007,614 B2 3/2006 Gaunt
D519,309 S 4/2006 Terada
7,025,217 B2 4/2006 Crown et al.
7,028,450 B2 4/2006 Hart
7,028,852 B2 4/2006 Johnson et al.
D520,776 S 5/2006 Richter et al.
7,040,494 B2 5/2006 Harper
D524,576 S 7/2006 Nomoto
7,080,969 B2 7/2006 Hart
7,086,541 B2 8/2006 Robertson
7,093,546 B2 8/2006 Hardy
7,104,026 B2 9/2006 Welborn
7,104,410 B2 9/2006 Primiano
7,108,143 B1 9/2006 Lin
D529,313 S 10/2006 Nomoto
D529,737 S 10/2006 Terada
D530,117 S 10/2006 Nomoto
7,124,898 B2 10/2006 Richter et al.
7,140,499 B2 11/2006 Burke
7,140,705 B2 11/2006 Dressendorfer
7,150,365 B2 12/2006 Hardy
7,152,536 B2 12/2006 Hardy
7,168,579 B2 1/2007 Richter et al.
7,182,209 B2 2/2007 Squitieri
7,195,123 B2 3/2007 Roslof et al.
D541,082 S 4/2007 Nomoto
7,198,340 B1 4/2007 Ertz
7,216,770 B2 * 5/2007 Mueller ..... A47F 1/126 211/59.3
7,229,143 B2 6/2007 Gilman
D556,031 S 11/2007 Johnson
7,293,663 B2 11/2007 Lavery
7,299,934 B2 11/2007 Hardy
7,306,301 B2 12/2007 Walburn
7,311,211 B2 12/2007 Chung
7,318,532 B1 1/2008 Lee
D564,865 S 3/2008 Johnson
7,347,335 B2 3/2008 Rankin, VI
7,357,469 B2 4/2008 Ertz
7,389,886 B2 6/2008 Hardy
7,395,938 B2 7/2008 Merit
7,404,494 B2 7/2008 Hardy
7,419,062 B2 9/2008 Mason
7,424,957 B1 * 9/2008 Luberto ..... A47F 1/126 211/59.3
7,438,268 B2 10/2008 Kologe
7,451,881 B2 11/2008 Hardy
7,462,012 B2 12/2008 Hart
7,469,791 B2 12/2008 Phoy
7,497,341 B2 3/2009 Hardy
7,497,342 B2 3/2009 Hardy
7,506,769 B2 3/2009 Howerton
7,614,350 B2 11/2009 Tuttle
7,621,409 B2 11/2009 Hardy
7,626,913 B2 12/2009 Usami
7,628,282 B2 12/2009 Hardy
7,641,057 B2 1/2010 Mueller
7,661,545 B2 2/2010 Hardy
7,665,618 B2 2/2010 Jay
7,669,722 B2 3/2010 Hardy
7,681,743 B2 3/2010 Hanretty
7,681,744 B2 3/2010 Johnson
7,681,745 B2 3/2010 Richter
7,703,614 B2 4/2010 Schneider
D615,389 S 5/2010 Shinozaki
D615,390 S 5/2010 Shinozaki
7,784,623 B2 8/2010 Mueller
7,823,734 B2 11/2010 Hardy
7,828,158 B2 11/2010 Colelli
7,854,333 B2 12/2010 Kottke et al.
7,891,503 B2 2/2011 Hardy
7,905,364 B2 3/2011 Pail
7,913,861 B2 3/2011 Mueller
7,918,353 B1 4/2011 Luberto
7,922,010 B2 4/2011 Hardy
7,931,156 B2 4/2011 Hardy
7,934,609 B2 5/2011 Alves
7,971,735 B2 7/2011 Mueller
7,980,398 B2 7/2011 Kahl
7,992,726 B2 8/2011 Goehring
8,016,139 B2 9/2011 Hanners
8,025,162 B2 9/2011 Hardy
8,047,385 B2 11/2011 Hardy
8,056,734 B2 11/2011 Menz
8,096,427 B2 1/2012 Hardy
8,104,630 B2 1/2012 Schneider
8,113,360 B2 2/2012 Olson
8,113,601 B2 2/2012 Hardy
8,118,181 B2 2/2012 Shinozaki
D655,107 S 3/2012 Clark
8,127,944 B2 3/2012 Hardy
8,136,682 B2 3/2012 Hardy
8,162,154 B2 4/2012 Trulaske
8,167,149 B2 5/2012 Wamsley
8,172,094 B2 5/2012 Meyer
8,177,076 B2 * 5/2012 Rataiczak, III ..... A47F 1/126 211/59.3
8,210,363 B2 7/2012 Hardy
8,215,520 B2 7/2012 Miller
8,225,946 B2 7/2012 Yang
8,235,222 B2 8/2012 Hardy
8,235,227 B2 8/2012 Hardy
8,267,261 B2 9/2012 Vanderhoek et al.
8,276,766 B2 10/2012 Rataiczak, III
8,312,999 B2 11/2012 Hardy
8,317,038 B2 11/2012 Luberto
8,322,544 B2 12/2012 Hardy
8,342,340 B2 1/2013 Rataiczak
8,353,425 B2 1/2013 Lockwood
8,360,253 B2 1/2013 Hardy
8,397,922 B2 3/2013 Kahl
8,413,823 B2 4/2013 Hardy
8,424,466 B2 4/2013 Botkin
8,453,850 B2 6/2013 Hardy
8,453,851 B2 * 6/2013 Ciesick ..... A47F 1/04 211/126.15
8,485,391 B2 7/2013 Vlastakis
8,496,126 B2 * 7/2013 Mueller ..... A47F 1/126 211/59.3
8,505,750 B2 8/2013 Shinozaki
8,505,751 B2 8/2013 Shinozaki
8,505,752 B2 8/2013 Shinozaki
8,561,817 B1 10/2013 Allen
8,579,123 B2 11/2013 Mueller
8,622,227 B2 1/2014 Bird
8,627,965 B2 1/2014 Hardy
8,646,650 B2 2/2014 Lockwood
8,662,319 B2 3/2014 Hardy
8,678,207 B2 3/2014 Shimazaki
8,695,816 B2 4/2014 Troyner
8,720,702 B2 5/2014 Nagel
8,739,984 B2 6/2014 Hardy

(56) References Cited

U.S. PATENT DOCUMENTS 8,746,468 B2 * 6/2014 Poulokefalos ..... A47F 5/005 211/59.3
8,752,717 B2 6/2014 Bird
8,800,811 B2 8/2014 Sherretts
8,820,545 B2 9/2014 Kologe
8,863,963 B2 10/2014 Hardy
8,893,901 B2 11/2014 Nagel
8,893,903 B2 11/2014 Nilsson
8,910,802 B2 12/2014 Hardy
8,967,394 B2 3/2015 Hardy
8,978,903 B2 3/2015 Hardy
8,978,904 B2 3/2015 Hardy
8,998,005 B2 4/2015 Hardy
9,016,482 B2 * 4/2015 Kim ..... A47F 1/126 211/59.2
9,016,483 B2 4/2015 Howley
9,033,164 B2 5/2015 Troyner
9,038,833 B2 5/2015 Ciesick
9,038,854 B2 5/2015 Brugmann
9,060,624 B2 6/2015 Hardy
9,070,261 B2 6/2015 Hardy
9,072,394 B2 7/2015 Hardy
9,084,482 B2 7/2015 Botkin
9,107,515 B2 8/2015 Hardy
9,119,488 B2 9/2015 Lockwood
9,138,075 B2 9/2015 Hardy
9,149,132 B2 10/2015 Hardy
9,167,913 B2 10/2015 Hardy
9,173,504 B2 11/2015 Hardy
9,198,527 B2 12/2015 Goehring
9,226,597 B2 1/2016 Hardy
9,289,078 B2 3/2016 Hardy
9,392,887 B2 7/2016 Nilsson
9,468,310 B2 10/2016 Hardy
9,486,088 B2 11/2016 Hardy
9,504,321 B2 11/2016 Hardy
9,510,677 B2 12/2016 Hardy
9,526,351 B2 12/2016 Hardy
9,538,860 B2 * 1/2017 Brej ..... A47F 1/126
9,549,622 B2 1/2017 Leahy
9,723,934 B2 8/2017 Hardy
9,730,528 B2 8/2017 Hardy
9,730,529 B2 8/2017 Colelli et al.
9,770,121 B2 * 9/2017 Walker ..... A47F 1/125
9,782,017 B1 * 10/2017 Luberto ..... A47F 1/125
D801,734 S 11/2017 Turner et al.
9,877,599 B2 1/2018 Turner et al.
D810,477 S 2/2018 Turner et al.
9,895,007 B2 * 2/2018 Hardy ..... A47B 57/58
D812,945 S 3/2018 Turner et al.
9,918,565 B2 * 3/2018 Hardy ..... A47F 5/005
9,930,973 B2 4/2018 Hardy et al.
9,955,802 B2 * 5/2018 Bird ..... A47B 57/585
10,045,640 B2 * 8/2018 Hardy ..... A47B 57/588
10,154,739 B2 12/2018 Turner et al.
D836,954 S 1/2019 Turner et al.
10,178,909 B2 * 1/2019 Hardy ..... A47F 7/0007
D843,760 S 3/2019 Turner et al.
10,314,412 B2 6/2019 Turner et al.
10,334,967 B2 7/2019 Mercier et al.
D856,040 S 8/2019 Fluegge et al.
2001/0002658 A1 6/2001 Parham
2001/0010302 A1 8/2001 Nickerson
2001/0019032 A1 9/2001 Battaglia
2001/0020604 A1 9/2001 Battaglia
2001/0042706 A1 11/2001 Ryan
2001/0045403 A1 11/2001 Robertson
2002/0024273 A1 2/2002 Osawa
2002/0066706 A1 6/2002 Robertson
2002/0079660 A1 6/2002 Shirai
2002/0148794 A1 10/2002 Marihugh
2002/0166830 A1 11/2002 Boron
2002/0170866 A1 11/2002 Johnson
2002/0179553 A1 12/2002 Squitieri
2002/0179556 A1 12/2002 Osawa
2002/0182050 A1 12/2002 Hart
2002/0189201 A1 12/2002 Hart
2002/0189209 A1 12/2002 Hart
2003/0000956 A1 1/2003 Maldonado
2003/0000957 A1 1/2003 Brexel
2003/0007859 A1 1/2003 Hart
2003/0024889 A1 2/2003 Dumontet
2003/0029824 A1 2/2003 Weiler
2003/0057167 A1 3/2003 Johnson
2003/0080075 A1 5/2003 Primiano
2003/0085187 A1 5/2003 Johnson
2003/0132178 A1 7/2003 Jay
2003/0132182 A1 7/2003 Jay
2003/0136750 A1 7/2003 Fujii
2003/0168420 A1 9/2003 Primiano
2003/0226815 A1 12/2003 Gaunt
2004/0000528 A1 1/2004 Nagel
2004/0004046 A1 1/2004 Primiano
2004/0079715 A1 4/2004 Richter
2004/0084390 A1 5/2004 Bernstein
2004/0094493 A1 5/2004 Higgins
2004/0105556 A1 6/2004 Grove
2004/0118794 A1 6/2004 Hardy
2004/0140278 A1 * 7/2004 Mueller ..... A47F 1/126 211/59.3
2004/0140279 A1 * 7/2004 Mueller ..... A47F 1/126 211/59.3
2004/0178156 A1 9/2004 Knorring
2004/0182805 A1 9/2004 Harper
2004/0206054 A1 10/2004 Welborn
2004/0232092 A1 11/2004 Cash
2004/0245197 A1 12/2004 McElvaney
2005/0040123 A1 2/2005 Ali
2005/0072747 A1 4/2005 Roslof
2005/0076817 A1 4/2005 Boks
2005/0092703 A1 * 5/2005 Mueller ..... A47F 5/005 211/59.3
2005/0098515 A1 5/2005 Close
2005/0127014 A1 6/2005 Richter
2005/0133471 A1 6/2005 Squitieri
2005/0133474 A1 6/2005 Nomoto
2005/0139560 A1 6/2005 Whiteside
2005/0139561 A1 6/2005 Ohkubo
2005/0150847 A1 7/2005 Hawkinson
2005/0166806 A1 8/2005 Hardy
2005/0189310 A1 9/2005 Richter
2005/0199563 A1 9/2005 Richter
2005/0199564 A1 9/2005 Johnson
2005/0199565 A1 9/2005 Richter
2005/0204966 A1 9/2005 Bienick et al.
2005/0224437 A1 10/2005 Lee
2005/0249577 A1 11/2005 Hart
2005/0263465 A1 12/2005 Chung
2005/0286700 A1 12/2005 Hardy
2006/0001337 A1 1/2006 Walburn
2006/0021957 A1 2/2006 Hardy
2006/0032827 A1 2/2006 Phoy
2006/0049122 A1 * 3/2006 Mueller ..... A47F 1/126 211/59.3
2006/0049125 A1 3/2006 Stowell
2006/0086680 A1 4/2006 Burke
2006/0104758 A1 5/2006 Hart
2006/0163272 A1 7/2006 Gamble
2006/0166830 A1 7/2006 Matsuzaki
2006/0186064 A1 8/2006 Merit
2006/0196840 A1 9/2006 Jay
2006/0213852 A1 9/2006 Kwon
2006/0226095 A1 10/2006 Hardy
2006/0260518 A1 11/2006 Josefsson
2006/0263192 A1 11/2006 Hart
2006/0273053 A1 12/2006 Roslof
2006/0283150 A1 12/2006 Hart
2006/0283151 A1 12/2006 Welborn
2007/0006885 A1 1/2007 Shultz
2007/0090068 A1 4/2007 Hardy
2007/0108142 A1 5/2007 Medcalf
2007/0138114 A1 * 6/2007 Dumontet ..... A47F 1/126 211/59.3
2007/0170127 A1 7/2007 Johnson

(56) References Cited

U.S. PATENT DOCUMENTS

| | | | | |
|---|---|---|---|---|
| 2007/0175839 | A1 | 8/2007 | Schneider | |
| 2007/0175844 | A1 | 8/2007 | Schneider | |
| 2007/0187344 | A1 | 8/2007 | Mueller | |
| 2007/0256992 | A1 | 11/2007 | Olson | |
| 2007/0267367 | A1 | 11/2007 | Mueller | |
| 2008/0011696 | A1 | 1/2008 | Richter | |
| 2008/0121146 | A1 | 5/2008 | Burns et al. | |
| 2008/0129161 | A1 | 6/2008 | Menz | |
| 2008/0156751 | A1 | 7/2008 | Richter | |
| 2008/0156752 | A1* | 7/2008 | Bryson | A47F 1/126 211/59.3 |
| 2008/0164229 | A1 | 7/2008 | Richter | |
| 2008/0203040 | A1 | 8/2008 | Kologe | |
| 2008/0296241 | A1 | 12/2008 | Alves | |
| 2008/0314852 | A1 | 12/2008 | Richter | |
| 2009/0039040 | A1 | 2/2009 | Johnson et al. | |
| 2010/0017025 | A1 | 1/2010 | Lockwood | |
| 2010/0059469 | A1 | 3/2010 | Mason | |
| 2010/0078398 | A1 | 4/2010 | Hardy | |
| 2010/0116760 | A1 | 5/2010 | Fazzone | |
| 2010/0206829 | A1 | 8/2010 | Clements | |
| 2010/0252519 | A1 | 10/2010 | Hanners et al. | |
| 2010/0276383 | A1 | 11/2010 | Hardy | |
| 2011/0139736 | A1 | 6/2011 | Hardy | |
| 2011/0174750 | A1 | 7/2011 | Poulokefalos | |
| 2012/0006773 | A1 | 1/2012 | Mueller | |
| 2012/0055892 | A1 | 3/2012 | Hardy | |
| 2012/0111813 | A1 | 5/2012 | Hardy | |
| 2012/0118840 | A1 | 5/2012 | Howley | |
| 2013/0015155 | A1 | 1/2013 | Brugmann | |
| 2013/0026122 | A1 | 1/2013 | Shimazaki | |
| 2013/0026176 | A1 | 1/2013 | Brugmann | |
| 2013/0062295 | A1 | 3/2013 | Bird | |
| 2013/0112640 | A1 | 5/2013 | Desmond | |
| 2013/0193095 | A1 | 8/2013 | Nagel | |
| 2013/0193096 | A1 | 8/2013 | Hardy | |
| 2013/0327730 | A1 | 12/2013 | Hardy | |
| 2014/0034592 | A1 | 2/2014 | Hardy | |
| 2014/0097149 | A1 | 4/2014 | Hardy | |
| 2014/0116972 | A1 | 5/2014 | Botkin | |
| 2014/0117818 | A1 | 5/2014 | Dipaolo | |
| 2014/0138330 | A1 | 5/2014 | Hardy | |
| 2014/0151313 | A1 | 6/2014 | Breslow | |
| 2014/0175024 | A1 | 6/2014 | Schoepf | |
| 2014/0175034 | A1 | 6/2014 | Hardy | |
| 2014/0175035 | A1 | 6/2014 | Hardy | |
| 2014/0190913 | A1 | 7/2014 | Hardy | |
| 2014/0217042 | A1 | 8/2014 | Hardy | |
| 2014/0226315 | A1 | 8/2014 | Nicieja | |
| 2014/0263134 | A1 | 9/2014 | Walker | |
| 2014/0284290 | A1 | 9/2014 | Hardy | |
| 2014/0299560 | A1* | 10/2014 | Kim | A47F 1/126 211/59.2 |
| 2014/0305895 | A1* | 10/2014 | Obitts | A47F 5/005 211/182 |
| 2014/0326690 | A1 | 11/2014 | Hardy | |
| 2014/0332480 | A1 | 11/2014 | Hardy | |
| 2015/0053631 | A1 | 2/2015 | Hardy | |
| 2015/0108075 | A1 | 4/2015 | Hardy | |
| 2015/0164242 | A1 | 6/2015 | Hardy | |
| 2015/0164245 | A1 | 6/2015 | Hardy | |
| 2015/0223620 | A1 | 8/2015 | Nilsson | |
| 2015/0157142 | A1 | 12/2015 | Turner et al. | |
| 2015/0359358 | A1 | 12/2015 | Miller, Jr. | |
| 2015/0374120 | A1 | 12/2015 | Hardy | |
| 2016/0000235 | A1 | 1/2016 | Hardy | |
| 2016/0296038 | A1* | 10/2016 | Walker | A47B 57/583 |
| 2016/0296039 | A1* | 10/2016 | Bird | A47F 7/28 |
| 2017/0035218 | A1 | 2/2017 | Riley | |
| 2017/0164762 | A1 | 6/2017 | Bryson | |
| 2017/0273477 | A1 | 9/2017 | Mercier et al. | |
| 2018/0103775 | A1 | 4/2018 | Kaczmarek et al. | |
| 2018/0153313 | A1 | 6/2018 | Padvoiskis et al. | |
| 2018/0199733 | A1 | 7/2018 | Mercier et al. | |
| 2018/0228303 | A1 | 8/2018 | Wills et al. | |
| 2018/0360233 | A1 | 12/2018 | Turner et al. | |

FOREIGN PATENT DOCUMENTS

| | | | | |
|---|---|---|---|---|
| CA | 2766171 | | 1/2011 | |
| CA | 2719208 | | 5/2011 | |
| CA | 2725928 | | 6/2011 | |
| CA | 2848792 | A1 | 10/2014 | |
| CA | 2998015 | A1 * | 9/2018 | A47F 1/125 |
| CH | 412251 | A | 4/1966 | |
| DE | 969003 | | 4/1958 | |
| DE | 1819158 | | 10/1960 | |
| DE | 2011792 | A | 3/1970 | |
| DE | 7311113 | U | 8/1973 | |
| DE | 2002720 | | 10/1979 | |
| DE | 2232398 | | 3/1981 | |
| DE | 2825724 | | 5/1981 | |
| DE | 8308485 | U1 | 9/1983 | |
| DE | 8426651 | U1 | 2/1985 | |
| DE | 8520125 | U1 | 1/1986 | |
| DE | 8717386 | U1 | 4/1988 | |
| DE | 3707410 | A1 | 9/1988 | |
| DE | 9300431 | U1 | 3/1993 | |
| DE | 29618870 | | 1/1997 | |
| DE | 29902688 | U1 | 7/1999 | |
| DE | 202009013581 | U1 | 3/2010 | |
| DE | 102013104023 | A1 * | 10/2014 | A47F 1/126 |
| DE | 202015105469 | U1 * | 10/2015 | A47F 5/005 |
| DE | 202015008264 | U1 * | 1/2016 | A47F 5/0068 |
| DE | 202016104354 | U1 | 8/2016 | |
| DE | 202016006754 | U1 * | 12/2016 | A47F 1/126 |
| DE | 202016008093 | U1 | 1/2017 | |
| EP | 0018003 | A2 | 10/1980 | |
| EP | 0176209 | | 4/1986 | |
| EP | 0337340 | A3 | 5/1990 | |
| EP | 0398500 | A1 | 11/1990 | |
| EP | 0408400 | | 1/1991 | |
| EP | 0454586 | A1 | 10/1991 | |
| EP | 0224107 | | 1/1992 | |
| EP | 0270016 | | 2/1992 | |
| EP | 0267569 | B1 | 9/1993 | |
| EP | 0568396 | A1 | 11/1993 | |
| EP | 0587059 | | 3/1994 | |
| EP | 0956794 | A2 | 11/1999 | |
| EP | 0986980 | | 3/2000 | |
| EP | 0779047 | | 4/2000 | |
| EP | 1174060 | | 1/2002 | |
| EP | 1395152 | | 2/2005 | |
| EP | 1256296 | | 7/2005 | |
| EP | 1549182 | | 8/2007 | |
| EP | 1857021 | | 11/2007 | |
| EP | 1510156 | | 5/2008 | |
| EP | 0270016 | | 2/2014 | |
| EP | 2859816 | A1 | 4/2015 | |
| EP | 2957195 | A1 | 12/2015 | |
| EP | 3017724 | A1 | 5/2016 | |
| FR | 2385365 | | 10/1978 | |
| FR | 2526338 | | 11/1983 | |
| FR | 2617385 | | 1/1989 | |
| FR | 2724098 | | 3/1996 | |
| FR | 2735963 | | 1/1997 | |
| GB | 740311 | | 11/1955 | |
| GB | 881700 | | 11/1961 | |
| GB | 1082150 | | 9/1967 | |
| GB | 2027339 | | 2/1989 | |
| GB | 2281289 | | 1/1995 | |
| GB | 2283407 | | 5/1995 | |
| GB | 2290077 | | 12/1995 | |
| GB | 2297241 | | 7/1996 | |
| GB | 2360514 | | 9/2001 | |
| GB | 2386116 | A | 9/2003 | |
| GB | 2392667 | | 3/2004 | |
| JP | S59218113 | | 12/1984 | |
| JP | 62060521 | | 3/1987 | |
| JP | S63099810 | | 5/1988 | |
| JP | H05277023 | | 10/1993 | |
| JP | 677614 | | 11/1994 | |

(56) References Cited

FOREIGN PATENT DOCUMENTS

| | | | |
|---|---|---|---|
| JP | 3005457 | | 12/1994 |
| JP | H07241227 | A | 9/1995 |
| JP | H09238787 | | 9/1997 |
| JP | 10263710 | | 10/1998 |
| JP | H1118889 | | 1/1999 |
| JP | H11155701 | A | 6/1999 |
| JP | 11313737 | | 11/1999 |
| JP | 11342054 | | 12/1999 |
| JP | H11342054 | | 12/1999 |
| JP | H11346879 | | 12/1999 |
| JP | 2000004996 | | 1/2000 |
| JP | 2000004997 | | 1/2000 |
| JP | 2000004998 | | 1/2000 |
| JP | 2000106988 | | 4/2000 |
| JP | 2000125998 | | 5/2000 |
| JP | 2000157378 | | 6/2000 |
| JP | 2000217675 | | 8/2000 |
| JP | 2000287790 | | 10/2000 |
| JP | 2000287791 | | 10/2000 |
| JP | 2000287795 | | 10/2000 |
| JP | 2000316680 | | 11/2000 |
| JP | 2000350642 | | 12/2000 |
| JP | 2001037600 | | 2/2001 |
| JP | 2001078860 | | 3/2001 |
| JP | 2001104117 | | 4/2001 |
| JP | 2001197978 | | 7/2001 |
| JP | 2001240225 | | 9/2001 |
| JP | 2003210286 | | 7/2003 |
| JP | 3099639 | U | 11/2003 |
| JP | 2004121631 | | 4/2004 |
| JP | 3115289 | U | 9/2005 |
| JP | 2005270416 | | 10/2005 |
| JP | 2005270419 | | 10/2005 |
| JP | 3115812 | U | 11/2005 |
| JP | 3932534 | B2 | 6/2007 |
| JP | 2007307244 | A | 11/2007 |
| JP | 4708539 | B2 | 6/2011 |
| KR | 132359 | B1 | 11/2013 |
| NL | 1018330 | C2 | 5/2002 |
| SE | 76532 | | 12/2002 |
| SU | 1600615 | | 10/1990 |
| WO | WO 9115141 | | 10/1991 |
| WO | WO 9201614 | | 2/1992 |
| WO | WO 9806305 | | 2/1998 |
| WO | WO 9925220 | | 5/1999 |
| WO | WO 0071004 | | 11/2000 |
| WO | WO 02091885 | | 11/2002 |
| WO | WO 03005862 | | 1/2003 |
| WO | WO 03013316 | | 2/2003 |
| WO | WO 03032775 | | 4/2003 |
| WO | WO 2004021843 | | 3/2004 |
| WO | WO 2004064484 | | 8/2004 |
| WO | WO 2004105556 | | 12/2004 |
| WO | WO 2005037027 | | 4/2005 |
| WO | WO 2005074564 | | 8/2005 |
| WO | WO 2005074635 | | 8/2005 |
| WO | WO 2006019947 | | 2/2006 |
| WO | WO-2006019947 | A2 * | 2/2006 ..... A47F 1/126 |
| WO | WO 2006027872 | | 3/2006 |
| WO | WO 2006028246 | | 3/2006 |
| WO | WO 2006094058 | | 9/2006 |
| WO | WO 2007050527 | | 5/2007 |
| WO | WO 2007073294 | | 6/2007 |
| WO | WO 2007133086 | | 11/2007 |
| WO | WO 2008115769 | | 9/2008 |
| WO | WO 2008153561 | | 12/2008 |
| WO | WO 2011002909 | | 1/2011 |
| WO | WO 2011112539 | | 9/2011 |
| WO | WO 2012030788 | | 3/2012 |
| WO | WO 2013033545 | | 3/2013 |
| WO | WO 2013033555 | | 3/2013 |
| WO | WO 2014198839 | | 12/2014 |
| WO | WO 2016124760 | | 8/2016 |
| WO | 2018200997 | A1 | 11/2018 |

OTHER PUBLICATIONS

International Search Report and Written Opinion in corresponding PCT Application No. PCT/US2018/029868, dated Aug. 2, 2018.

Wills et al., "Tray Accessory, Tray with Mounting Structure and Methods Relating to Same" Unpublished U.S. Appl. No. 16/421,354, filed May 23, 2018.

Padvoiskis et al., "Product Display Merchandiser and Related Methods," Unpublished U.S. Appl. No. 16/511,717, filed Nov. 14, 2018.

Wills et al., "Adjustable Width Pusher Tray Assembly," Unpublished U.S. Appl. No. 62/804,004, filed Feb. 11, 2019.

Wills et al., "Modular Pusher Tray Assembly," Unpublished U.S. Appl. No. 62/804,012, filed Feb. 11, 2019.

Bryson, et al., M. Scott, U.S. Appl. No. 60/588,665, "Merchandising System," filed Jul. 16, 2004.

Rushing, Tom, Abandoned U.S. Appl. No. 08/017,280, "Display Apparatus," filed Feb. 12, 1993.

Richter et al., Gary M., U.S. Appl. No. 60/489,676, "Merchandising System," filed Jul. 23, 2003.

Hardy, Stephen N., Abandoned U.S. Appl. No. 08/968,599, "Universal Shelf Mounting Bracket," filed Nov. 13, 1997.

Henry, et al., Eric, Abandoned U.S. Appl. No. 09/075,647, "Merchandise Display System," filed May 11, 1998.

Johnson et al., Allen E., U.S. Appl. No. 60/329,656, "Merchandising System," filed Oct. 15, 2001.

Johnson et al., Allen E., U.S. Appl. No. 60/335,924, "Merchandising System," filed Oct. 31, 2001.

Johnson, et al., Allen E., U.S. Appl. No. 60/286,892, "Divider System for Shelf or the Like," filed Apr. 26, 2001.

Johnson, et al., Allen E., U.S. Appl. No. 60/313,894, "Shelf Divider System," filed Aug. 21, 2001.

Kologe, Joseph F., Abandoned U.S. Appl. No. 11/741,317, "Display Bar Assembly for Merchandising Displays," filed Apr. 30, 2007.

* cited by examiner

SHELF-MOUNTED TRAY AND METHODS RELATING TO SAME

CROSS-REFERENCE TO RELATED APPLICATIONS

This application is the U.S. national stage application of International Application PCT/US2018/029868, filed Apr. 27, 2018, which international application was published on Nov. 1, 2018, as International Publication WO2018/200997 in the English language. The international application is incorporated herein by reference, in its entirety. The international application claims priority to U.S. Provisional Patent Application No. 62/663,147, filed Apr. 26, 2018, and U.S. Provisional Patent Application No. 62/490,760, filed Apr. 27, 2017, both of which are incorporated herein by reference, in their entireties.

FIELD

This invention relates generally to product displays and, more particularly, to pull-out tray merchandisers for front-facing product merchandise for displaying and dispensing product to consumers.

BACKGROUND

Product displays, such as merchandisers, are frequently used in retail environments to display products for sale. It is advantageous for these product displays to be configured to provide consumers easy access to the displayed product as well as facilitate easy reloading by store employees. In addition to ease of use considerations, manufacturers of product displays seek to minimize materials and manufacturing costs associated with the product displays.

One problem with conventional merchandisers is that they typically require intricate structures to make them more user friendly to both end consumers and the retail store clerks or associates who stock and/or restock the merchandisers with displayed product. For example, pull-out tray or drawer-type merchandisers that pull out like a drawer to assist store associates in stocking/restocking the merchandiser often require intricate structures that are expensive to manufacture, hard to assemble, and often require operation of inconveniently located release mechanisms to get the tray or drawer to slide out from the display for stocking or restocking purposes.

In addition, conventional tray or drawer type merchandisers require the displayed product to be pressed against pushers during stocking/restocking which can make the merchandiser harder to stock/restock and can cause damage to the product being stocked/restocked depending on how much force is exerted against the product between the person stocking/restocking the displayed product and the pushers of the merchandiser.

While some conventional merchandisers allow flexibility by offering adjustable width side members so that the merchandiser can be used to merchandise products of different size, conventional merchandisers do not allow the merchandiser to be repurposed from displaying one product to two separate products or vice versa.

In addition, conventional tray or drawer type merchandisers typically have to be suspended from a bar, grid or gondola rear wall rather than set atop a shelf in order to provide a stable and sturdy merchandiser that does not move in unwanted manners (e.g., unwanted vertical, lateral or wobble movement, or pitch, yaw and roll movement, etc.).

Unfortunately, there are many applications where it is desirable to utilize a store's gondola shelving for front-facing or self-facing merchandisers. In such applications, stores are typically left with using a shelf management system that requires the placement of a front rail along the upper front surface of the shelf and connecting dividers, end brackets and pusher mechanisms to the front rail to front face product (sometimes the pushers and dividers or end brackets are combined into an integrated divider/pusher assembly or bracket/pusher assembly). While these shelf management systems have their place in the industry, they do not allow the store associate to pull out the product channel as a tray to stock or restock the unit and, thus, require the associate to reach back into the shelving to stock and restock the shelf management system.

Attempts have been made to provide pull-out tray type merchandisers that can be connected to both shelf and bar/grid/vertical wall, however, these require separate base structures to be utilized and, thus, amount to nothing more than two separate tray structures (i.e., one that is shelf mountable and the other that is bar/grid/vertical wall mountable). Such dual product formats are not efficient and require separate tray tooling or molds to be made and maintained.

Accordingly, it has been determined that a need exists for improved product display merchandisers that are not only easy to use, for both consumers and store associates, but also minimally expensive to produce and that offer improved features and functions over conventional merchandisers.

BRIEF DESCRIPTION OF THE FIGURES

Embodiments of the invention are illustrated in the figures of the accompanying drawings in which:

FIG. 41 is a side view of a baffle system coupled to a merchandising shelf in accordance with the embodiment in FIG. 36A;

FIGS. 76D-76E are top and bottom perspective views of the shelf mounting accessory for the tray of the product display of FIGS. 76A-76C.

Figure 1A:
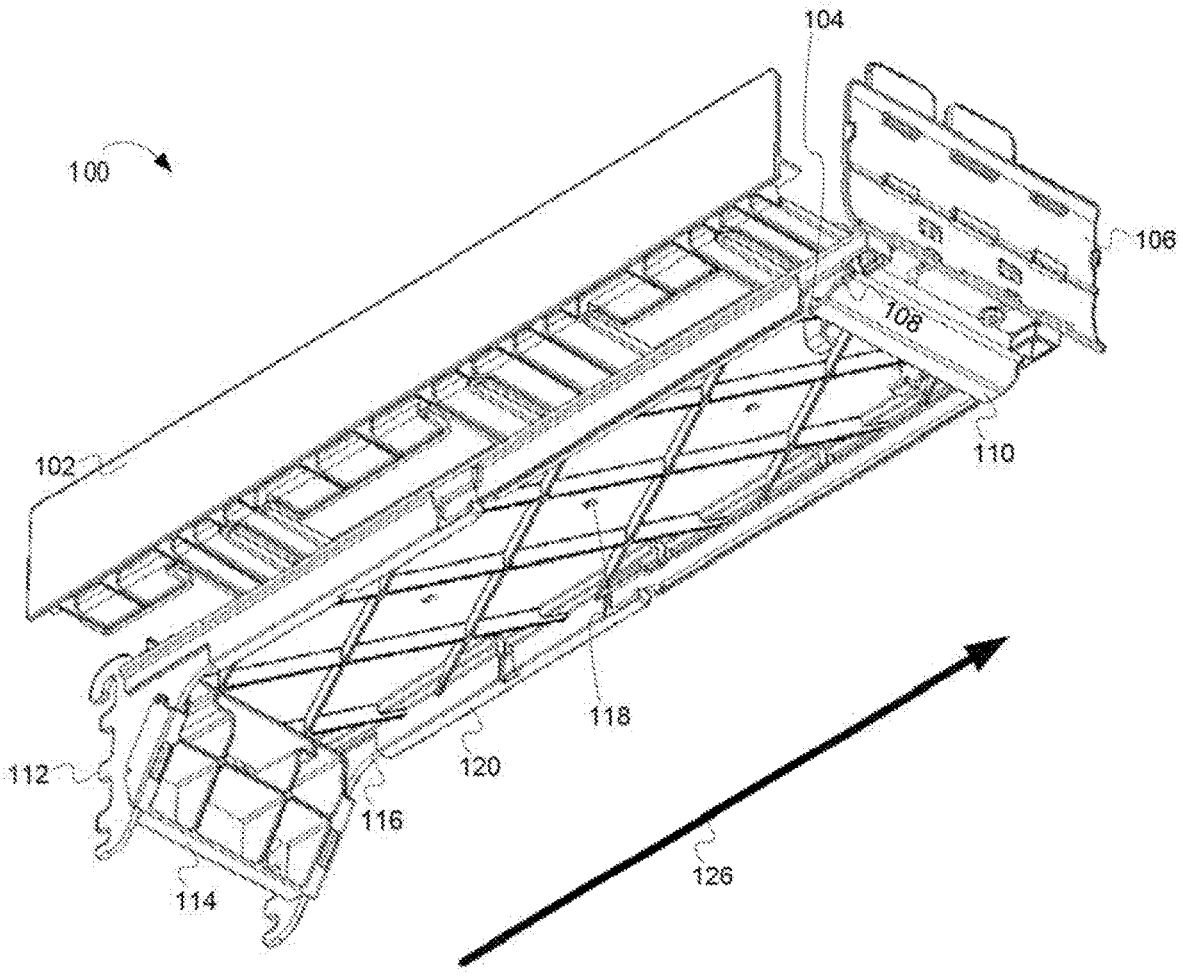
FIG. 1A is a perspective view of a product display merchandiser according to some embodiments of the inventive subject matter taken from below and in front of the merchandiser (or the lower right front of the unit) and illustrating an exemplary baseless design with the left side member or wing in a first, retracted position and the right side member or wing in a second, extended position.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DESCRIPTION OF THE EMBODIMENTS

Many variations of product displays are discussed herein and even further are contemplated in view of this disclosure. The product displays discussed herein are configured, and designed, to hold and display product that is for sale and to front face this product so that the next item in the display is moved to the front of the display as the product in front of it is removed from the merchandiser. While many variations of product display are described and contemplated herein, FIGS. 1A-1M, and the associated text, generally depict and describe a first embodiment of a product display, wherein the product display has a baseless design, FIG. 2 and its associated text generally depict a second embodiment, FIG. 3 and its associated text generally depict a third embodiment, FIGS. 4A-R, and the associated text, generally depict and describe a fourth embodiment of a product display merchandiser, wherein the product display merchandiser has an adjustable width and a unique stabilizing structure, FIGS. 5A-5E, and the associated text, generally depict and describe a fifth embodiment of a product display merchandiser, wherein the product display merchandiser has an alternate mechanism for adjusting the position of, and securing, the sidewalls or wings and alternate structures for retaining displayed product in the merchandiser when the lens is removed, FIGS. 6A-6D, and the associated text, generally depict and describe a sixth embodiment of a product display merchandiser, wherein the product display merchandiser includes a mechanism to securely attach a bracket engagement member to a rear stabilizer, and FIGS. 7A-7B, and the associated text, generally depict and describe a seventh embodiment of a product display merchandiser, wherein the product display merchandiser includes one or more removable sidewalls or wings for use in unison with one or more other product display merchandisers. Although seven main embodiments are shown, it is understood that features from any one embodiment may be combined with features of other embodiments to come-up with yet further embodiments that are intended to be covered by this disclosure and the following claims despite not being illustrated in a specific drawing figure for same.

FIGS. 1A-1M illustrate an exemplary embodiment of a product display merchandiser 100, according to some forms of the inventive subject matter. The product display merchandiser 100 includes a tray 102 for holding a product to be displayed. The tray 102 is supported underneath by arms, support members, brackets, or "blades" 116. The arms 116 include bracket engagement members 112 that attach to a rear support member (not shown), such as a vertical upright of a conventional gondola or other store shelving system. The rear support member can be any suitable support member such as conventional grid-type systems, bar type systems, shelves, etc. The product display merchandiser 100 can also have one or more stabilizers positioned in various locations on the product display merchandiser 100. For example, FIG. 1 depicts a stabilizer 114 positioned between the bracket engagement members 112 near the rear of the product display merchandiser 100. In some embodiments, the product display merchandiser 100 can include a stabilizer, in addition to or in lieu of the stabilizer 114, near the front of the product display merchandiser 100. The stabilizer 114 (as well as any other stabilizers) can be sized so as to accommodate trays of multiple dimensions. The product display merchandiser 100 can also include a lens 106 for holding and displaying signage, preventing product from falling out of the tray 102, etc. Such a lens can be formed from any suitable material and in any suitable manner. For example, the lens can be extruded or injection molded plastic. Additionally, in one form, the lens can have perforations which allow for easy snap-off type custom-sizing of the lens.

In use, the product display merchandiser 100 has multiple positions. In one embodiment, the product display merchandiser 100 can have a closed position (best shown in FIGS. 1A-1B, and 1E-1G) for presenting product and an open position (best shown in FIGS. 1H-1K) for restocking product. In the closed position, a majority of the tray 102 is positioned over top of the arms 116. In the open position, the majority of the tray 102 is not positioned over top of the arms 116. The tray 102 travels along the arms 116 from the closed position to the open position in a direction indicated by arrow 126. As depicted in FIG. 1, the tray 102 includes tracks 120 through which the arms 116 extend. The tracks 120 can take any suitable form. For example, the tracks 120 can comprise a number of individual pieces protruding from the tray 102, a continuous or semi-continuous channel running along the tray 102, etc. Additionally, the tracks 120 (and/or arms 116) can include ball bearings or any other suitable friction-reducing mechanism.

In some embodiments, the product display merchandiser 100 includes a mechanism that resists movement of the tray 102 between the open and closed positions. Such a mechanism can prevent the tray 102 from moving from the closed position to the open position unintentionally. For example, the product display merchandiser 100 can include a handle 110 (also seen in FIG. 1K) with first engagement members 108. The arms 116 can include second engagement members 104 that are complimentary to the first engagement members 108. Such first engagement members 108 and second engagement members 104 are well-depicted in FIG. 1E. The engagement members are engaged when the tray 102 is in the closed position. Such engagement resists and/or prevents movement of the tray 102 to the open position. In the embodiment depicted in FIG. 1, operation of the handle 110 disengages the engagement members. Such disengagement permits movement of the tray 102 from the closed position to the open position. In one form, the first engagement members 108 disengage from the second engagement members 104 when the handle 110 is displaced in a direction parallel to the movement of the tray 102 across the arms 116 (i.e., in the direction of arrow 126). For example, movement of the handle away from the bracket engagement members 112 disengages the first engagement members 108 from the second engagement members 104. As another example, the handle 110 may displace in a somewhat rotational manner. For example, the handle 110 can be affixed to the tray 102 near a leading edge of the tray (i.e., a portion of the tray opposite the bracket engagement members 112). The handle 110 is operated from an end of the handle 110 opposite a side of the handle 110 affixed to the tray 102. In such embodiments, the handle 110 displaces in a somewhat rotational direction that, for purposes of this specification, can be considered to have a displacement in a direction parallel to the motion of the tray 102 and in a direction perpendicular to the motion of the tray 102.

In one form, the product display merchandiser 100 can include a mechanism that prevents the tray 102 from moving from the open position to the closed position during restocking. For example, the arms 116 and the tracks 120 can include complimentary engagement members that engage when the tray 102 is in the open position. Such engagement members can provide mechanical resistance which must be overcome to move the tray 102 from the open position to the closed position. For example, FIG. 1I depicts a product display merchandiser 100 with arms having an arm engagement member 144 which engages a track engagement member 136. When the tray 102 is in the open position, the track engagement member 136 engages the arm engagement member 144 and provides resistance against the tray 102 moving from the open position to the closed position. In some embodiments, such resistance is physical and is overcome by force being exerted on the tray 102 in a direct of the closed position. In other embodiments, there can be a hook, latch, lever, or other release mechanism which must be utilized to disengage the track engagement members 136 from the arm engagement members 144.

Figure 1B:
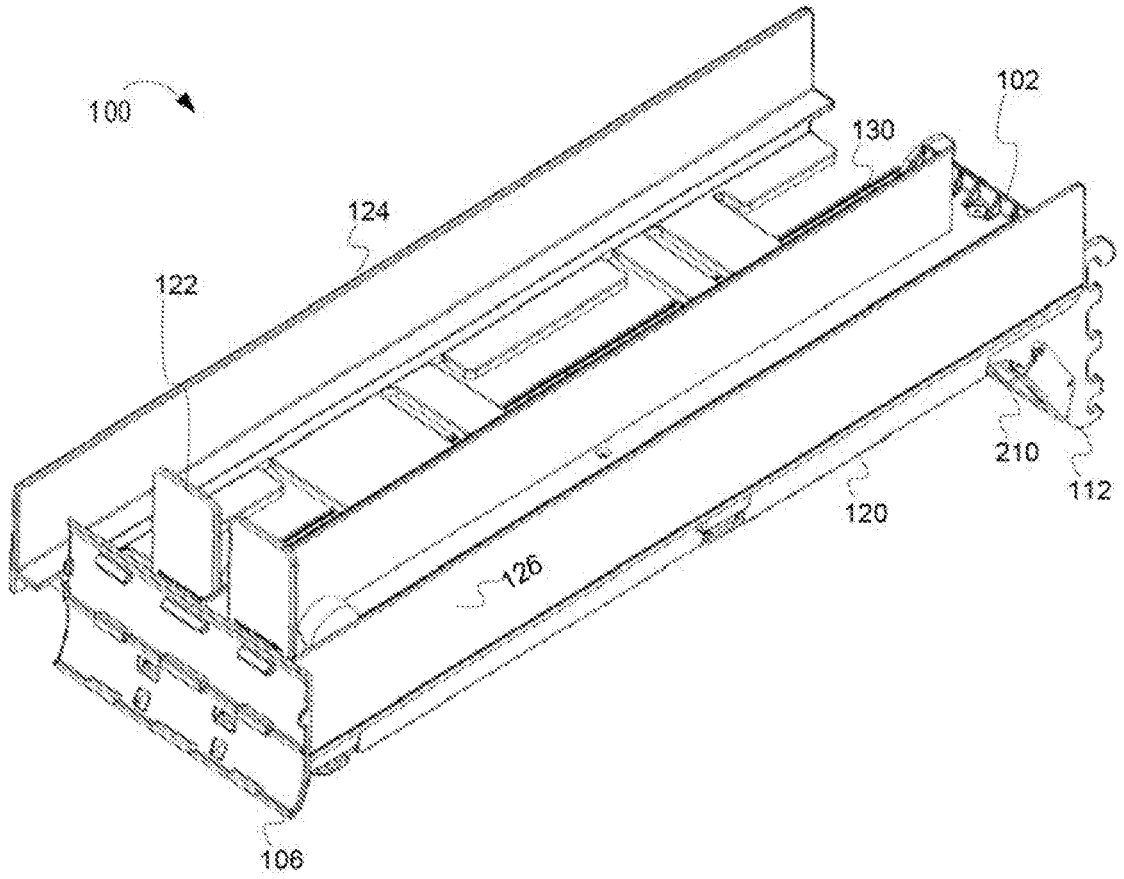
FIG. 1B is an alternate perspective view of the product display merchandiser of FIG. 1, taken from above and in front of the merchandiser (or the upper left front of the unit).
Figure 1C:
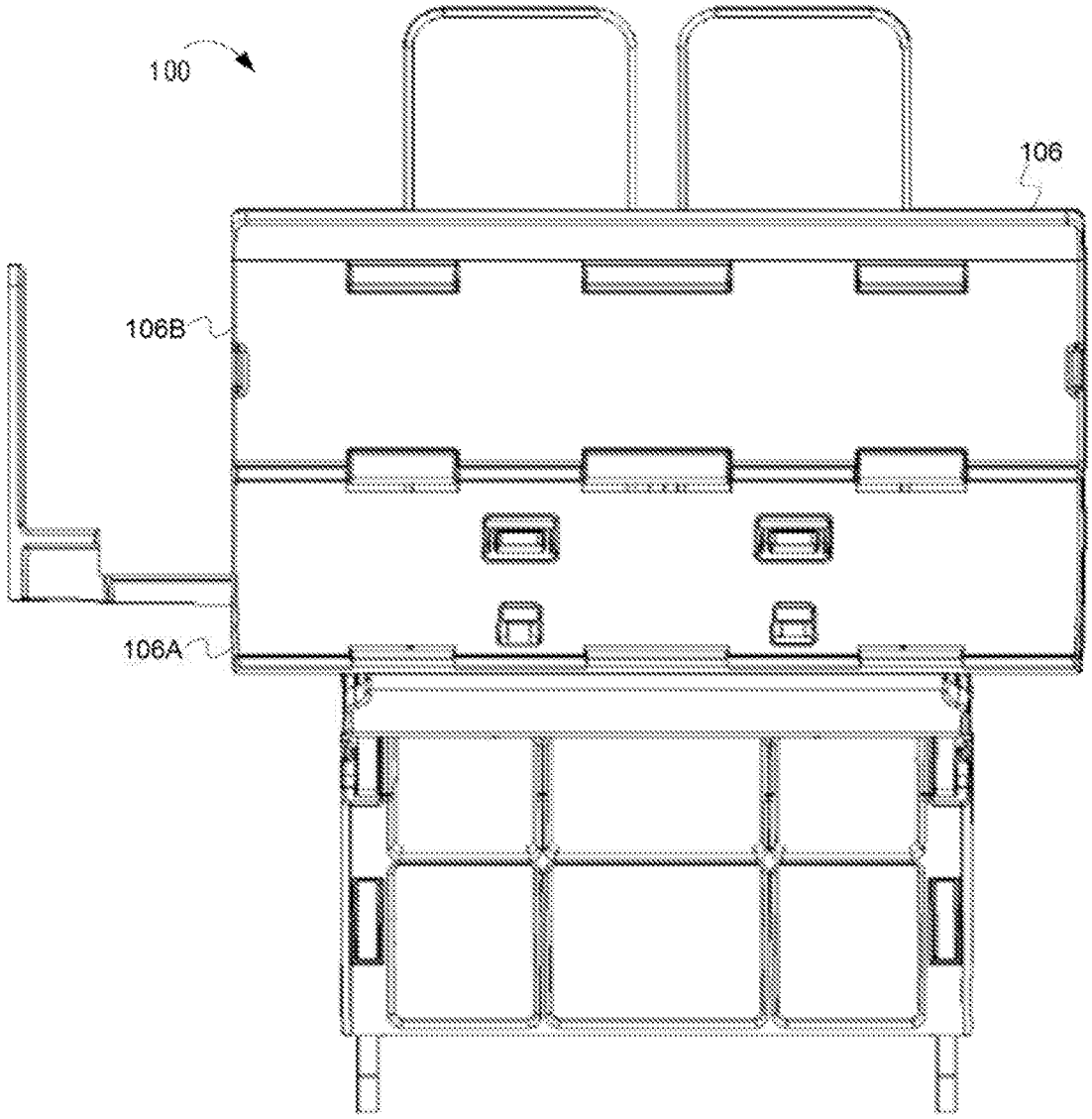
FIGS. 1C, 1D, and 1E are front elevation, rear elevation, and left side elevation views, respectively, of the product display merchandiser of FIGS. 1A-1B, the right side elevation view being a mirror image of the left side elevation view.
Figure 1D:
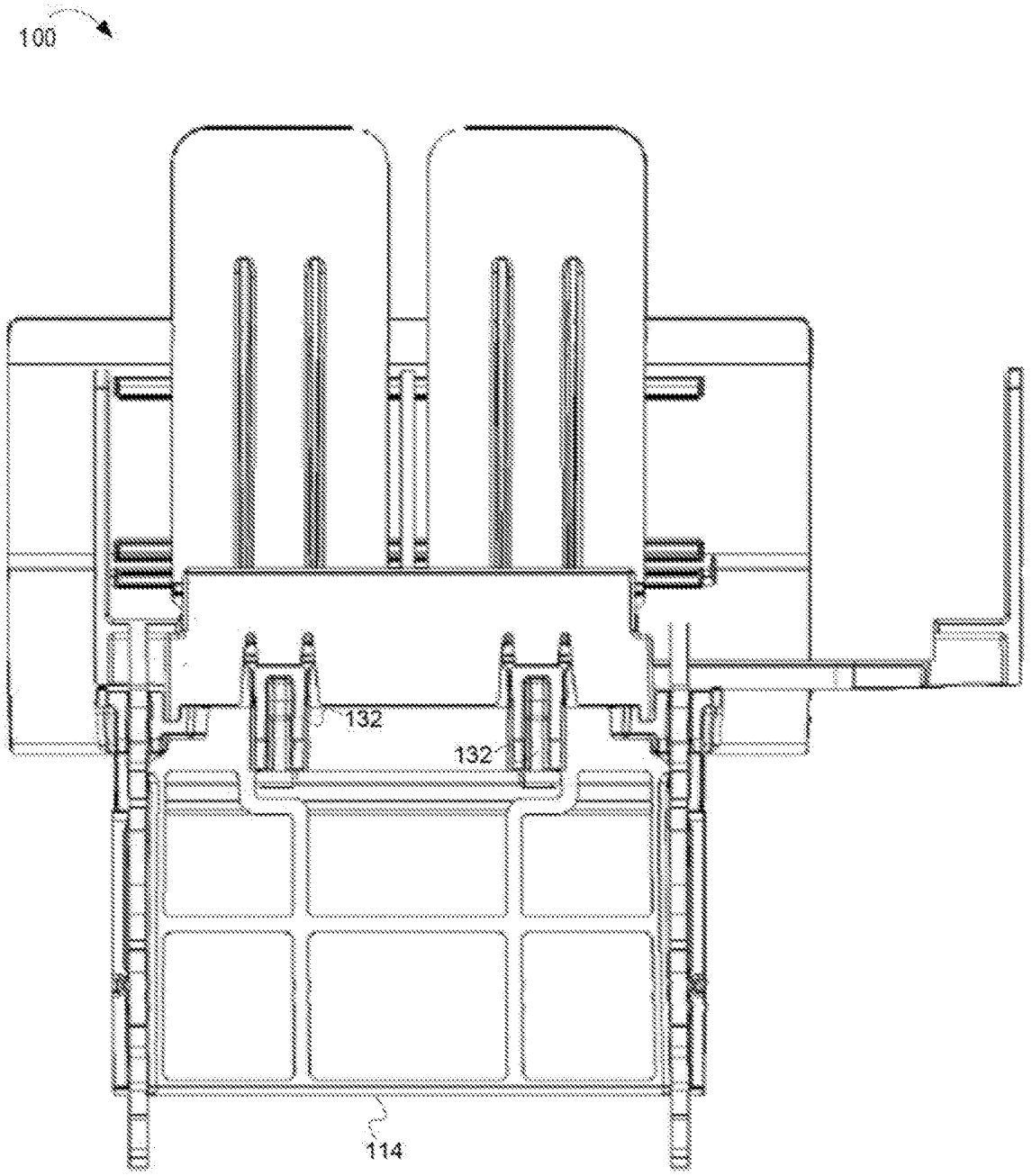
Figure 1E:
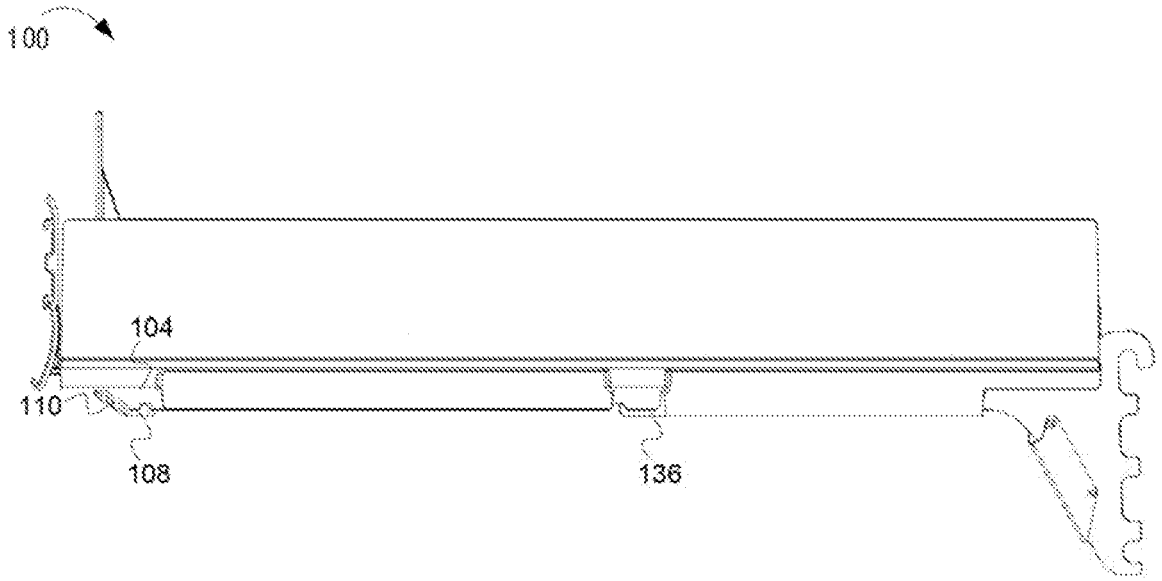

As shown in FIG. 1B the product display merchandiser 100 includes a tray 102 and arms 116. The tray 102 includes tracks 120 through which the arms 116 extend. The tray 102 displaces along the arms 116. The arms 116 can include bracket engagement members 112 configured to mount to a rear support member (not shown). Although FIG. 1B depicts the product display merchandiser 100 configured with bracket engagement members 112 to mount to a rear stabilizer, in some embodiments, the product display merchandiser 100 can be configured to be supported by, attach to, and/or rest on a shelf.

The tray 102 includes a right sidewall 124 and a left sidewall 126 (also referred to as a "side members" or "wings"), as well as a lens 106. In some embodiments, as depicted in FIG. 1B, either (or both) of the right sidewall 124 and the left sidewall 126 are extendable to accommodate product of varying dimensions. The tray 102 of FIG. 1B is depicted with the right sidewall 124 extended. In one form, the right sidewall 124 and left sidewall 126 are incrementally extendable. Additionally, the right sidewall 124 and the left sidewall 126 can be individually extendable or mechanically coupled in such a way that extension of one of the right sidewall 124 and the left sidewall 126 cause extension of the other of the right sidewall 124 and the left sidewall 126.

To further increase compatibility with product of varying dimensions, some embodiments of the product display merchandiser 100 include a removable divider 130. The removable product divider 130 is shown in greater detail in FIG. 1L. The removable divider 130 can attach to the product display merchandiser 100 in any suitable manner. For example, as shown in FIG. 1L, the removable divider 130 can include divider protrusions 148 that mate with slots 118 on the tray 102 (as shown in FIG. 1G), slots which mate with protrusions on the tray 102, a bar that mates with a track on the tray 102, etc. In some embodiments, the removable divider 130 is mountable at multiple locations of varying distance from the right sidewall 124 and the left sidewall 126. When removed, the product display merchandiser 100 preferably includes a storage space for the removable divider 130. FIG. 1M depicts one example by which the removable divider 130 can be stored onboard the product display merchandiser 100. In one form, the tray 102 includes a recess on a bottom side of the tray 102 configured to accommodate and store the removable divider 130. Alternatively or additionally, as depicted in FIG. 1M, the tray 102 can include clips 150 (or other suitable connectors) which hold the removable divider 130 in a stored position on the product display merchandiser 100.

Figure 1F:
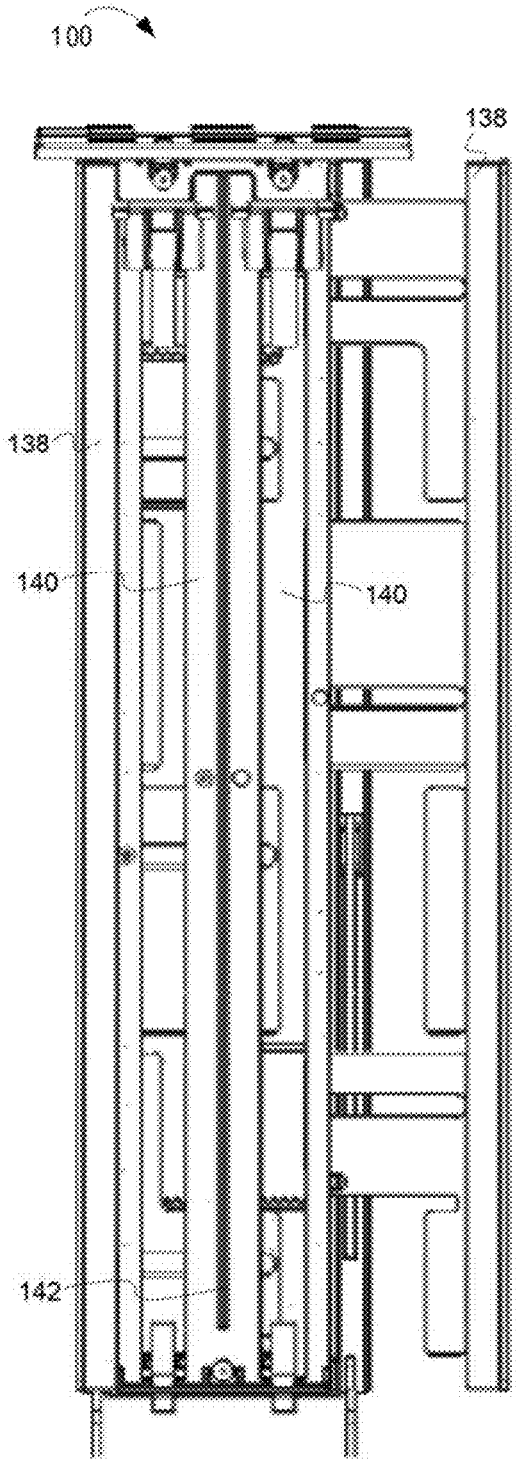
FIGS. 1F and 1G are top and bottom views, respectively, of the product display merchandiser of FIGS. 1A-E illustrating the merchandiser with the tray in a first, retracted position.
Figure 1G:
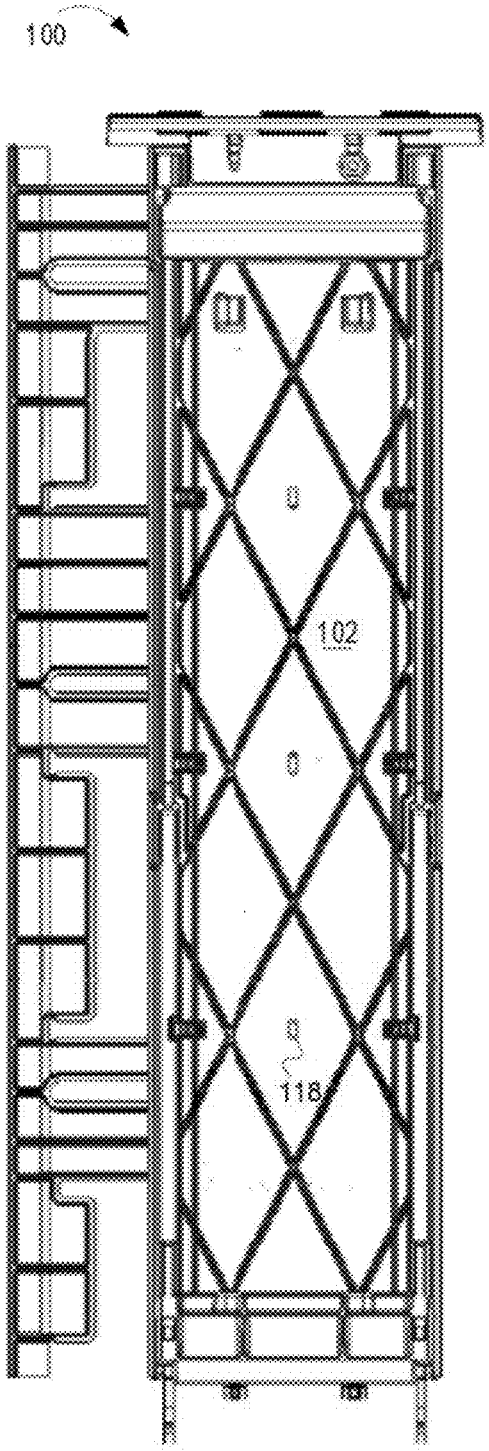

In some embodiments (as depicted in FIG. 1F) a divider 142 (whether or not removable) can take the form of a "T-shape." A horizontal portion of such divider 142 can form a product support surface 140. This product support surface 140 can support a portion of product displayed in the product display merchandiser and a second product support surface 138 located on the sidewall can support another portion of the product displayed in the product display merchandiser 100.

Figure 1H:
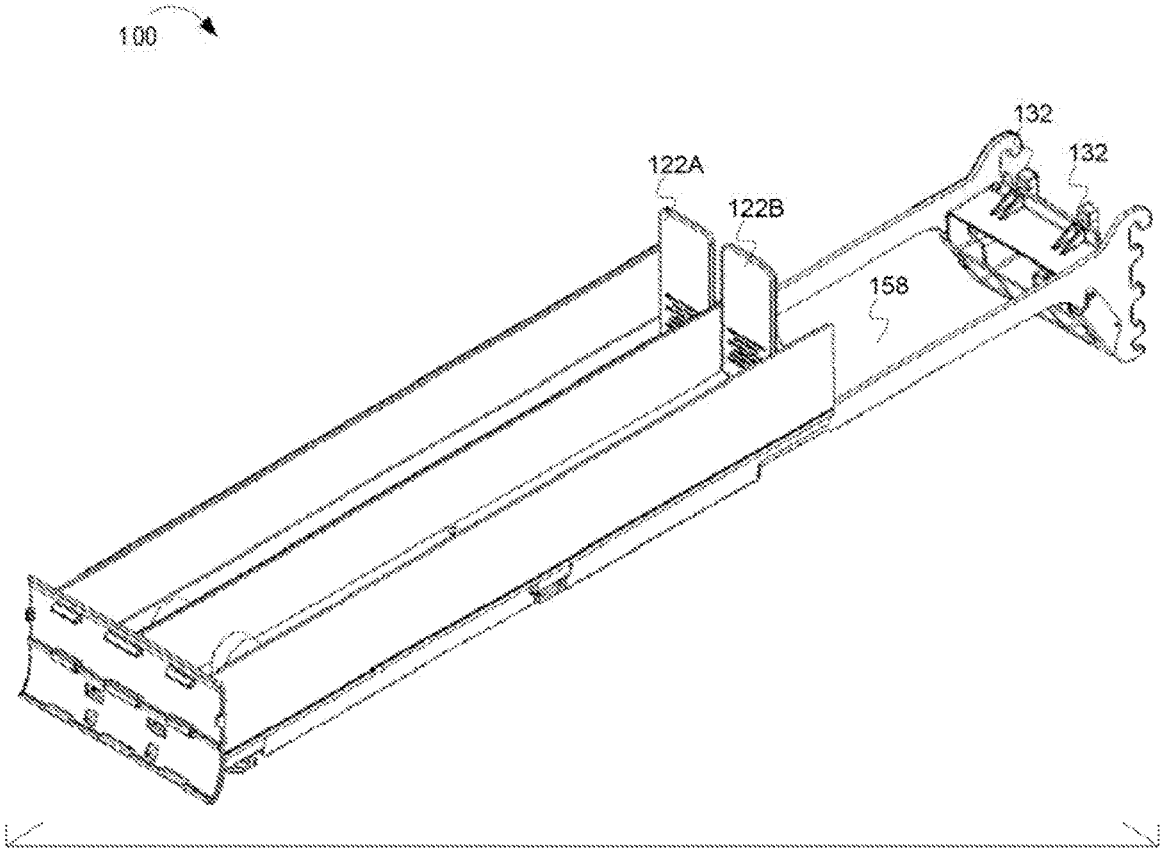
FIGS. 1H, 1I, 1J, and 1K are alternate perspective, left side elevation, top view, and bottom view, respectively, of the product display merchandiser of FIGS. 1A-1G illustrating the merchandiser with the tray in a second, extended position.
Figure 1I:
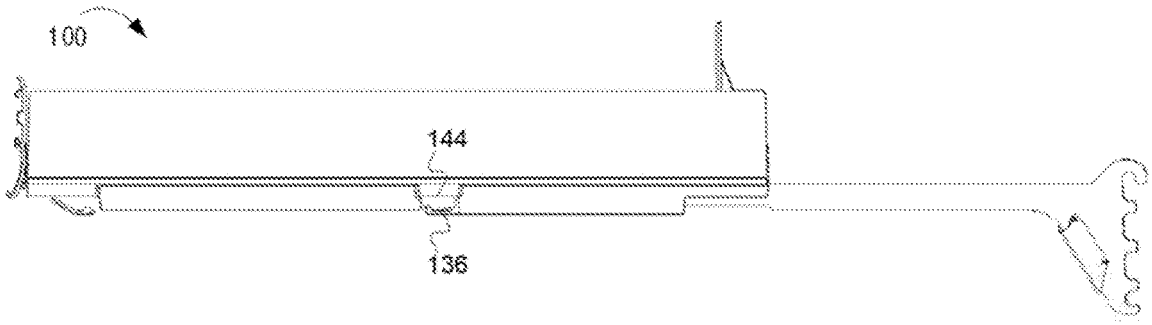
Figure 1J:
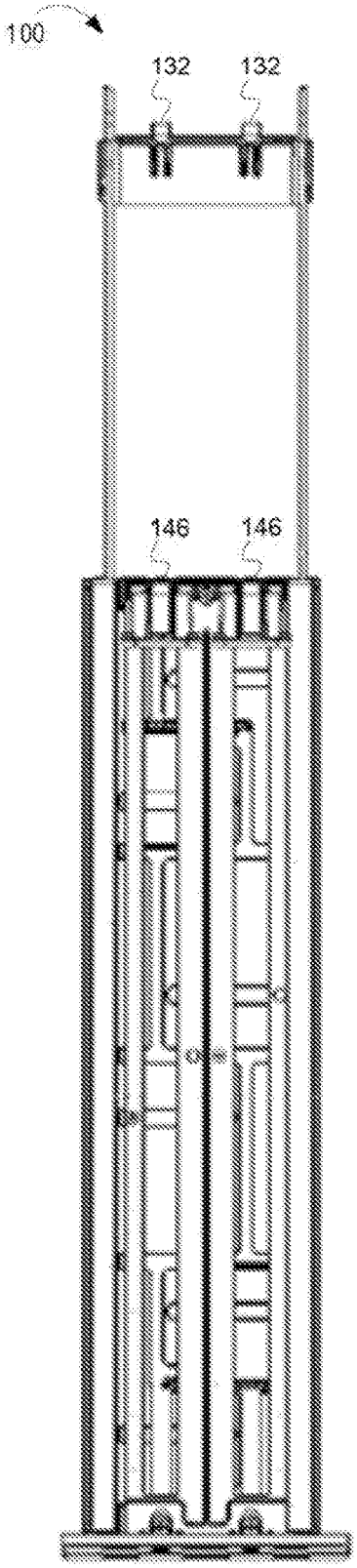
Figure 1K:
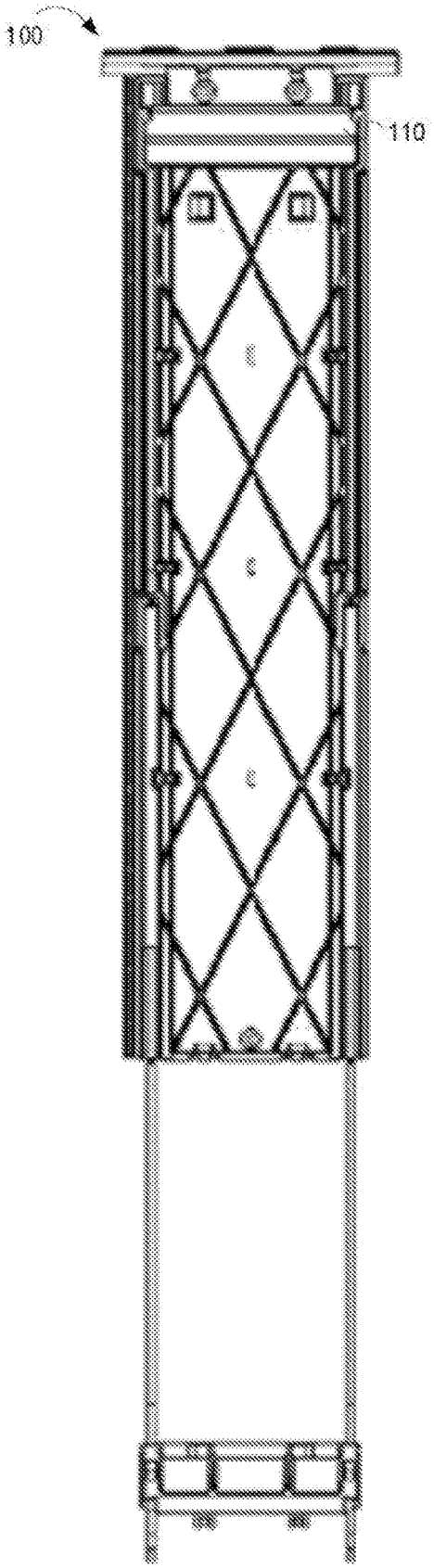
Figure 1L:
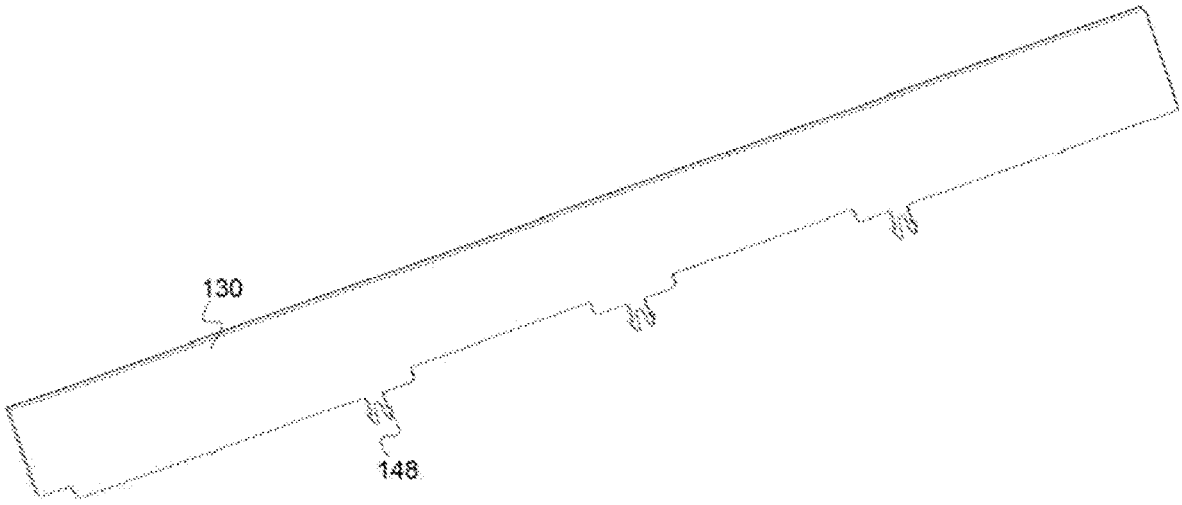
FIGS. 1L and 1M are perspective views of an exemplary removable divider illustrating, in FIG. 1L, one form of mating structure that may be used to mate the divider to the merchandiser unit, and illustrating in FIG. 1M, an exemplary manner in which the removable divider may be stored on the merchandiser for future use.
Figure 1M:
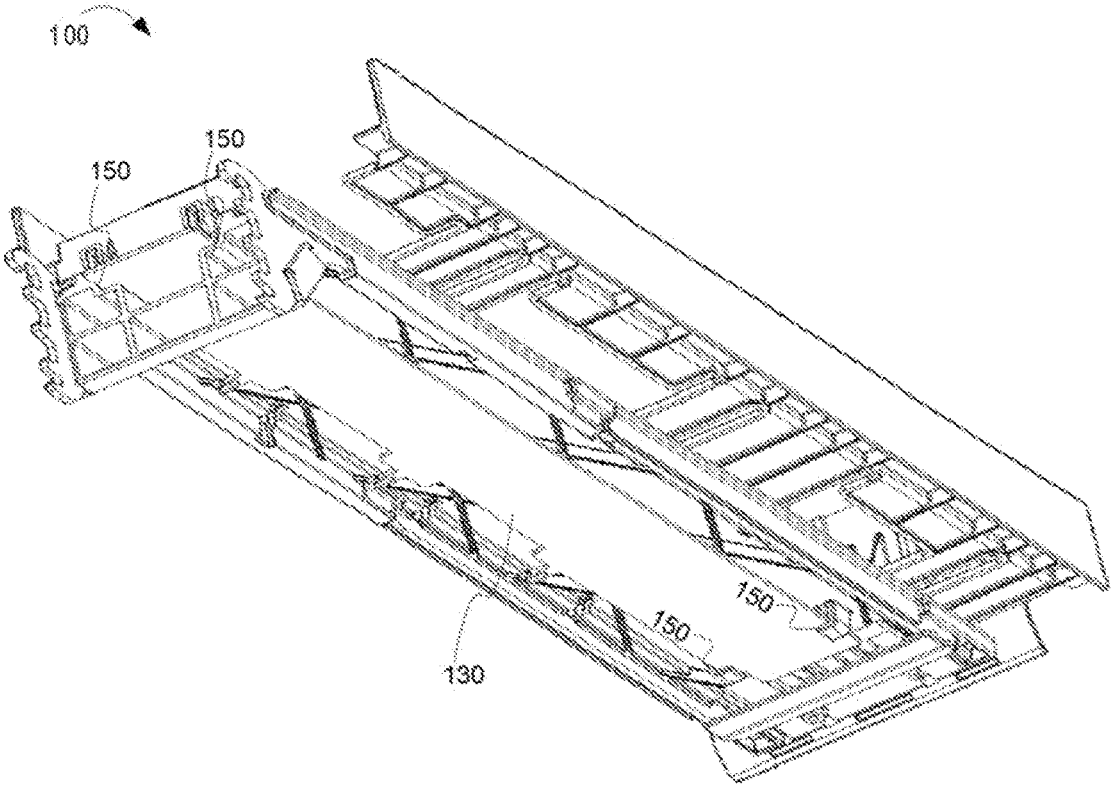

The tray 102 also includes pushers 122. The pushers 122 act to urge product toward the front of the tray 102 (i.e., front face product) making the product easier to access. Although FIG. 1B depicts the tray 102 as including pushers 122, some embodiments of the inventive subject matter do not include pushers 122 to urge product to the front of the tray. For example, instead of pushers 122, the product display merchandiser 100 may be configured to incline, or mount on an incline, in a manner in which gravitational force is employed to urge product to the front of the tray 102. Additionally, although FIG. 1B depicts a product display merchandiser 100 including two pushers 122, some embodiments of the inventive subject matter can include fewer than two pushers or more than two pushers. In embodiments that include pushers 122, the pushers 122 generally comprise a vertical member and a biasing mechanism. The pushers 122 can employ any suitable biasing mechanism, such as a spring, a counterweight, a pulley system, etc. In some embodiments, the pushers 122 include engagement members (e.g., clips, latches, detents, etc.) that engage with complimentary engagement members located on the tray 102, tracks 120, and/or arms 116. The engagement members and the complimentary engagement members act to maintain the pushers 122 in a restocking position when the tray 102 is in an open position. Maintaining the pushers 122 in the restocking position not only makes restocking easier but also helps prevent product from being damaged during the restocking process. In some embodiments, the pushers 122 are maintained at a backmost portion of the tray 102 during restocking. In some embodiments, the engagement members and the complimentary engagement members automatically disengage when the tray 102 is moved from the open position to the closed position. For example, the tray 102, tracks 120, and/or arms 116 can include disengagement members that cause disengagement of the engagement members from the complimentary engagement members. FIGS. 1D, 1H and 1J depict one embodiment of such engagement and disengagement members. FIG. 1J depicts two engagement members 146 coupled to the pushers 122. Although FIG. 1J depicts an embodiment including two pushers 122 and two engagement members 146, it is not necessary that there be a one-to-one correspondence between the pushers 122 and engagement members 146. The two engagement members 146 act (in concert with the complimentary engagement members) to maintain the pushers 122 in the restocking position when the tray 102 is in the open position. FIGS. 1D and 1H depict a product display merchandiser 100 having disengagement members 132. In one form, the disengagement members 132 are linearly aligned with the pushers 122 and correspond one-to-one with the pushers 122, although embodiments exist that do not have either of these features (e.g., one form may have one disengagement member 132 and three pushers 122). The disengagement members 132 act to disengage the engagement members 146 and the complimentary engagement members when the tray 102 is moved from the open position to the closed position. Such action by the disengagement members 132 causes the pushers 122 to be automatically removed from the restocking position. In one form, the disengagement members 132 are protrusions that physically contact one or more of the engagement members and the complimentary engagement members to force disengagement of the engagement members and the complimentary engagement members.

FIG. 1C is a front view of a product display merchandiser 100, according to some embodiments of the inventive subject matter. The product display merchandiser 100 includes a lens 106. As previously discussed, the lens 106 can hold and/or display signage, prevent product from falling out of the tray 100, etc. Such a lens can be formed from any suitable material and in any suitable manner. For example, the lens can be extruded or injection molded plastic. Additionally, in one form, the lens can have perforations which allow for easy snap-off type custom-sizing of the lens. Additionally, the lens 106 can have multiple display sections or channels. For example, the lens 106 may have a first display portion 106A and a second lens portion 106B. Although FIG. 1C depicts lens 106 as having the second display portion 106B arranged above the first display portion 106A, many other configurations exist. For example, the lens 106 may have left and right display sections, or any other combination of two or more display sections.

The remaining figures and text describe alternative embodiments of a product display merchandiser. For purposes of convenience, items that are similar to those discussed above with respect to FIGS. 1A-1M will be referenced using the same last two-digit number but using a first digit corresponding to the figure number simply to distinguish from one another. For example, in FIGS. 1A-1M, the product tray is referred to generally by reference number 102, while the product tray is referred to as 202, 302, and 402, in FIG. 2, FIG. 3, and FIG. 4A-4R, respectively.

Figure 2:
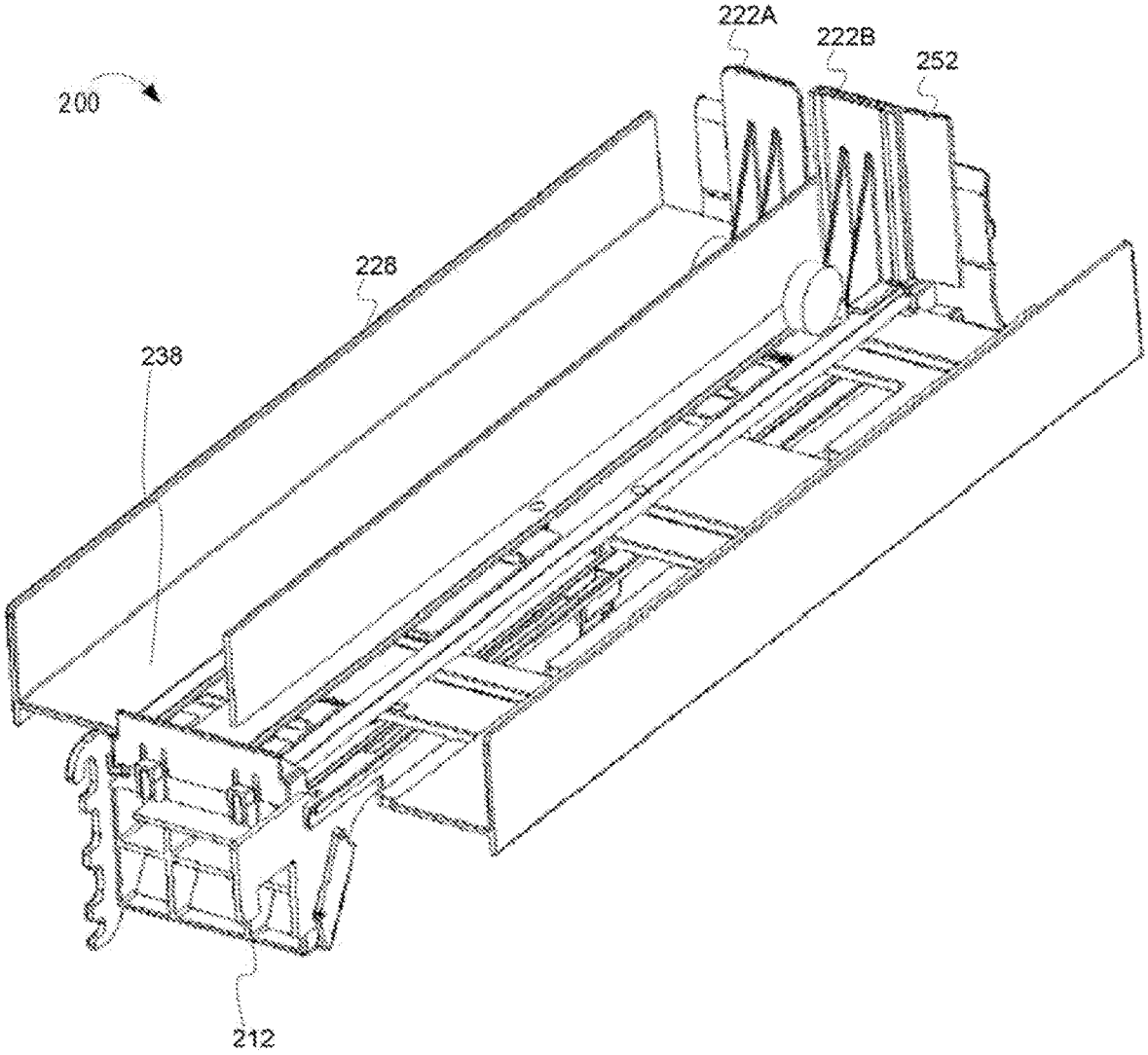
FIG. 2 is a perspective view of an alternate product display merchandiser in accordance with aspects of the invention taken from above the rear right corner of the merchandiser and illustrating the merchandiser with an alternate form of mounting bracket intended for use with bar mounted systems rather than grid systems, including alternate side members or wings for larger product and an exemplary pusher attachment accessory (note: while a bar mounting bracket and a grid mounting bracket are shown for comparison purposes, it should be understood that the merchandiser would be equipped with either two bar mounting brackets or two grid mounting brackets, rather than a combination of either).

While FIGS. 1A-1M depict a first embodiment of a product display merchandiser 100, FIG. 2 depicts a second embodiment of a product display merchandiser 200, according to some embodiments of the inventive subject matter. The product display merchandiser 200 includes sidewalls 228, pushers 222A and 222B, bracket engagement members 212, and a pusher attachment 252. The pusher attachment 252 attaches to the pusher 222B to expand the surface area of the pusher 222B. Additional types of pusher attachments exist. For example, pusher attachments can be designed for specific products, to minimize the surface area of the contact point with a product, to extend the depth of the pusher, etc. Additionally, FIG. 2 depicts a bracket engagement member 212 that is configured to engage a bar mounted system (not shown). Additionally, FIG. 2 depicts an embodiment of a product display merchandiser in which a horizontal portion of the sidewall 228 (i.e., the product support 238 portion of the sidewall) is roughly equal in area to a vertical portion of the sidewall 228.

Figure 3:
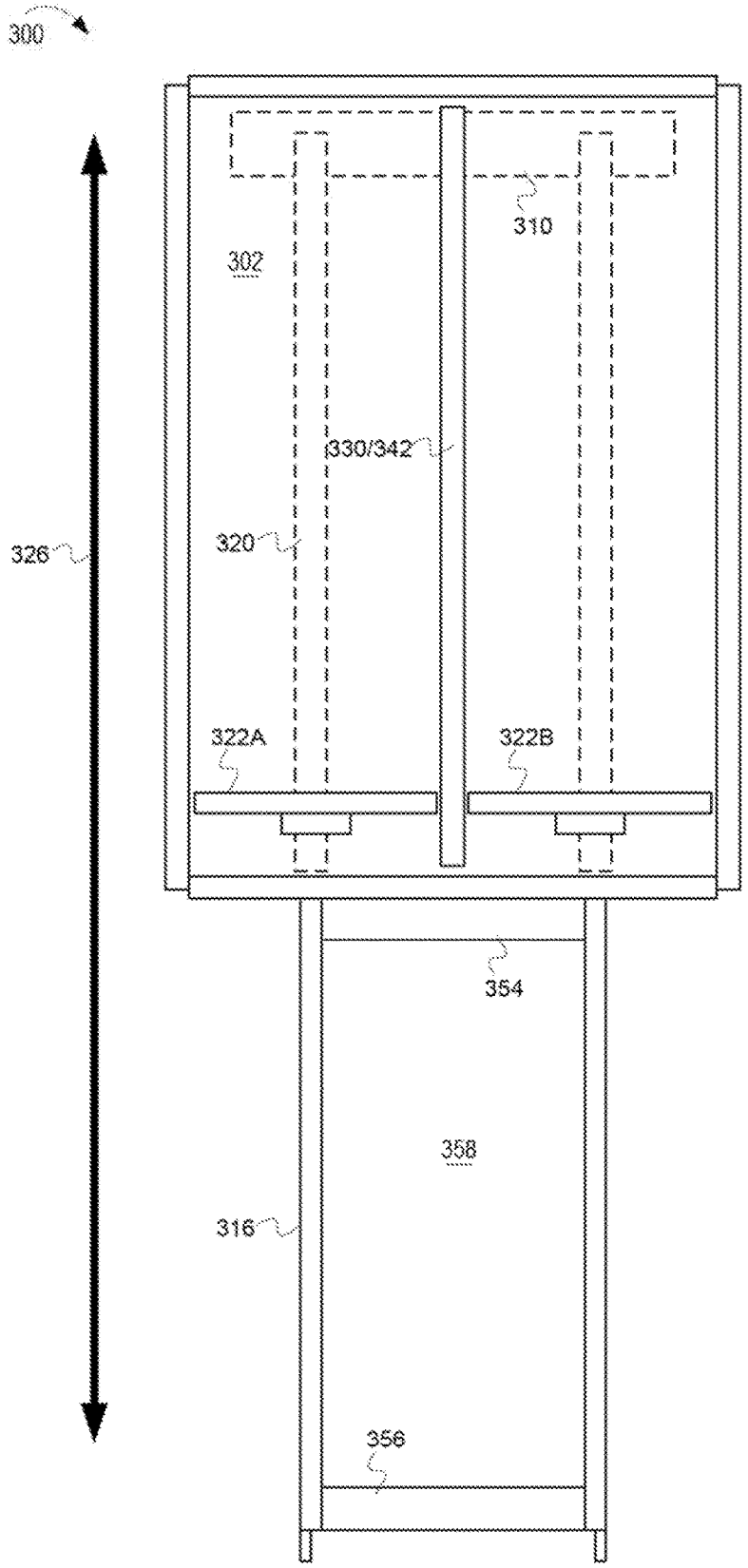
FIG. 3 is a top view of an alternate product display merchandiser in accordance with embodiments of the invention illustrating an optional front and/or rear stabilizer member connected to the mounting brackets for stabilizing same.

While FIG. 2 depicts a second embodiment of a product display merchandiser, FIG. 3 depicts a third embodiment of a product display merchandiser 300, according to some embodiments of the inventive subject matter. The product display merchandiser 300 includes a tray 302 that is slidable along arms 316. The tray 302 includes tracks 320 disposed on the bottom side of the tray 302. The arms 316 are seated in the tracks 320. The tray 302 moves in a direction as indicated by arrow 326 from an open position (shown) to a closed position (not shown). When in the open position, a void (or unobstructed opening) 358 is revealed (i.e., the product display merchandiser 300 has a baseless design). The void 358 is bounded on a left side and a right side by arms 416, on a front side by front stabilizer 354, and on a rear side by rear stabilizer 356. The tray also includes pushers 322A and 322B which are movable within in the tray 302 and a handle 310. In some embodiments, the handle 310 is operable to disengage engagement members so as to allow the tray 302 to be moved from the closed position to the open position. In one form, the tray 302 includes a divider 330/342. The divider 330/342 can be fixed to the tray 302 or removably attached to the tray 302.

Figure 4A:
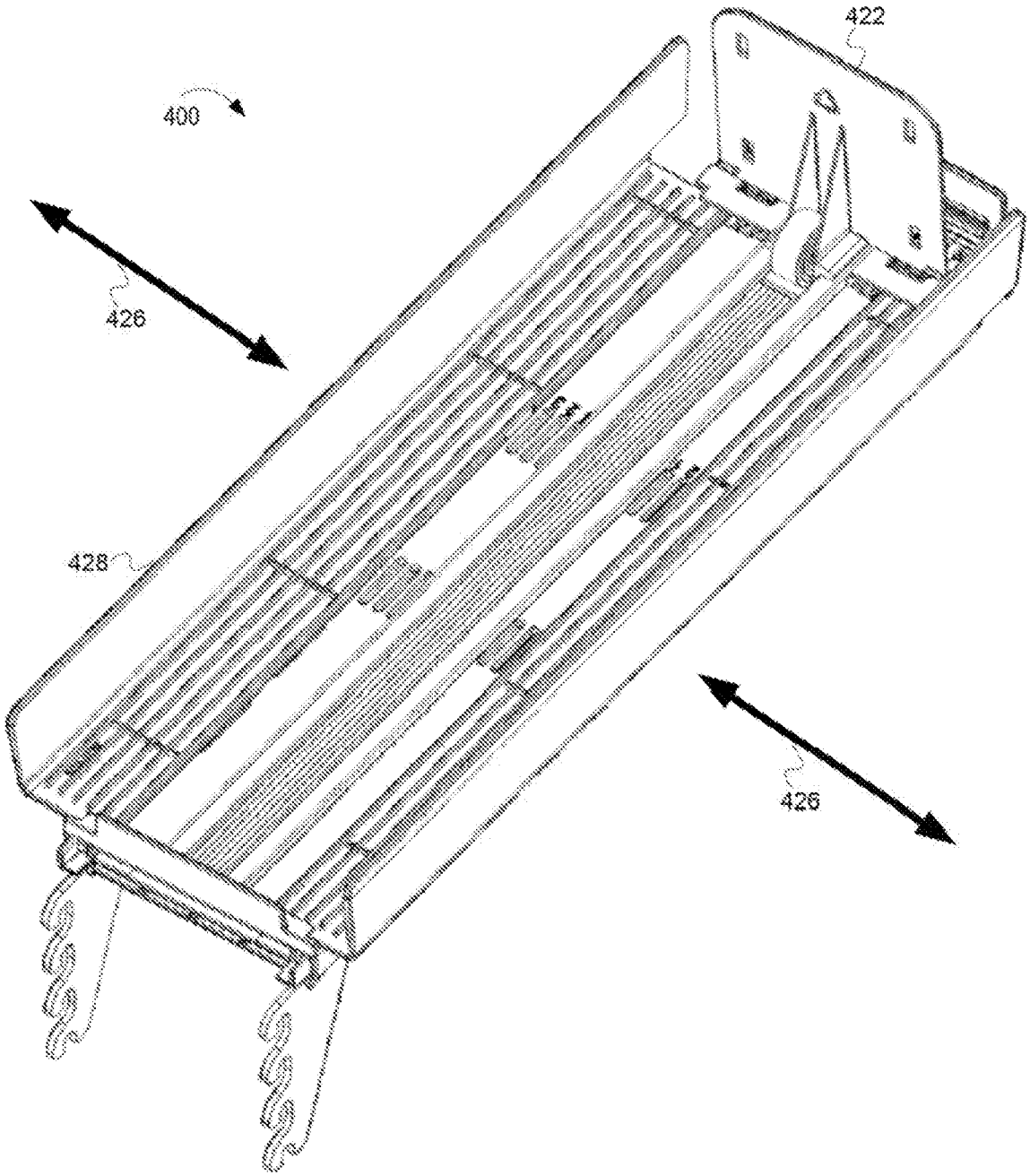
FIG. 4A is a perspective view of another product display merchandiser in accordance with embodiments of the invention taken from above and behind the merchandiser (or the right rear corner of the unit) and illustrating an alternate baseless tray or drawer type merchandiser design with an alternate manner for adjusting the side members or wings of the unit to adjust width of the merchandiser and an alternate means for securing the tray in the first, retracted position so as to avoid inadvertent movement of the merchandiser to the second, extended position (note: the left side member or wing is adjusted to a wider position than the right side member or wing simply to show that the merchandiser does not have to be setup symmetrically if desired).
Figure 4B:
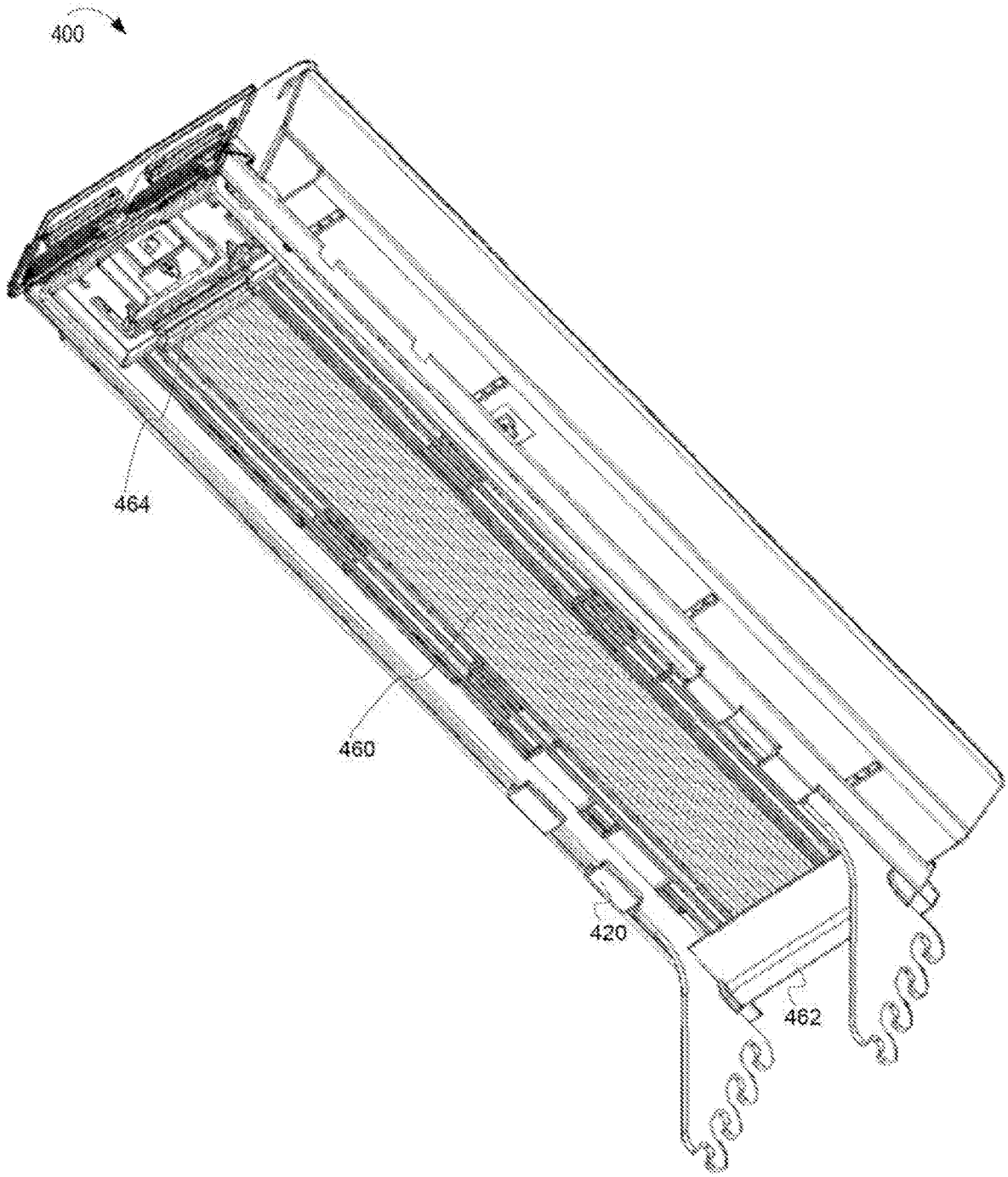
FIG. 4B is a perspective view of the merchandiser of FIG. 4A taken from below and in front of the merchandiser (or the lower left front corner of the unit) and illustrating the alternate rear stabilizer and adjustable width mechanism of the merchandiser.
Figure 4C:
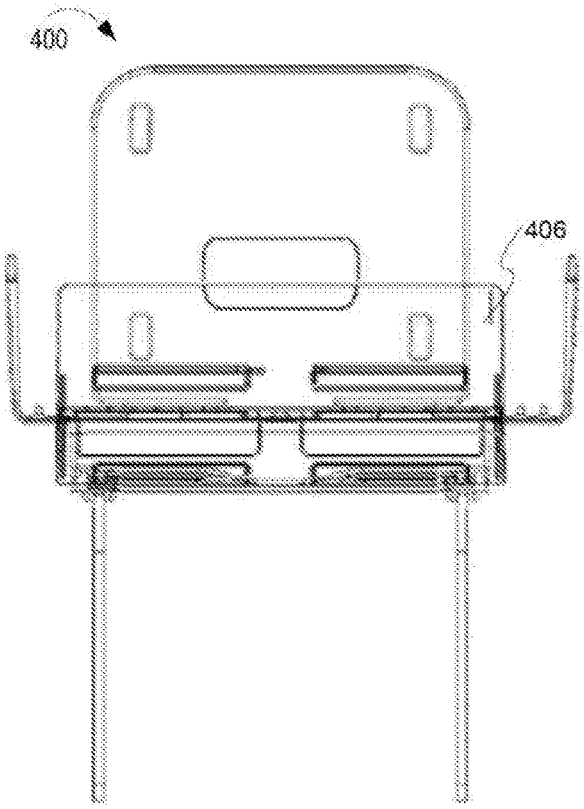
FIG. 4C-D are front elevation and rear elevation views of the product display merchandiser of FIGS. 4A-B again illustrating how the width of the left side member or wing has been adjusted more than the right (or the left side member has been displaced further from the center of the merchandiser or from a central axis running through the center of the merchandiser than the right side member is from the central axis).
Figure 4D:
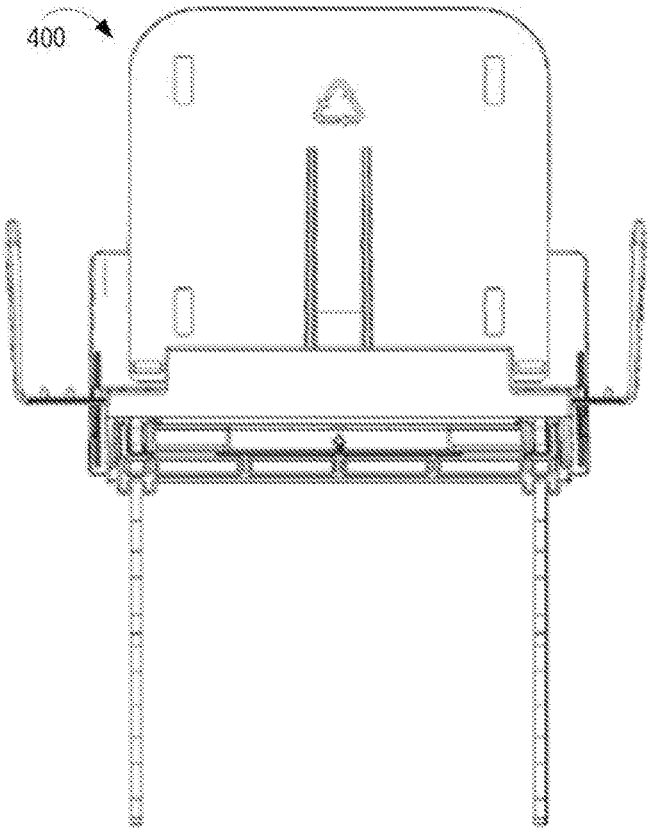
Figure 4E:
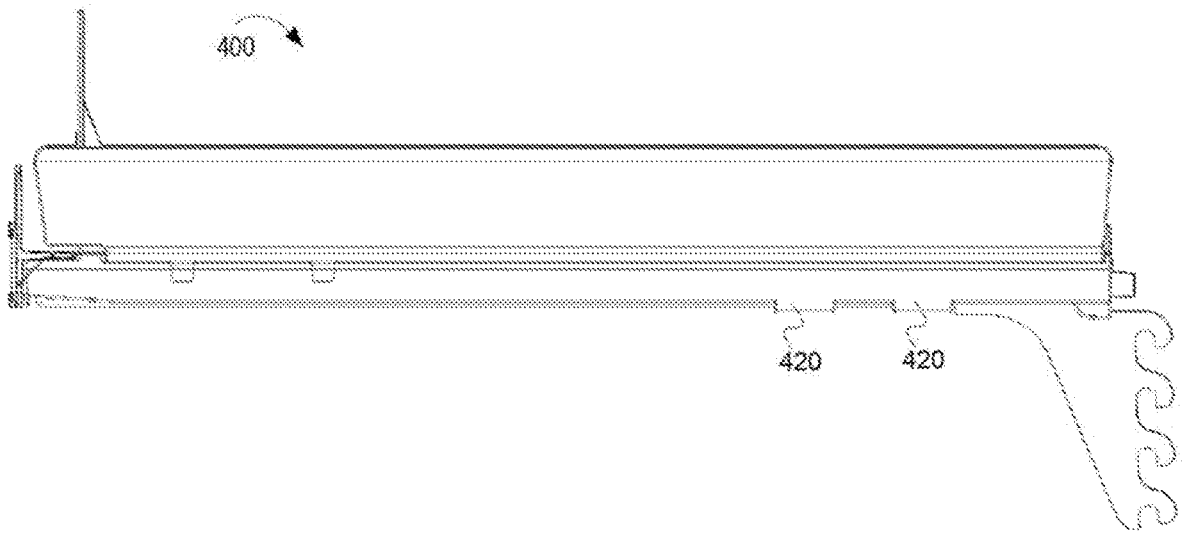
FIGS. 4E, 4F, and 4G are left side elevation, top, and bottom views, respectively of the product display merchandiser of FIGS. 4A-D illustrating the merchandiser in the same first, retracted or closed position the merchandiser is illustrated in for FIGS. 4A-D.
Figure 4F:
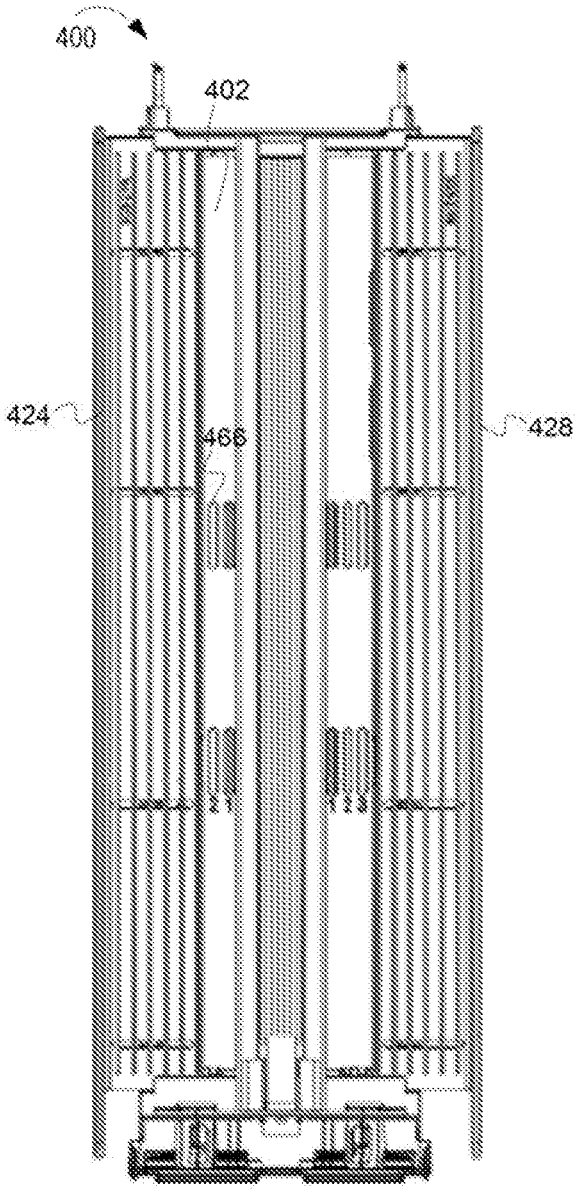
Figure 4G:
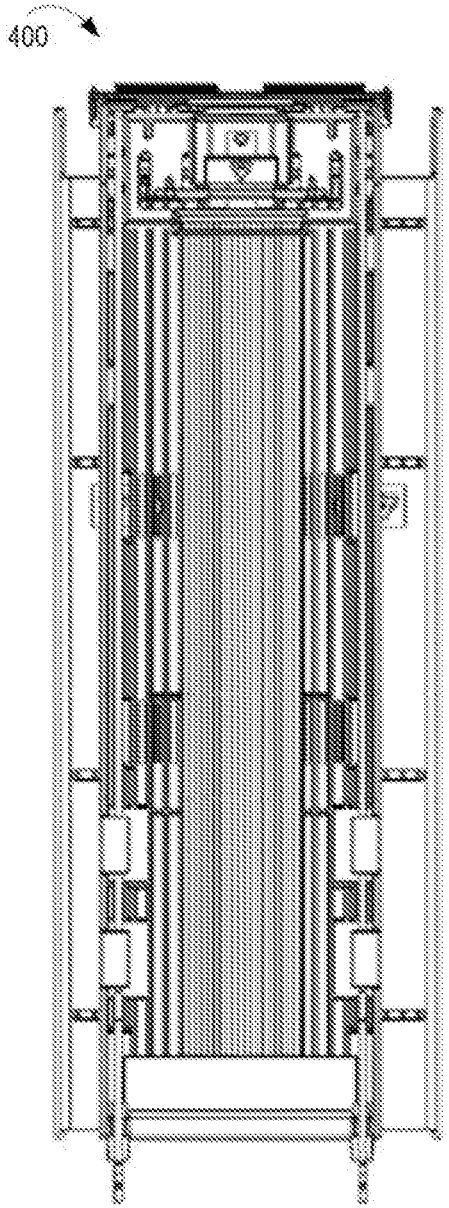
Figure 4H:
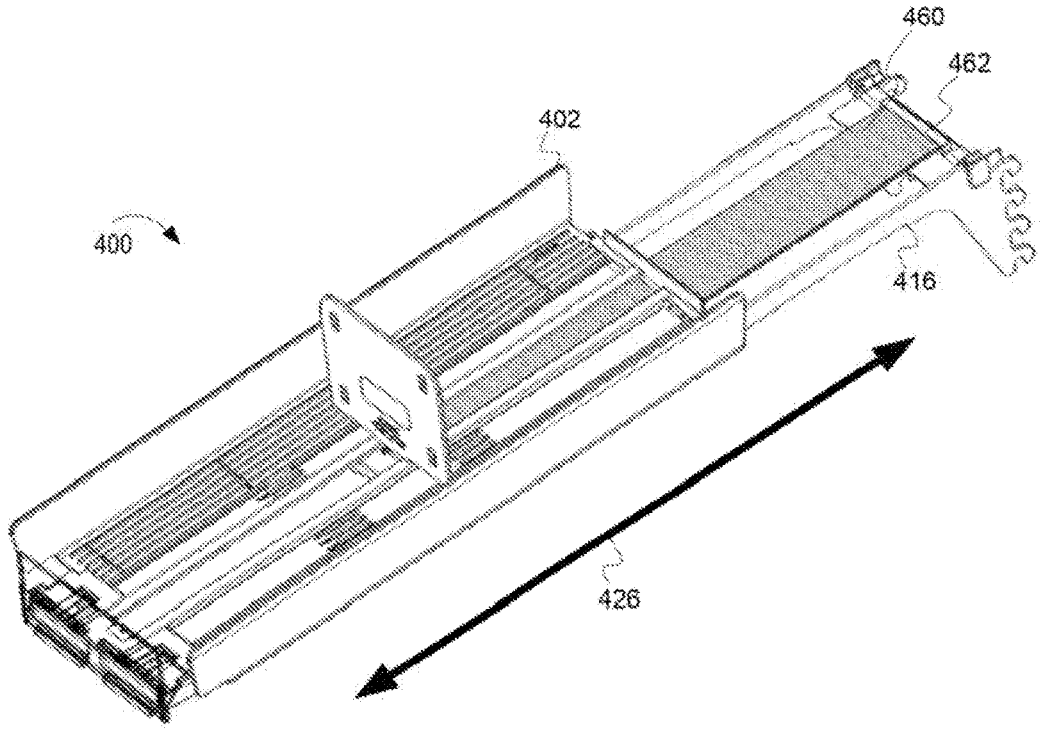
FIGS. 4H and 41 are alternate perspective and left side elevation views, respectively, of the merchandiser of FIGS. 4A-G illustrating the merchandiser in a second, extended or open position in which a store associate may place the merchandiser for stocking or restocking purposes.
Figure 4I:
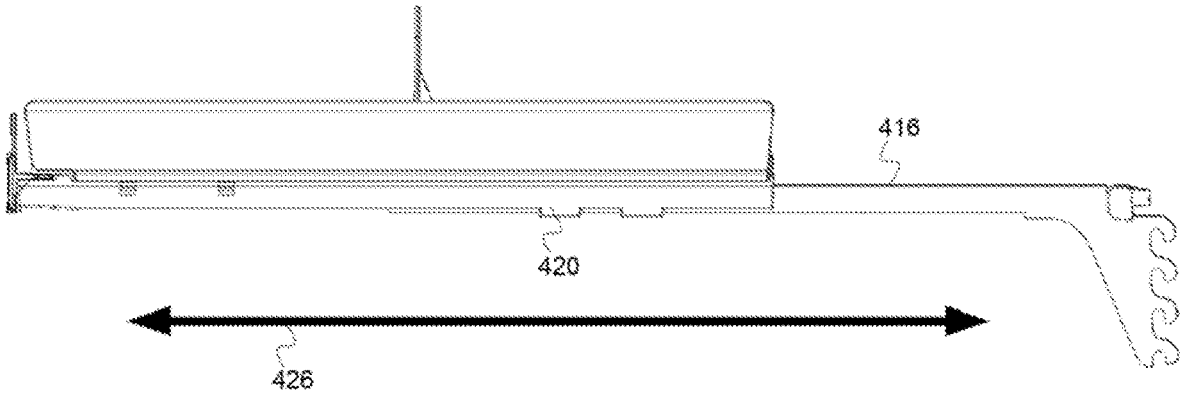
FIG. 4J is an enlarged, partial perspective view of the tray portion of the merchandiser of FIGS. 4A-41 illustrating how the width of the side members may be adjusted and how a user may keep track of same (again noting the left side member is illustrated as being adjusted to a wider position than the right side member).
FIG. 4K is a cross-section of the merchandiser of FIG. 4J taken along line 4K-4K.
FIG. 4L is a partial perspective view of only a portion of the merchandiser of FIGS. 4A-4K illustrating the support brackets, first and second stabilizing members and a baffle structure for directing air from a rear of the merchandiser toward the front of the merchandiser and, thus, from the rear of any open-air refrigeration unit the merchandiser may be installed in toward the front of the open air refrigeration unit in order to assist in keeping product within the refrigeration unit at a generally uniform temperature. The front stabilizer also has a first mating structure for engaging a portion of the remainder of the merchandiser unit in order to retain the unit in the retracted position and/or prevent inadvertent movement of the merchandising unit to the second, extended position.
FIG. 4M is a partial perspective view of only a portion of the merchandiser of FIGS. 4A-4K illustrating second mating structures for engaging with the first mating structures of the merchandiser portions of FIG. 4L in order to retain the merchandising unit in the retracted position and/or to prevent inadvertent movement of the merchandising unit to the second, extended position.
FIGS. 4N, 4O, and 4P are partial perspective views of the stabilizer located at the rear portion of the merchandiser of FIG. 4L illustrating from the front (FIG. 4N) and rear (FIG. 4O) how the baffle is inserted into or nested within the rear stabilizer and how the rear stabilizer is connected to the side members, and further illustrating in FIG. 4P what the rear stabilizer looks like when removed from the merchandiser.
FIGS. 4Q and 4R are partial perspective views of the tray and a side member, respectively, depicting one exemplary mechanism for securing a side member to the tray.
Figure 4J:
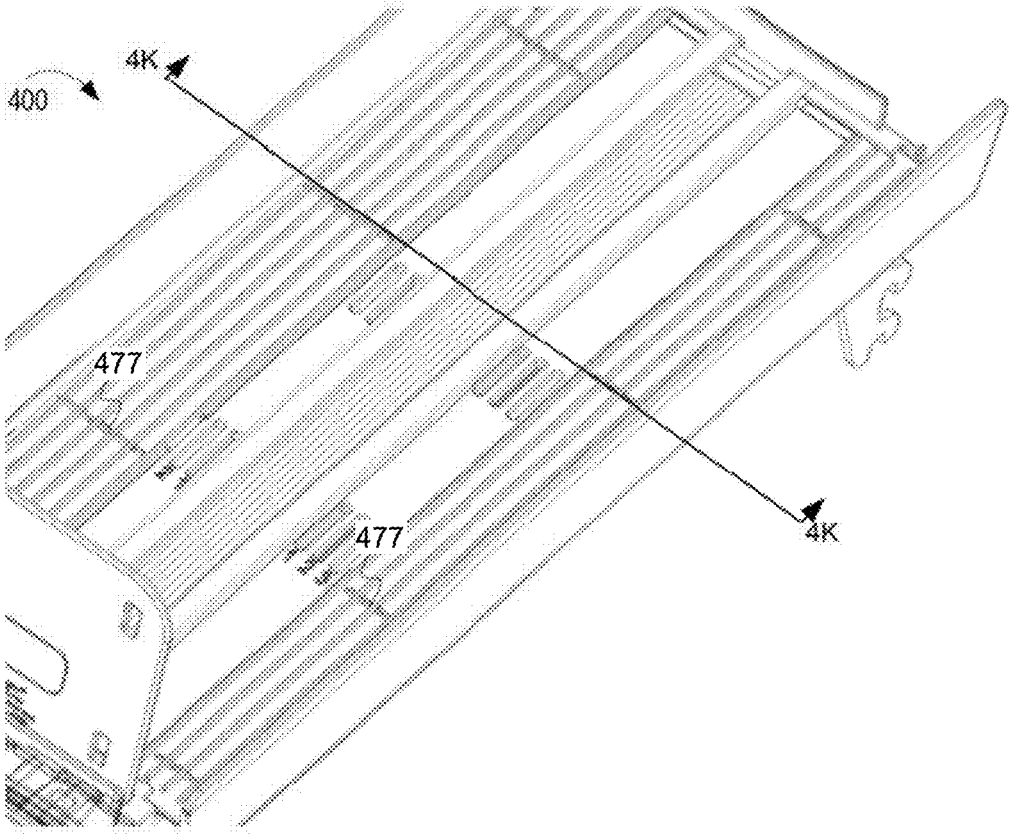
Figure 4K:
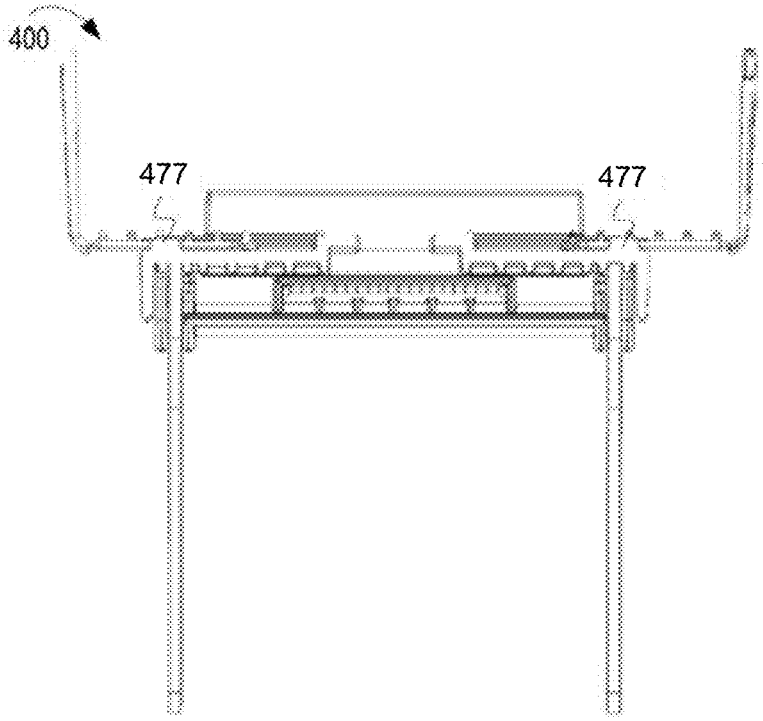
Figure 4L:
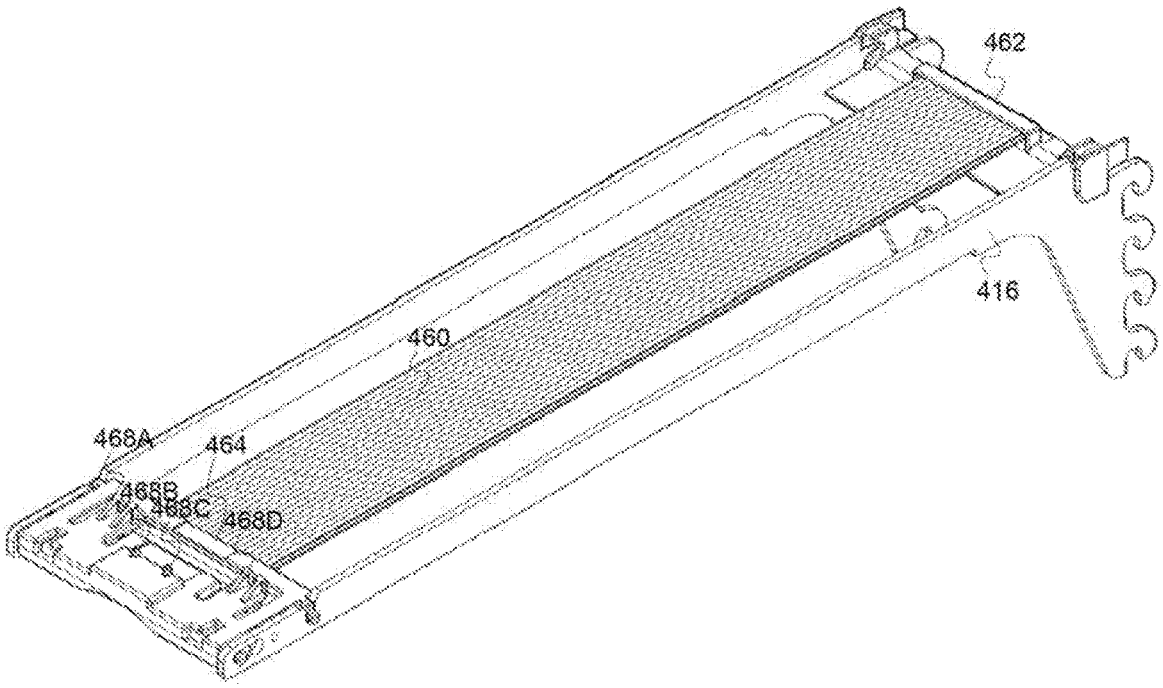
Figure 4M:
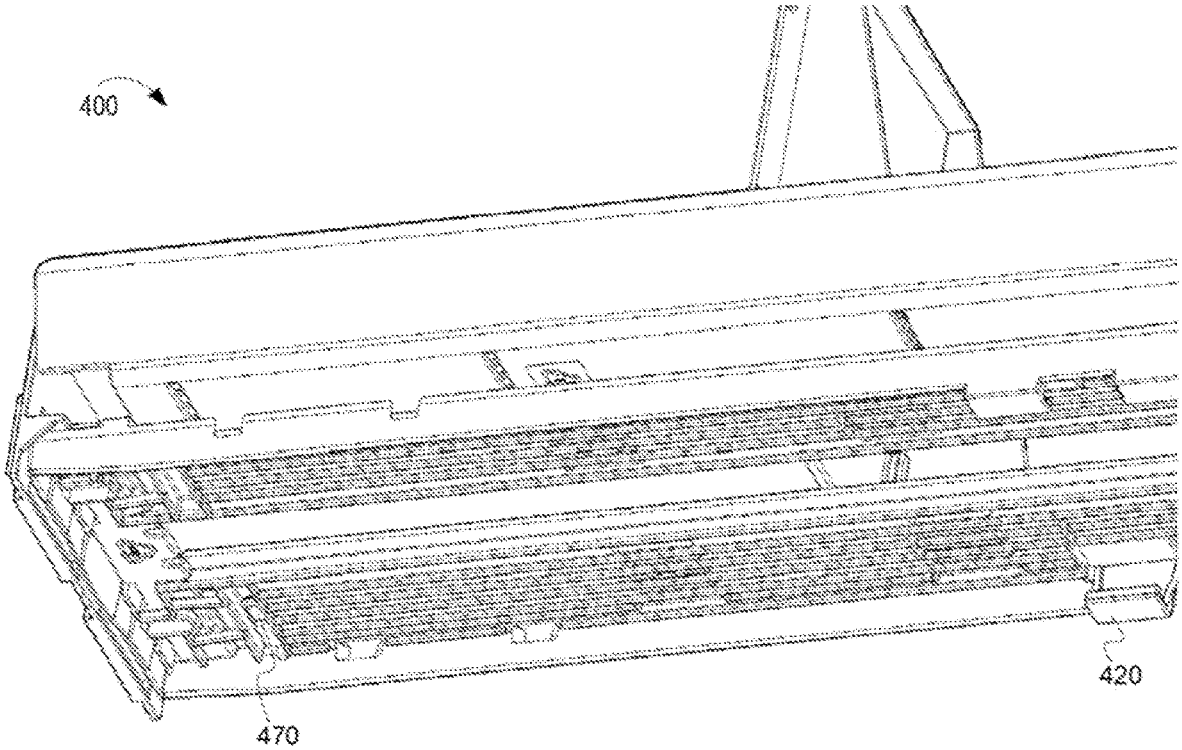
Figure 4N:
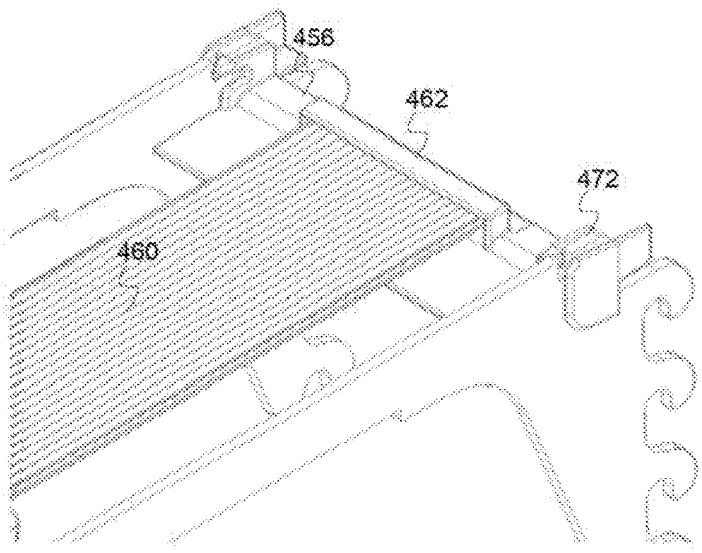
Figure 4O:
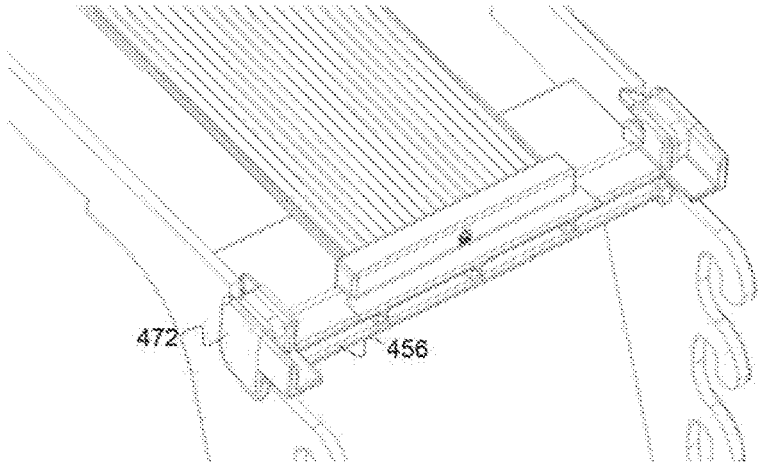
Figure 4P:
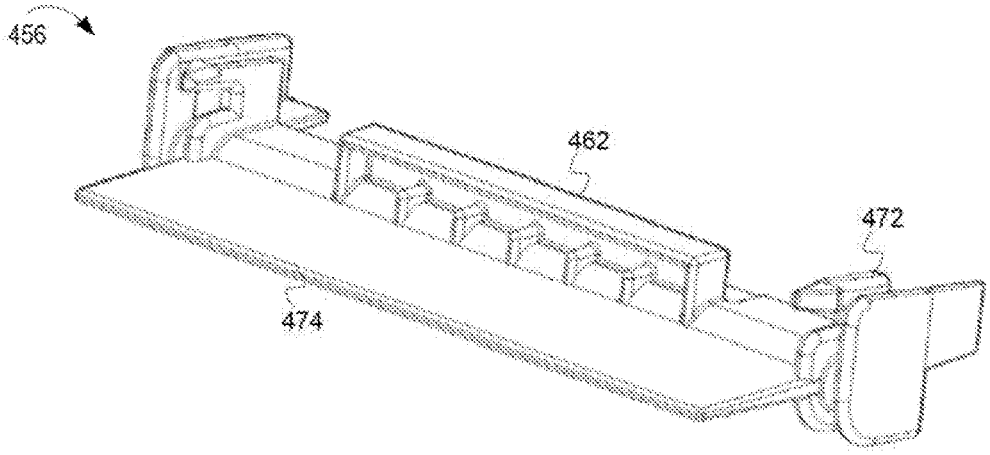
Figure 4Q:
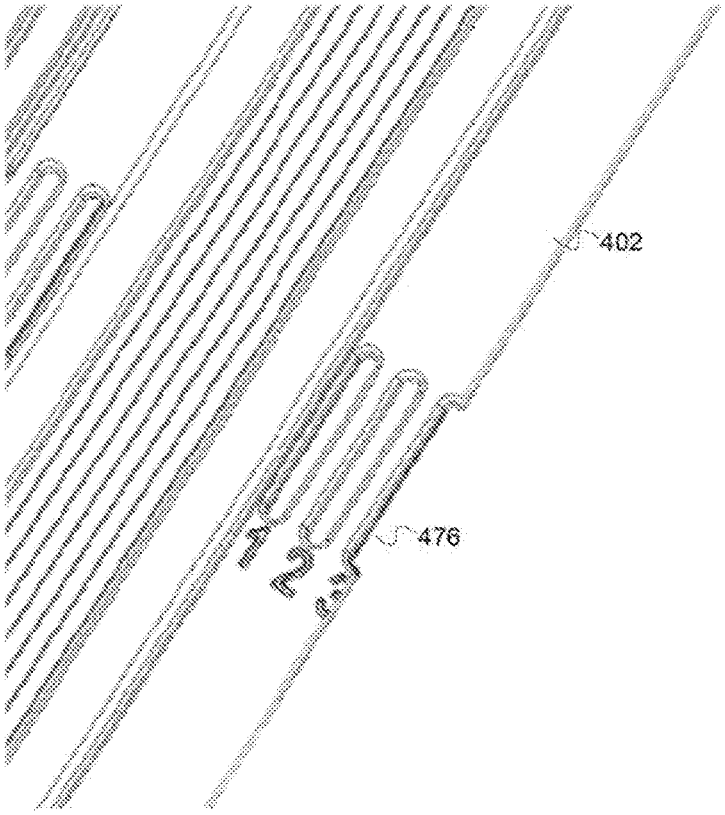
Figure 4R:
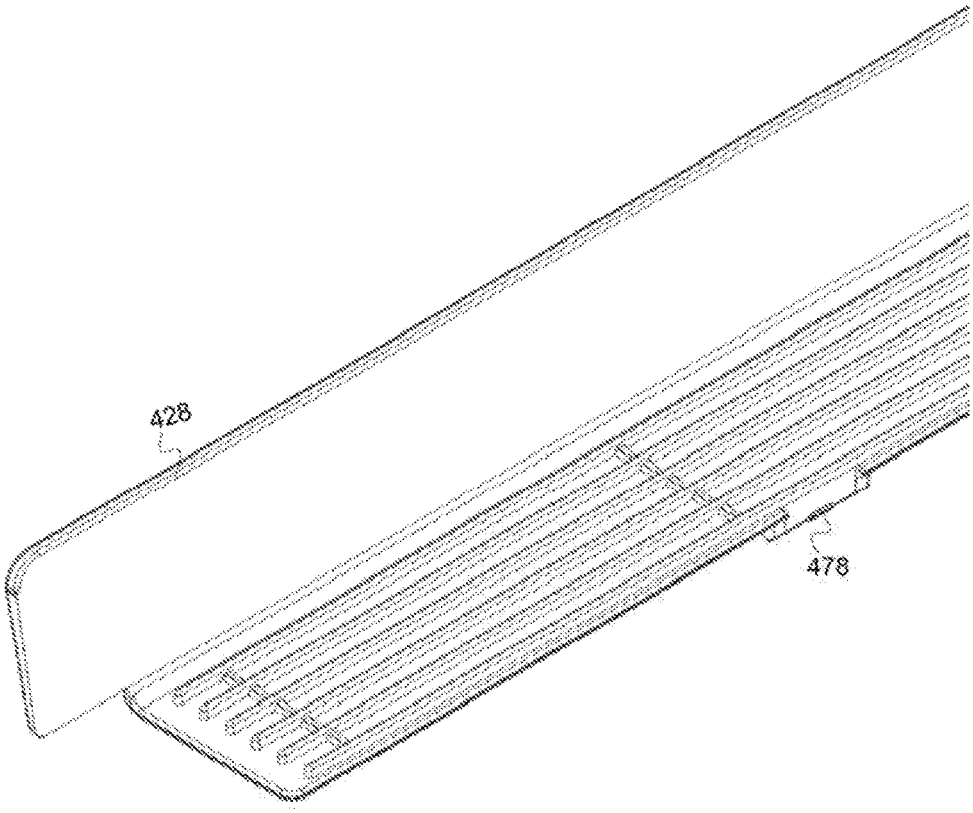

While FIG. 3 depicts a third embodiment of a product display merchandiser, FIGS. 4A-4R depict a fourth embodiment of a product display merchandiser 400 having an extendable tray width.

FIG. 4A is an upper perspective view of a fourth embodiment of the product display merchandiser 400 having adjustable side members 428, according to some embodiments of the inventive subject matter. The product display merchandiser 400 depicted in FIG. 4A has one pusher 422 and movable sidewalls 428. The sidewalls 428 are extendable from the tray in directions indicated by arrows 426. Extension of the sidewalls 428 allows for the tray width to be adjusted. The tray also includes first mating members 476 (best shown in FIG. 4Q) into which corresponding protrusions 478 (best shown in FIG. 4R) can seat to secure the sidewalls 428 in an extended position. In some embodiments, a horizontal portion of the sidewalls 428 includes second mating members (e.g., protrusions 478 extending from the horizontal portion of the sidewalls 428, as depicted in FIG. 4R) which fit into the first mating members 476. In some embodiments, the second mating members "snapfit" into the first mating members 476. For example, a person can lift an edge of one of the sidewalls 428 to disengage the second mating members from the first mating members 476. In one form, the sidewalls 428 are secured to the product display by one or more housing members or cords. Such housing members or cords can prevent the sidewalls 428 from becoming completely detached from the product display merchandiser 400 when disengaged. Once disengaged, the person can slide the sidewall 428 in and out until a desired spacing is achieved. Once the desired spacing is achieved, the person can push the sidewall back into place to reengage the second mating members 478 with the first mating members 476 (i.e., snap the second mating members 478 into the first mating members 476). In some embodiments, each of the sidewalls 428 are independently movable. For example, a first of the two sidewalls 428 can be moved, and then a second of the two sidewalls 428 can be moved independently of the first. In other embodiments, the sidewalls 428 can be coupled in such a manner that when one of the two sidewalls 428 is moved, the other of the two sidewalls 428 moves in a corresponding manner.

In some embodiments, the product display merchandiser 400 includes linear guides 477, depicted in FIGS. 4J and 4K. The linear guides 477 help ensure that the sidewalls 428 travel linearly with respect to the product display merchandiser 400 when moved between positions. In one form, the linear guides 477 are protrusions that are seated in recess disposed in a horizontal portion of the sidewalls 428.

Although FIG. 4Q depicts the first mating members 476 as incrementally spaced slots, any suitable mechanism for securing the sidewalls in an extended position may be employed. For example, one continuous aperture extending in a direction parallel to the direction in which the sidewalls 428 extend can be utilized. In such embodiments, any suitable fastener (e.g., a screw and nut combination) can be used to secure the sidewalls in an extended position. For example, a horizontal portion of the sidewalls can include a threaded shaft which protrudes through the continuous aperture. In such embodiments, the sidewall can be secured with a nut fastened to the threaded shaft. Alternatively, the horizontal portion of the sidewall can include an internally threaded aperture and the sidewall can be secured by inserting a screw through continuous aperture into the internally threaded aperture. Although multiple examples are given for the first mating members 476, numerous additionally possibilities exist and are considered within the scope of the teachings herein.

Additionally, although FIG. 4R depicts the second mating members 478 as protrusions and the first mating members as incrementally spaced slots, any suitable combination of second mating members 478 and first mating members 476 can be used. For example, the second mating members 478 can be shaped as pegs and the first mating members 476 can take the form of complementarily apertures in which the pegs can be seated.

Figure 41:
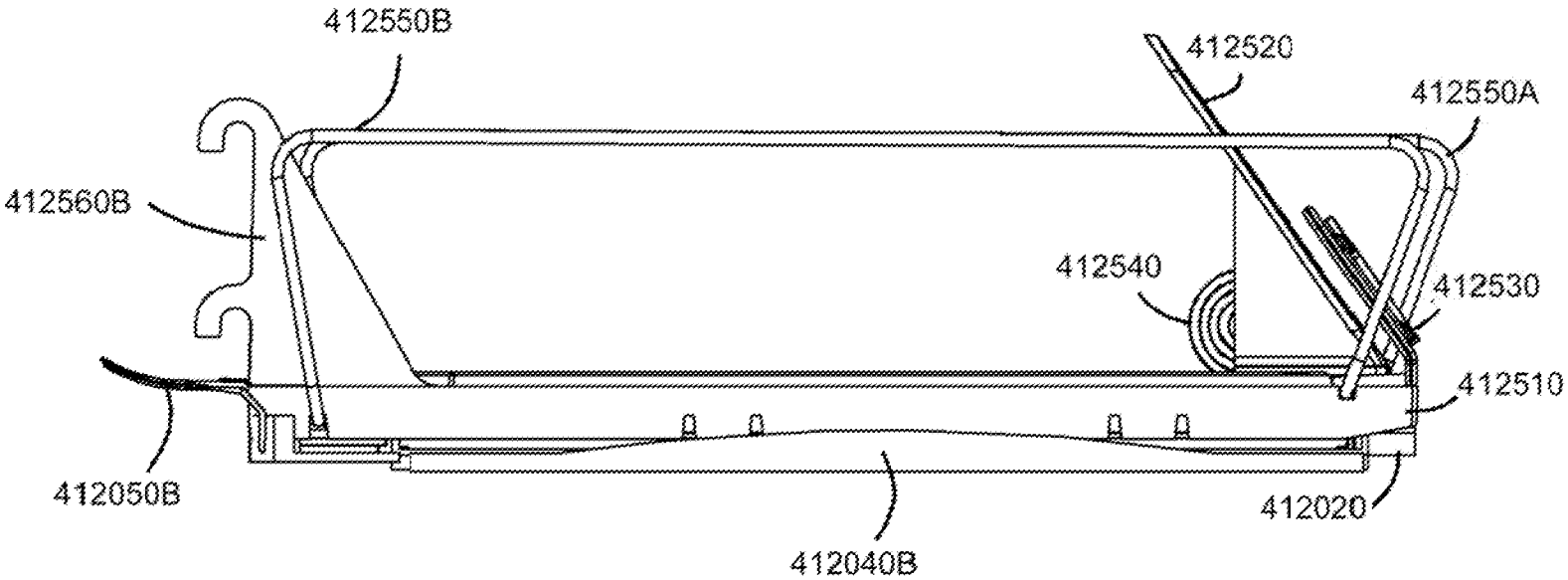
Figure 42:
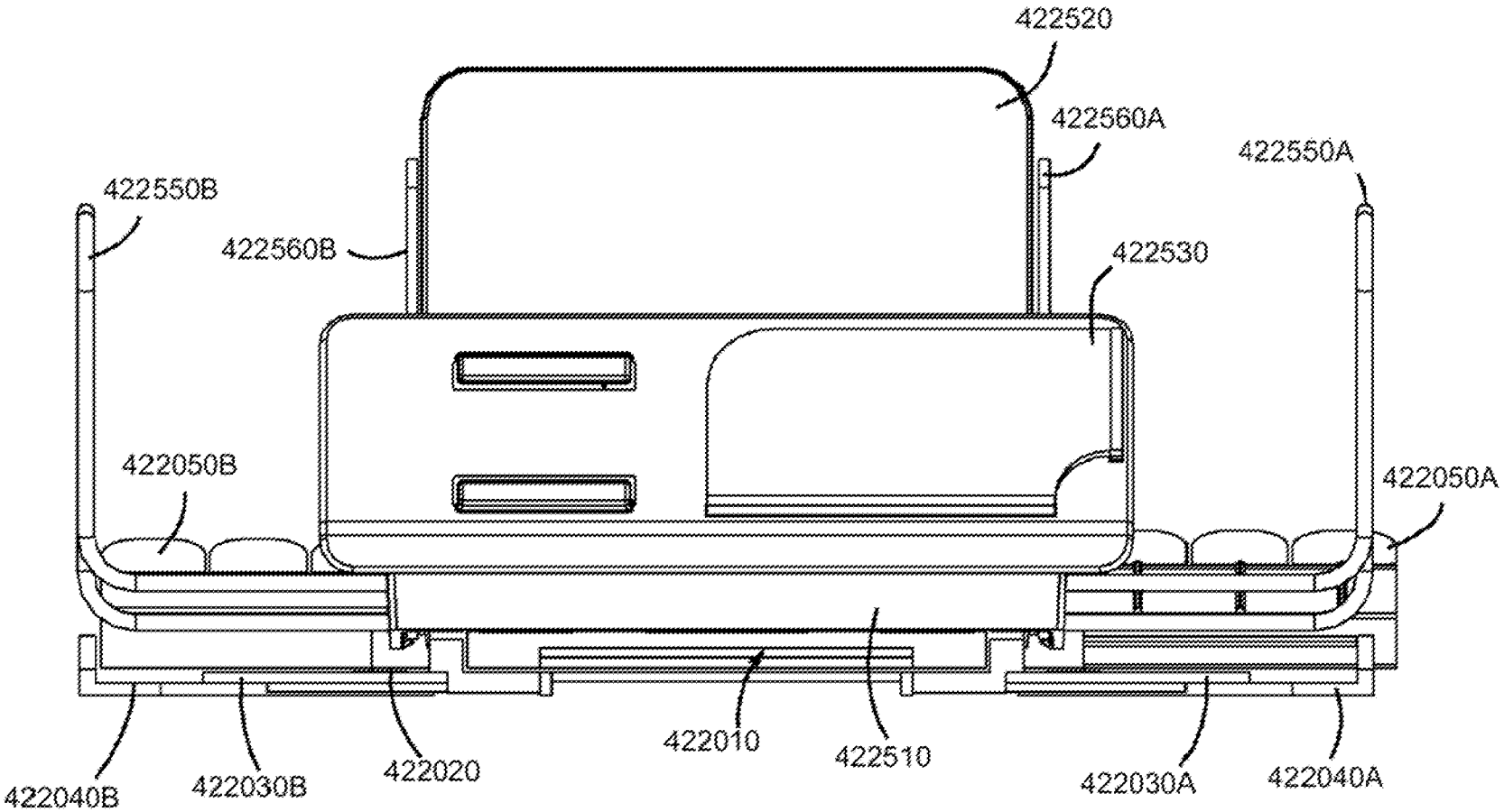
FIG. 42 is a front view of a baffle system coupled to a merchandising shelf in accordance with the embodiment in FIG. 36A.
Figure 43:
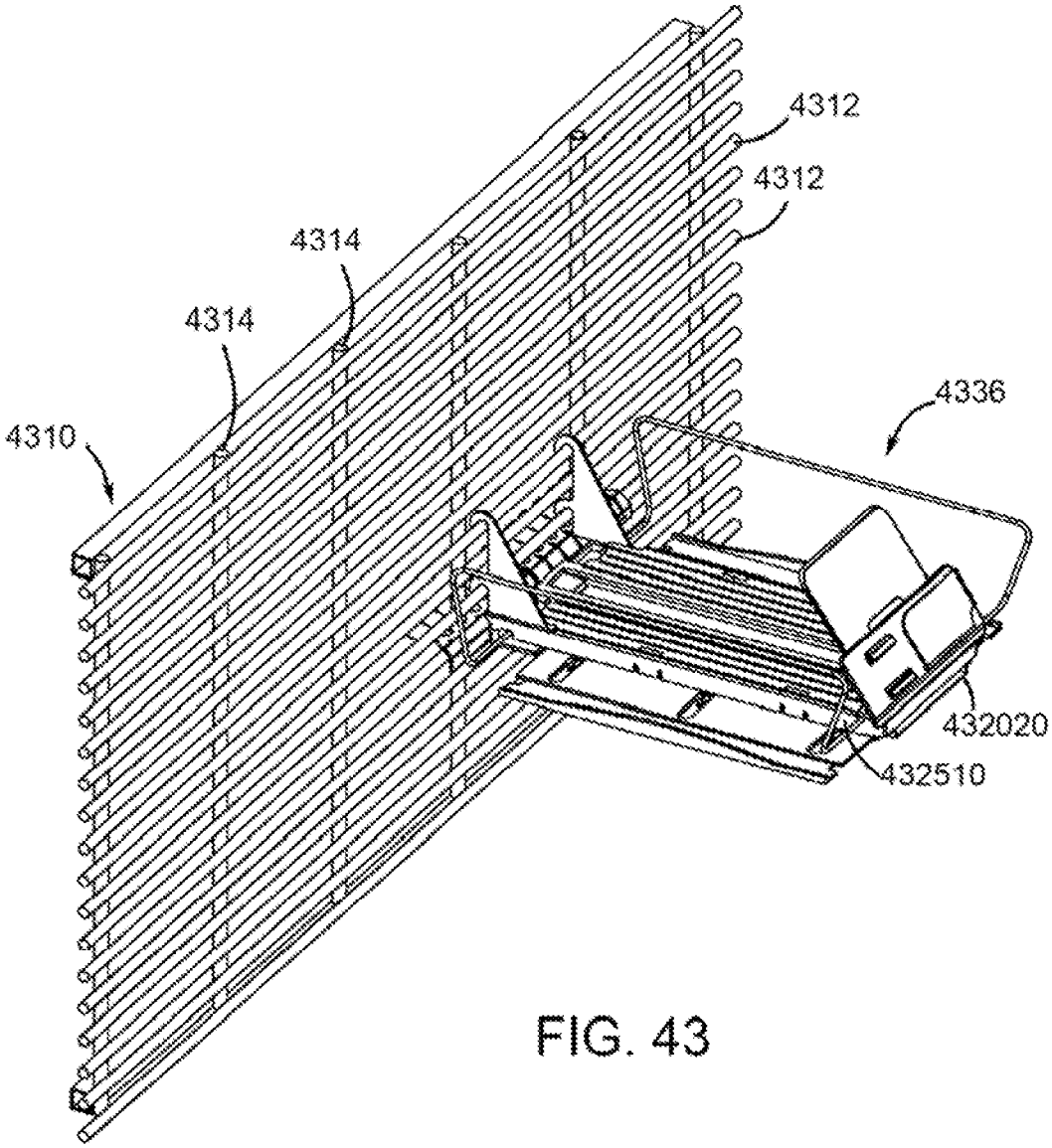
FIG. 43 is a perspective view of a baffle system coupled to a merchandising shelf in accordance with the embodiment in FIG. 36A, attached to a grid system.
Figure 44:
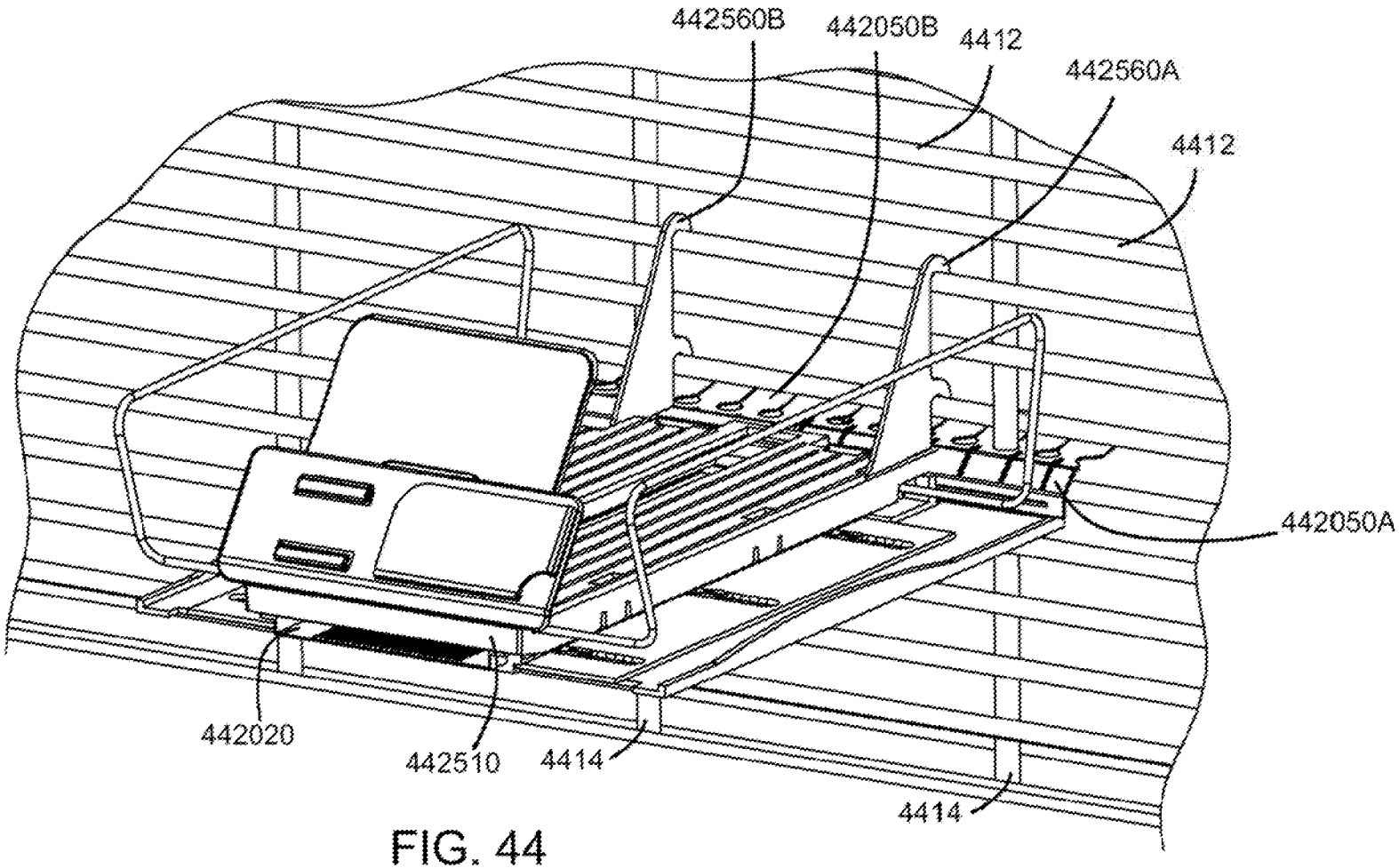
FIG. 44 is a perspective view of a baffle system coupled to a merchandising shelf in accordance with the embodiment in FIG. 36A, attached to a grid system.
Figure 45:
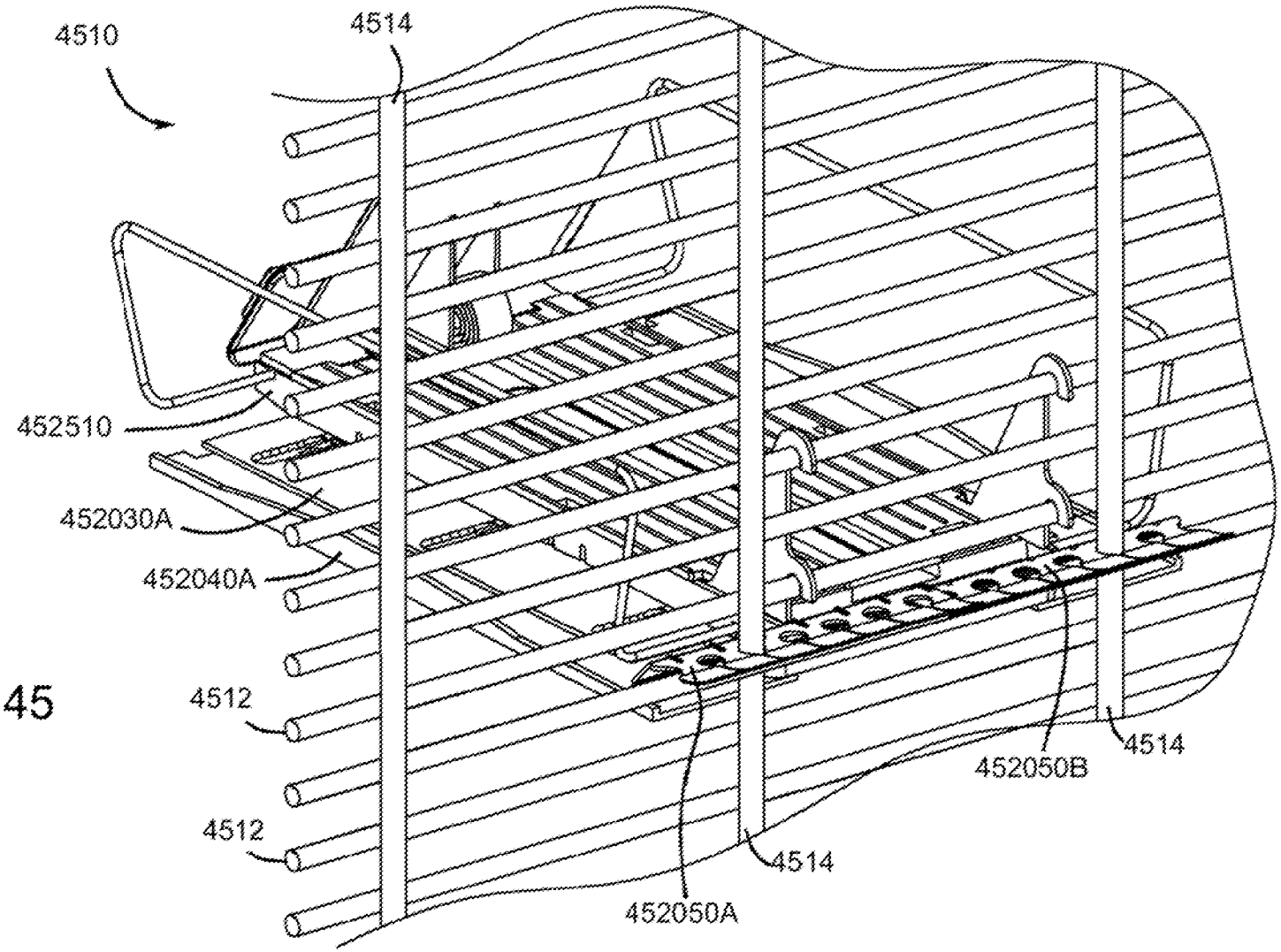
FIG. 45 is a rear perspective view of a baffle system coupled to a merchandising shelf in accordance with the embodiment in FIG. 36A, attached to a grid system.
Figure 46:
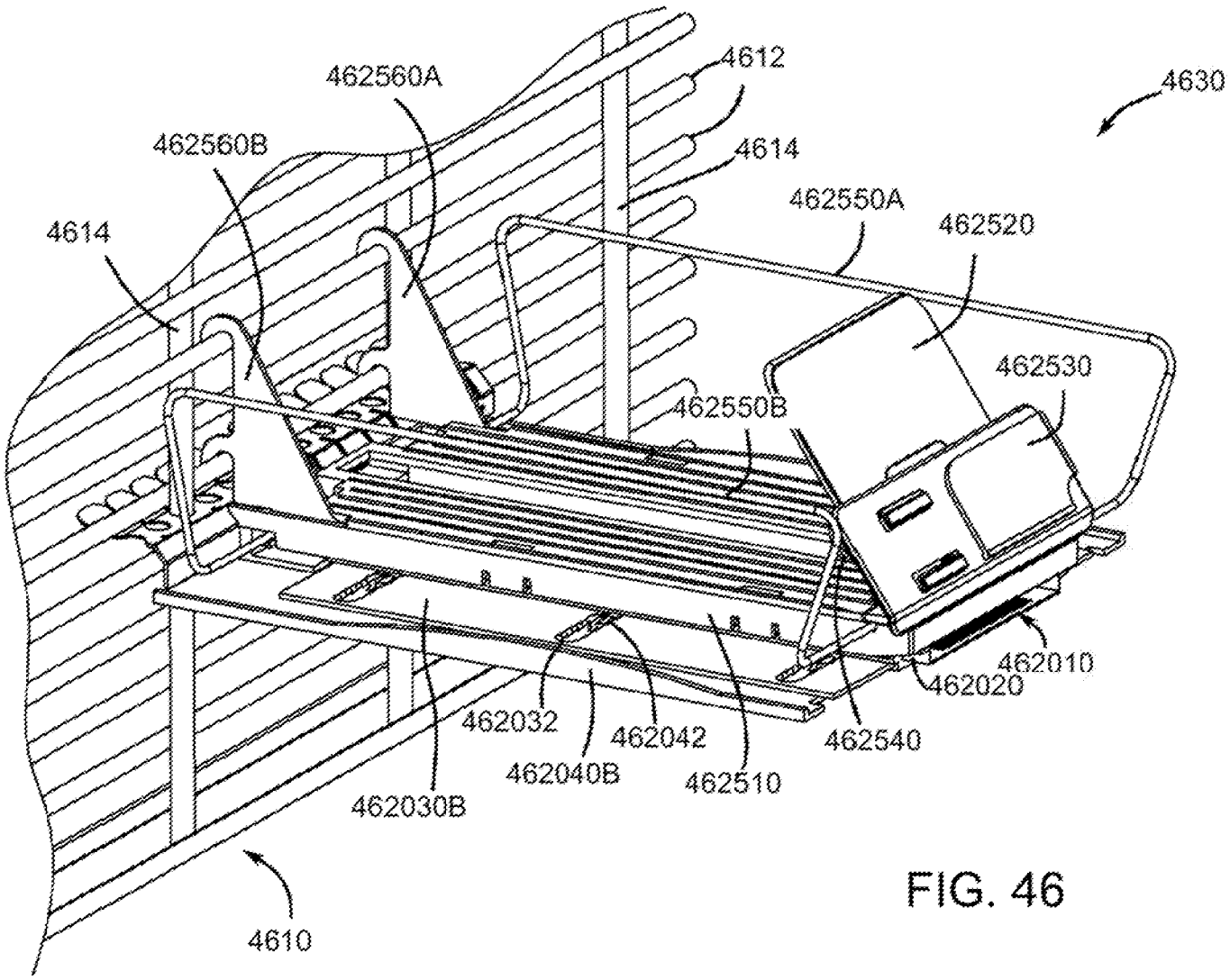
FIG. 46 is a side perspective view of a baffle system coupled to a merchandising shelf in accordance with the embodiment in FIG. 36A, attached to a grid system.

FIG. 4B is a lower perspective view of the product display merchandiser 400 depicted in FIG. 4A. As seen in FIG. 4B, the product display merchandiser 400 includes tracks 420 (also well-depicted in FIG. 4M) through which arms 416 extend. The tray 402 is slidable along the arms in a direction as indicated by arrow 426 from a closed position (shown in FIG. 4E) to an open position (shown in FIG. 41).

FIG. 4B also depicts a baffle 460 inserted on the underside of the product display merchandiser 400 and secured by a rear baffle mount 462 and a front baffle mount 464. The baffle 460 can server many different purposes, depending on a shape of the baffle 460, a material from which the baffle 460 is made, and a position of the baffle 460 within the product display merchandiser 400. For example, the baffle 460 can server to direct airflow through or around the product display merchandiser 400. Additionally, in some forms, the baffle 460 can be removably attached to the product display merchandiser 400 by insertion and removal from the rear baffle mount 462 and the front baffle mount 464.

The arms 416, baffle 460, rear baffle mount 462, front baffle mount 464 are well-depicted in FIG. 4L. FIG. 4L also depicts a first tray engagement mechanism 468A-468D which acts to maintain the tray 402 in the closed position. A second tray engagement mechanism 470 (best shown in FIG. 4M) mates with the first tray engagement mechanism 468A-468D when the tray is in the closed position. In some embodiments, such as those depicted in FIG. 4P, the rear baffle munt 462 and insert support surface 474 are integral to the rear stabilizer 456. Additionally, the rear stabilizer 456 can attach to the arms 416 via stabilizer engagement members 472.

While FIGS. 4A-4R depict a fourth embodiment of a product display merchandiser 400 having an extendable tray width or adjustable width feature, FIGS. 5A-5E depict a fifth embodiment of a product display merchandiser 500 having an alternate manner for adjusting the width of the side members 528, 524 and securing them in position so that they cannot be moved once the merchandiser is stocked with product and installed on a shelf, grid or bar.

The product display merchandiser 500 of FIG. 5 includes a left sidewall 528, a right sidewall 524, a tray 502, arms 516, a removable divider 530, a lens 506, and rear stabilizer 556. The left sidewall 528 and right sidewall 524 are securable to the tray 502. The tray 502 mounts to, and is supported, by the arms 516. In a preferred form, the tray 502 is slidable along the arms 516 to an open or extended position making loading product onto the product display merchandiser 500 easier and in a manner that does not require a separate base structure that the tray slides upon.

The positions of the left sidewall 528 and the right sidewall 524 are adjustable or moveable with respect to the tray 502. Such adjustability or movability allows the distance between the left sidewall 528 and the right sidewall 524 to be adjusted to accommodate products of varying size and dimension.

Figure 5A:
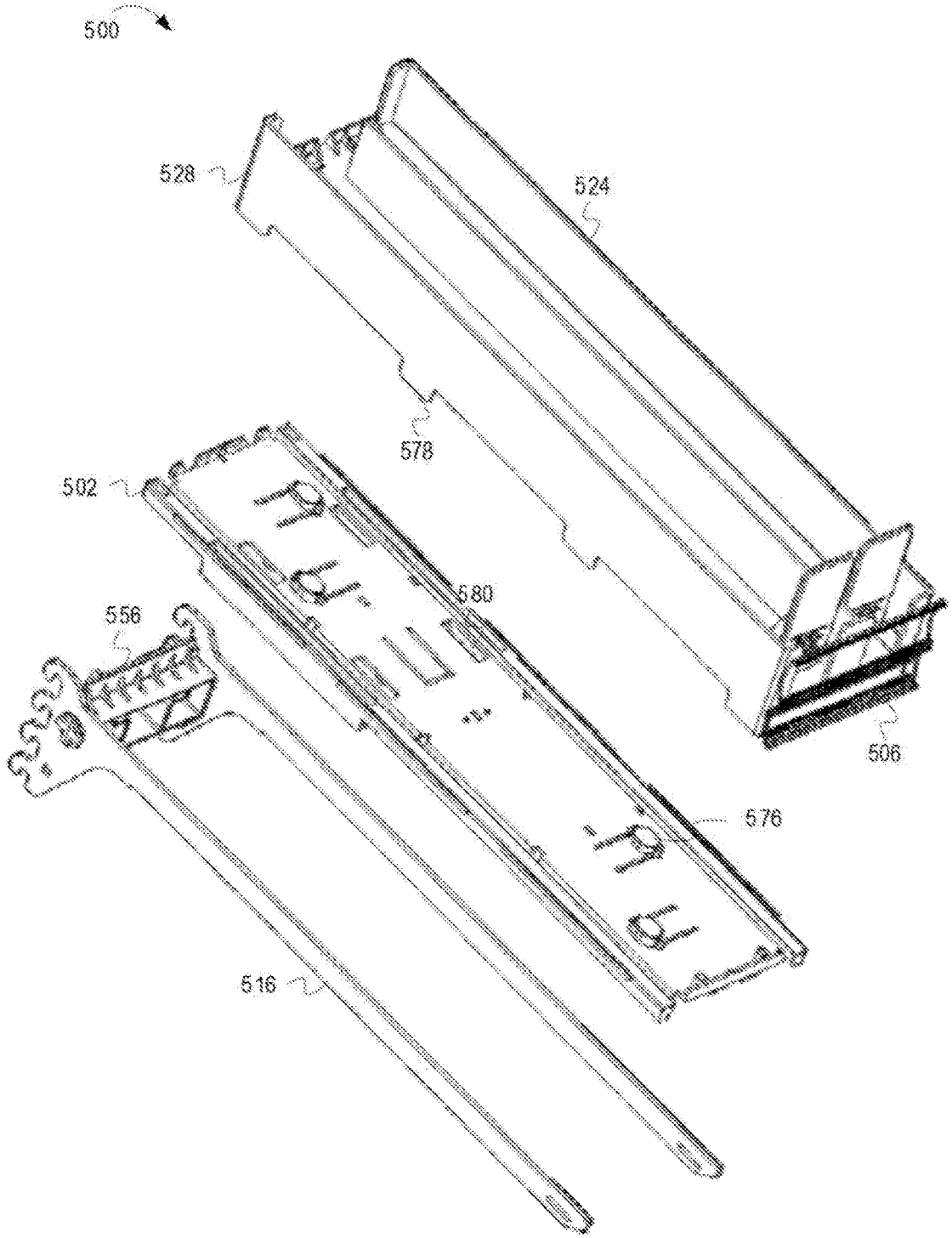
FIG. 5A is an exploded view of another product display merchandiser in accordance with embodiments of the inventive subject matter having an alternate manner for adjusting the side member or wings of the unit to adjust width of the merchandiser.
Figure 5B:
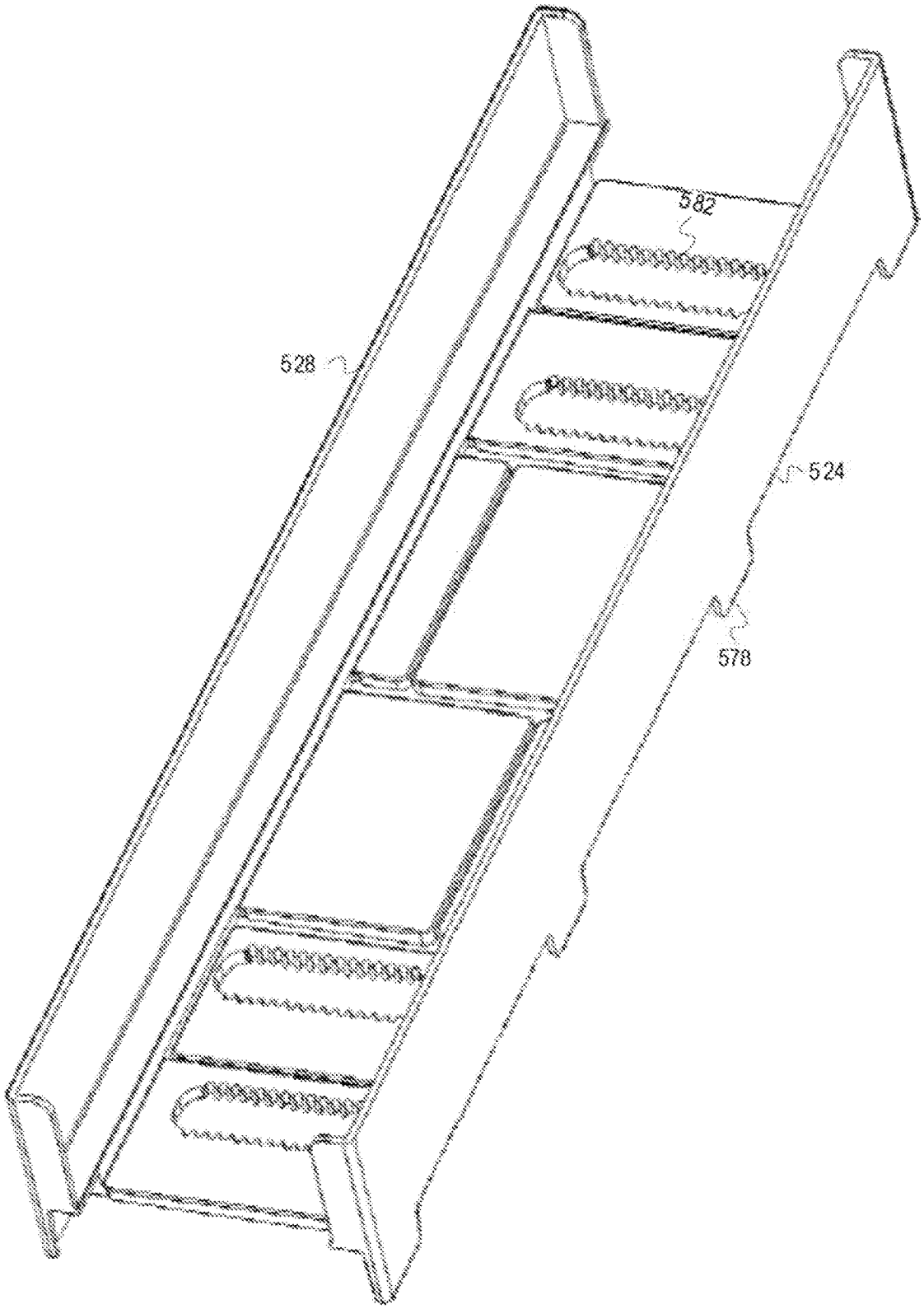
FIGS. 5B and 5C are perspective views of the side members or wings of the product display merchandiser depicted in FIG. 5A.
Figure 5C:
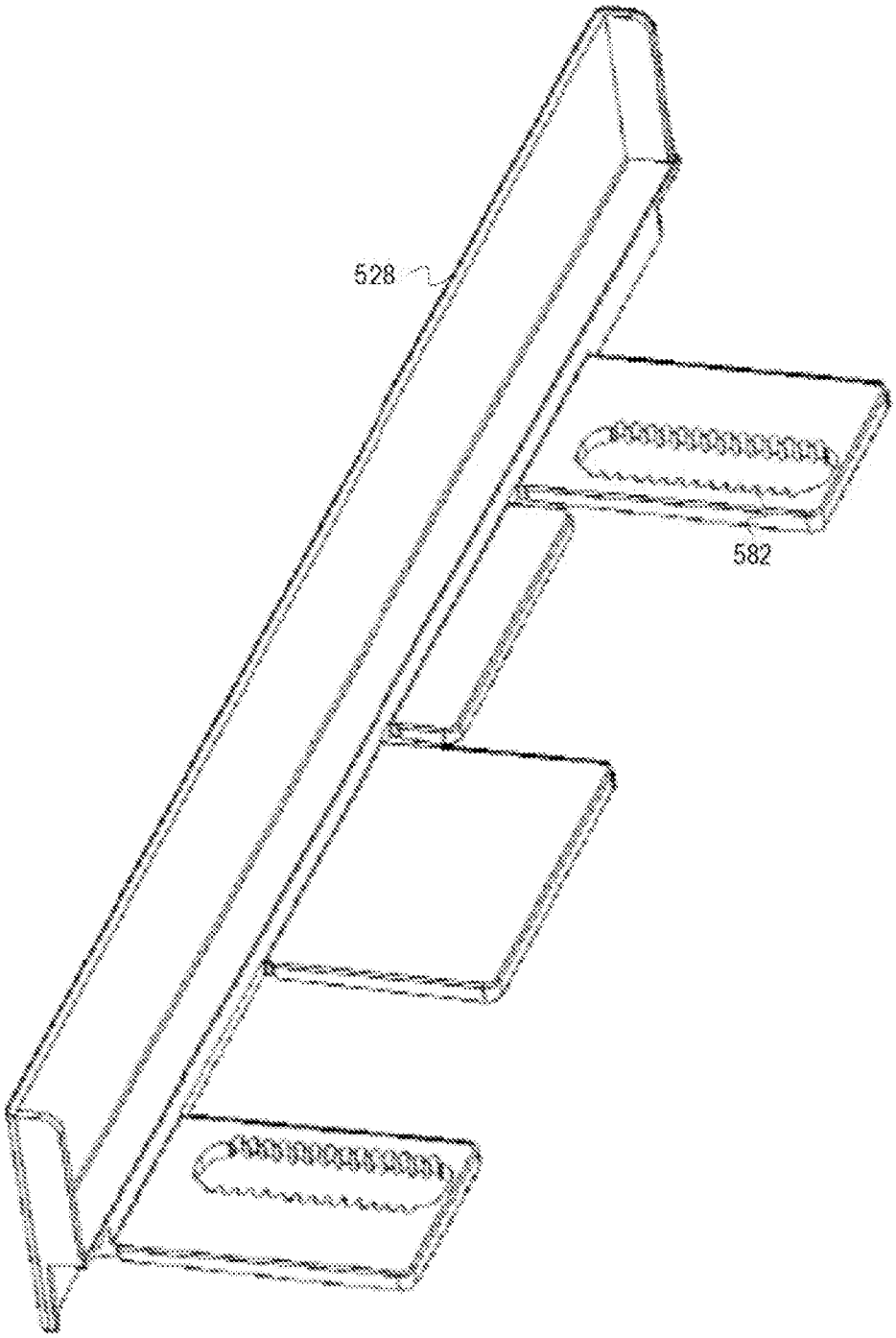
Figure 5D:
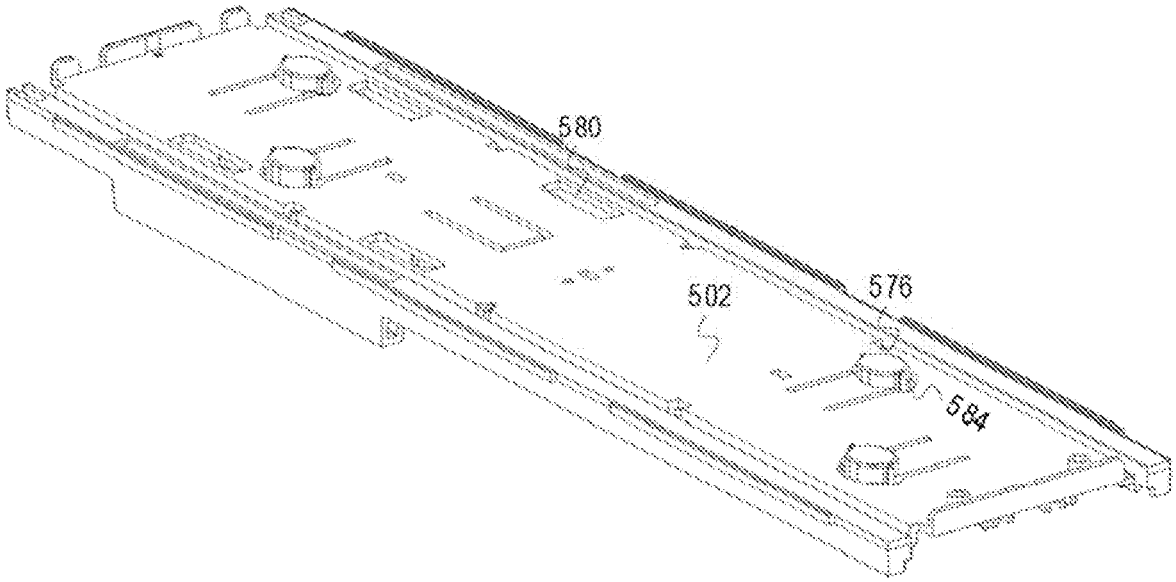
FIG. 5D is a perspective view of a tray of the product display merchandiser depicted in FIG. 5A.

In one form, the left sidewall 528 and right sidewall 524 include tongue engagement portions 582, e.g., grooves, (as shown in FIGS. 5B-5C) that mate with the tongues 576 on the tray 572. Although FIGS. 5A-5E depict the left sidewall 528 and right sidewall 524 as including tongue engagement portions 582, in some embodiments, the tray 502 can include tongue engagement portions or grooves 582 and the left sidewall 528 and the right sidewall 524 can include the tongues 576. In yet other embodiments, the tray 502 may have tongue and tongue engagement portions and the sidewalls 524, 528 may have tongue engagement portions and tongues that correspond with and/or mate with those on the tray 502. In any of these embodiments, the tongues 576 mate with the tongue engagement portions or grooves 582 to secure the left sidewall 528 and the right sidewall 524 in a desired position on tray 502. In the embodiment shown in FIG. 5E, the tongues 576 are formed into the tray 502 and include a raised portion that engages the tongue engagement portions of the left sidewall 528 and the right sidewall 524. The tongues 576 are deformable (e.g., can be pushed from a first, resting position to a second, deformed position) to disengage from the tongue engagement portions 582 and allow the position of one or more of the left sidewall 528 and the right sidewall 524 to be adjusted.

In one form, the tongues 576 and/or tongue engagement portions 582 can include a mechanism (e.g., an indexing mechanism) that allows movement of the left sidewall 528 and the right sidewall 524 between predefined or predetermined positions. For example, as depicted in FIGS. 5A-5E, the tongues 576 include protrusions 584 (e.g., finger members) that seat within the serrated boundaries of the tongue engagement portions 582. Such embodiments allow for very fine adjustments of the left sidewall 528 and right sidewall 524. Further, if it is desired to set the width of the sidewalls of numerous merchandisers to the same width setting, this can be done by counting which groove or serration the tongue should be set to and simply setting the protrusion to that serration for each sidewall. To assist in this effort, indicia may be added to one or more serrations or grooves in order to make quick adjustments to that setting on one or many merchandisers.

Although FIGS. 5A-5E depict tongues 576 as having protrusions 584 and left sidewall 528 and right sidewall 524 as having tongue engagement portions 582 with serrated boundaries, other mechanisms exist for allowing movement of the left sidewall 538 and the right sidewall 524 between predefined positions, such as those depicted and described in FIGS. 4A-4R and the associated text, or any other suitable mechanism. Additionally, in some forms, the left sidewall 528 and right sidewall 524 include sidewall tabs 578 that mate with sidewall tab recesses 580 located on the tray 502 to aid in securing the sidewalls to the tray 502 and ensuring a desired position of the sidewalls is retained. Further, as mentioned above, while various tongue and groove type mating structures may be used to mate the sidewalls to the tray, other types of mating engagements may be used and, of these, they may be alternated so that some appear on both the tray and sidewalls. For example, in some forms, dovetail mating configurations or mortise and tenon mating configurations may be used. In still other forms, other protrusion and mating recess type configurations may be used.

In addition to simply providing adjustability, the mechanism described above also helps to ensure that the left sidewall 528 and right sidewall 524 will remain in desired positions after the width of the product display merchandiser 500 has been set. For example, to adjust the position of the left sidewall 528 and the right sidewall 524 the tongues 576 must be manipulated so that they no longer engage the tongue engagement portions 582. Because the tongues 576 are positioned on the tray 502, the tongues are not easily accessible when the product display merchandiser 500 contains product. Because the tongues 576 are not easily accessible, it is unlikely that they will be manipulated unintentionally (e.g., by an employee, heavy product, a customer, etc.). Consequently, the left sidewall 528 and right sidewall 524 remain in a relatively fixed position until such position is intentionally altered. Additionally, because the position of the left sidewall 528 and the right sidewall 524 is relatively fixed, some embodiments of the inventive subject matter are able to hold and display heavier products, as it is less likely that such products will cause the left sidewall 528 and the right sidewall 524 to move out of position. This is helpful in avoiding the merchandiser from inadvertently being changed by retailer stocking associates or the like after it has been set or configured in the desired manner to display specific products.

Figure 5E:
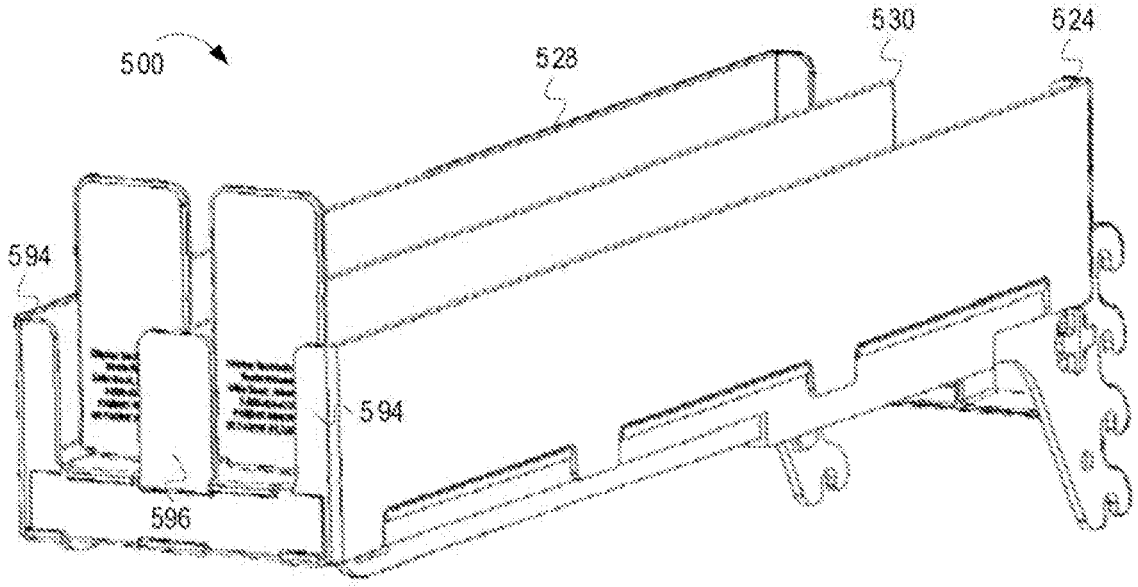
FIG. 5E is a perspective view of a product display merchandiser with a lens removed.
Figure 6A:
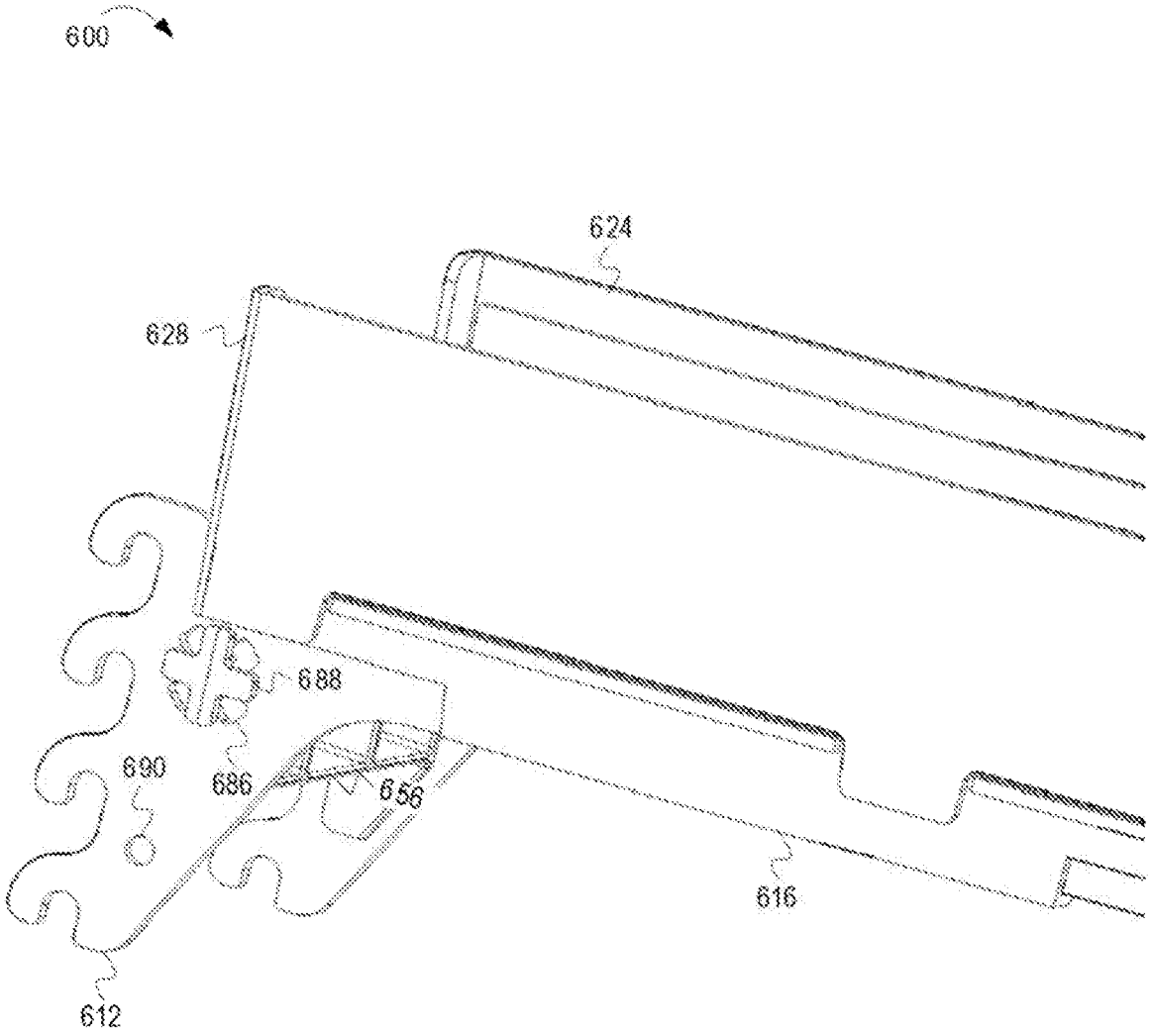
FIG. 6A is a partial perspective view of another product display merchandiser in accordance with embodiments of the inventive subject matter having a mechanism to securely attach a bracket engagement member to a rear stabilizer
Figure 6B:
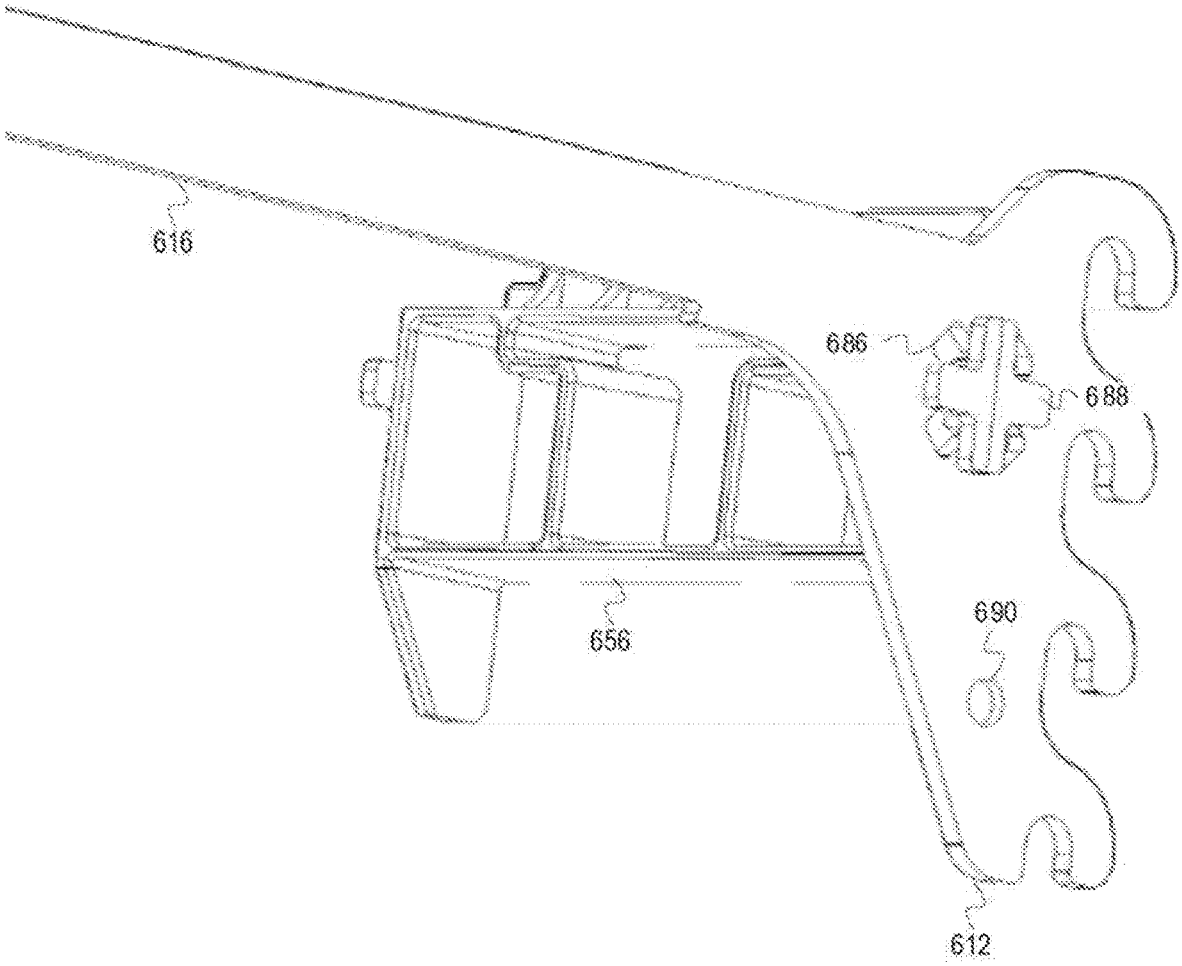
FIG. 6B is an exploded view of the bracket engagement member and rear stabilizer of the product display merchandiser depicted in FIG. 6A.
Figure 6C:
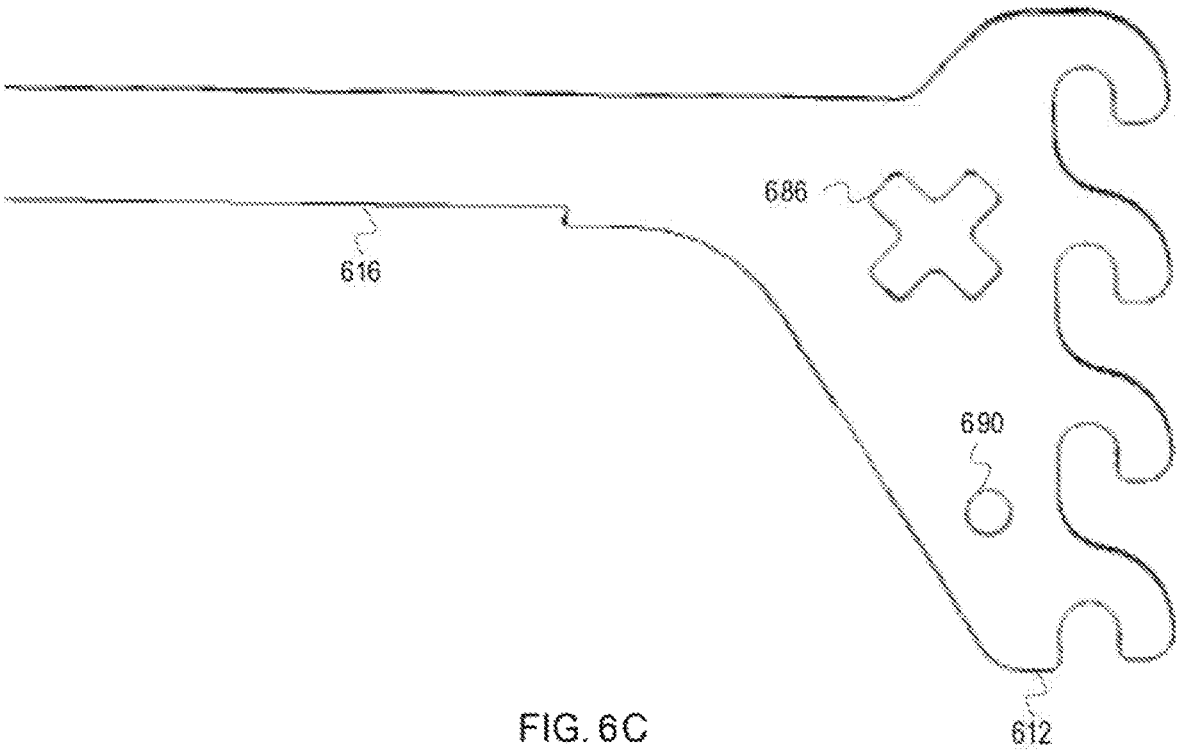
FIG. 6C is an exploded view of the bracket engagement member of the product display merchandiser depicted in FIG. 6A.
Figure 6D:
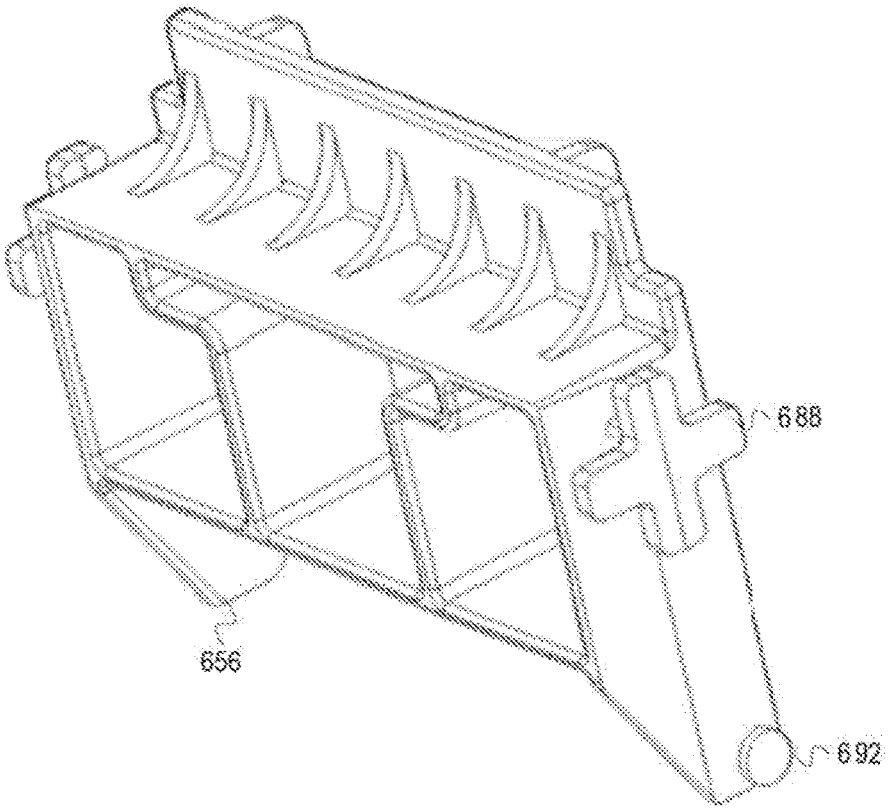
FIG. 6D is an exploded view of the rear stabilizer of the product display merchandiser depicted in FIG. 6A.

In one form, as depicted in FIG. 5E, the lens 506 of the product display merchandiser 500 may be removable. In such embodiments, the product display merchandiser can include stops, or protrusions, 594, 596. Such stops 594, 596 can prevent product from falling out of the product display merchandiser 500 when the lens 506 is removed. The stops 594 can be integral to the tray 502 or left sidewall 528 and right sidewall 524. The stop 596 can be integral to the tray 502 or the center divider 530 (whether or not the center divider is removable). This allows product in certain situations to be advantageously displayed without a lens so that an unobstructed view of the displayed product may be seen by potential consumers.

In the form illustrated in FIGS. 5A-E the wings or side members 528, 524 preferably will define product support surfaces extending inward toward the opposing side member 528, 524 for supporting at least a portion of the displayed product. An example of this product support surface is illustrated in FIG. 5B for the left side member 528. This product support surface runs from the rear of the merchandiser toward the front of the merchandiser and terminates in the protrusions or stops 594, 596. In some forms, the side members 528, 524 preferably form stops or abutting surfaces that limit how close the side members 528, 524 can be moved toward one another. More particularly, the portions of each side member that define the tongue engagement openings or grooves 582 that protrusions or finger members 584 engage form distal ends that abut the opposing side member 528, 524 to limit the travel of the side members 528, 524 toward one another. In the form illustrated, the side members 528, 524 contain additional protruding members coplanar with the portions that define the tongue engagement openings 582 that further serve as abutment surfaces that limit travel of the side members 528, 524 toward one another. These additional protrusions or protruding members are illustrated for the left side member 528 best in FIG. 5C and are positioned between the portions that define the tongue engagement openings 582.

While FIGS. 5A-5E depict a fifth embodiment of a product display merchandiser having an alternate manner for adjusting the side members, FIGS. 6A-6D depict a sixth embodiment of a product display merchandiser 600 having a mechanism to securely attach a bracket engagement member 612 to a rear stabilizer 656. The product display merchandiser 600 includes a left sidewall 628, a right sidewall 624, arms 616, a rear stabilizer 656, a tray, and bracket engagement members 612. The arms 616 support the tray and are connected to the rear stabilizer 656 via the bracket engagement members 612. The arms 616 and rear stabilizer 656 connect to the bracket engagement members 612. For example, in one form, the bracket engagement members 612 can be fastened to the rear stabilizer 656. The bracket engagement members 612 engage a vertical support (not shown) such as a bar mounted system or a grid mount system from which the product display merchandiser 600 can hang. In the form illustrated, the bracket engagement members 612 and one arm 616 are formed integral to one another as a metal support arm.

The bracket engagement members 612 include a locking receiver 686 that mates with a locking protrusion 688 located on the rear stabilizer 656. The locking receiver 686 and the locking protrusion 688 mate in such a way as to securely affix the bracket engagement member 612 to the rear stabilizer 656. The locking receiver 686 and the locking protrusion 688 can take any suitable form. For example, the locking receiver 686 can be an aperture through which the locking protrusion 688 extends, a cavity that receives the locking protrusion 688, a clip to which the locking protrusion 688 attaches, etc.

In the example depicted in FIGS. 6A-6D, the locking protrusion 688 is a piece of material that extends from the rear stabilizer 656. The locking protrusion 688 can be integral to the rear stabilizer 656 or a separate piece that is attached to the rear stabilizer 656. The locking receiver 686 can take the form of an aperture located in the bracket engagement member 612. As depicted in the FIGS. 6A-6D, the locking protrusion 688 and the locking receiver 686 are similarly shaped (or correspond in shape) and have a slightly different orientation (e.g., approximately 45° out of alignment). The locking protrusion 688 and the locking receiver 686 can take any suitable shape. In the example depicted in FIGS. 6A-6D, the locking protrusion 688 and the locking receiver 686 are cross-shaped. In such embodiments, the bracket engagement member 612 is placed onto the rear stabilizer 656 in a first position such that the locking receiver 686 and the locking protrusion 688 are oriented in a similar direction. Once the engagement bracket 612 has passed the locking protrusion 688, the bracket engagement member 612 can be rotated to a second position, the second position being a display position for the product display merchandiser 600. Once in the second position, the locking protrusion 688 acts on the bracket engagement member 612 to securely hold the bracket engagement member 612 and the rear stabilizer 656 together. For example, the locking receiver 686 may fit behind a larger portion of the locking protrusion 688 in such a manner as to experience a clamping force or camming force between an inner surface of the locking protrusion 688 and the rear stabilizer 656.

In the form illustrated, the protrusions 688 correspond in shape with the locking receiver opening 686 so that the protrusion may be orientated into a position to be inserted into the opening 686. The protrusion 688 further defines a cutout, channel or groove that the locking receiver may be aligned with and then one or both the rear stabilizer 656 and integrated arm 616 and engagement member 612 are moved with respect to each other to securely clamp or fasten the integrated arm 616 and engagement member 612 to one end of the stabilizer 656. The same process is then repeated with the protrusion located on the opposite end of the stabilizer 656. In a preferred form, the cutout, channel or groove, is configured to either cam against the engagement member 612 or form a friction fit with the engagement member 612. Thus, once fully assembled, the three pieces (i.e., rear stabilizer and support arms/engagement members 612 are securely connected to one another to minimize play between each item.

Additionally, in some embodiments, the rear stabilizer 656 can include an alignment protrusion 692 and the bracket engagement member 612 can include a mating alignment recess 690. The alignment protrusion 692 and the alignment recess 690 can be positioned in such a manner as to engage when the bracket engagement member 612 is in the second position. The alignment protrusion 692 and alignment recess 690 can aid in assembly of the product display merchandiser 600 and provide greater stability to the product display merchandiser 600. In a preferred form, the mating alignment recess 690 and protrusion 692 correspond in shape (e.g., both are circular or other curved structures, rectangular or triangular or other polygonal structures, etc.). In addition, while the illustrated rear stabilizer 656 having protrusions 692 on opposing sides of the stabilizer and, thus, the respective engagement members 612 each have a mating recess 690, it should be understood that in alternate forms, only one side of the stabilizer 656 may include a protrusion and only one bracket engagement member 612 will include a mating alignment recess.

Similarly, although FIGS. 6A-6D depict the rear stabilizer 656 as having the locking protrusions 688 and the bracket engagement member as having the locking receiver 686, embodiments are not so limited. For example, in one form, the rear stabilizer 656 can include the locking receiver 686 and the bracket engagement member 612 can include the locking protrusion 688. Similarly, in some embodiments, the bracket engagement member 612 can include the alignment protrusion 692 and the rear stabilizer 656 can include the alignment recess 690. Additionally, although many of the figures (including FIGS. 6A-6D) depict the arm 616 and the bracket engagement member 612 as a single piece, in some embodiments, the arm 616 is separate from, and attachable to, the bracket engagement member 612.

Similarly, while this engagement has been described as requiring the engagement bracket 612 to be moved or rotated, it should be understood that in the illustrated embodiment, the engagement bracket 612 does not have to move, but rather the rear stabilizer 656 could alternatively be moved or, in yet other forms, both could be moved with respect to each other. The point being that via some movement of either the engagement bracket 612 and/or the stabilizer 656, the two items are moved from a first position wherein the two items can be removed from one another or connected to one another, and then be moved to or toward a second position wherein the two items are secured to one another via a clamping or camming force or other fastening engagement. This same procedure can be done for the protrusion 688 extending from the opposite side of the stabilizer and the other integrated engagement bracket and support arm illustrated on the opposite side of the stabilizer 656.

Figure 7A:
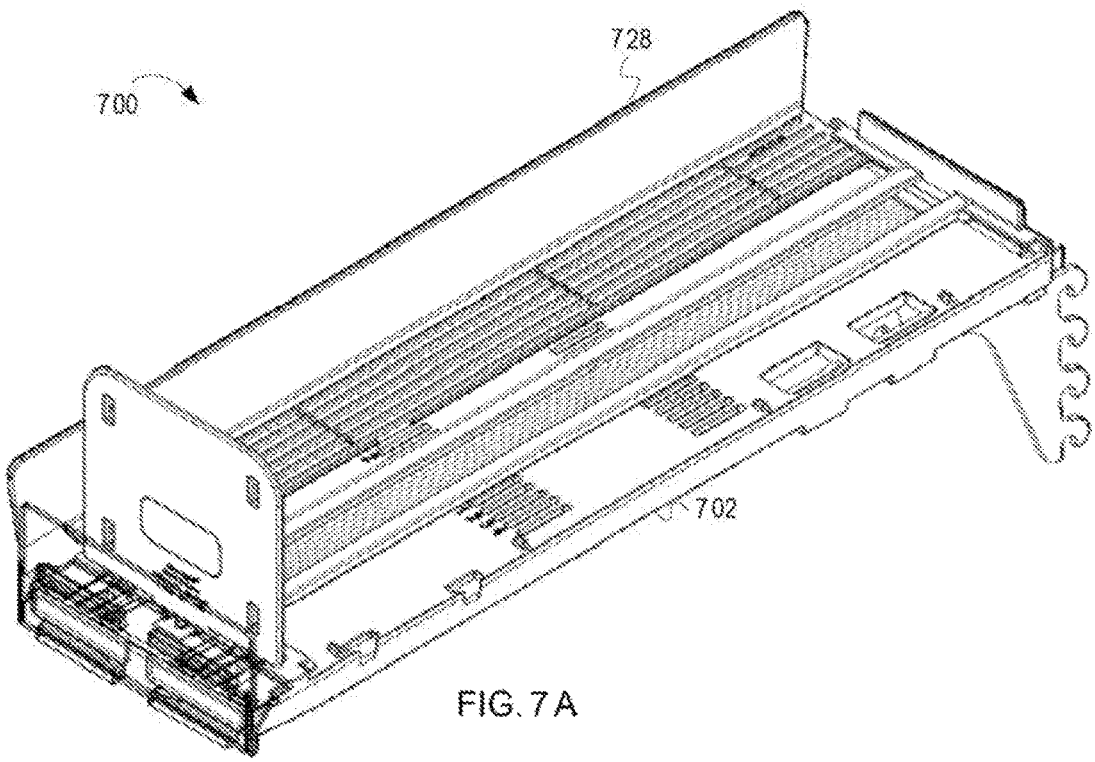
FIG. 7A is a perspective view of another product display merchandiser in accordance with embodiments of the inventive subject matter in which one or more of the product display merchandiser's sidewalls or wings is removable. In some embodiments, such product display merchandisers can be arranged in a linear fashion and a sidewall or wing of an adjacent product display merchandiser can provide support for a product displayed in the product display merchandiser.
Figure 7B:
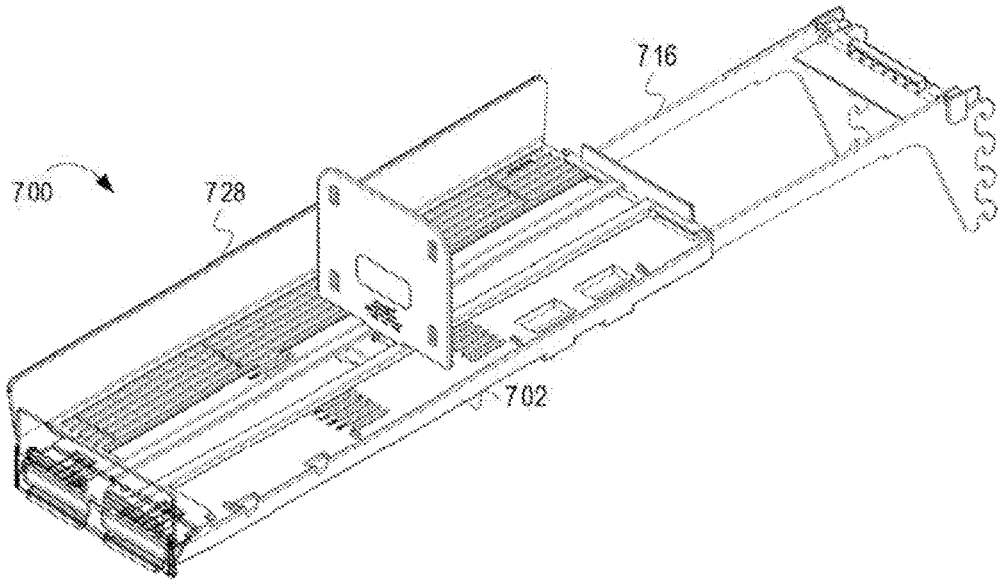
FIG. 7B is a perspective view of the product display merchandiser of FIG. 7A in an extended position in which product can be loaded onto the product display merchandiser from the side.

While FIGS. 6A-6D depict a sixth embodiment of a product display merchandiser having a mechanism to securely attach a bracket engagement member to a rear stabilizer, FIGS. 7A-7B depict a product display merchandiser 700 in which one or more of the product display merchandiser's 700 sidewalls is removable. The product display merchandiser 700 includes a tray 702, a left sidewall 728 attached to the tray 702, and arms 716. The tray 702 is slidable along the arms 716 from a first retracted or closed position (depicted in FIG. 7A) to an open, or extended position (depicted in FIG. 7B). The product display merchandiser 700 can also include a right sidewall (not shown). In the embodiment depicted in FIGS. 7A-7B, the right sidewall has been removed from the product display merchandiser 700. In such a configuration, two or more product display merchandiser 700 can be mounted adjacent to one another so as to utilize one or more sidewalls of an adjacent product display merchandiser(s). For example, all product display merchandisers 700 in an arrangement of product display merchandisers 700 may have their right sidewalls removed (except for the rightmost product display merchandiser). In such a configuration, product presented in a product display merchandiser 700 will be supported on the left by the left sidewall 728 of the product display merchandiser 700 and on the right by the left sidewall of the right-adjacent product display merchandiser. In such embodiments, the tray 702 and one or more of the left sidewall 728 and the right sidewall can be designed in a complimentary manner such that the tray 702 and the left sidewall 728 and/or right sidewall create a continuous or nearly continuous surface.

Not only does such a configuration allow product display merchandisers 700 to be placed in closer proximity to one another, but also decreases difficulty in loading the product display merchandisers 700. For example, most product display merchandisers have two sidewalls and a base, allowing product stocking to be performed only from above the product display merchandiser (e.g., top loading of the merchandiser). In embodiments in which the product display merchandiser 700 includes sidewalls that are removable, product can be stocked from the side (in addition to from above) (e.g., side loaded vs. top loaded).

Additionally, product display merchandisers that have removable sidewalls can be configured to have interchangeable sidewalls. For example, sidewalls that are different heights, different widths, made of different materials, different shapes, different colors, etc. may be useful for different products or uses. For example, product display merchandisers can be repurposed for different applications or products by changing the removable/interchangeable sidewalls.

An embodiment of a ventilated merchandising system 830 for placement on a grid system 2410 of a refrigerator or cooler case 2420 is shown in the FIGS. 8-26. In each FIG, every element number starts with the FIG number. The digits following the FIG number identify the specific elements. Some elements are substantially identical throughout multiple figures, and therefore may only be described once herein. If an element is not expressly described it is assumed to be substantially identical with an element in a previous drawing sharing the same identifying digits. When discussing multiple FIGS at a time, the elements shown across multiple drawings will be referred to in this written description using the first drawing of the group's FIG number at the beginning. As seen in FIGS. 8-11, the system 830 includes a base member 940, separator portion 1050 and tray 860. The separator portion 1050 and the tray 860 together form a platform coupled to the base member 940 for supporting products to be displayed. As seen best in FIGS. 9A-9B, the separator 950 is coupled to the base member 940 by flanges 941, 942 which fit into slots 951, 952 of the separator 950. In one embodiment, the slots 951, 952 of the separator 950 fit over the flanges 941, 942 so that the entire separator 950 is slidably coupled to the base member 940. As seen in FIG. 10, lips 1053A, 1053B, 1054A 1054B are located on the bottom of the separator 1050. These lips 1053A, 1053B, 1054A 1054B fit into a groove 1148 coupled to a button 1147 on the base 1140 (other similar means of releasably engaging the separator 1050 to the base 1040 could also be used). In the first mode of operation, the display mode seen in FIG. 8, the front lips 1053A, 1053B are fit into the groove 1148. To disengage the separator 1050 and slide the separator 850 and tray 860 forward away from the rear edge 1145 of the base 840 to the second mode of operation, the loading mode seen in FIG. 13, the button 1147 is pressed upward, causing the groove 1148 to move downward away from the separator 1050 and moving the groove 1148 away from the front lips 1053A, 1053B. This releases the separator 1050 from the base 940 and allows for the separator 1050 (and tray 860 coupled to the separator 1050) to be advanced away from the rear edge 1145 of the base 940 so that the tray 860 can be moved forward to allow easy loading of products onto the tray 860. The rear lips 1054A, 1054B then engage with the groove 1148 to secure the separator 1050 in the second position for loading of the products. When the products have been loaded, the release button 1147 is again pressed upward, moving the groove 1148 away from the rear apertures 1054A, 1054B so that the separator 1050 can be slid backward toward the rear edge 1145 into the first position. The groove 1148 then engages again with the front lips 1053A, 1053B to secure the tray 860 with loaded products in the first display position. As seen in an alternate embodiment in FIGS. 16A-16E, the release mechanism may be located on the separator 1650, and metal supports 16130 may be incorporated into the bottom of the separator 1650 for added stability when separator 1650 is pulled away from the base member 1640 for product loading.

Figure 8:
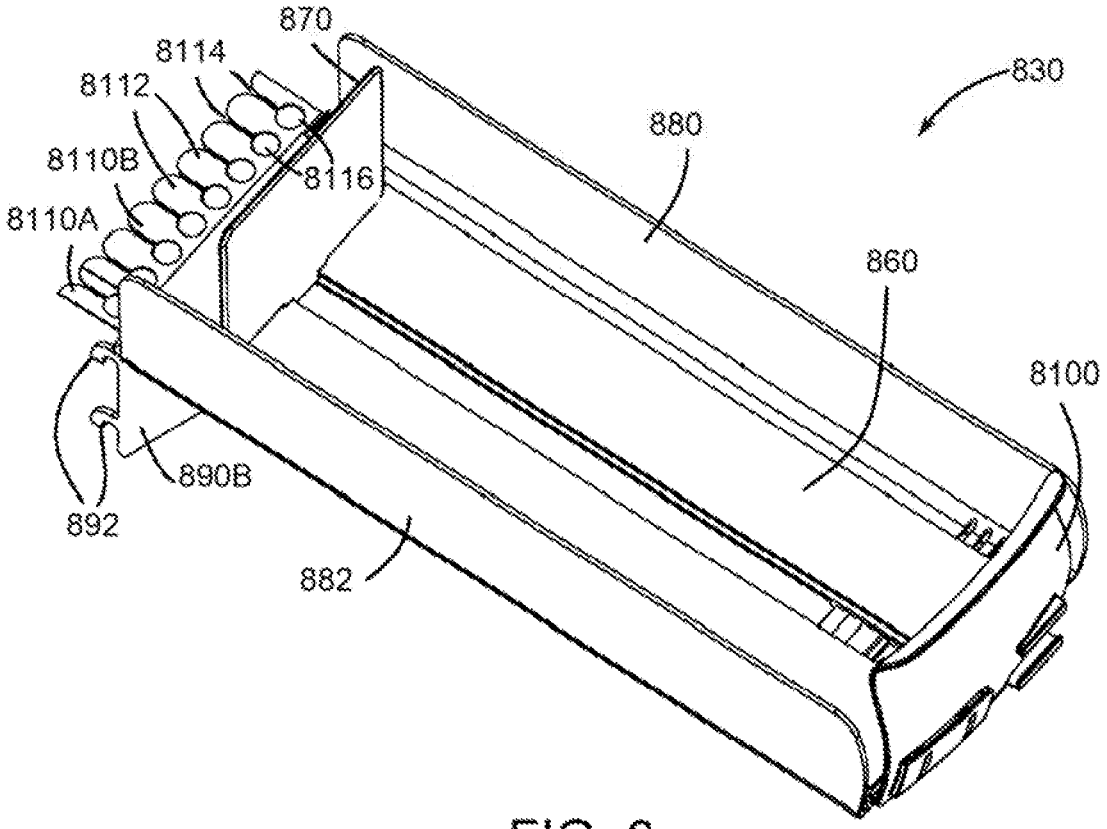
FIG. 8 is a top perspective view of a ventilated merchandising system in accordance with one embodiment of the present invention.
Figure 9A:
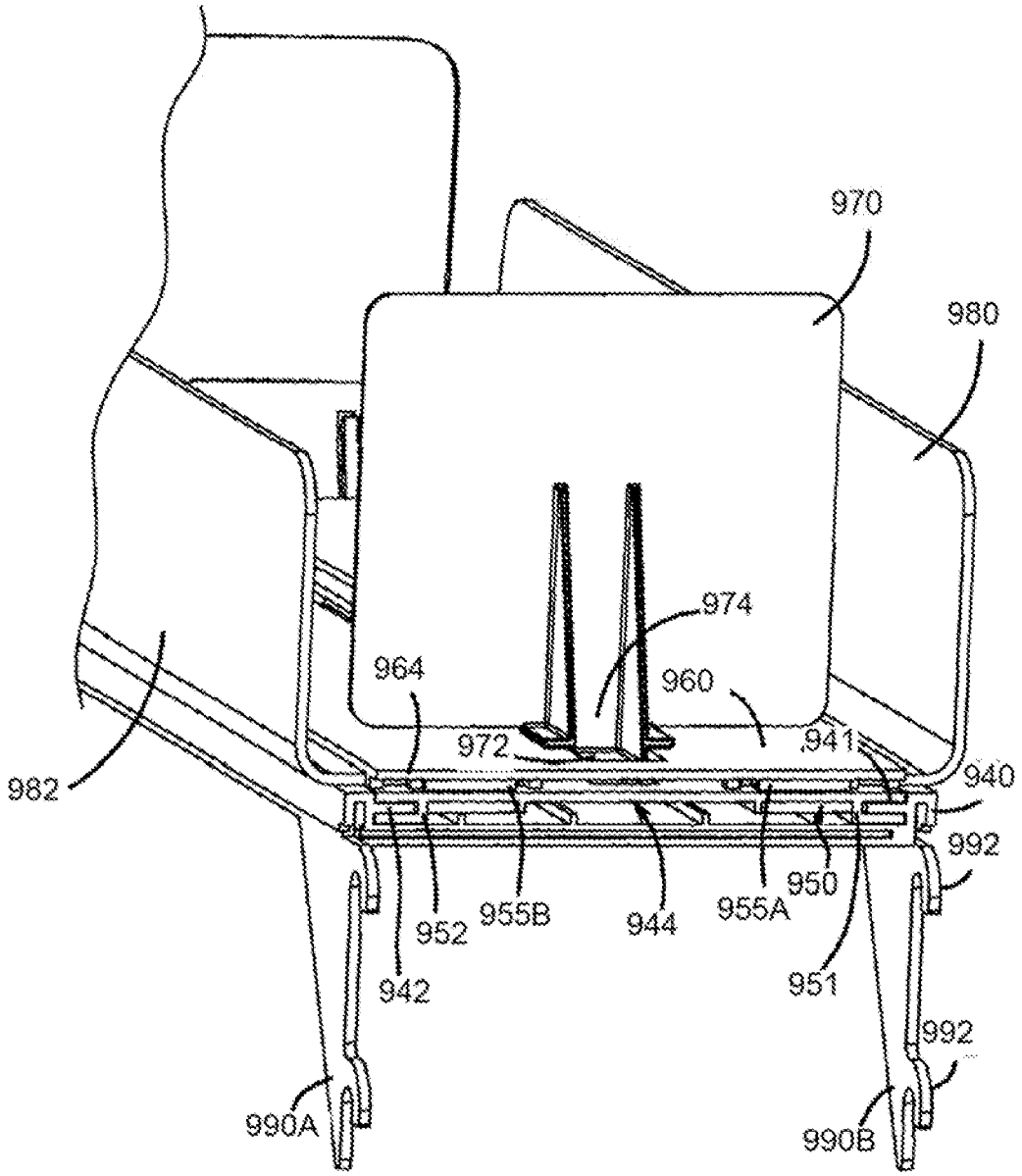
FIG. 9A is a partial rear perspective view of a ventilated merchandising system without plenum plates in accordance with one embodiment of the present invention.
Figure 9B:
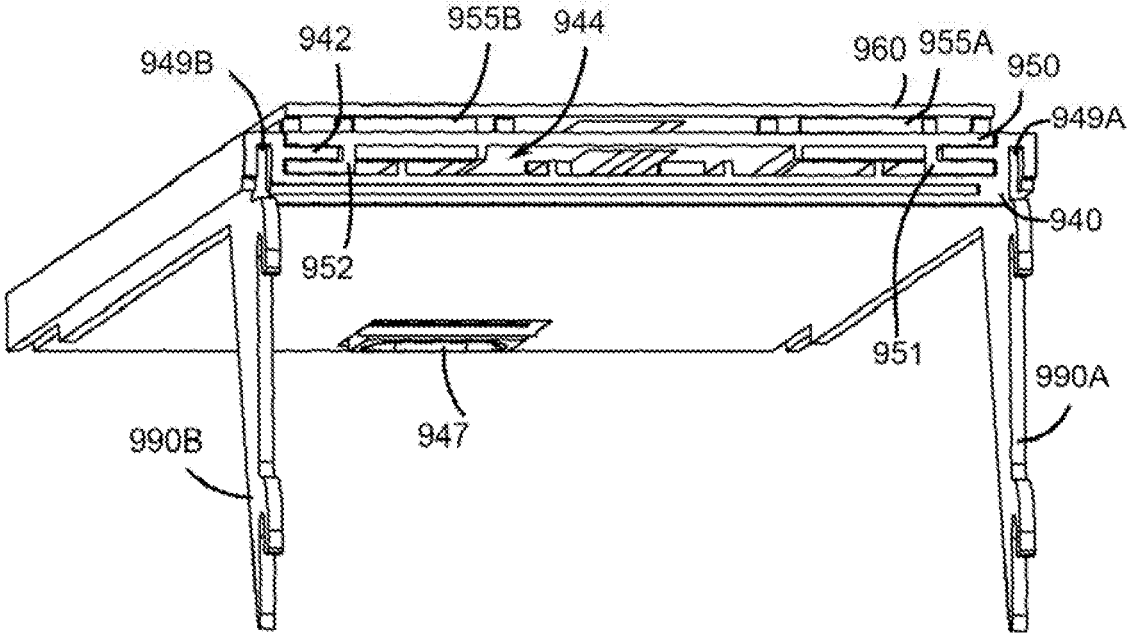
FIG. 9B is a rear perspective view of a base member, separator, tray and mounting brackets of a ventilated merchandising system in accordance with one embodiment of the present invention.
Figure 10:
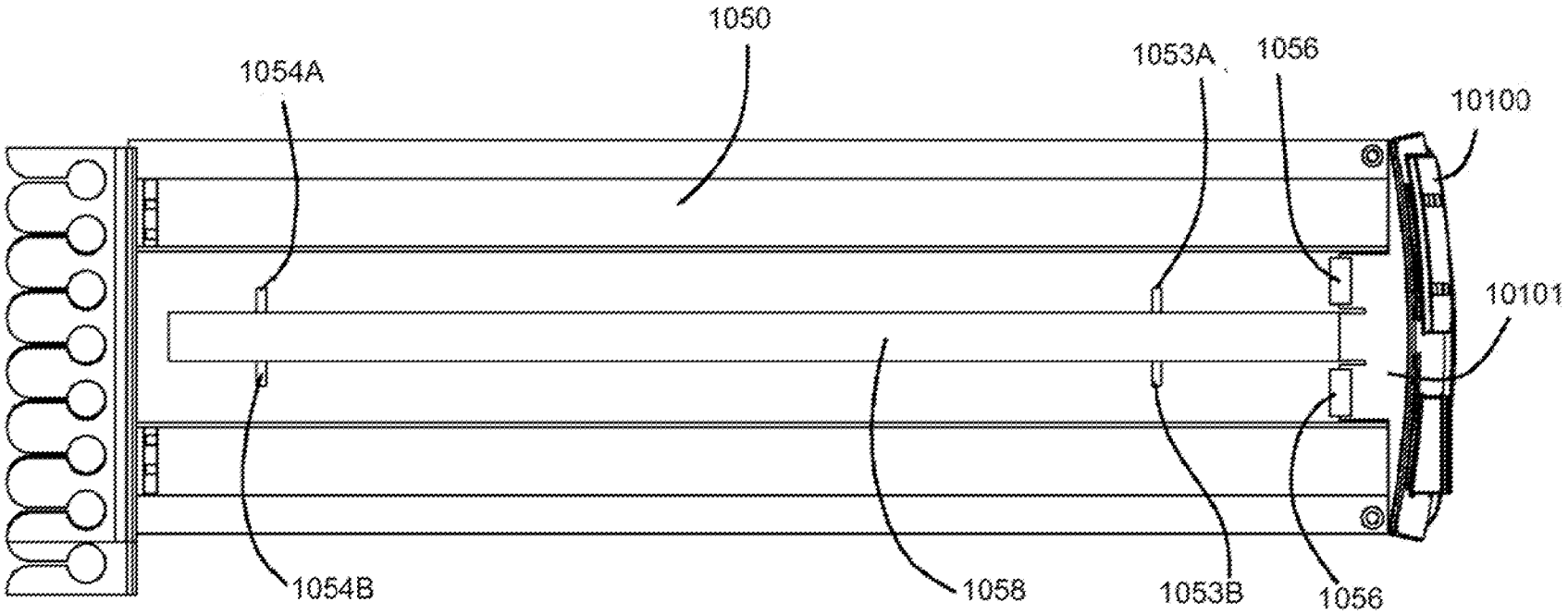
FIG. 10 is a bottom view of a separator, front plate and plenum plates of a ventilated merchandising system in accordance with one embodiment of the present invention.
Figure 11:
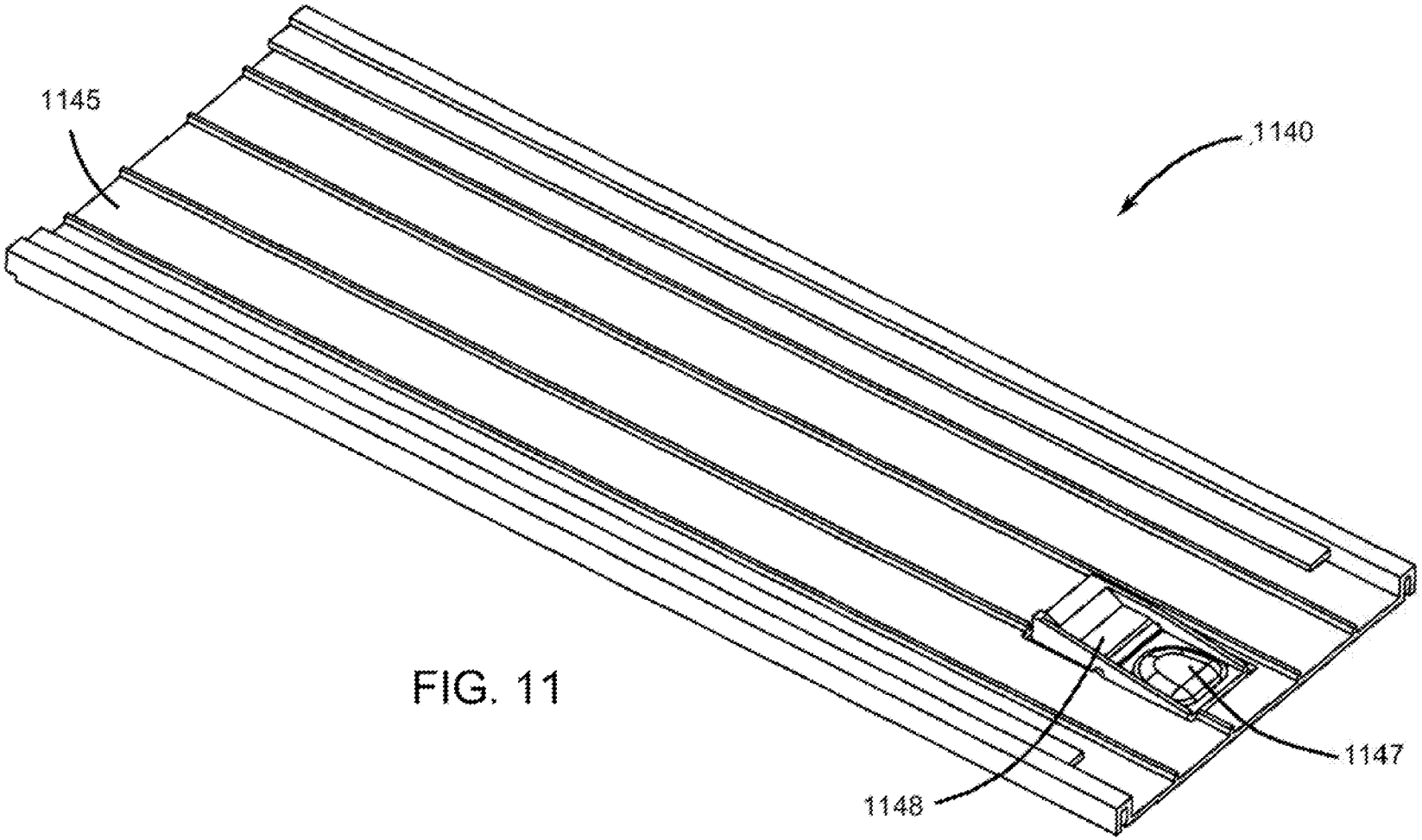
FIG. 11 is a top perspective view of a base member of a ventilated merchandising system in accordance with one embodiment of the present invention.
Figure 12:
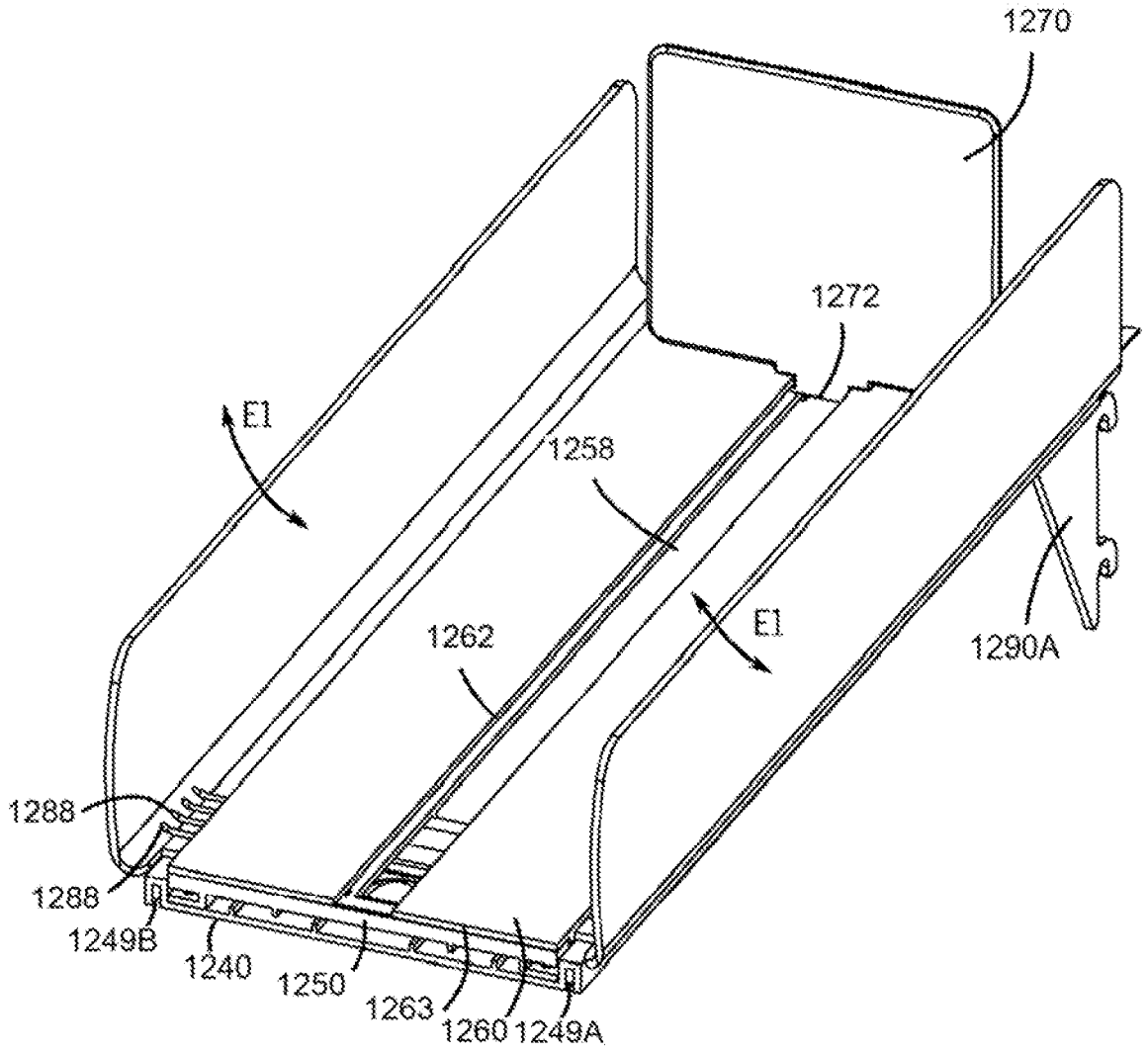
FIG. 12 is a top perspective view of a ventilated merchandising system in accordance with one embodiment of the present invention.
Figure 13:
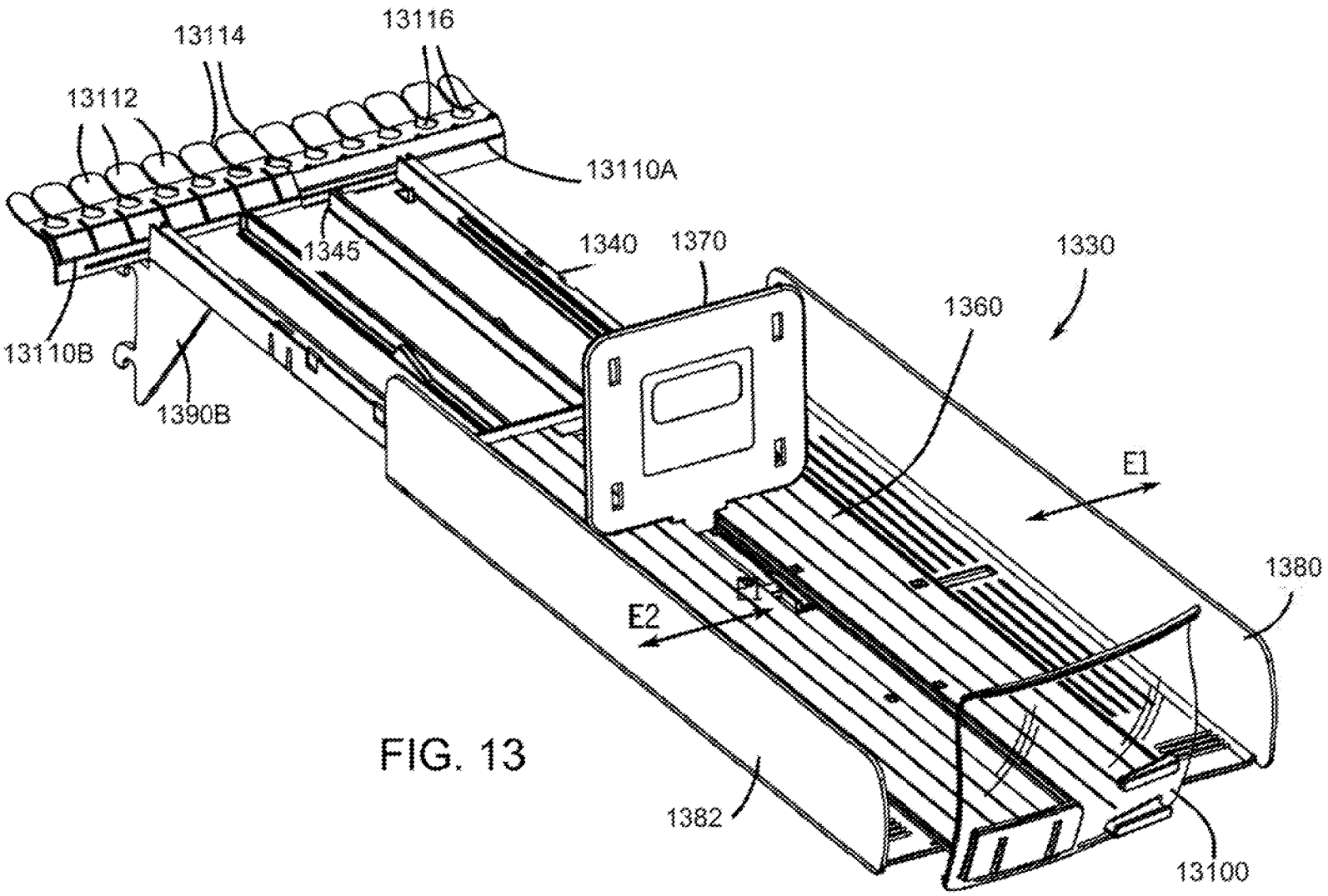
FIG. 13 is a top perspective view of a ventilated merchandising system with arms expanded and in product loading position in accordance with one embodiment of the present invention.

As shown in FIG. 9B, tray 1660 is coupled to separator 1650 by fitting front edge 1663 of tray 1660 into channels 1655A, 1655B of separator 1650. In other embodiments, tray 1660 may be integrally formed with or rigidly coupled to the separator 1650. Separator 1650 may include a generally rectangular opening 1658 along the length of the separator 1650. As seen in FIGS. 8 and 12, tray 860 includes a generally rectangular opening 1262 that extends along the length of the tray 860 to a distance adjacent the front 1263 and rear 964 edges of the tray 860. A projection 1272 on the bottom of a pusher plate 1270 snap-fits securely into the opening 1262 of the tray 860. As is well known in the art, the pusher plate 1270 and a coil spring (not shown), which fits into a trough 1274 of the pusher plate 1270, serve as means of biasing products toward the front edge 1263 of the tray 860 as products are removed from the tray 860. The coil spring abuts the pusher plate 1270 and biases the pusher plate 1270 forwardly toward the front edge 1263 of tray 860.

Figure 15:
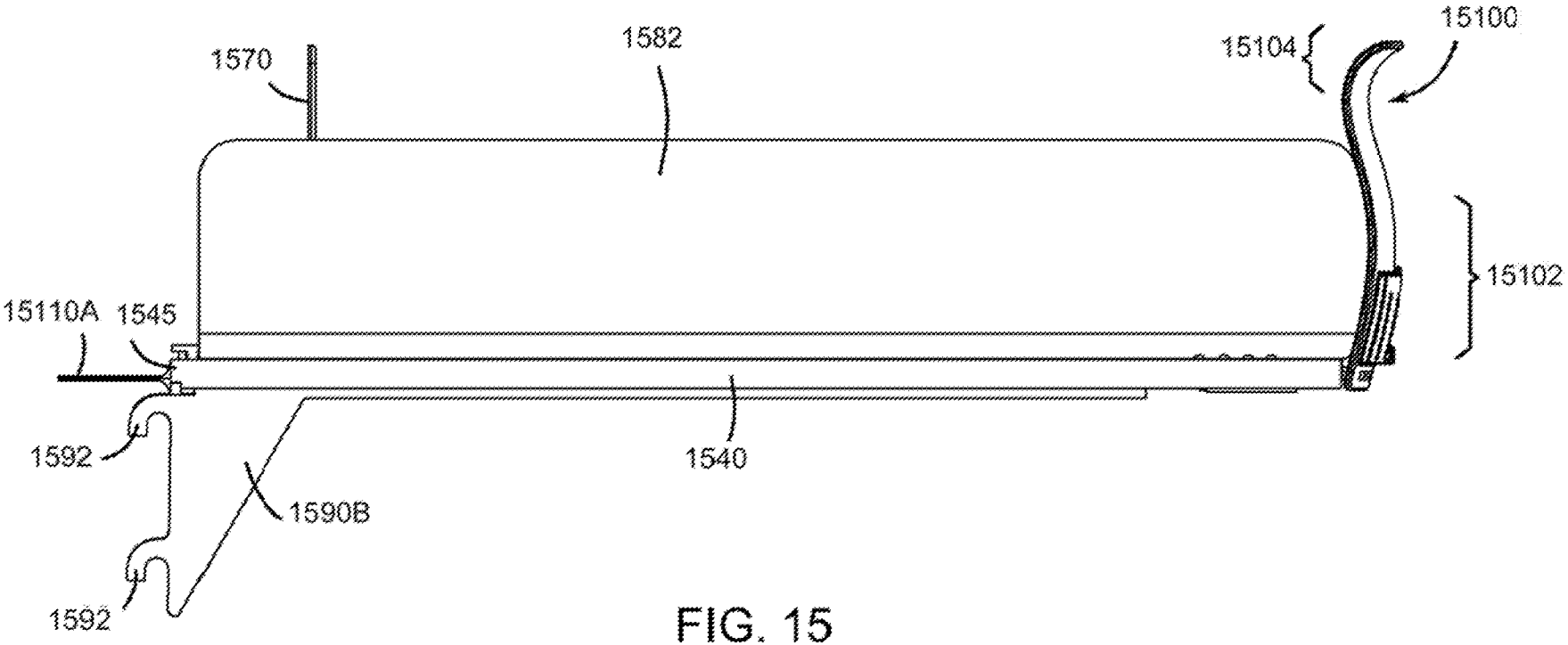
FIG. 15 is a side view of a ventilated merchandising system in accordance with one embodiment of the present invention.
Figure 16A:
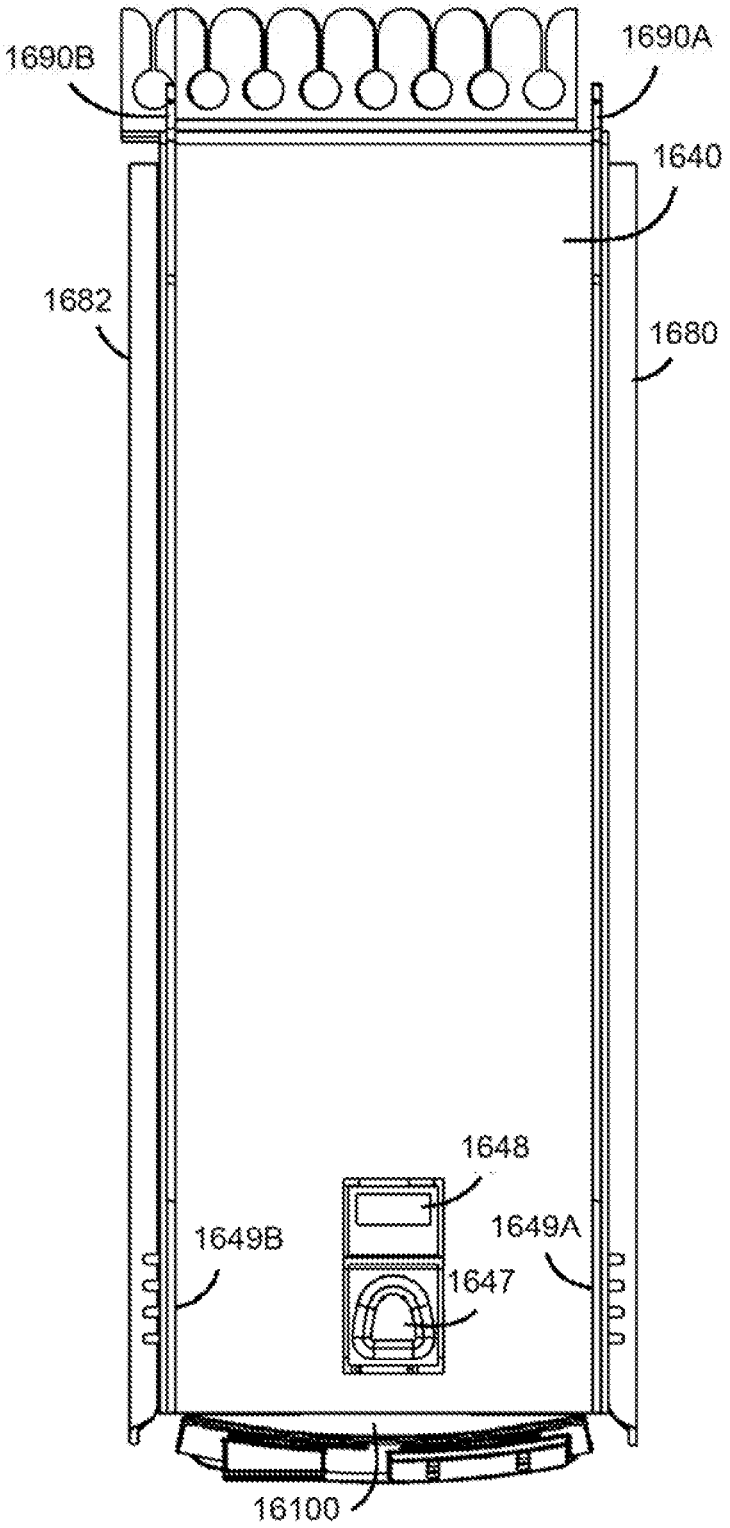
FIG. 16A is a bottom view of a ventilated merchandising system in accordance with one embodiment of the present invention.
Figure 16B:
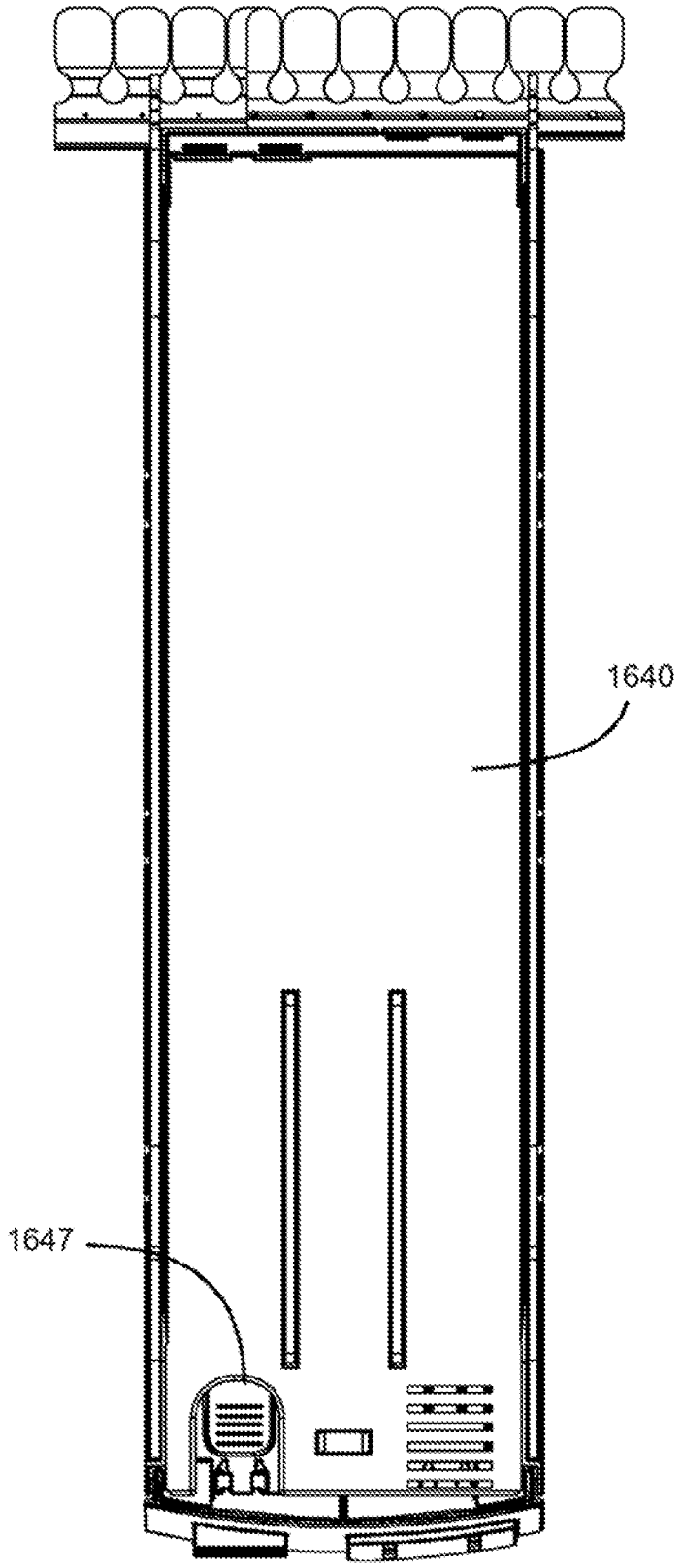
FIG. 16B is a bottom view of a ventilated merchandising system in accordance with another embodiment of the present invention.
Figure 16C:
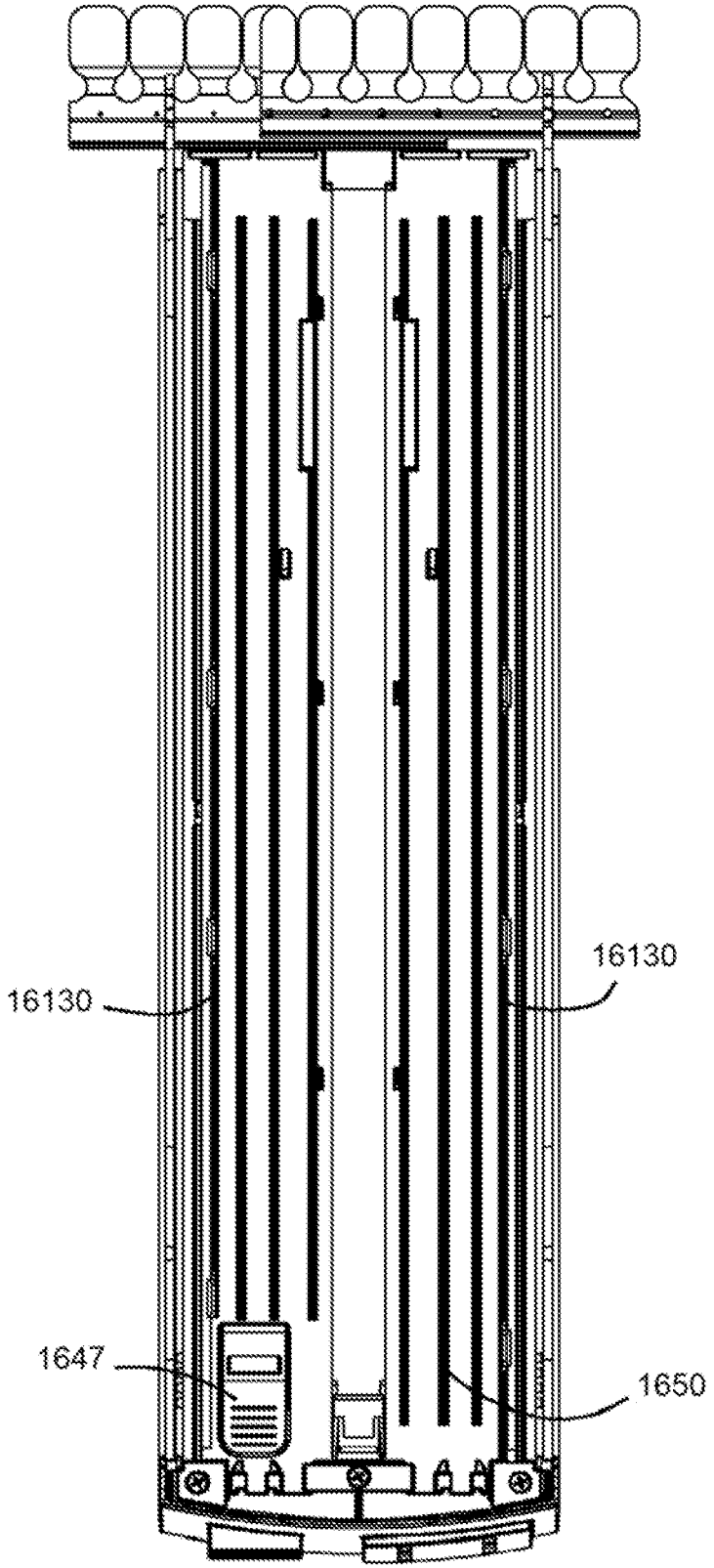
FIG. 16C is a bottom view of the embodiment in FIG. 16A, without a base member.
Figure 16D:
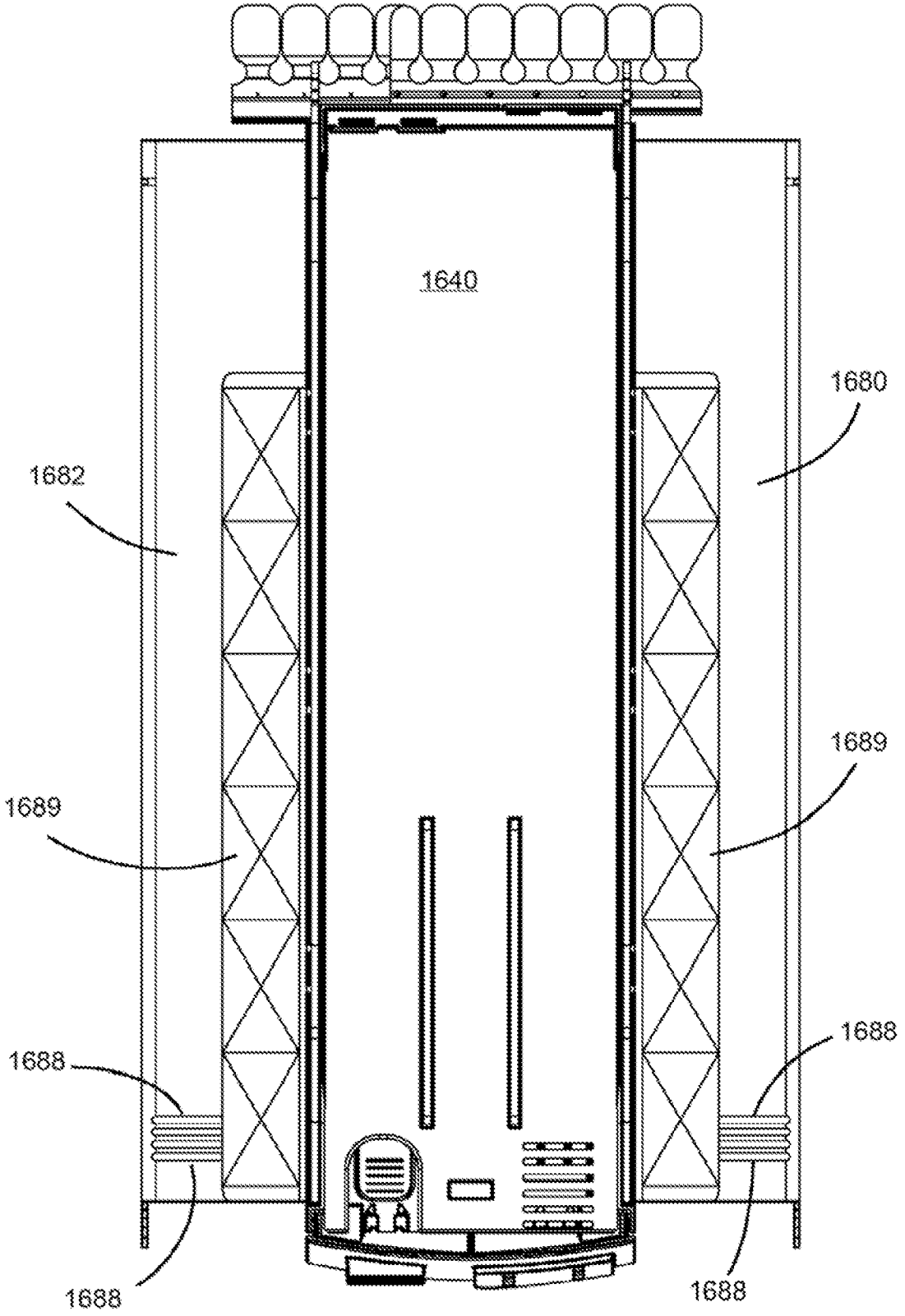
FIG. 16D is a bottom view of the embodiment in FIG. 16A with arms expanded.
Figure 16E:
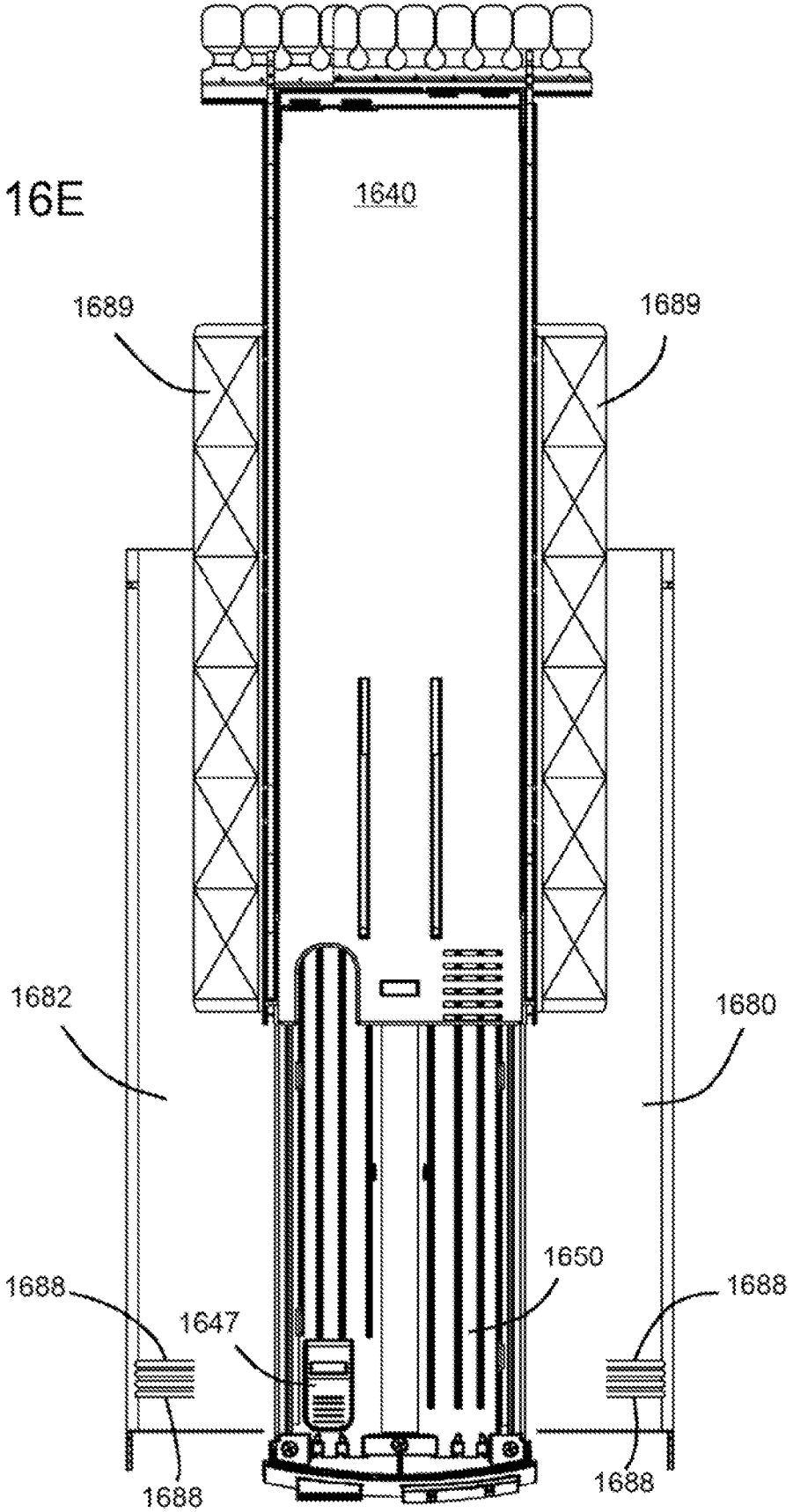
FIG. 16E is a bottom view of the embodiment in FIG. 16A with arms expanded and in product loading position.
Figure 17:
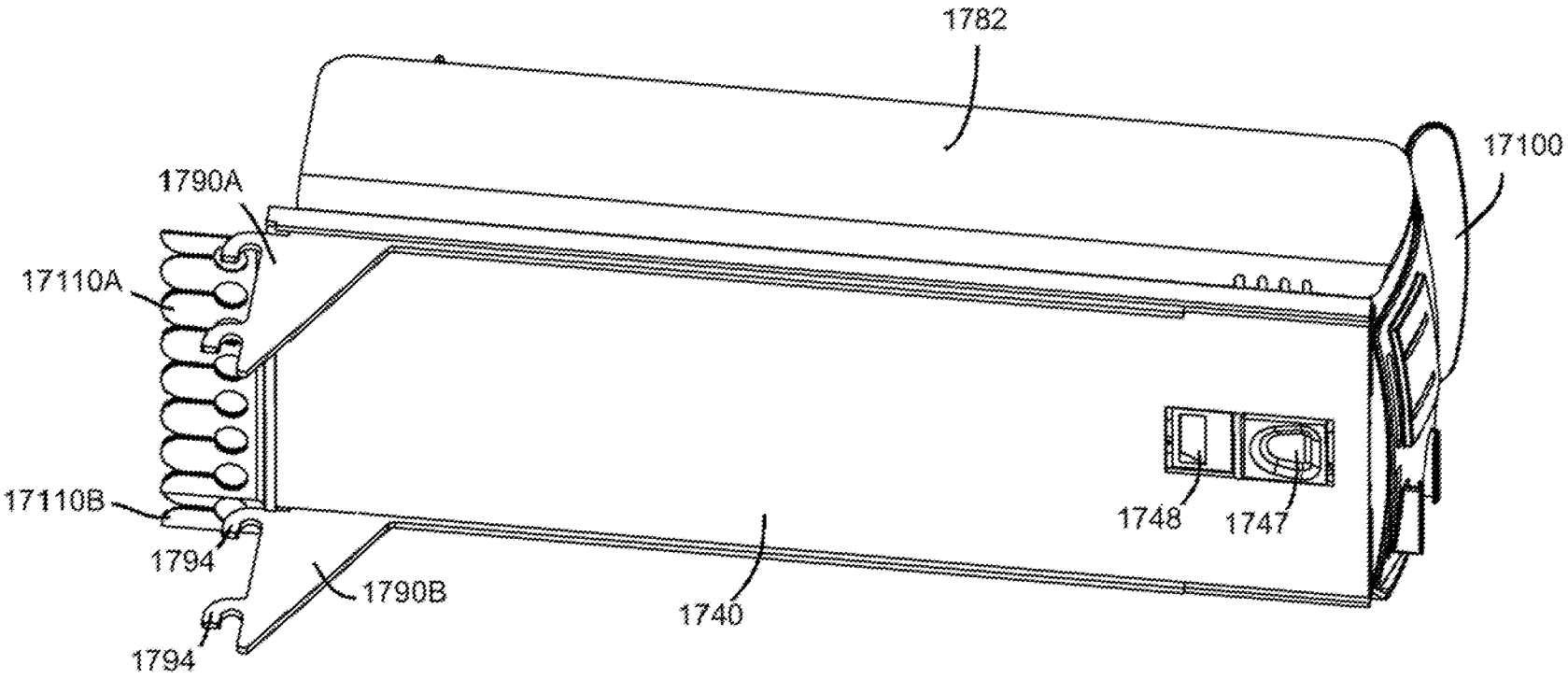
FIG. 17 is a bottom perspective view of a ventilated merchandising system in accordance with one embodiment of the present invention.
Figure 24B:
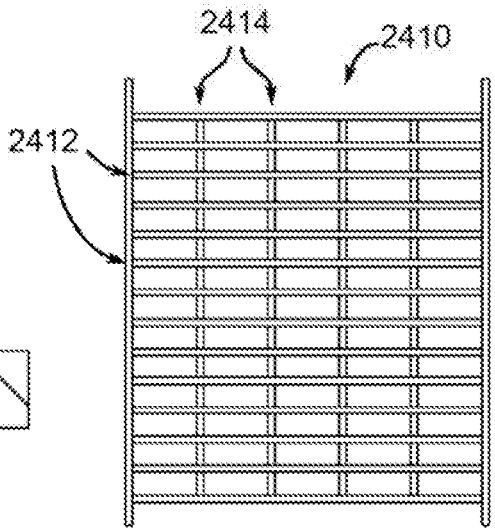
FIG. 24B is a front view of a grid system.
Figure 24A:
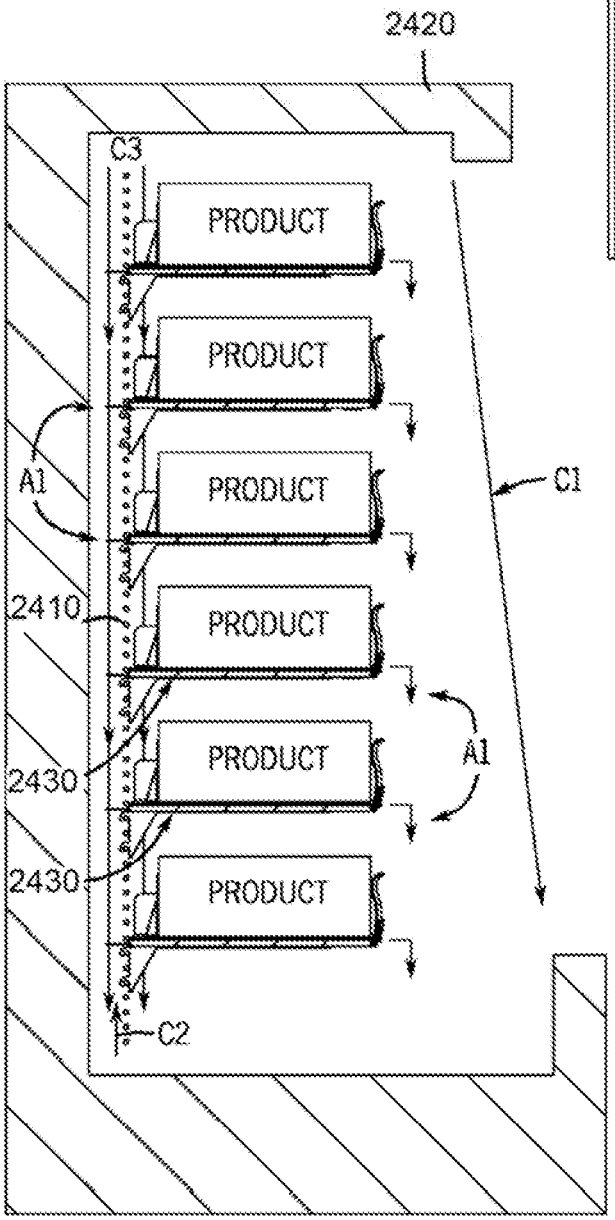
FIG. 24A is a schematic side view of ventilated merchandising systems with products displayed and installed in a refrigerator or freezer case.

As seen in FIGS. 15-17, base 1540 may also include tracks 1649A, 1649B into which mounting brackets 1690A, 1690B can be fit. Mounting brackets 1690A, 1690B are slid into tracks 1649A, 1649B to mount system 830 on a wire grid system 2410 in the back of a case 2420. As seen in FIG. 24A, grid system 2410 includes a plurality of horizontal 2412 and vertical 2414 bars. Each mounting bracket 1690A, 1690B includes one or more hooks 1592 located, when assembled, near the rear edge 1545 of base 1540. Hooks 1592 hook over horizontal bars 2412 of the grid system 2410 to mount the system 830 in place on the grid 2410. Base 1540 may include additional tracks 1649A, 1649B to accommodate additional mounting brackets 1690A, 1690B for mounting the system 830. Each mounting bracket 1690A, 1690B could also include additional hooks 1592 for hooking the mounting brackets 1690A, 1690B onto the grid system 2410.

Figure 14:
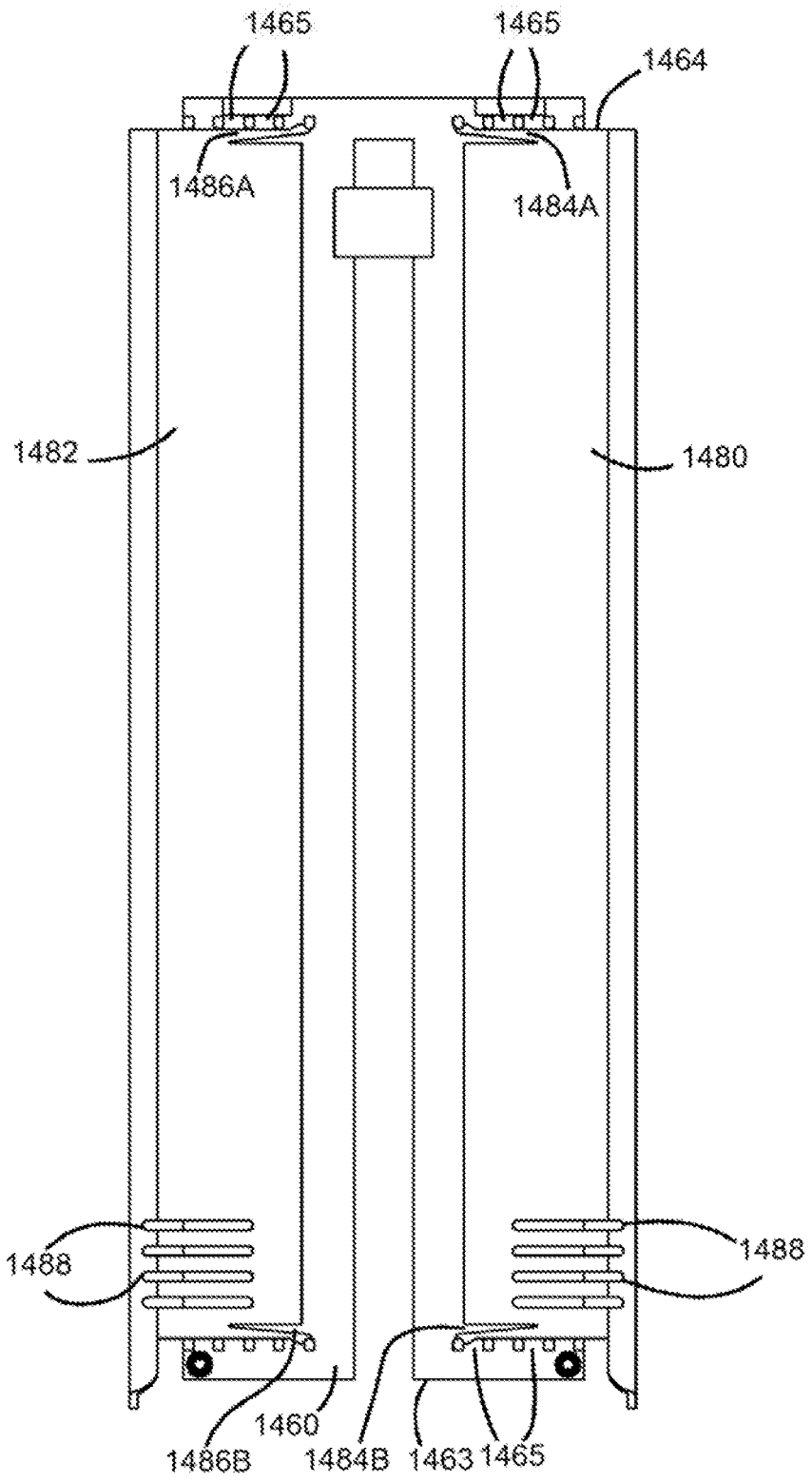
FIG. 14 is a bottom view of a tray and arms of a ventilated merchandising system in accordance with one embodiment of the present invention.

As seen in FIGS. 16-19, system 830 may also include adjustable side arms 1680 and 1682 to accommodate different sized products. Arms 1680, 1682 are adjustable to contain various sizes of products so that the products do not fall off the tray 860 over the side of the system 830. Arms 1680, 1682 are movable in the directions indicated by arrows E1, such that they can be positioned nearer the tray 860 and away from the tray 860. As seen in FIG. 14, arms 1680, 1682 are coupled to the tray 860 by flexible tabs 1484A, 1484B, 1486A, 1486B at the edges of each arm 1480, 1482. Tabs 1484A, 1484B, 1486A, 1486B fit into slots 1465 near the front edge 1463 of and rear edge 1464 of tray 860. When arms 1480, 1482 are in the first or unexpanded position, tabs 1484A, 1484B, 1486A, 1486B are fit into the centermost slots 1465 of the tray. To move the arms 1480, 1482 away from the tray 860 to the extended position (FIGS. 13, 19), a user can pull outward on the arms 1480, 1482 until the tabs 1484A, 1484B, 1486A, 1486B loosen from the slots 1465. When the arms 1480, 1482 are at the desired position, tabs 1484A, 1484B, 1486A, 1486B fit into the appropriate slots 1465 to secure that arms 1480, 1482 at the desired expanded position. Other means of moving and securing the arms 1480, 1482 may be used. Alternatively, side rails may be used in place of arms 1480, 1482. Stationary side arms may also be used in lieu of movable arms 1480, 1482. Arms 1480, 1482 may also include vents 1488 to allow the cool air to easily travel to the front of the case 2420. Also, as seen in an alternate embodiment in FIGS. 16C and 16D, support arms 1689 may be coupled to base 1640 to provide added stability to the arms 1680, 1682 in their extended position.

Figure 18:
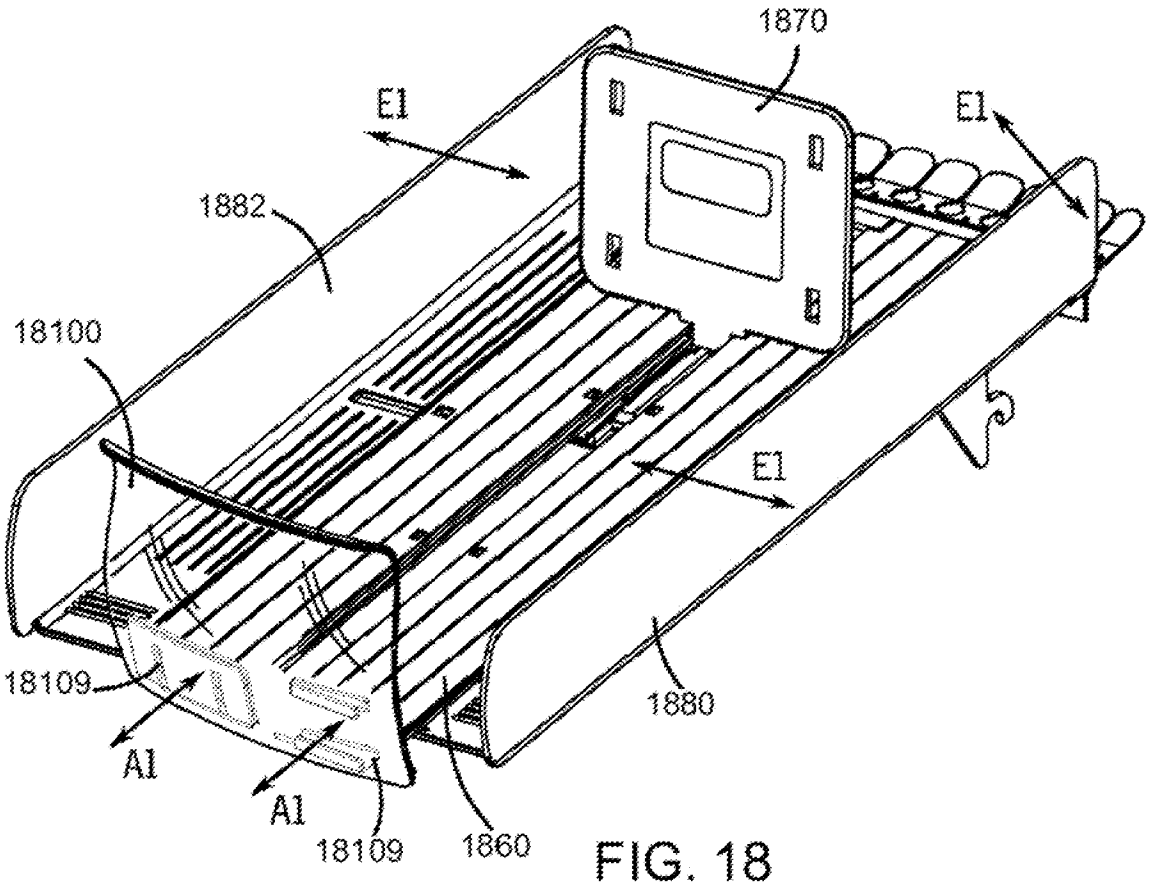
FIG. 18 is a top perspective view of a ventilated merchandising system with arms expanded in accordance with one embodiment of the present invention.
Figure 19:
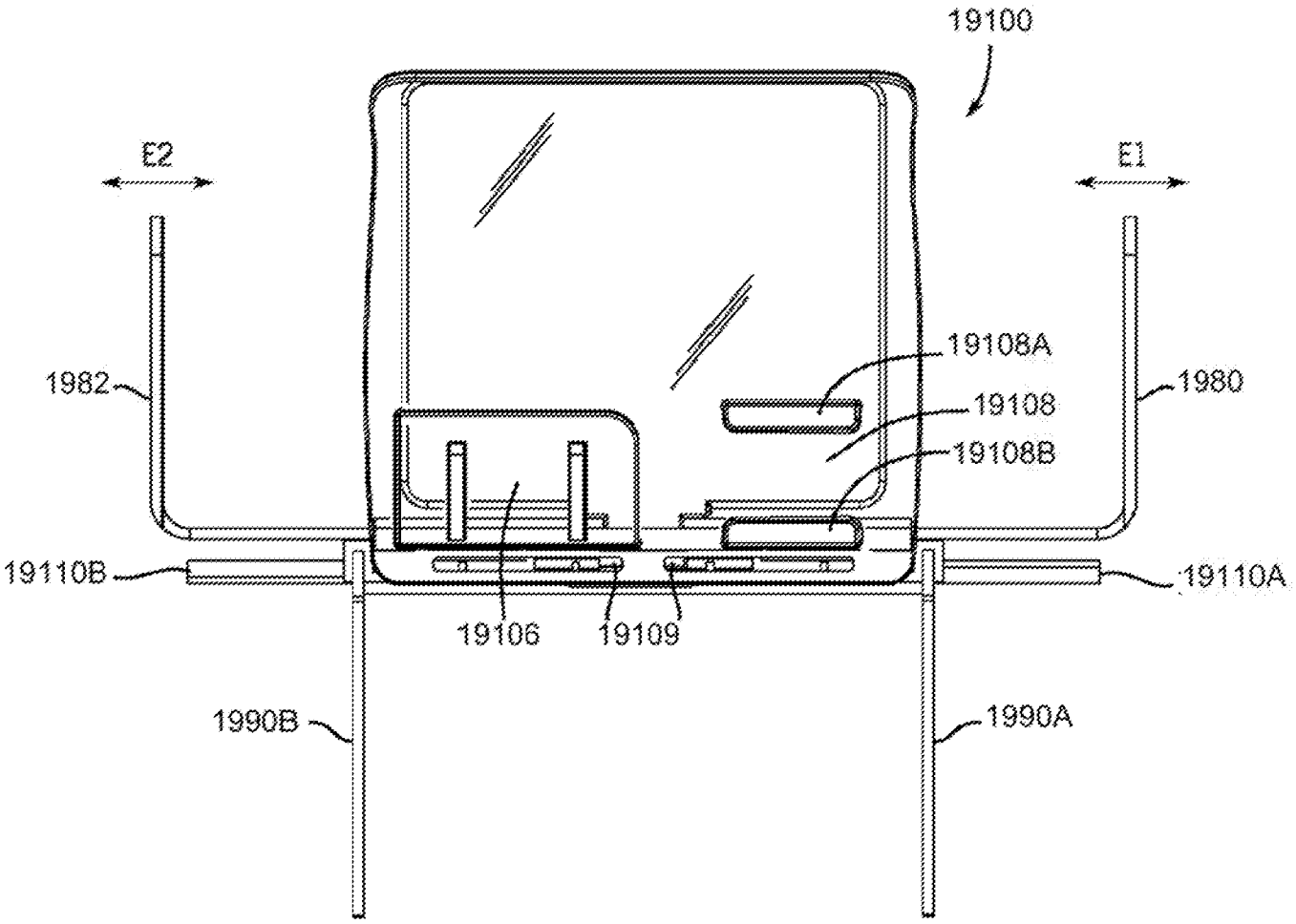
FIG. 19 is a front view of a ventilated merchandising system with arms expanded in accordance with one embodiment of the present invention.
Figure 20:
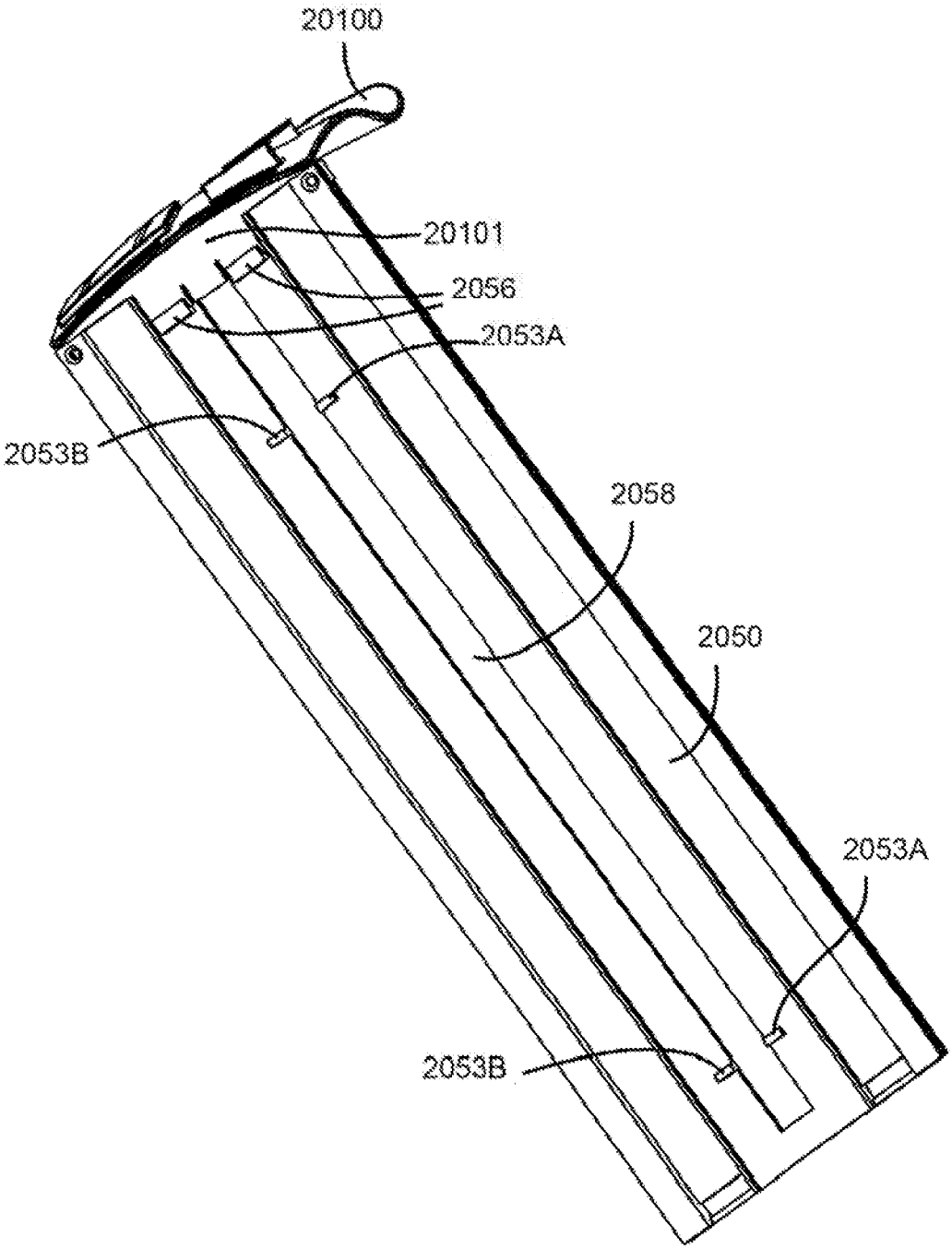
FIG. 20 is a bottom perspective view of a separator and front plate of a ventilated merchandising system in accordance with one embodiment of the present invention.
Figure 21:
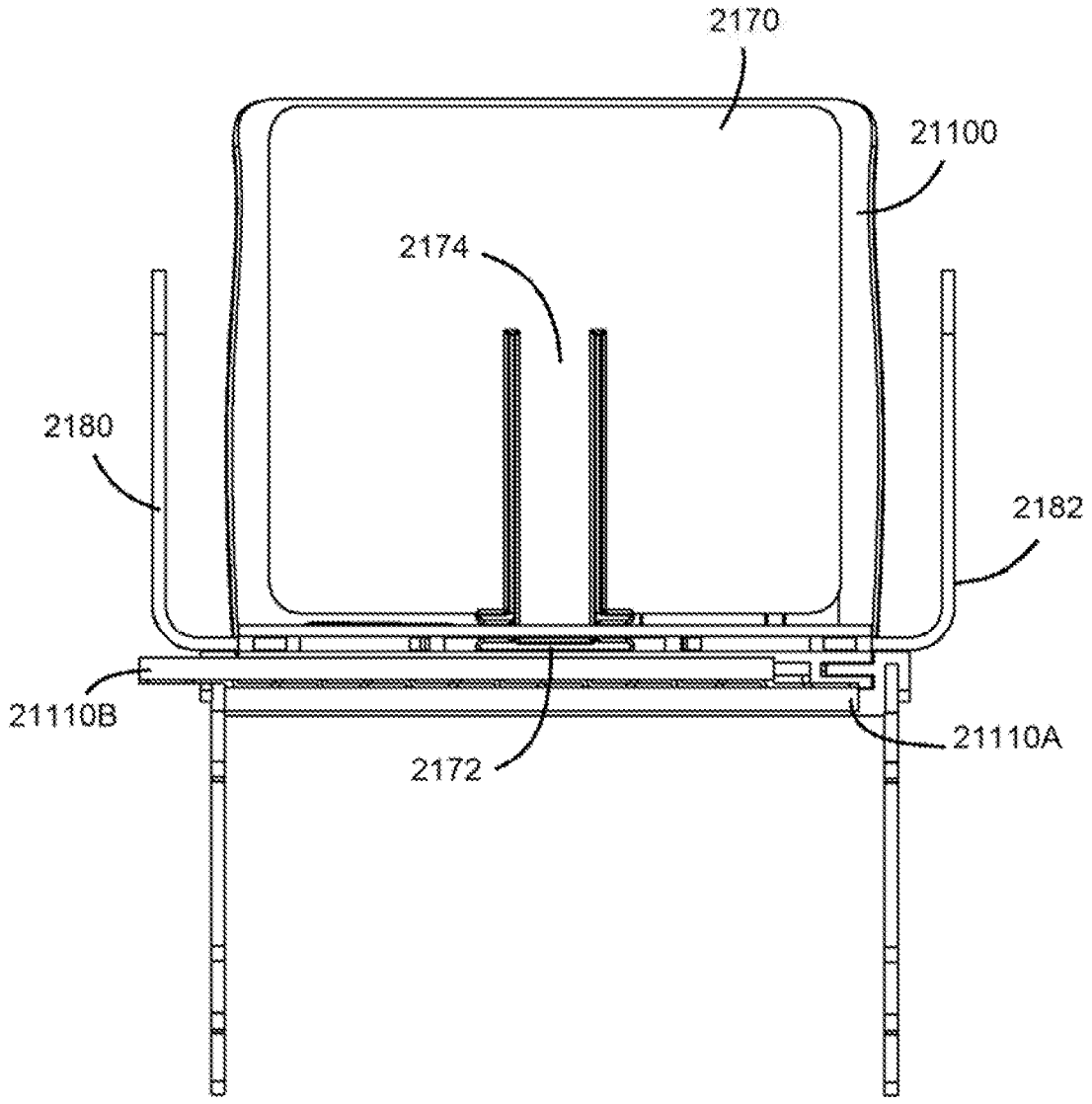
FIG. 21 is a rear view of a ventilated merchandising system in accordance with one embodiment of the present invention.
Figure 22A:
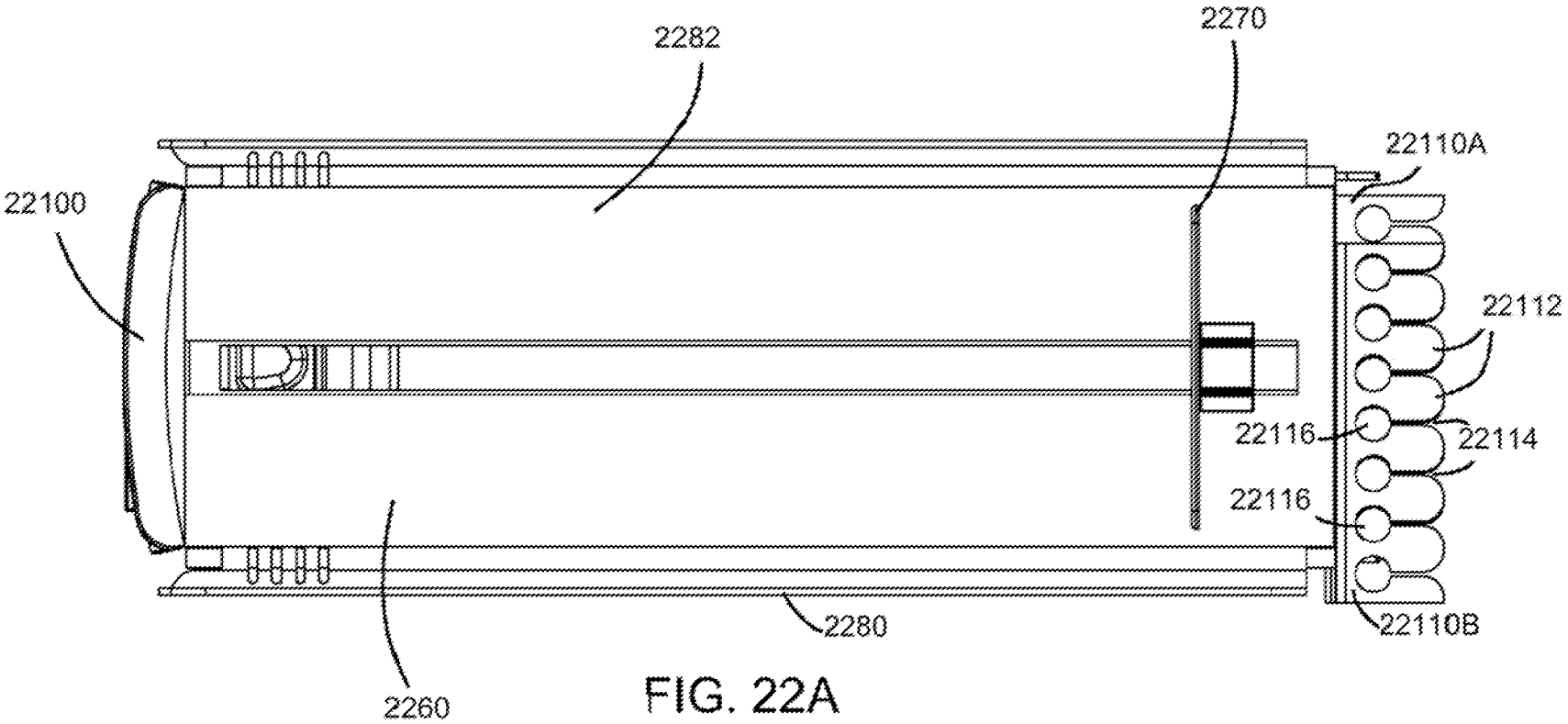
FIG. 22A is a top view of a ventilated merchandising system in accordance with one embodiment of the present invention.
Figure 22B:
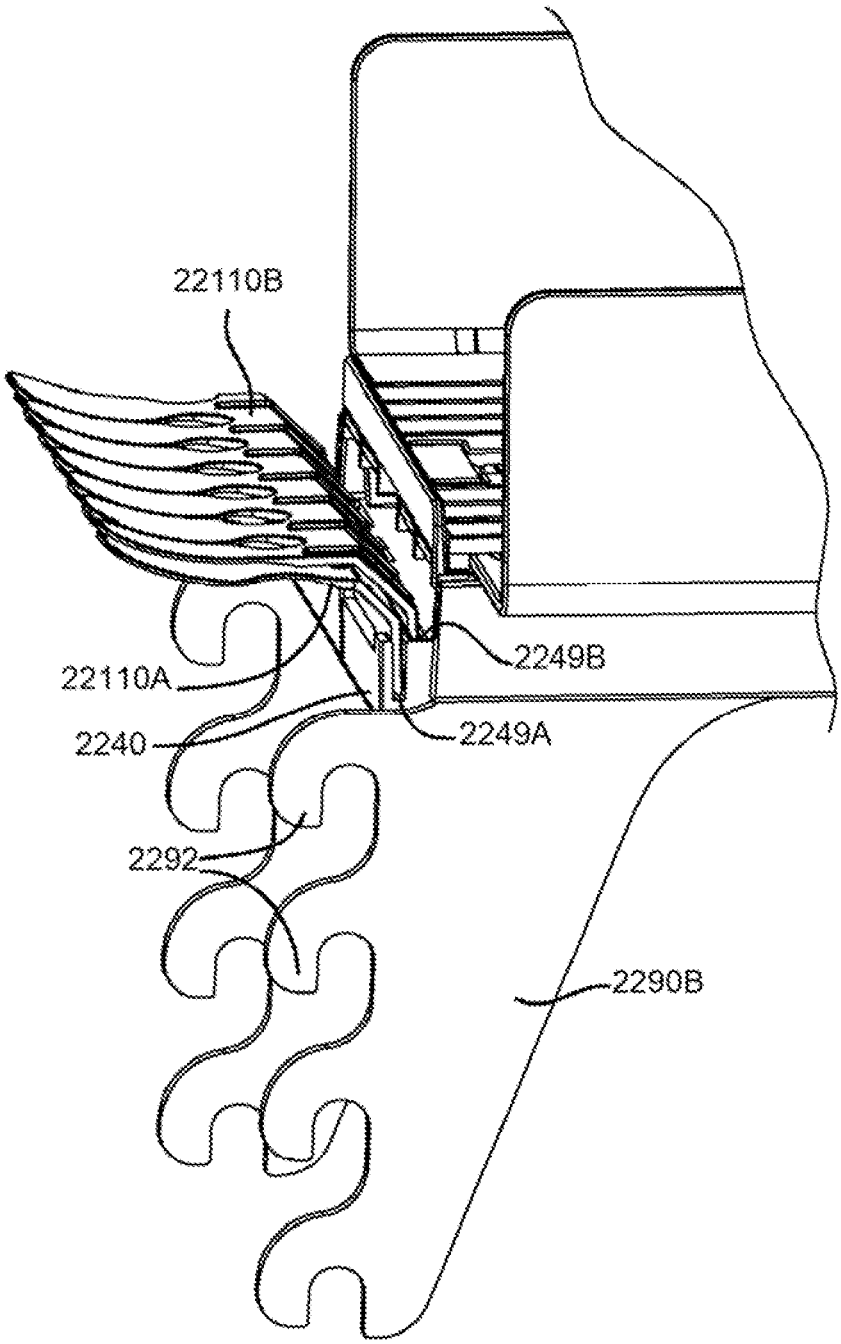
FIG. 22B is a detail side perspective view of the rear portion of a ventilated merchandising system in accordance with one embodiment of the present invention.
Figure 22C:
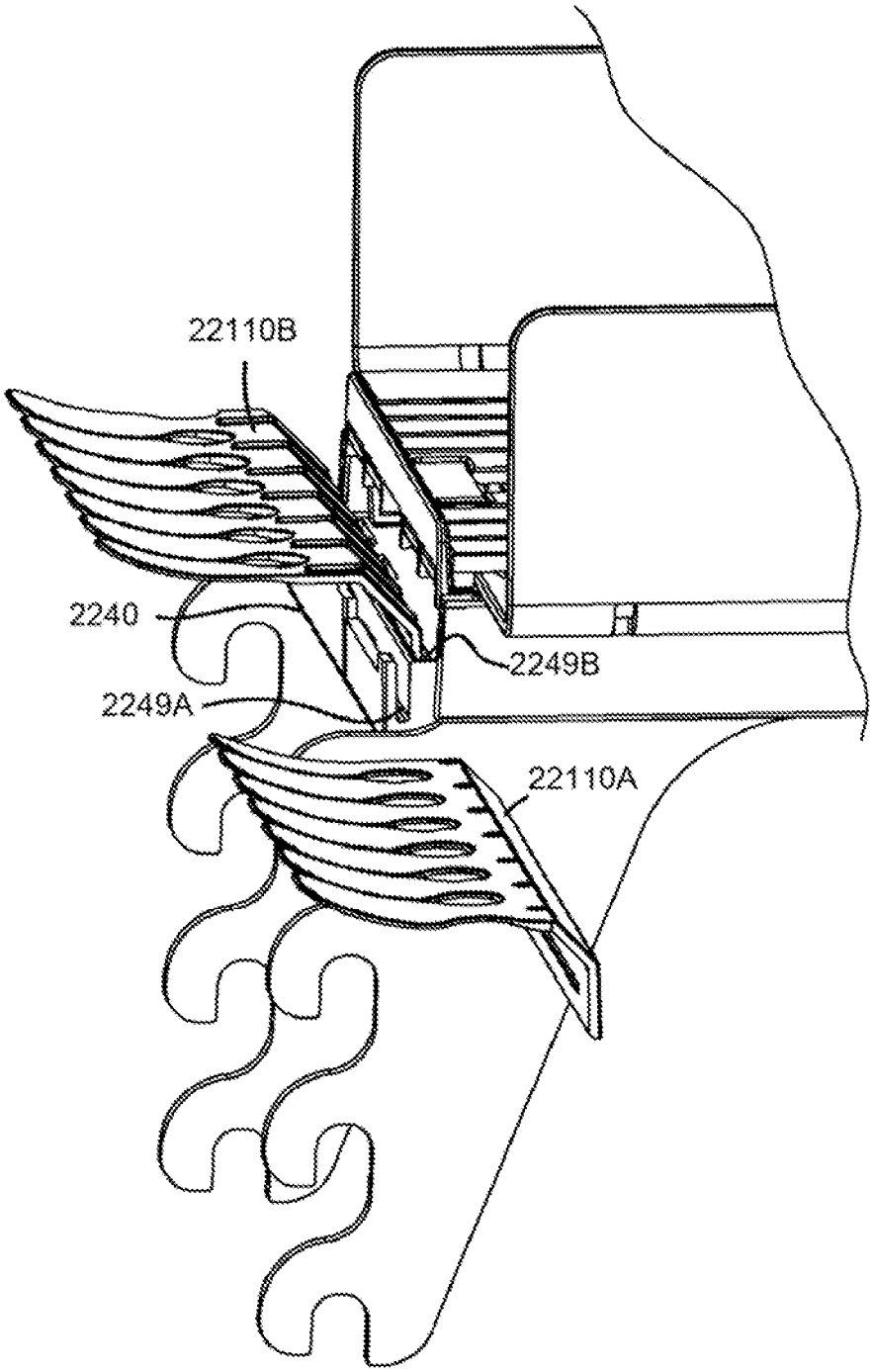
FIG. 22C is a detail side perspective view of the rear portion of a ventilated merchandising system in accordance with one embodiment of the present invention.
Figure 22D:
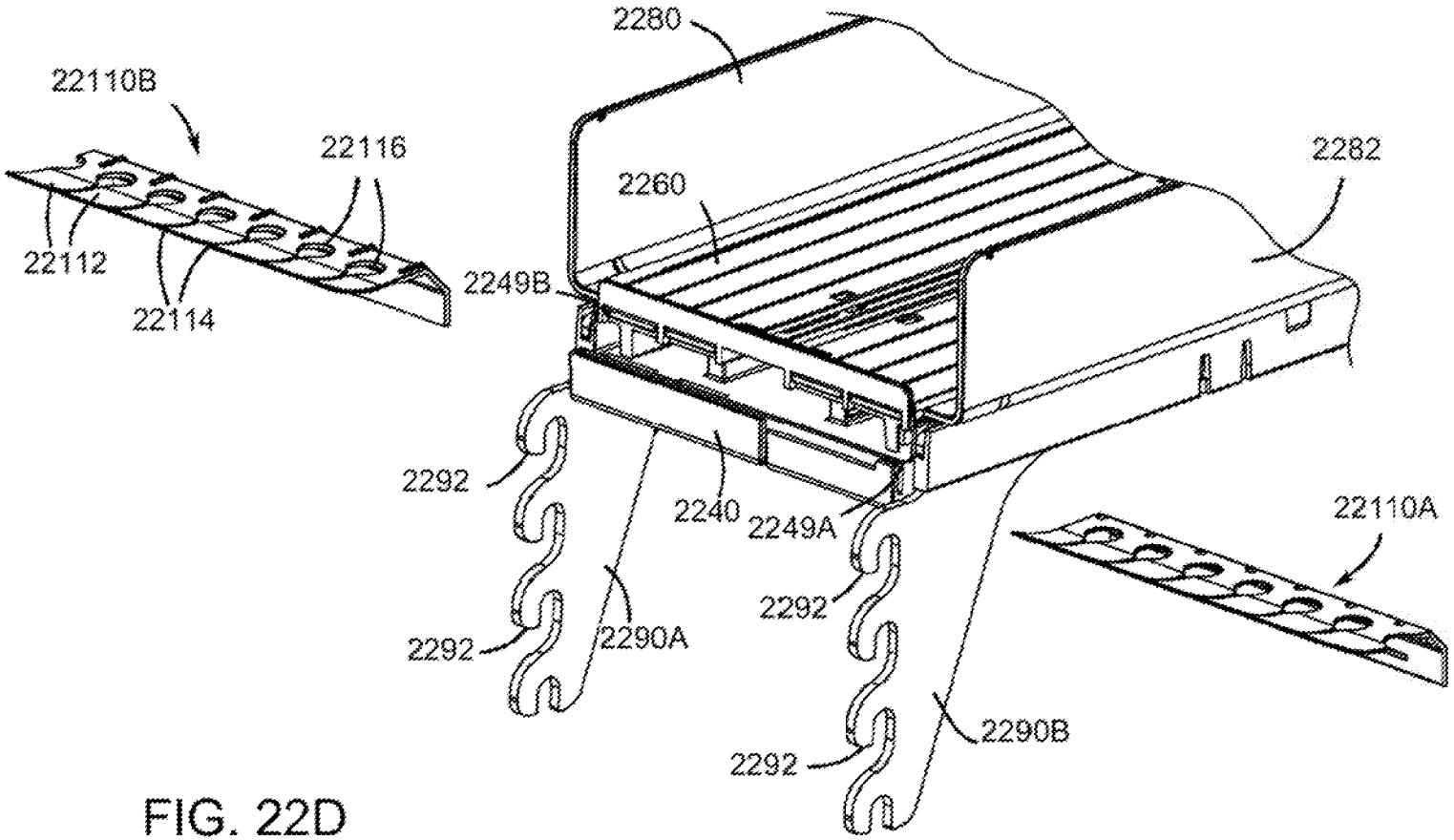
FIG. 22D is a detail top perspective view of the rear portion of a ventilated merchandising system in accordance with one embodiment of the present invention.

System 830 also includes a front plate 18100. Front plate 18100 is aligned with the front edge 1263 of tray 860 as seen in FIGS. 18-19. The front plate 18100 acts as a product stop so that products do not fall over the front edge 1263 of the tray 860. Front plate 18100 is coupled to the separator 2050 by a lip 20101 extending from front plate 18100 that fits into recesses 2056 on bottom of separator 2050 (see FIGS. 10, 20). As shown best in FIG. 50B, snap-fit tabs 50107*b* can be used to fit the lip 20101 into recesses 1056. As seen in FIGS. 15 and 22, front plate 15100 has a curved shape. This shape provides several advantages over traditional flat front plates. First, when bagged products are displayed on the system 830, the bottom curvature 15102 gives a bigger footprint to the bottom of the bags to help in keeping the bags upright on the tray 860. Additionally, the top curvature 15104 both helps to keep bagged products upright, and also, with any shape of product used with the system 830, makes removal of products easier as the products easily slide over the top curvature 15104 for smooth removal from the tray 860 (as opposed to traditional flat plates, which have a blunt straight top edge that can make pulling products over the edge difficult). As seen best in FIG. 19, front plate 19100 also provides a display surface on which indicia such as graphics, information, labels, tags or bar codes can be placed. In the embodiment shown, front plate 19100 includes two label holders 19106, 19108. First label holder 19106 is sized to fit standard-sized price tags. The second label holder 19108 includes two protrusions 19108A, 19108B to form the top and bottom walls of the label holder 19108. Because no side barriers are included, second label holder 19108 can accommodate non-traditional sized tags or labels. Second label holder 19108 could also be formed by including differently-sized or shaped protrusions 19108A, 19108B and/or spacing the protrusions 19108A, 19108B further apart or closer together to accommodate various types and sizes of labels or tags. Front plate 19100 further includes vents 19109. As seen in FIGS. 18 and 24, vents 18109 allow cool air which enters at the rear of the system 830 to flow through and out of the front of the system 830 through the vents 18109 (indicated by arrow A1).

Figure 49A:
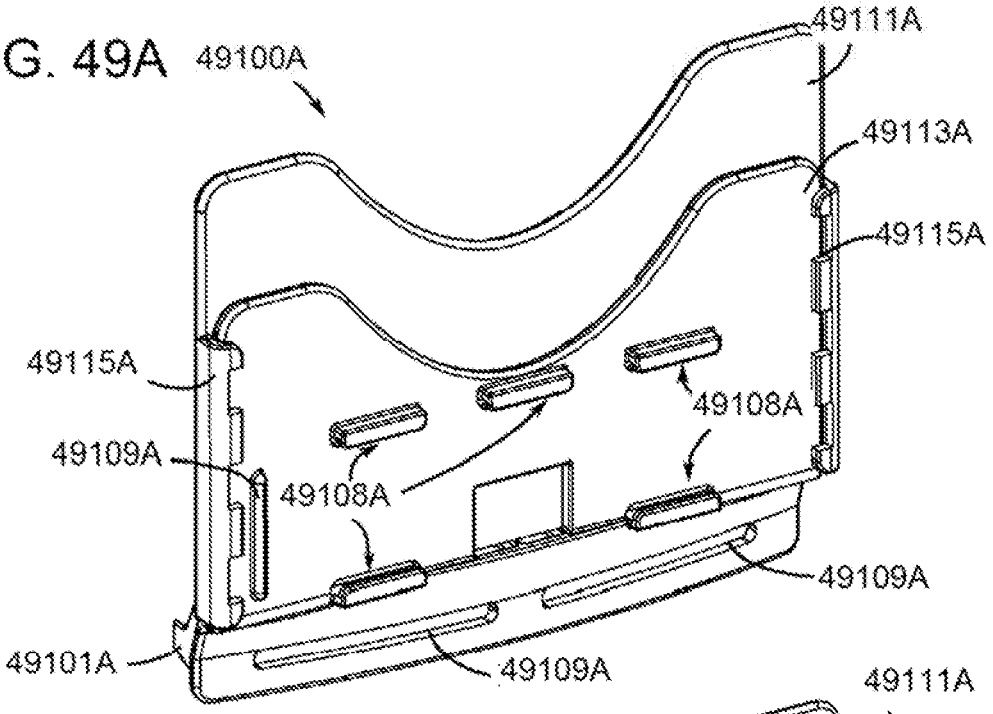
FIG. 49A is a top perspective view of a front plate of a ventilated merchandising system in accordance with one embodiment of the present invention.
Figure 49B:
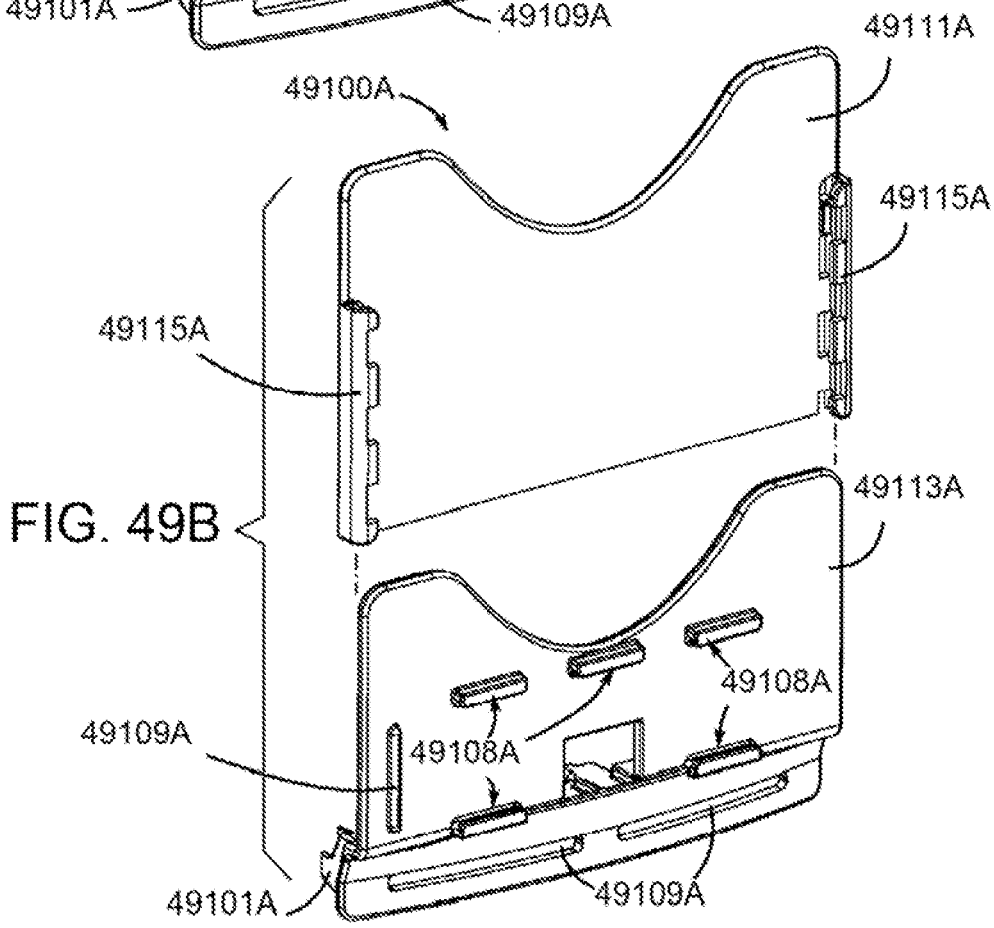
FIG. 49B is an exploded view of the front plate of FIG. 49A.
Figure 50A:
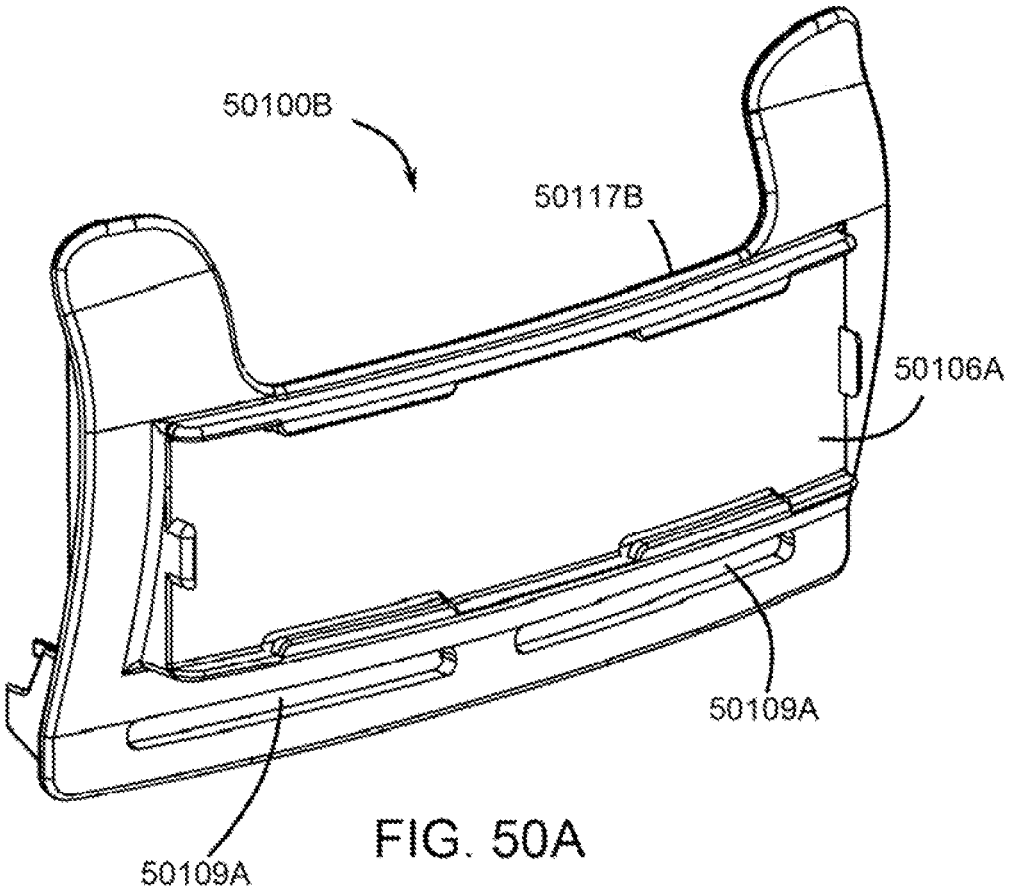
FIG. 50A is a top perspective view of a front plate of a ventilated merchandising system in accordance with another embodiment of the present invention.
Figure 50B:
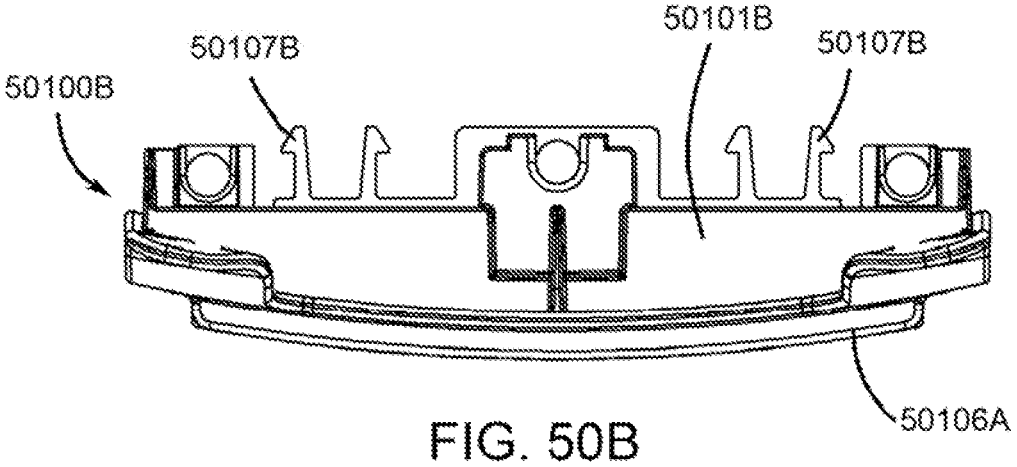
FIG. 50B is a bottom view of the front plate of FIG. 50A.
Figure 51A:
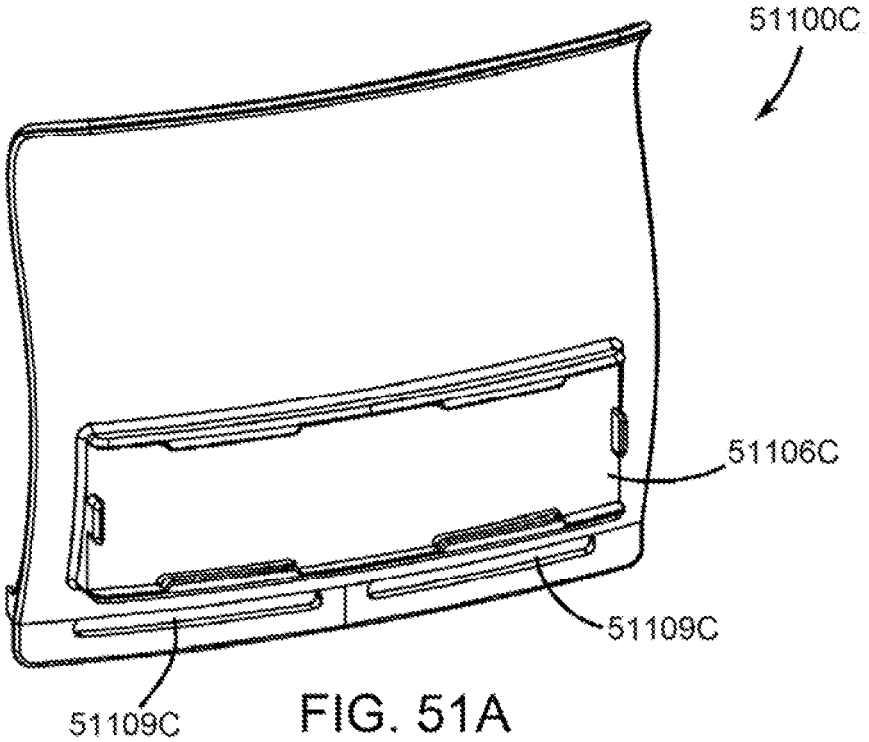
FIG. 51A is a top perspective view of a front plate of a ventilated merchandising system in accordance with another embodiment of the present invention.
Figure 51B:
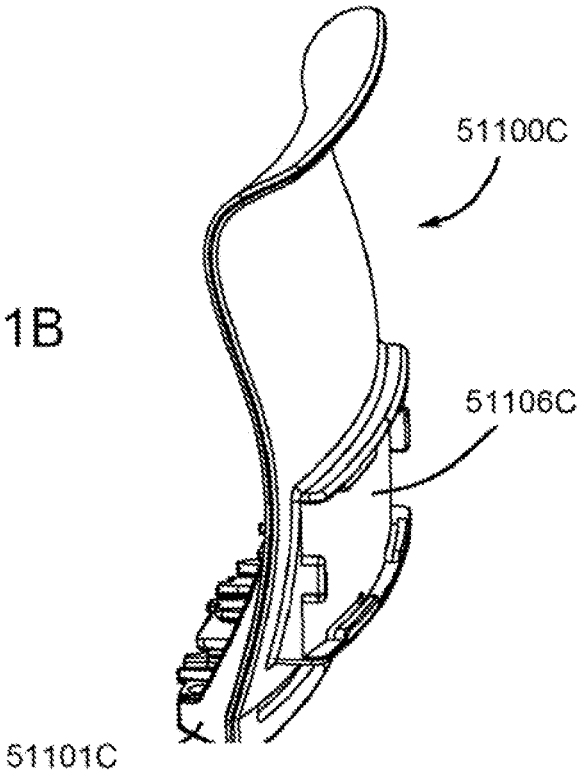
FIG. 51B is a side perspective view of the front plate of FIG. 51A.

FIGS. 49A and 49B show another embodiment of a front plate. The front plate 49100*a* includes an adapter plate 49111*a* and coupler plate 49113*a*. The coupler plate 49113*a* can be coupled to the separator 2050 as described with respect to front plate 18100. The adaptor plate 49111*a* can be removably coupled to the coupler plate 49113*a* via channels 49115*a* for quick and easy assembly, removal and replacement of the adapter plate 49111*a*. Like front plate 18100, front plate 49100*a* can also include vents 49109*a* and label holders 49108*a*. Another embodiment of a front plate is shown in FIGS. 50A and 50B. Like front plate 18100, the front plate 50100*b* is curved and includes vents 50109*a* and lip 50101*b*. Front plate 50100*b* includes a curved label holder 50106*a*, and a short section 50117*b*. FIG. 50B also shows snap-fit tabs 50107*b* that can be used to fit any front plate of the present invention to recesses 2056 on the bottom of separator 2050. Yet another embodiment of a front plate is shown in FIGS. 51A and 51B. Like front plate 50100*b*, front plate 51100*c* includes a curved label holder 51106*c*, vents 51109*c* and lip 51101*c*.

Figure 23:
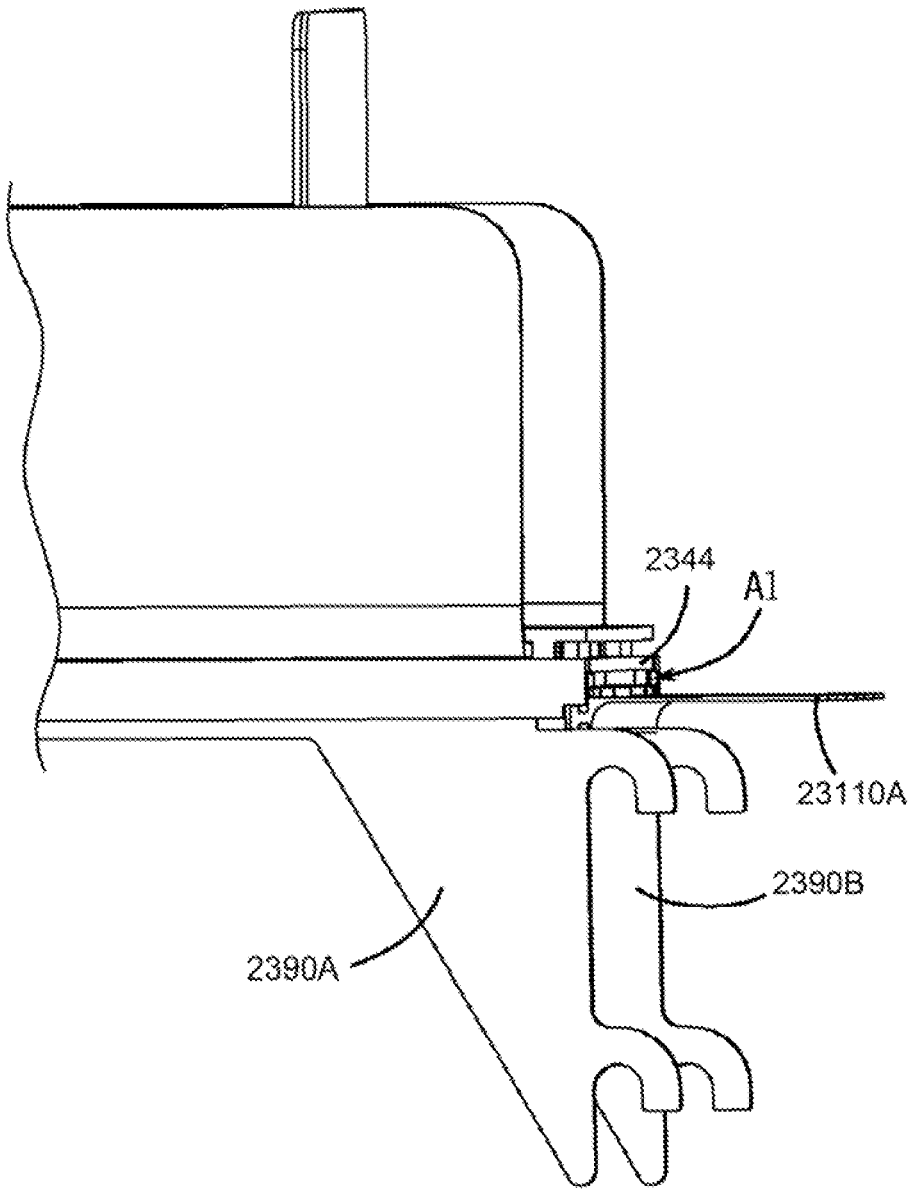
FIG. 23 is a detail side perspective view of the rear portion of a ventilated merchandising system in accordance with one embodiment of the present invention.

System 830 can also include one or more plenum plates 8110A, 8110B. Each plenum plate 8110 has a plurality of fingers 8112. As seen best in FIGS. 22A-22C, plenum plates 22110A, 22110B are attached to base by channels 2249A, 2249B molded into the rear edge 1145 of base 1140. Plenum plates 22110A, 22110B are also adjustable. To adjust plenum plates 22110A, 22110B a user can slide the plates 22110A, 22110B toward (22A) or away from (22B, 22C) the center of the base 1140 in the channels 2249A, 2249B. Plenum plates 8110A, 8110B can be adjusted to align with the positioning of the adjustable arms 880, 882, and adjustment also allows alignment of slits 8114 between fingers 8112 with the vertical grid wires 2014. When mounting the system 830 onto a grid 2410, fingers 8112 are placed between the vertical grid wires 2414 and pushed through, so that vertical grid wires 2414 slide through slits 8114 and into voids 8116 in the plenum plates 8110A, 8110B and system 830 is snap-fit onto the grid system 2410. As seen in FIGS. 23 and 24, the fingers 8112 act to capture cold air which would otherwise drop behind the products (as shown by the lines C3) and guide the cold air into the gap 2344 in the system 830 (shown by the arrow A1) to promote better cooling of the products displayed on the system 830.

Figure 47A:
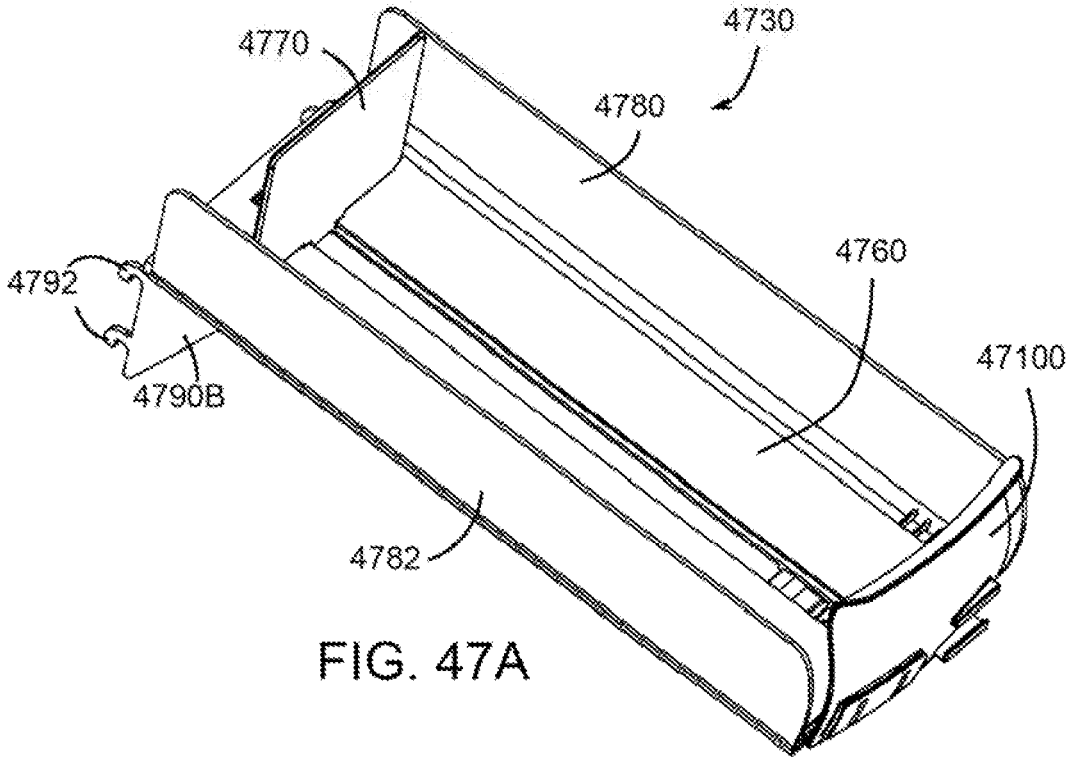
FIG. 47A is a top perspective view of a ventilated merchandising system in accordance with one embodiment of the present invention.
Figure 47B:
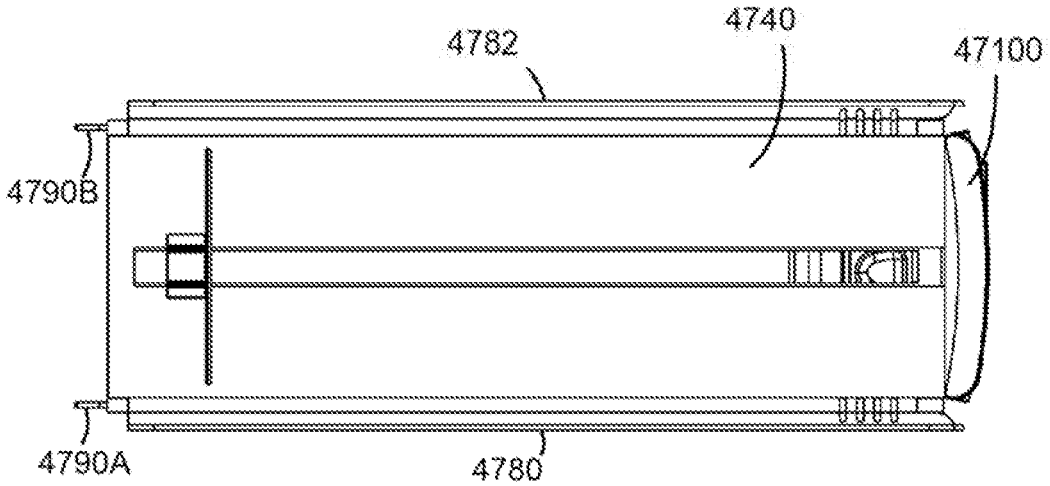
FIG. 47B is a bottom view of the ventilated merchandising system of FIG. 47A.
Figure 48:
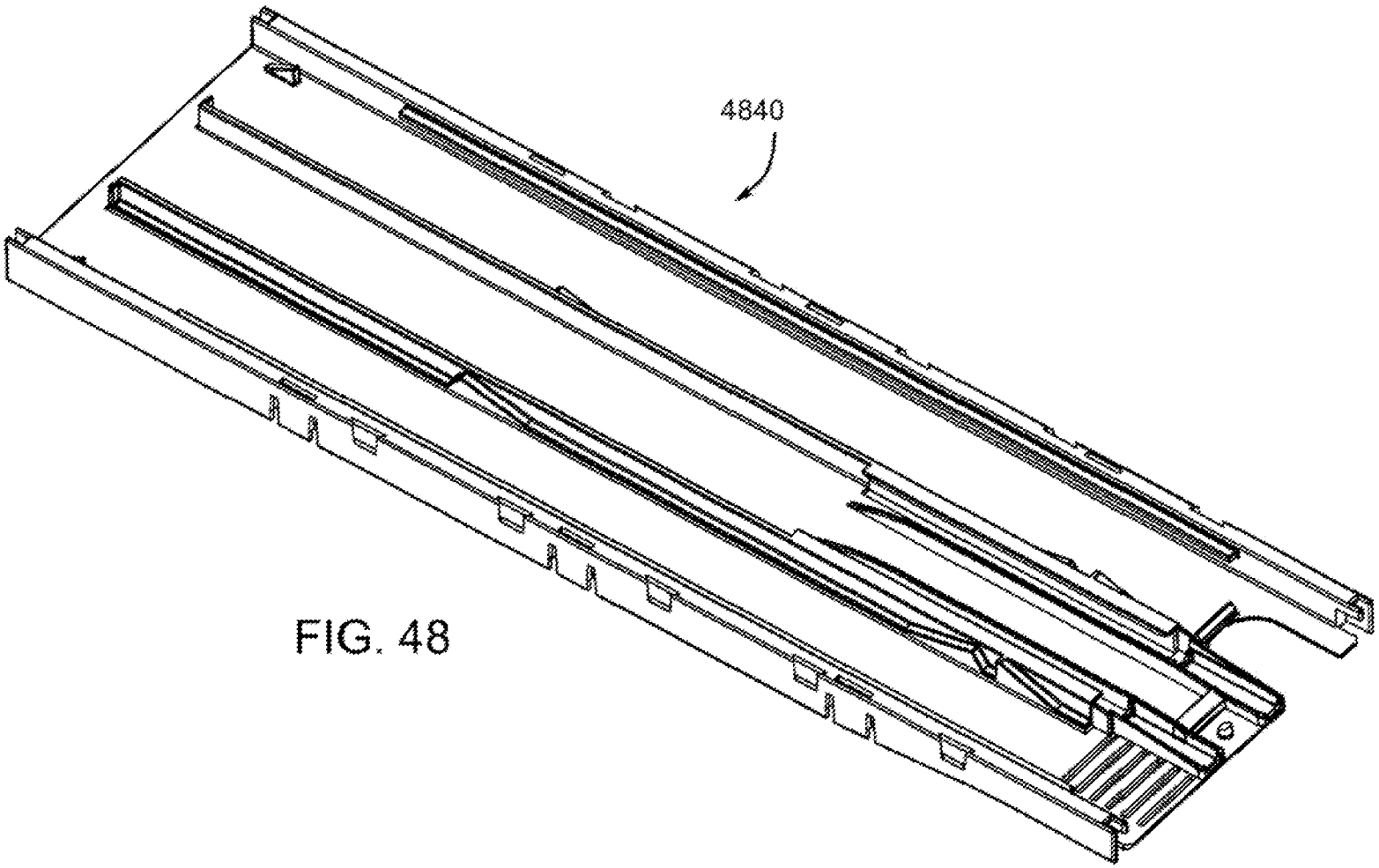
FIG. 48 is a top perspective view of a base member of a ventilated merchandising system in accordance with one embodiment of the present invention.

System 830 is also effective without plenum plates. FIGS. 47A, 47B and 48 show one embodiment of system 830 without plenum plates. While the plenum plates are effective to direct cold air into the gap 944, the placement of the fingers between the vertical grid wires 2014 can be an extra step in the installation process that merchandisers may want to avoid. Without the plenum plates, cold air still flows into gap 944 to sufficiently circulate cold air beneath the products. For these reasons, merchandisers may prefer the system 830 without plenum plates.

As shown in FIG. 24A, cold air is pumped into the case 2420 at the front side of the case in the direction indicated by the arrow C1. The cold air then circulates around the bottom of the case 2420 and upward toward the top of the case 2420 along the back wall of the case 2420, as indicated by the arrow C2. Normally, as shown by the dotted line C3, the cold air then falls to the bottom of the case 2420 behind the products, meaning cold air is not directed to the products themselves. Not only does the insufficient direct cooling present food safety issues, but the response to the issue is often to increase the amount of cold air pumped into the case 2420 to decrease the overall air temperature in the entire case 2420. The increased energy necessary to cool the entire case 2420 means an increased expense to the retailer and possible damage to the food from improper temperatures. To attempt to stop cold air from falling behind the products, baffles are sometimes placed between traditional display systems within the case to attempt to stop cold air from falling behind the products and directing it to the products on the shelves. However, as described above, the baffles present a host of disadvantages to the retailer, consumer, and, because of imprecise placement in the case, often fail to sufficiently direct the cold air to the products on the shelves.

Figure 25A:
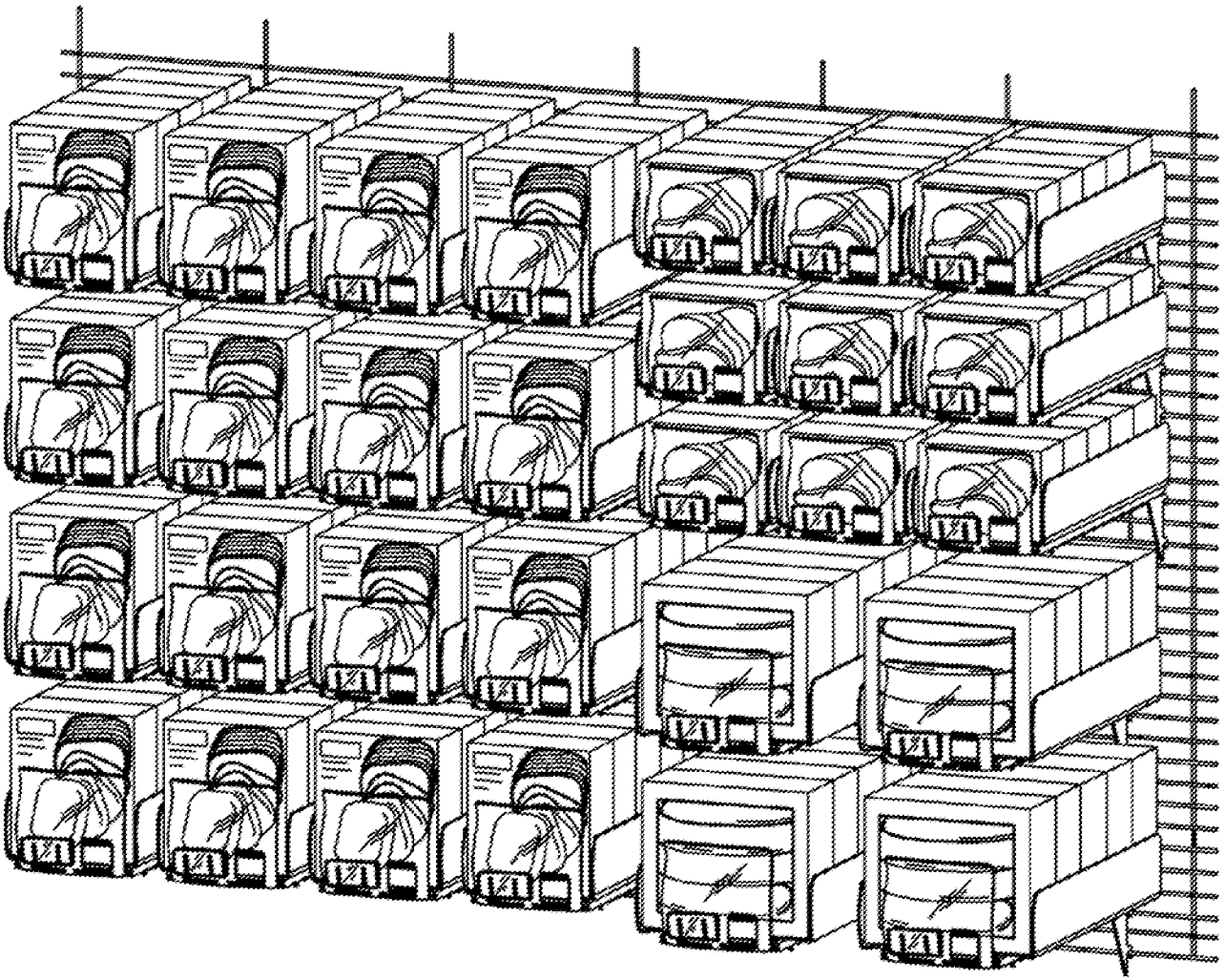
FIG. 25A is a schematic of numerous merchandising systems with products displayed and installed on a grid system.
Figure 25B:
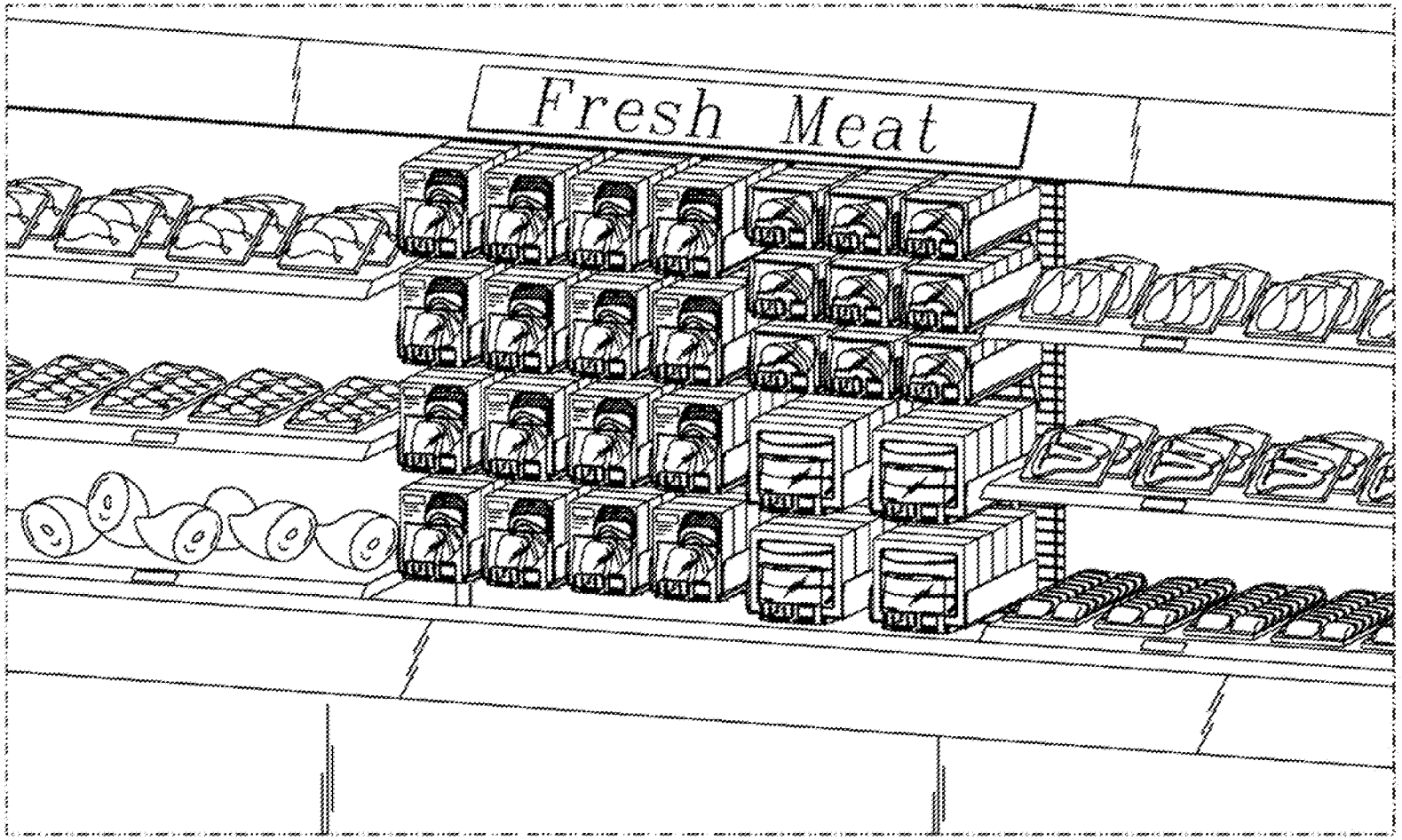
FIG. 25B is a schematic of numerous ventilated merchandising systems with products displayed and installed in a refrigerator case.
Figure 26:
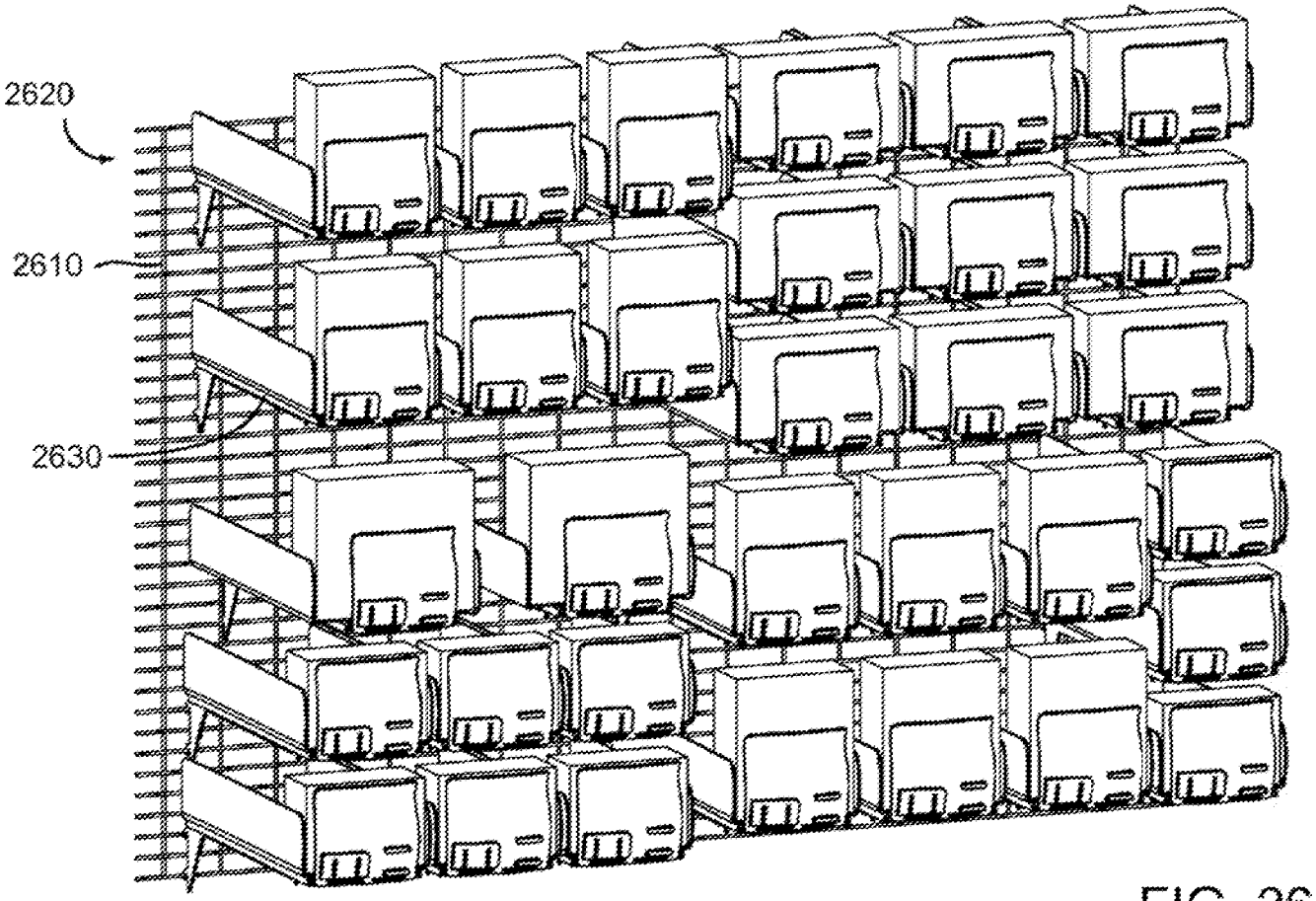
FIG. 26 is a schematic view of numerous ventilated merchandising systems installed in a refrigerator case.
Figure 27:
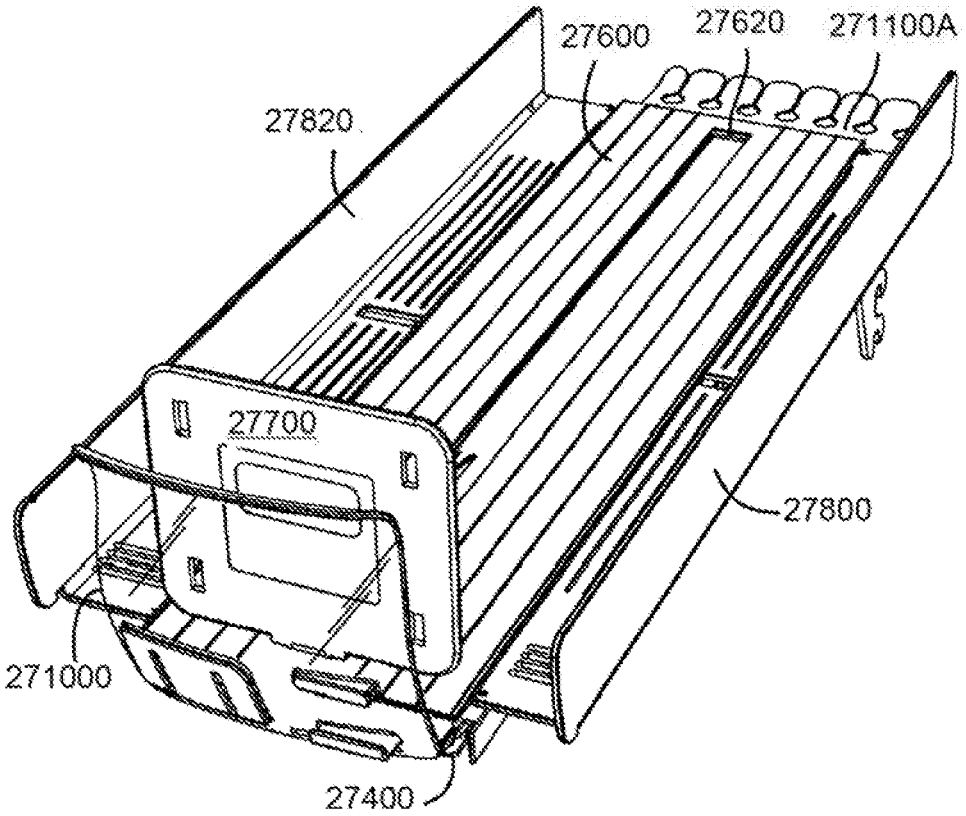
FIG. 27 is a top perspective view of a ventilated merchandising system in accordance with another embodiment of the present invention.

The current system 830 solves these problems by allowing proper cooling of the products through capturing of the falling cold air (C3) and circulation under the products (A1) in one easy-to-install, versatile, space-saving system 830. Ventilation of the system 830 works as follows. As seen best in FIGS. 9A-9B and 24, the assembled system 830 includes a gap 944 between the base member 940 and the separator 1150, allowing cold air to pass through the gap 944 and beneath the products displayed on the system 830. If used, the fingers 8112 of the plenum plates 8110A, 8110B help capture the falling cold air (C3) and direct it into the back of the system 830, above the rear edge 945 of the base 940, and through the gap 944 beneath the products displayed on the system 830. The cold air then exits the front of the system 930 through the vents 18109 in the front plate 18100 aligned with the gap 944. This airflow through the system is indicated by arrows A1. By allowing the cold air to flow beneath the displayed products, the food is more directly cooled than in traditional systems, without the use of baffles. The self-ventilating system 830, by eliminating the need for baffles, allows retailers to increase the number of systems 830 in a case by placing them closer together and without space-wasting baffles in between. Also, as seen in FIGS. 25A-B and 26, systems 830 do not have to be linearly aligned across the case to accommodate baffles, and as such a retailer has more freedom to vary the number and types of systems 830 and products within a case 2420.

Figure 28:
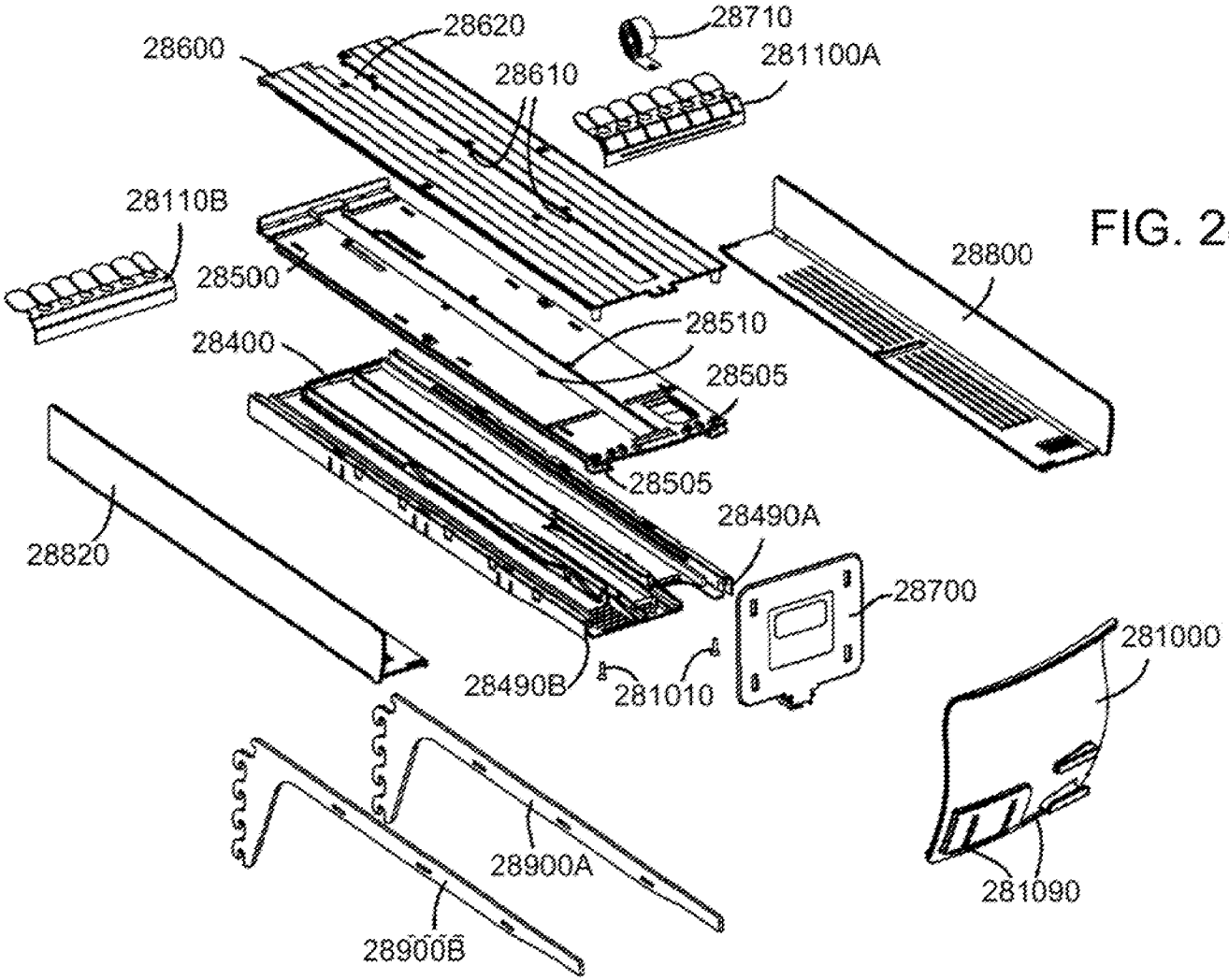
FIG. 28 is an exploded view of a ventilated merchandising system in accordance with the embodiment shown in FIG. 27.
Figure 29:
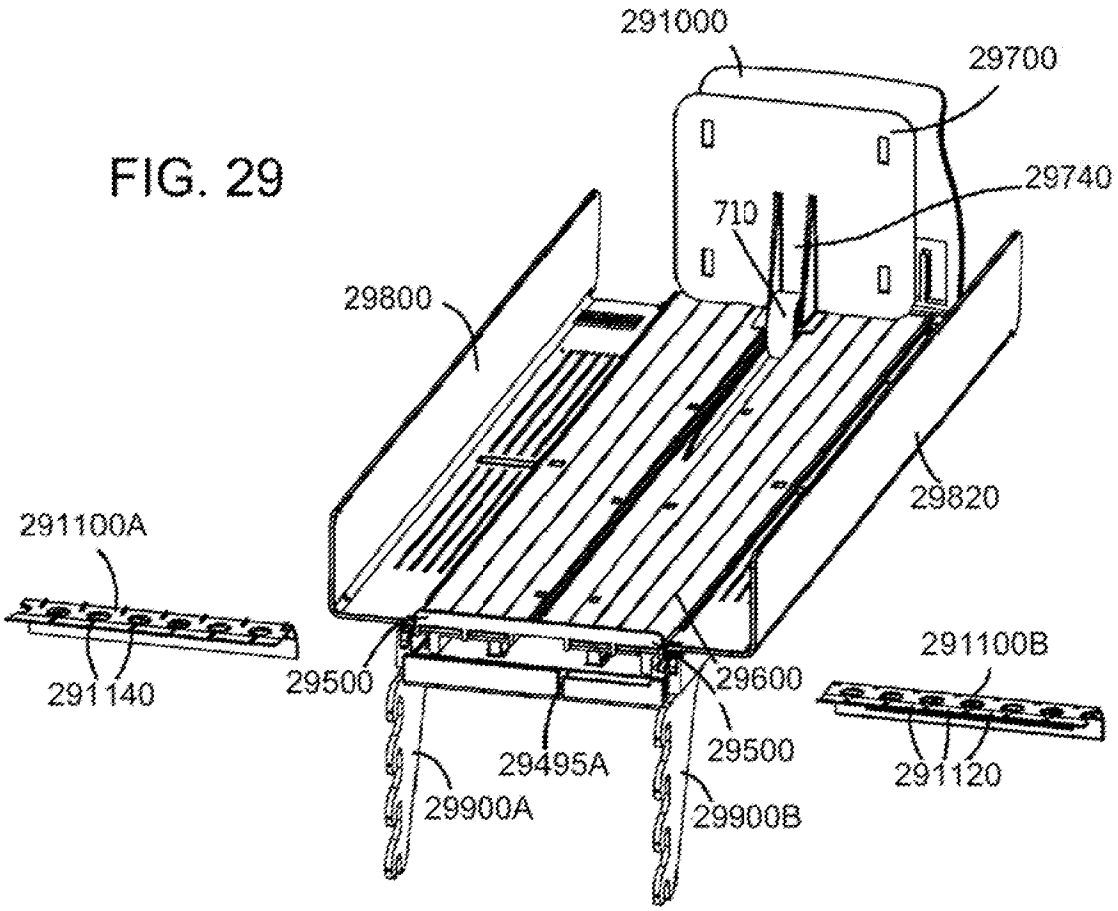
FIG. 29 is a rear perspective view of a ventilated merchandising system in accordance with the embodiment shown in FIG. 27.
Figure 30:
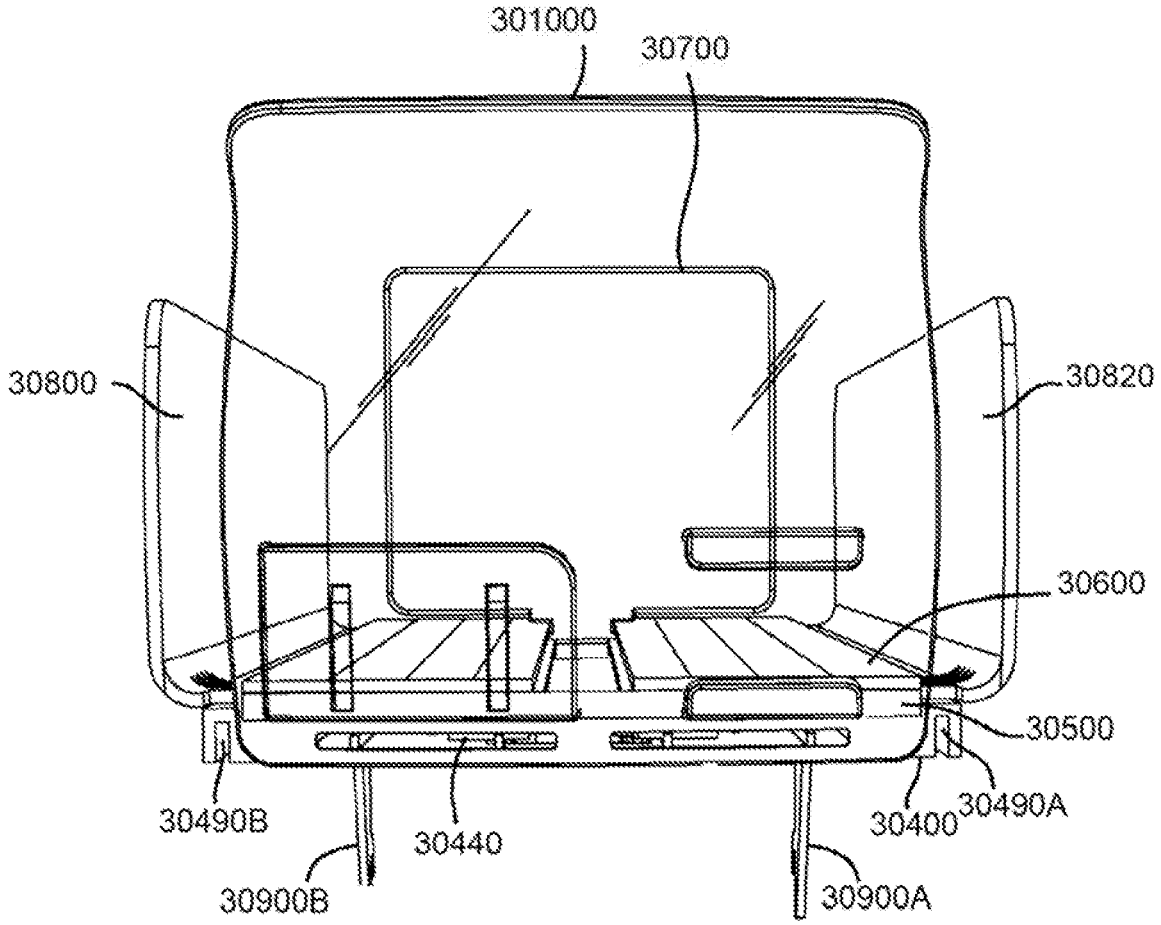
FIG. 30 is a front view of a ventilated merchandising system in accordance with the embodiment shown in FIG. 27.
Figure 31:
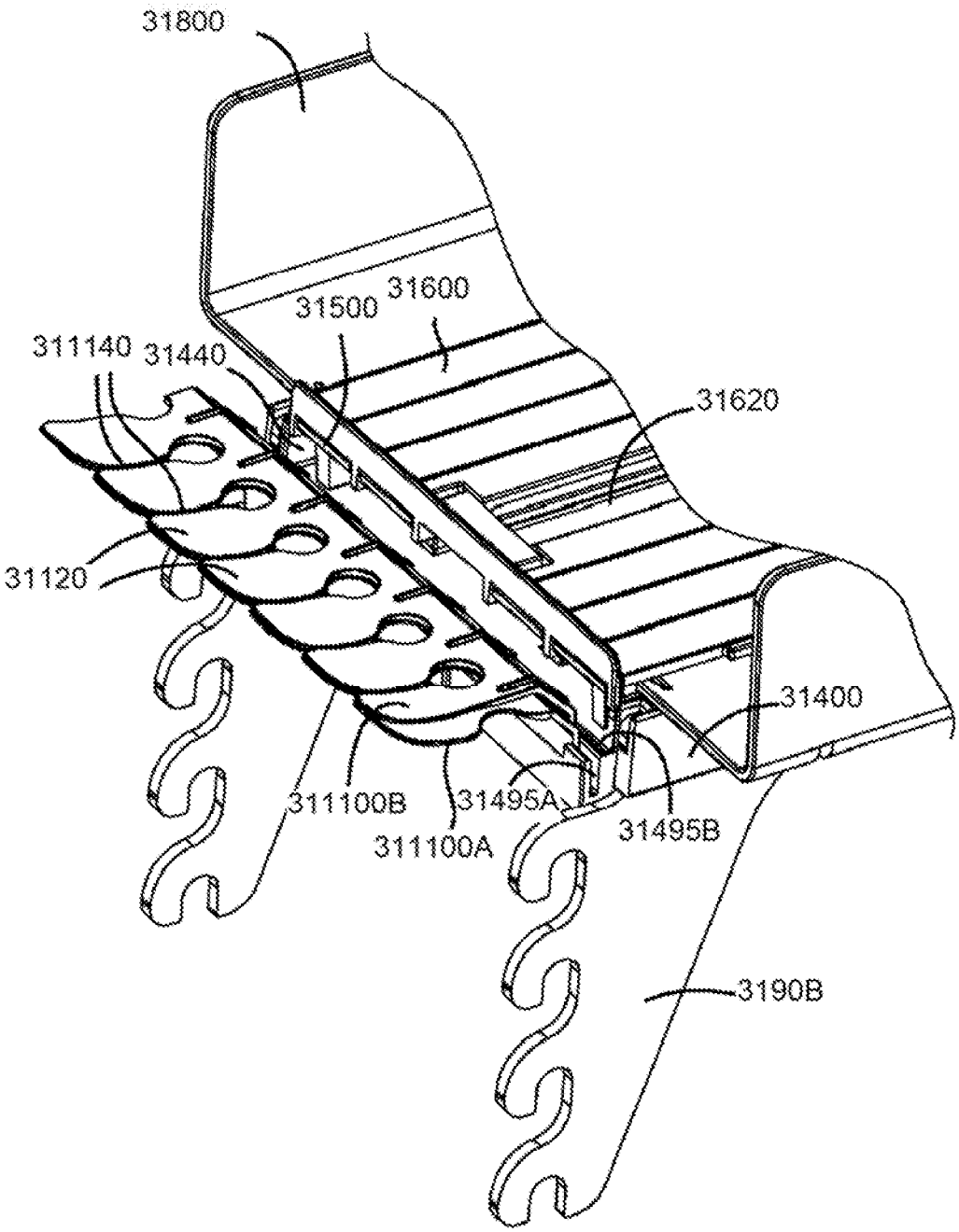
FIG. 31 is a side perspective view of the rear portion of a ventilated merchandising system in accordance with the embodiment shown in FIG. 27.
Figure 32:
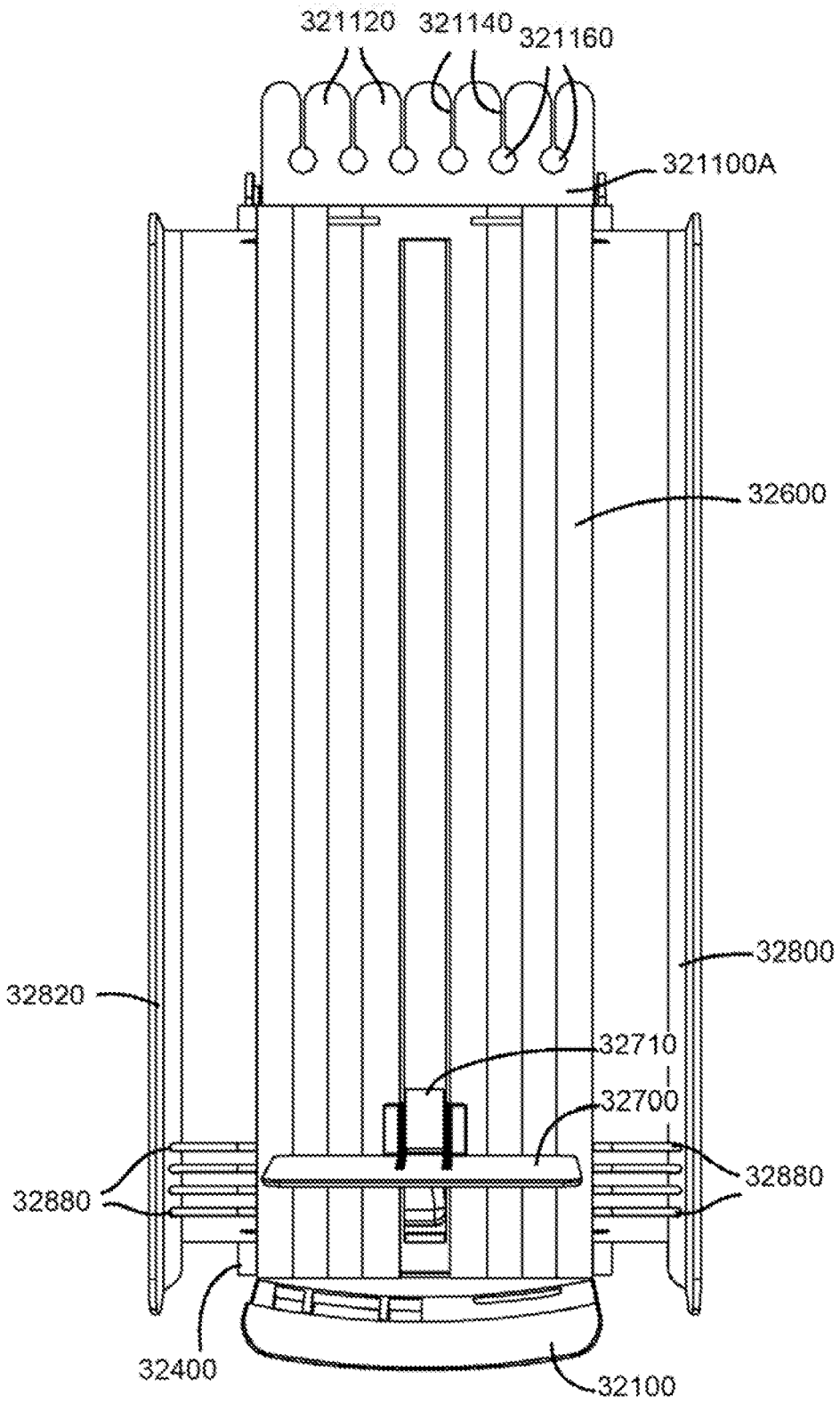
FIG. 32 is a top view of a ventilated merchandising system in accordance with the embodiment shown in FIG. 27.

In another embodiment shown in FIGS. 27-35, the system 830 includes a base member 27400, separator portion 28500 and tray 27600. In this embodiment, the separator portion 28500 is stationary and does not slidably connect to the base member 27400. As seen in FIG. 28, the tray 27600 is snap-fit into the separator portion 28500 by inserting shafts 28610 on the bottom of the tray 27600 into holes 28510 in the separator 28500. The separator 28500 is sized so that it securely snap-fits into the base 27400. As seen in FIGS. 30 and 31, a gap 30440 is provided between the base 30400 and the separator 30500 through which air can flow beneath products on the tray 30600.

Figure 33:
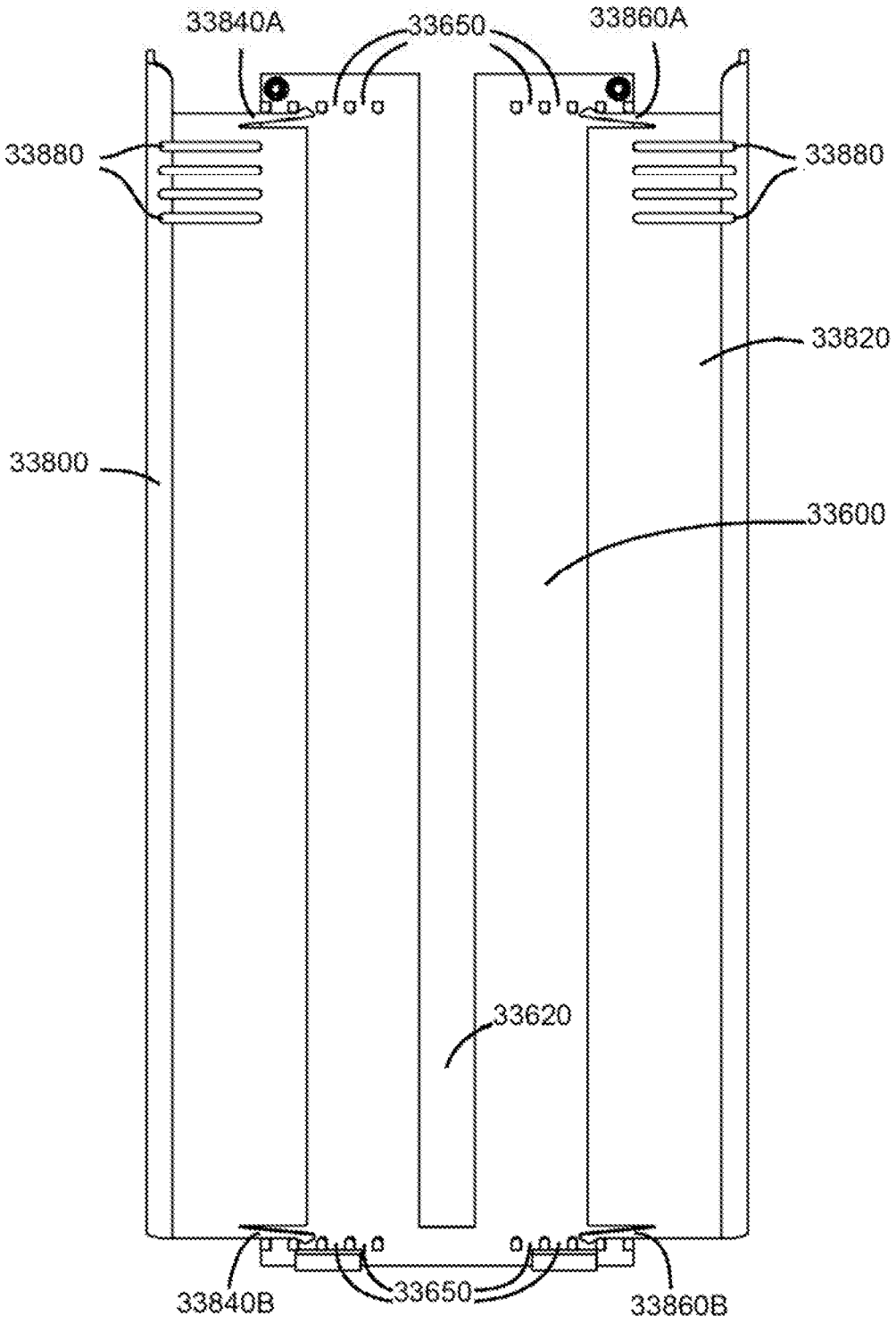
FIG. 33 is a bottom view of a tray and side arms of a ventilated merchandising system in accordance with the embodiment shown in FIG. 27.
Figure 34:
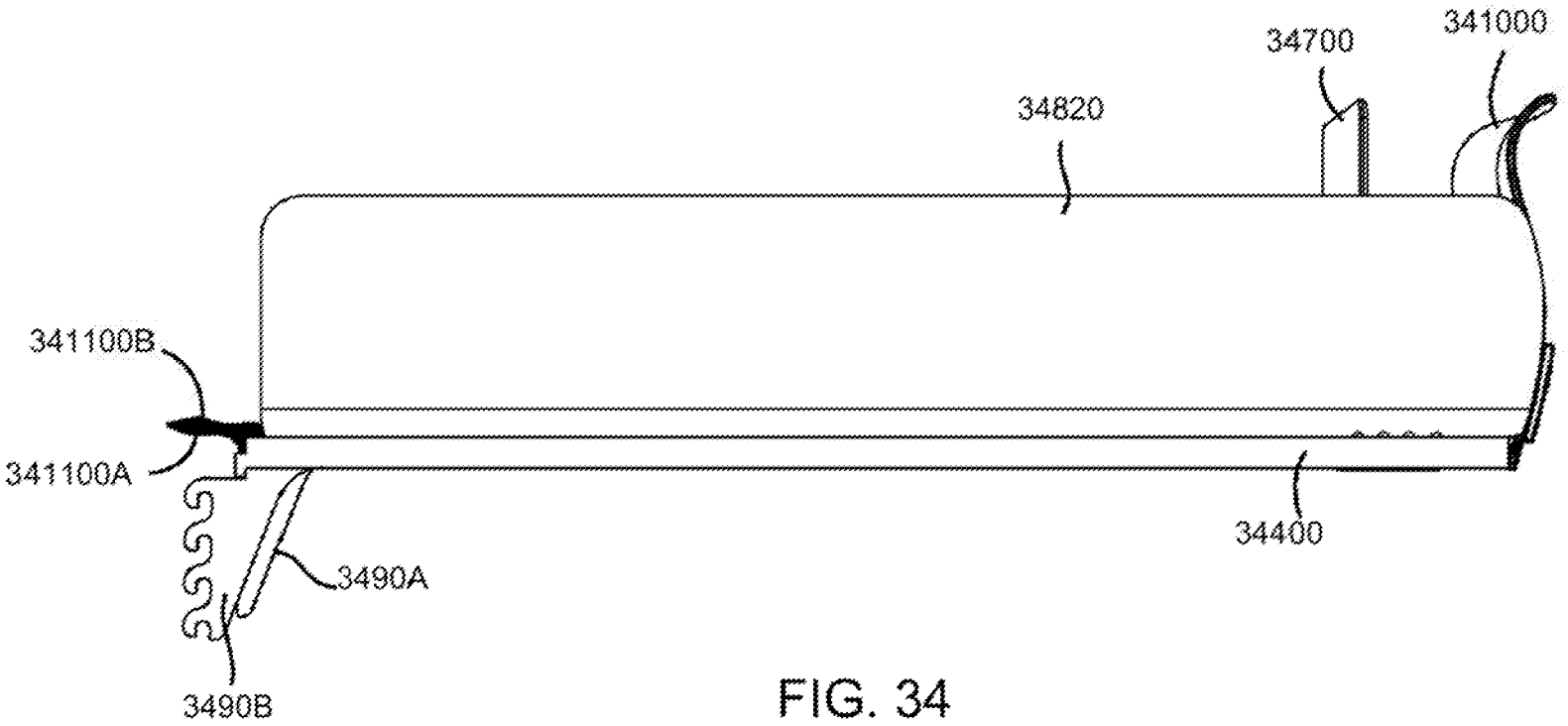
FIG. 34 is a side view of a ventilated merchandising system in accordance with the embodiment shown in FIG. 27.
Figure 35:
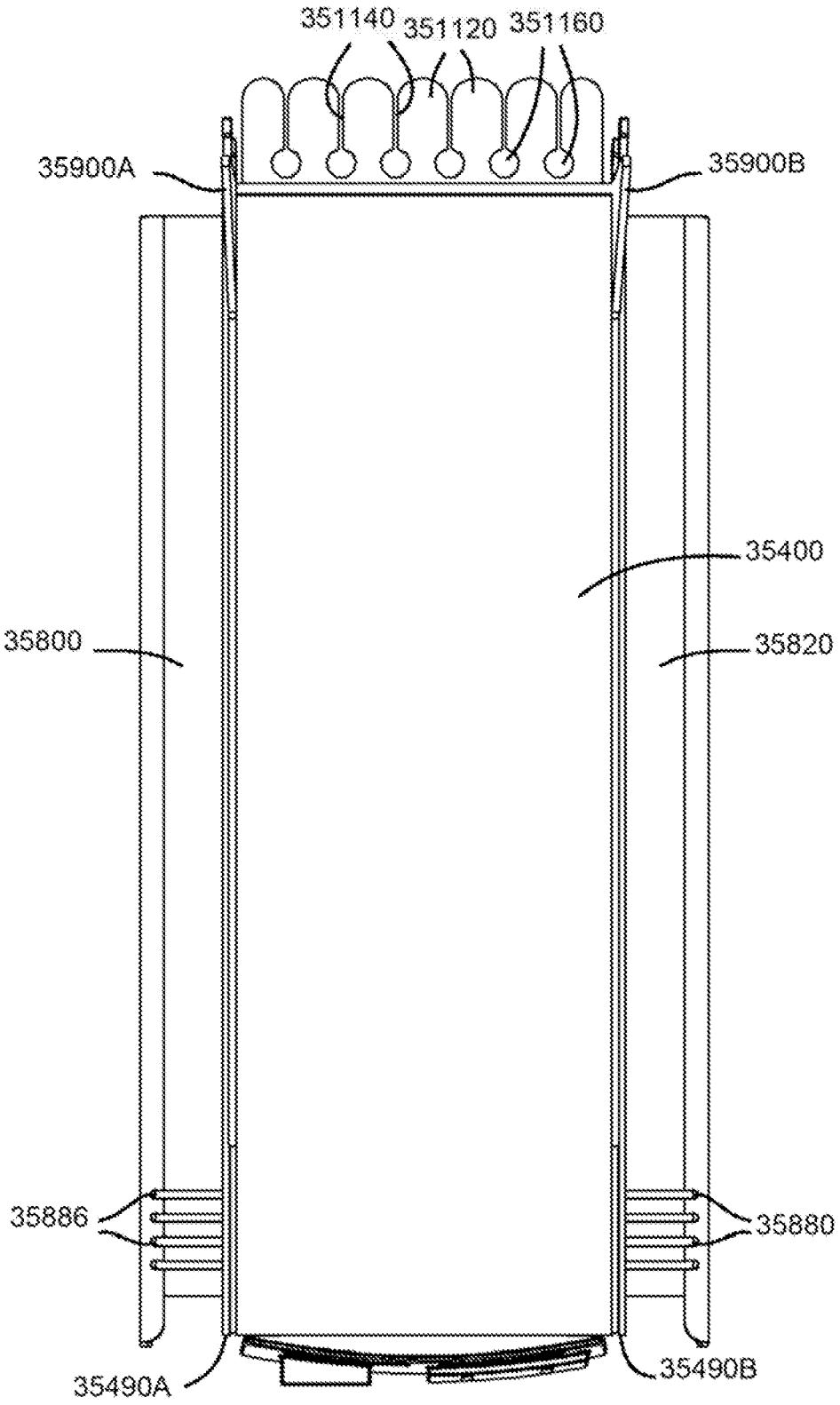
FIG. 35 is a bottom view of a ventilated merchandising system in accordance with the embodiment shown in FIG. 27.
Figure 36A:
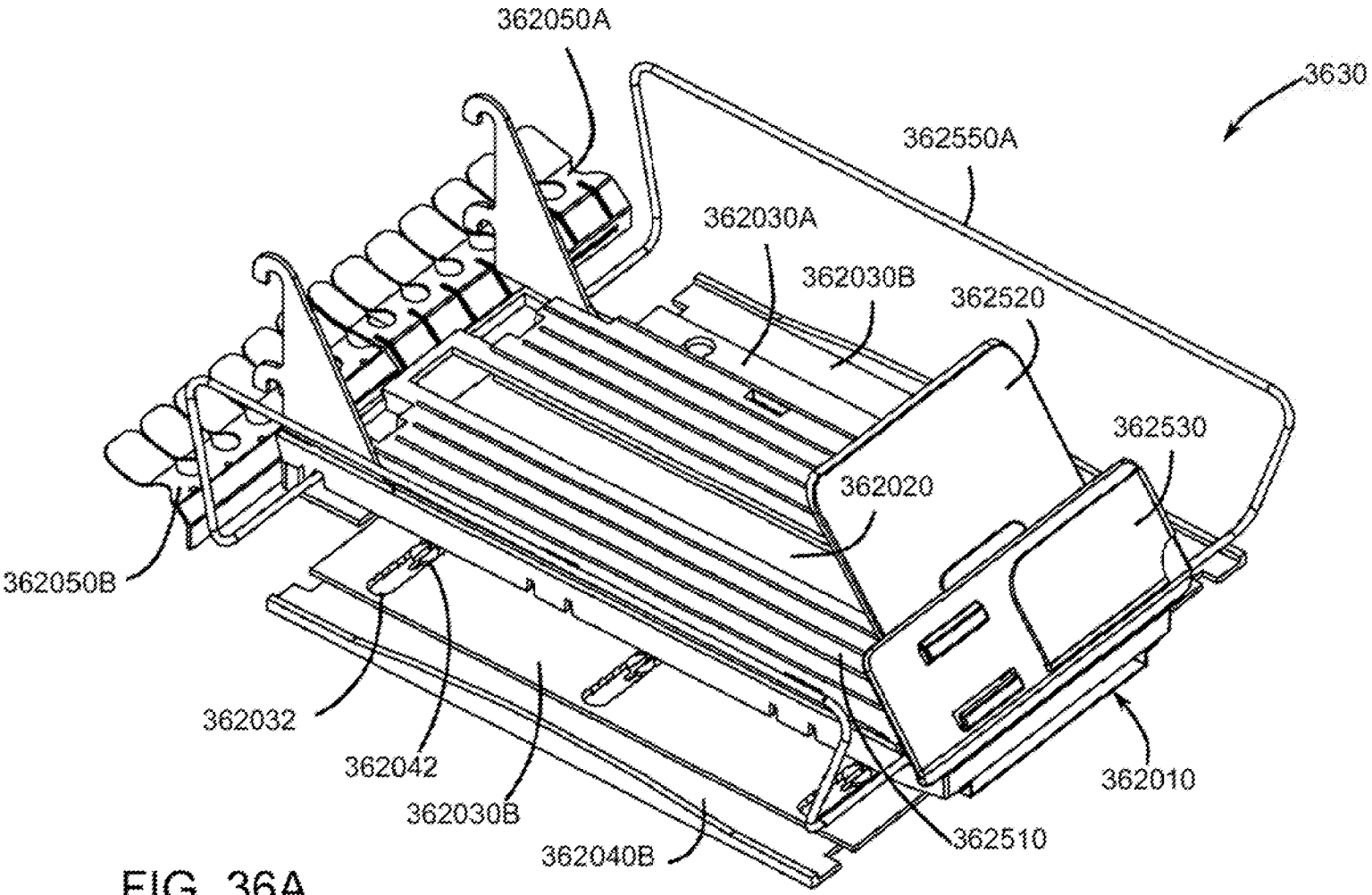
FIG. 36A is a perspective view of a baffle system coupled to a merchandising shelf in accordance with another embodiment of the present invention.
Figure 36B:
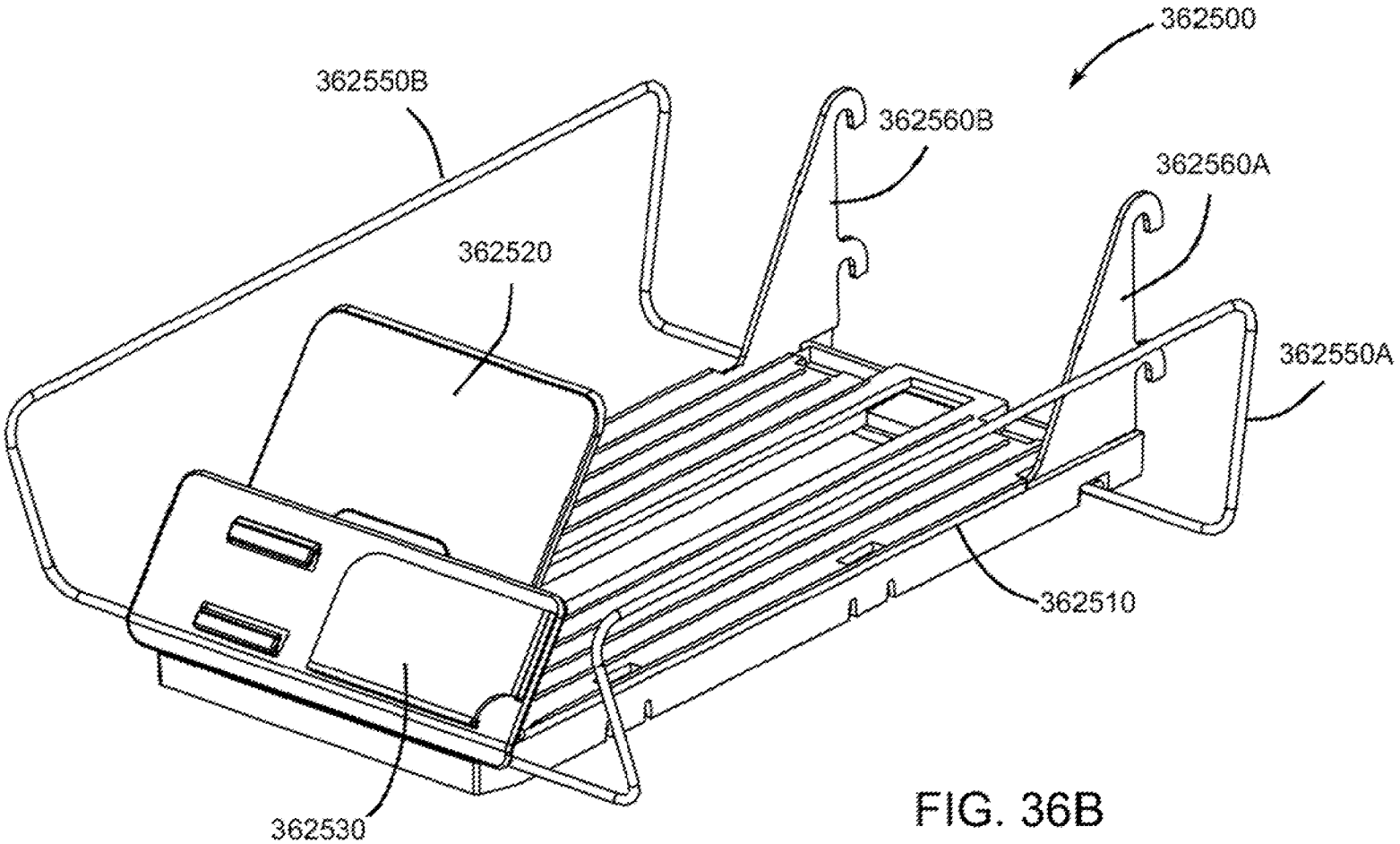
FIG. 36B is a perspective view of a standard merchandising shelf to which a baffle system may be coupled in accordance with the embodiment in FIG. 36A.

Similar to the embodiment including the pull-out features shown in FIGS. 8-26, the embodiment in FIGS. 27-35 includes adjustable side arms 27800 and 27820 to accommodate different sized products by positioning them nearer the tray 27600 and away from the tray 27600. As seen in FIG. 33, arms 27800, 27820 are coupled to the tray 27600 by flexible tabs 33840A, 33840B, 33860A, 33860B at the edges of each arm 27800, 27820. Tabs 33840A, 33840B, 33860A, 33860B fit into slots 28650 near the front and rear edges of tray 27600. When arms 27800, 27820 are in the first or unexpanded position, tabs 33840A, 33840B, 33860A, 33860B are fit into the centermost slots 28650 of the tray. To move the arms 27800, 27820 away from the tray 27600 to the extended position, a user can pull outward on the arms 27800, 27820 until the tabs 33840A, 33840B, 33860A, 33860B loosen from the slots 28650. When the arms 27800, 27820 are at the desired position, tabs 33840A, 33840B, 33860A, 33860B fit into the appropriate slots 28650 to secure that arms 27800, 27820 at the desired expanded position. Stationary side arms may also be used in lieu of movable arms 27800, 27820. Arms 27800, 27820 may also include vents 33880 to allow the cool air to easily travel to the front of the case 2420.

As seen in FIGS. 27-29, 32 and 33, tray 27600 includes a generally rectangular opening 27620 that extends along the length of the tray 27600. Similarly to the embodiment in FIGS. 8-26, a pusher plate 27700 snap-fits securely into the opening 27620 of the tray 27600. The pusher plate 27700 and a coil spring 28710, which fits into a trough 27740 of the pusher plate 27700, serve as means of biasing products toward the front of the tray 27600 as products are removed from the tray 27600. As seen in FIGS. 29-31 and 34-35, base 28400 may also include tracks 28490A, 28490B into which mounting brackets 28900A, 28900B can be fit. Mounting brackets 28900A, 28900B are slid into tracks 28490A, 28490B to mount system 830 on a wire grid system 2410 in the back of a case 2420 as shown in FIG. 24A and described above.

Similar to the embodiment shown in FIGS. 8-26, the embodiment of system 30 in FIGS. 20-28 also includes a front plate 1000. Front plate 1000 is coupled to the separator 28500 by inserting screws 281010 through holes 28505 in the separator and tightening into holes (not shown) in the front plate 271000. Front plate 271000 also has the curved shape and display surface and advantages of these features as described above with respect to the embodiment shown in FIGS. 8-26. Front plate 271000 further includes vents 281090 to allow cool air which enters at the rear of the system 830 to flow through and out of the front of the system 830 through the vents 281090 as described above.

In the embodiment shown in FIGS. 27-35, system 830 also can include one or more plenum plates 281100A, 281100B. As seen in FIGS. 27 and 29-31, these plenum plates 281100A, 281100B are the same as those described above with respect to previous embodiments, where each plenum plate 281100 has a plurality of fingers 311120, and plenum plates 311100A, 311100 are attached to base 31400 by channels 31495A, 31459B molded into the base 31400. Plenum plates 311100A, 311100B are also adjustable and can be adjusted to align with the positioning of the adjustable arms 27800, 27820, and adjustment also allows alignment of slits 311140 between fingers 311120 with the vertical grid wires 2414, where the grid wires 2414 fit in the voids 311160 in the plates 311100A, 311100B. In the same way as described above and as seen in FIGS. 23 and 24, the fingers 311120 act to capture cold air which would otherwise drop behind the products (as shown by the lines C3) and guide the cold air into the gap 31440 in the system 830 (shown by the arrow A1) to promote better cooling of the products displayed on the system 830. As with other embodiments, the system 830 is also effective without the plenum plates.

The embodiment shown in FIGS. 27-35 fits into the same types of cases 2420 in the same way as described above and has the same features and advantages as described above. It allows proper cooling of the products through circulation of cold air under the products (A1) in one easy-to-install, versatile, space-saving system 830. If used, the fingers 311120 of the plenum plates 311100A, 311100B help capture the falling cold air (C3) and direct it into the back of the system 830, above the rear of the base 31400, and through the gap 31440 beneath the products displayed on the system 830. The cold air then exits the front of the system 830 through the vents 281090 in the front plate 271000 aligned with the gap 31440. By directing the cold air to flow beneath the displayed products, the food is more directly cooled than in traditional systems, without the use of baffles.

In yet another embodiment of the system 830 shown in FIGS. 36-46, a baffle system 372000 is added to a standard merchandising system 362500 to allow cold air to move under the products as described above and shown in FIGS. 23-26. FIG. 36B shows one example of a standard merchandising shelf 362500 to which a baffle system 372000 may be added. The shelf may include a tray 362510, a pusher plate 362520, a front plate 362530, a coil spring 412540, side arms 362550A, 362550B which may be adjustable, and mounting brackets 362560A, 362560B. Other configurations of merchandising systems with additional or modified components may also be used with a baffle system 372000. By fitting a standard shelf 362500 with a baffle system 372000 as shown in FIG. 36A, cooling of the products on the shelf 362500 by directing cold air through the baffle system 372000 beneath the products may be accomplished without the need to purchase an entirely new self-ventilating merchandising system. A baffle system 372000 as shown in FIGS. 37-46 would provide all of the advantages described with respect to the other embodiments contemplated herein (such as proper cooling of products, varied arrangements of shelves in the cases, ventilation without the need for troublesome stand-alone baffles placed between shelves, etc.), but could also be easily coupled to standard merchandising shelves 362500 already in use in refrigerator or freezer cases.

Figure 37:
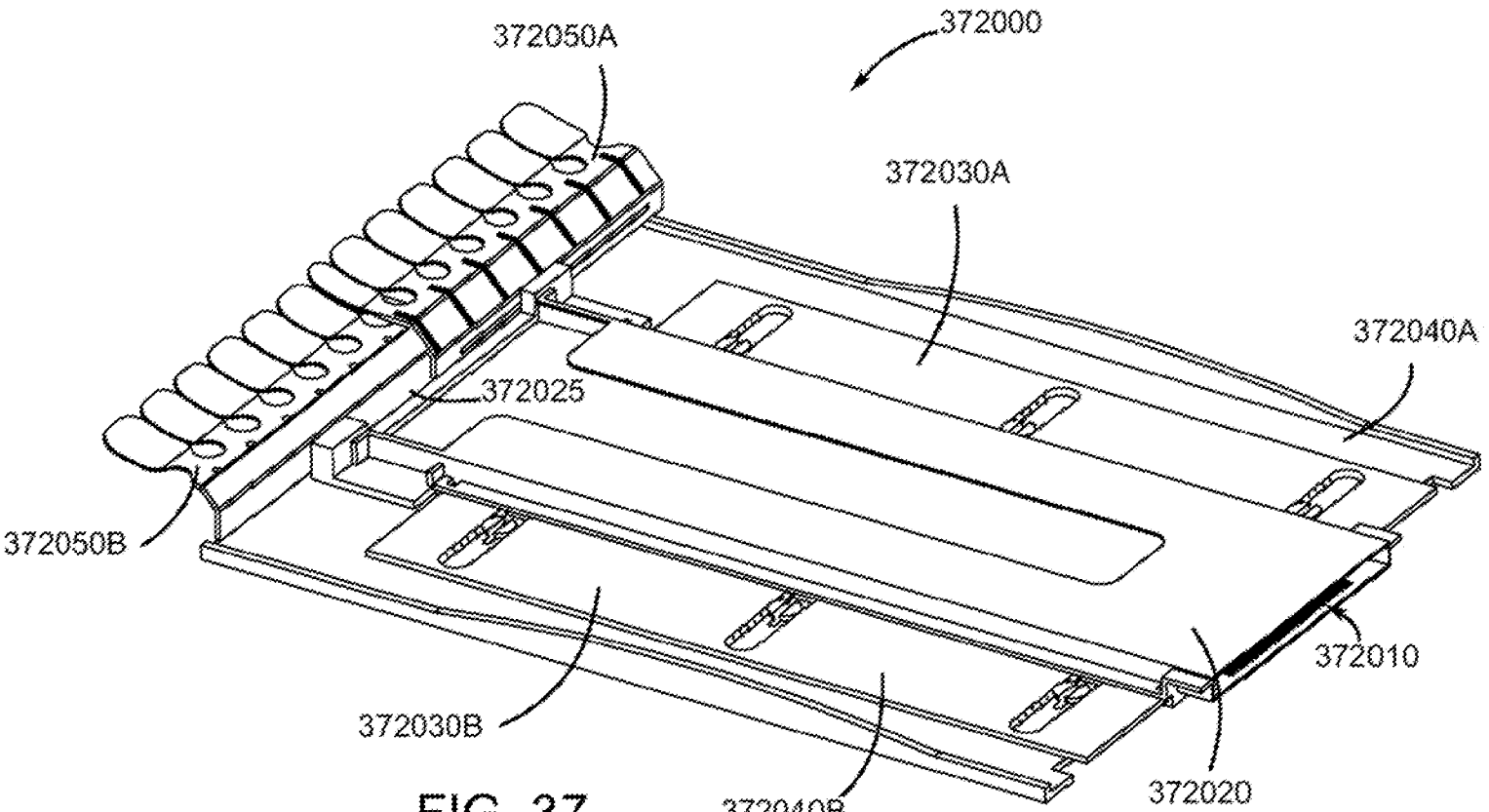
FIG. 37 is a perspective view of a baffle system in accordance with the embodiment in FIG. 36A.
Figure 38:
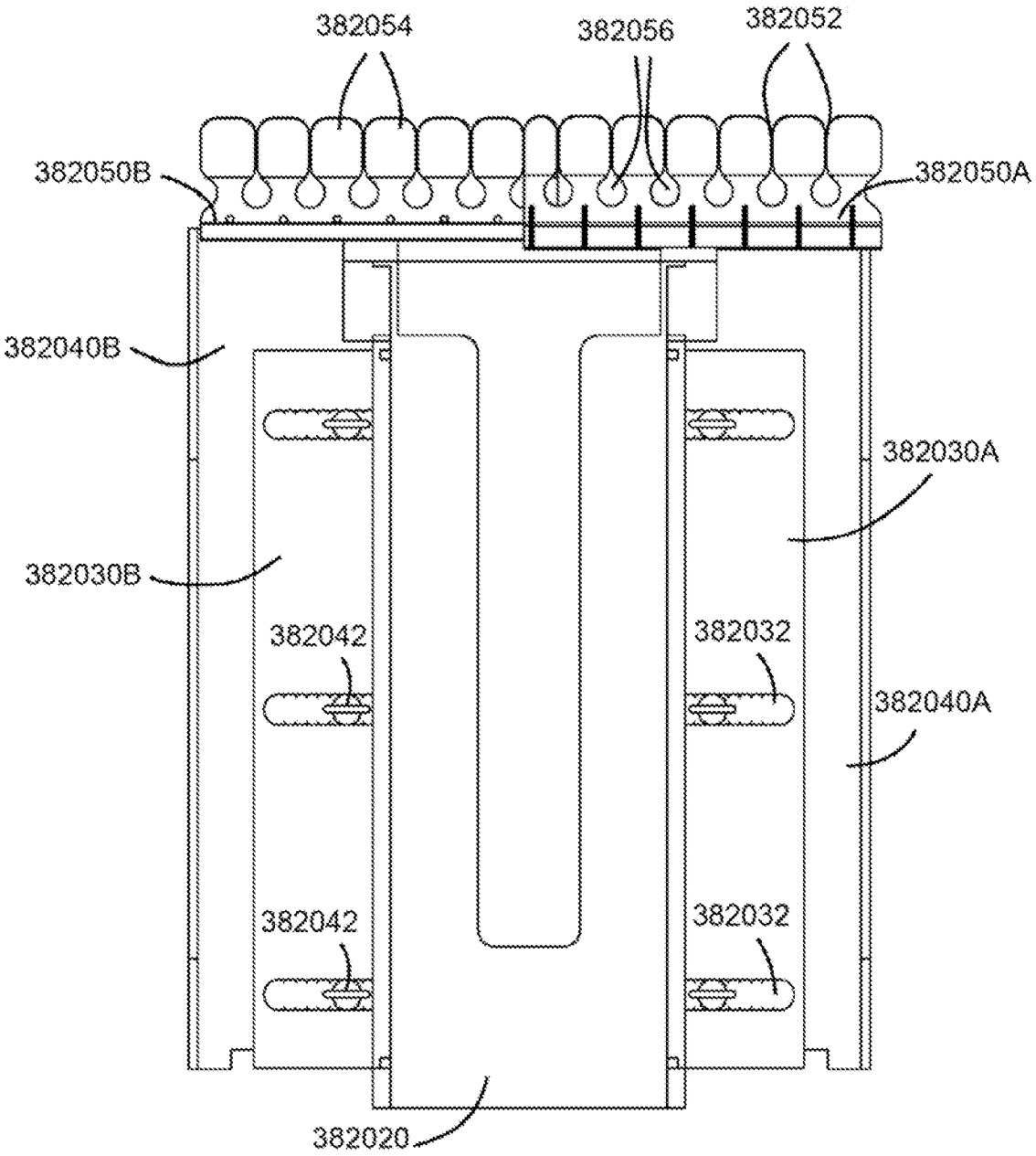
FIG. 38 is a top view of a baffle system in accordance with the embodiment in FIG. 36A.
Figure 39:
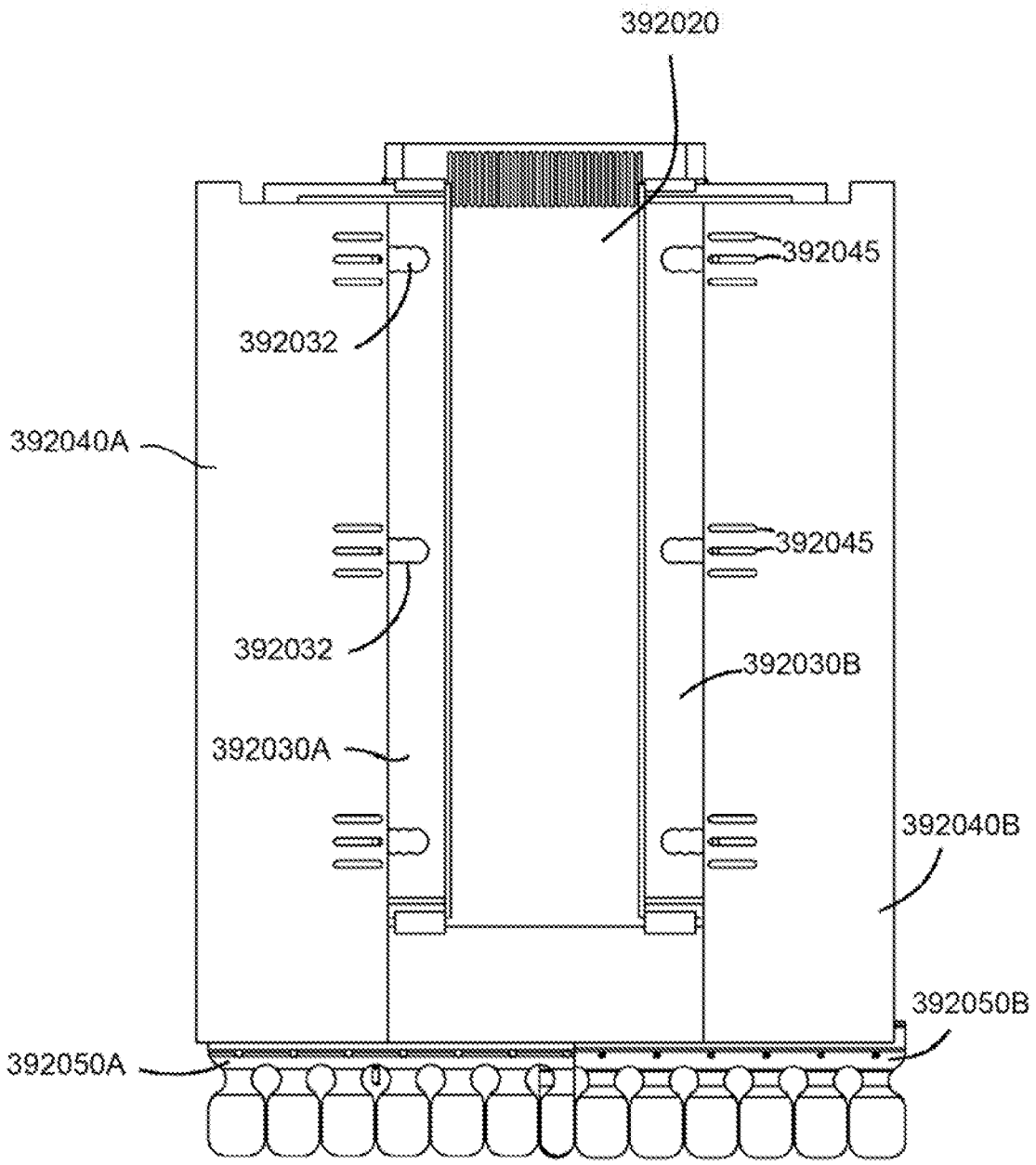
FIG. 39 is a bottom view of a baffle system in accordance with the embodiment in FIG. 36A.
Figure 40:
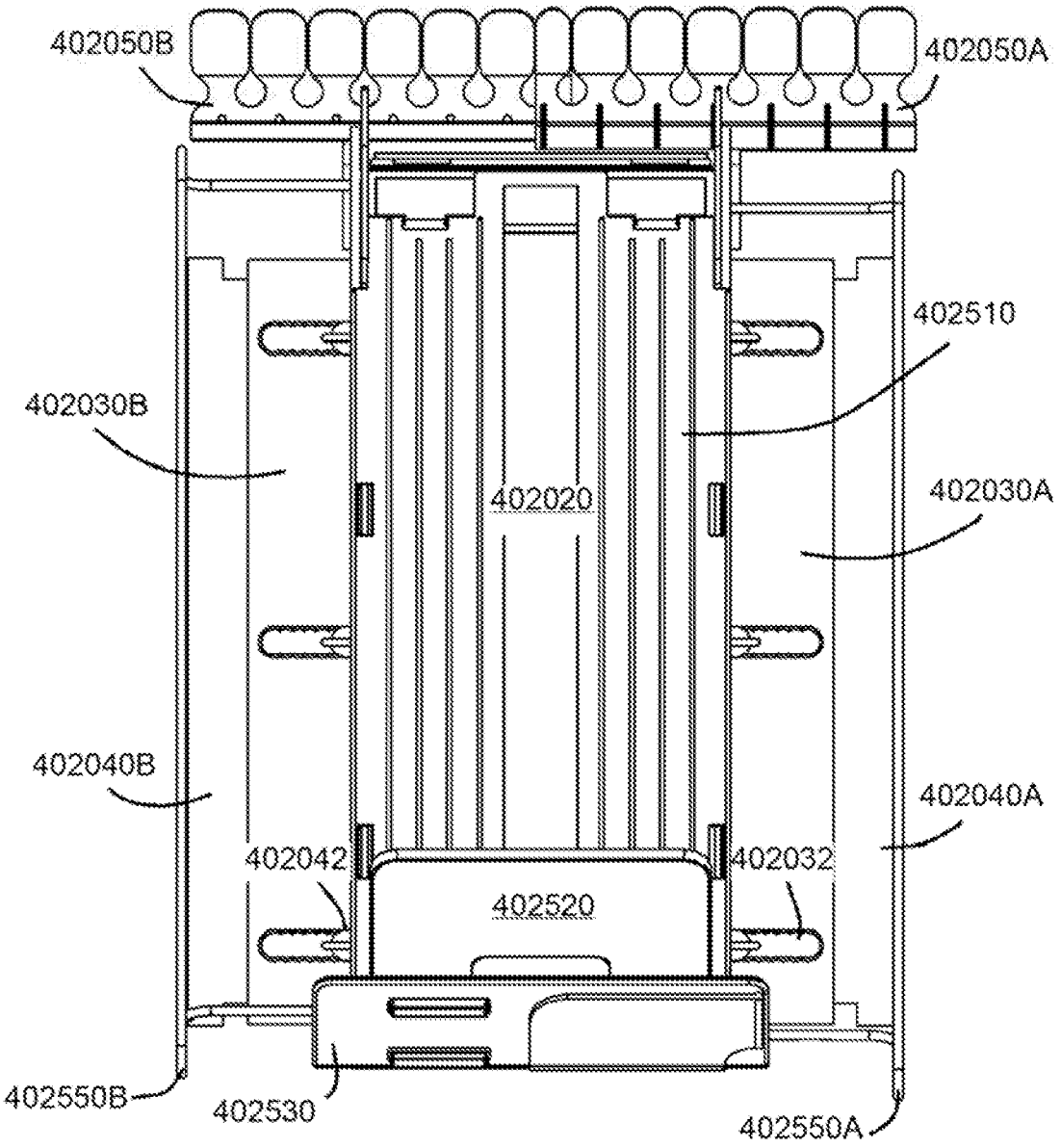
FIG. 40 is a top view of a baffle system coupled to a merchandising shelf in accordance with the embodiment in FIG. 36A.

One embodiment of a baffle system 372000 in accordance with the embodiment shown in FIGS. 36-46 that can be added to a standard merchandising shelf 362500 is shown in FIGS. 37-39. Baffle system 372000 includes baffle base 372020, baffle wings 372030A, 372030B, wing extensions 372040A, 372040B, and plenum plates 372050A, 372050B. Baffle base 372020 snap-fits onto the merchandising shelf 362500, and as seen in FIGS. 36A and 40-46, assembled baffle system 372000 works to direct air from the back of the cooler beneath products on the shelf 362500 to provide direct cooling to the products. Baffle base 372020 includes slots 372025 into which plenum plates 372050A, 372050B can be slidably fit and allows slidable adjustment of the plenum plates 372050A, 372050B.

Baffle wings 372030A, 372030B snap-fit onto baffle base 372020. As seen in FIGS. 37-39, openings 382032 in wings 382030A, 382030B are used to movably attach wing extensions 382040A, 382040B to each wing 382030A, 382030B. Tabs 382042 on the wing extensions 382040A, 382040B friction fit into the openings to allow wing extensions 382040A, 382040B to slide toward and away from the center of the baffle base 382020. This allows wing extensions 382040A, 382040B to be adjusted to accommodate larger products which extend beyond the tray 362510 and are held in place by extendable side arms 362550A, 362550B and ensure that cold air directed by the plenum plates 372050A, 372050B (also adjustable to line up with larger products extending beyond the tray 362510) is directed beneath the entire product area. Thus, plenum plates 372050A, 372050B, wing extensions 372040A, 372040B and arms 362550A, 362550B of the shelf 362500 can all be adjusted to accommodate products of varying sizes to ensure that cold air is properly directed beneath the products. Wing extensions 372040A, 372040B may also include vents 372045 to allow further circulation of cold air beneath products on the tray 362510 above.

As seen best in FIG. 37, baffle base 372020 includes a gap 372010. Similar to the other embodiments shown and described herein, the plenum plates 372050A, 372050B in this embodiment capture the falling cold air (C3) and direct it into the back of the system 830, through the gap 372010 beneath the products displayed on the merchandising shelf 362500. In the same way as described above and as seen in FIGS. 23 and 24, the fingers 382054 of the plenum plates 372050A, 372050B act to capture cold air which would otherwise drop behind the products (as shown by the lines C3) and guide the cold air into the gap 372010 in the system 830 (shown by the arrow A1) to promote better cooling of the products displayed on the system 830. By directing the cold air to flow beneath the displayed products, the food is more directly cooled than in traditional systems. Plenum plates 372050A, 372050B, as seen in FIGS. 43-49, are adjustable, and adjustment allows alignment of slits 382052 between fingers 382054 with the vertical grid wires 2414, where the grid wires 2414 fit in the voids 382056 in the plates 382050A, 382050B. Thus, when plenum plates 382050A, 382050B are adjusted to accommodate products of varying sizes on the shelf 362500, the slits 382052, fingers 382054, and voids 382056 ensure that the system 830 can be attached to a grid.

While the embodiments discussed above cover numerous different types of merchandisers and, in particular, several types of pull-out tray merchandisers that are configured to mount to bars, grids and/or vertical gondola uprights, it should be understood that in alternate forms, any of these embodiments may be provided in a shelf-mounted version. In an effort to provide such flexibility without requiring that an entirely separate tray be constructed for on-shelf embodiments (e.g., separate base, separate tooling or molding, etc.), various shelf-mounting accessories will now be discussed which may be used in connection with any one of the above-identified embodiments and/or which may be combined with one or more features from any or all of the above-identified embodiments to come-up with even more embodiments. An exemplary embodiment of such a shelf-mounting accessory is illustrated in FIGS. 52A-F, which shows the accessory connected to a pull-out tray similar to the one illustrated in FIGS. 8-51B in order to make a shelf-mounted version of the tray. In FIGS. 52A-F, the shelf-mounted tray assembly is referred to generally by reference numeral 52100 and includes a base 52110, a tray 52120 movably connected to base 52110 and having adjustable width left and right wings 52122*a* and 52122*b*, respectively, pusher assembly or paddle 52130 to front face the products disposed in the product channel of tray 52120 via a spring (not shown) like the embodiments discussed above, and a front fence or lens 52140. Unlike the embodiments discussed above, however, the tray assembly 52100 further includes a shelf-mounting accessory that can be coupled to the tray assembly 52100 to allow the tray assembly 52100 to be mounted to a conventional retail store shelf or shelving unit.

In the form shown in FIGS. 52A-F, the shelf-mounting accessory includes a first spacer, such as first riser 52160 and an end bracket 52180. The riser 52160 is used to provide space below the tray assembly 52100 so as to access the tray actuator or release button 52120*a*. This spacing also forms an air channel below the merchandiser 52100 which can assist air circulating over or through the shelving unit to keep all of the product stored within the product channel between the left and right wings 52122*a*, 52122*b*, respectively, more uniformly cooled or chilled and preventing just the products on either end of the product channel from staying cool as compared to the remainder of the products in the product channel. Thus, the gap created between the tray assembly 52100 and the upper surface of the shelf via first riser 52160 serves as a baffle or air duct to promote proper circulation of air when the unit 52100 is used in a refrigerated or cooled/chilled setting or environment (e.g., such as in an open-air cooler).

In the form illustrated, the riser 52160 is a molded plastic part that has at least two legs extending down from opposite sides of the tray (generally below the left wing 52122*a* and right wing 52122*b*, respectively, at least when the wings are in their narrow most setting). In a preferred form, the riser 52160 will include four legs extending down from opposite corners of the riser 52160 in order to provide greater structure strength and stability to the riser 52160 and tray assembly 52100.

Figure 52A:
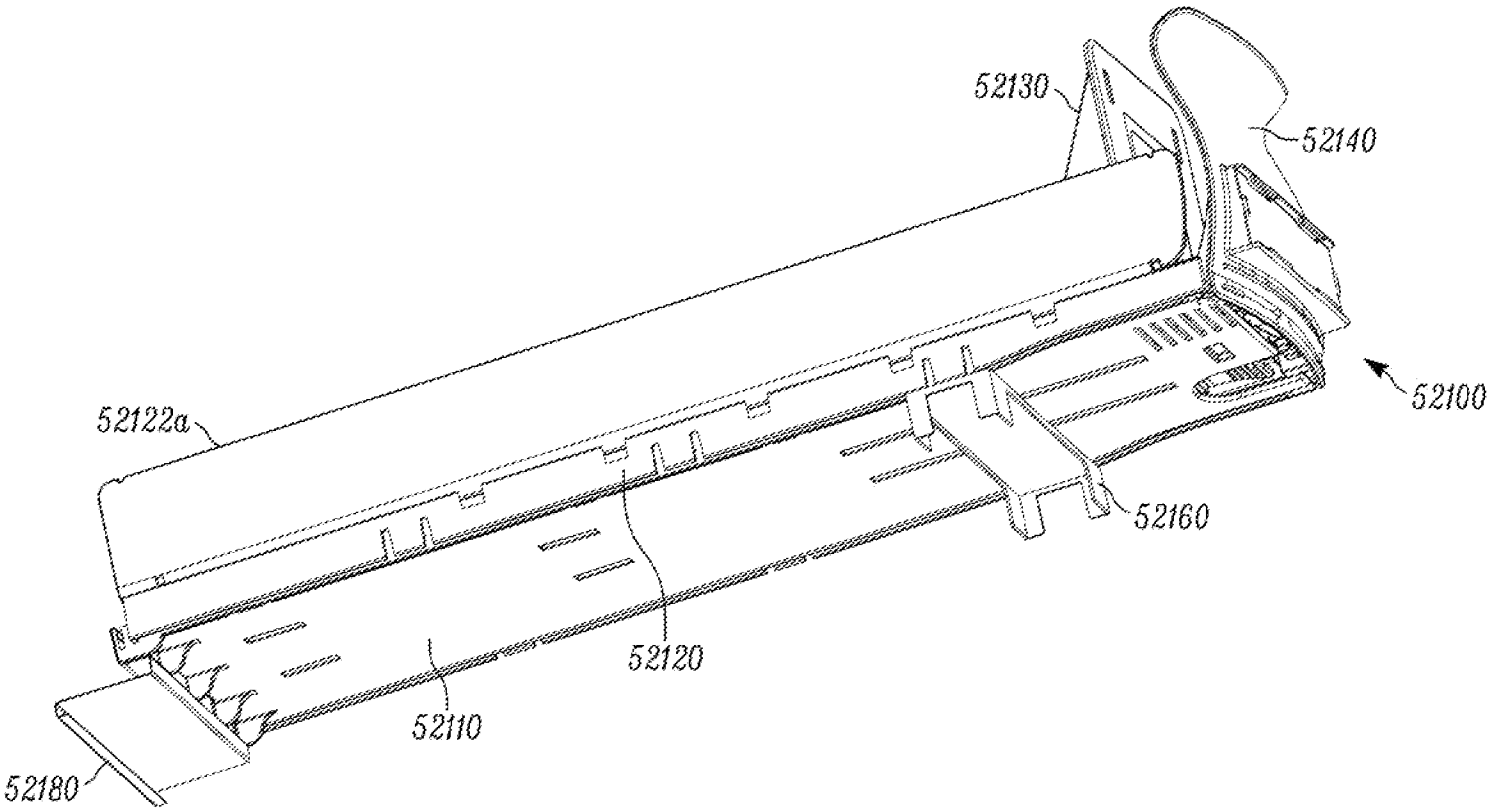
FIGS. 52A-F are front bottom perspective, side bottom perspective, bottom rear perspective, top rear perspective, bottom front perspective, and left-front perspective views, respectively, of another embodiment of a shelf-mounted pull-out tray merchandiser in accordance with aspects of the invention.
Figure 52B:
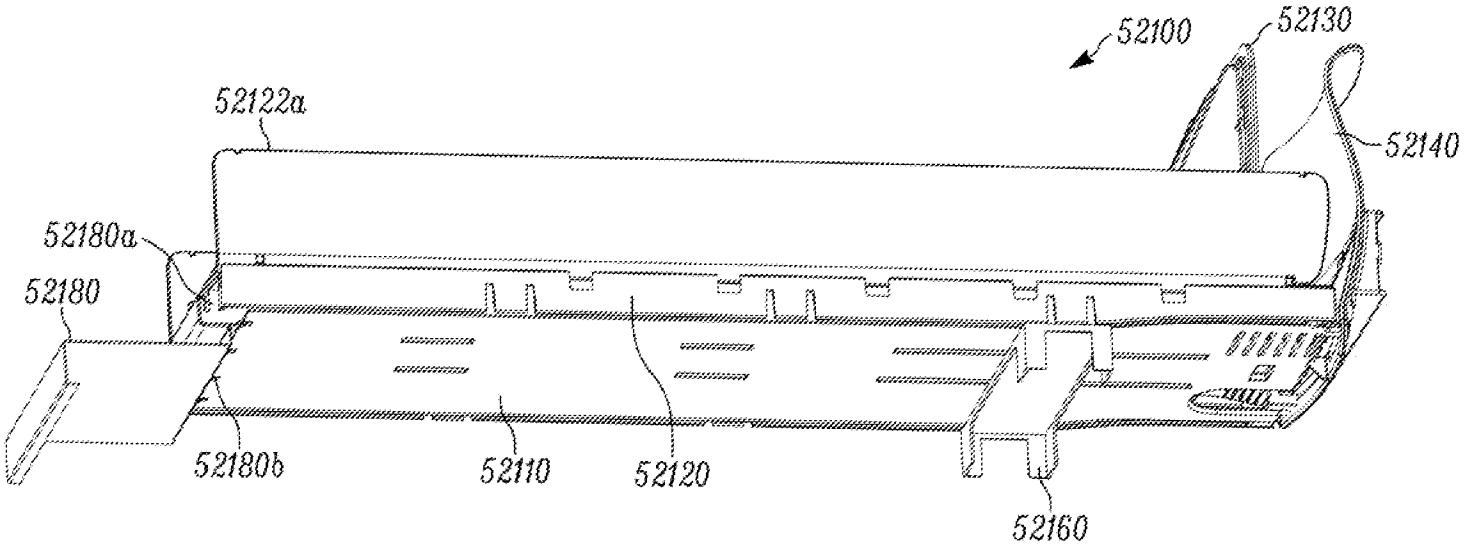
Figure 52C:
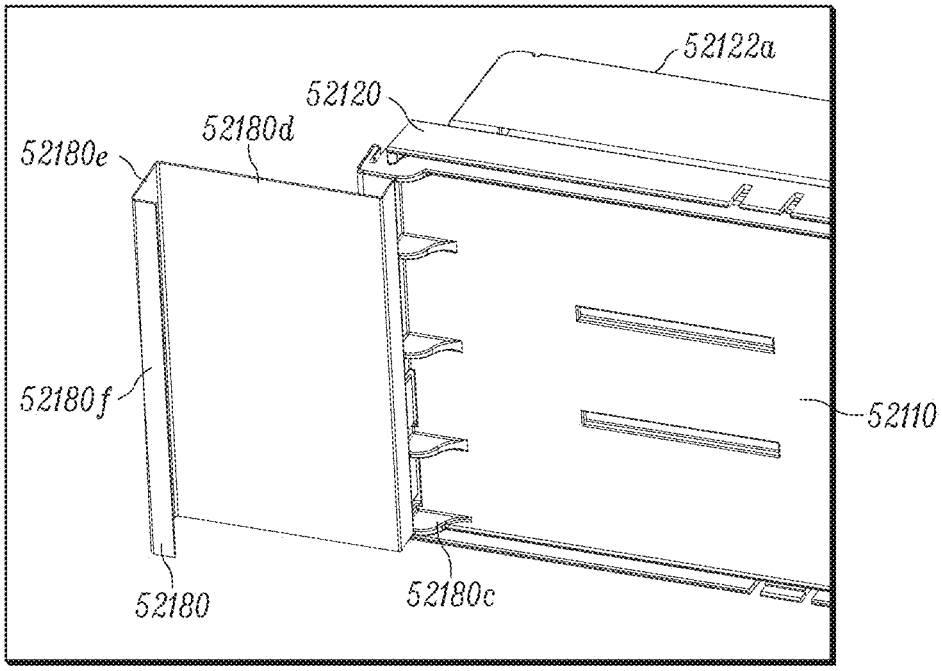
Figure 52D:
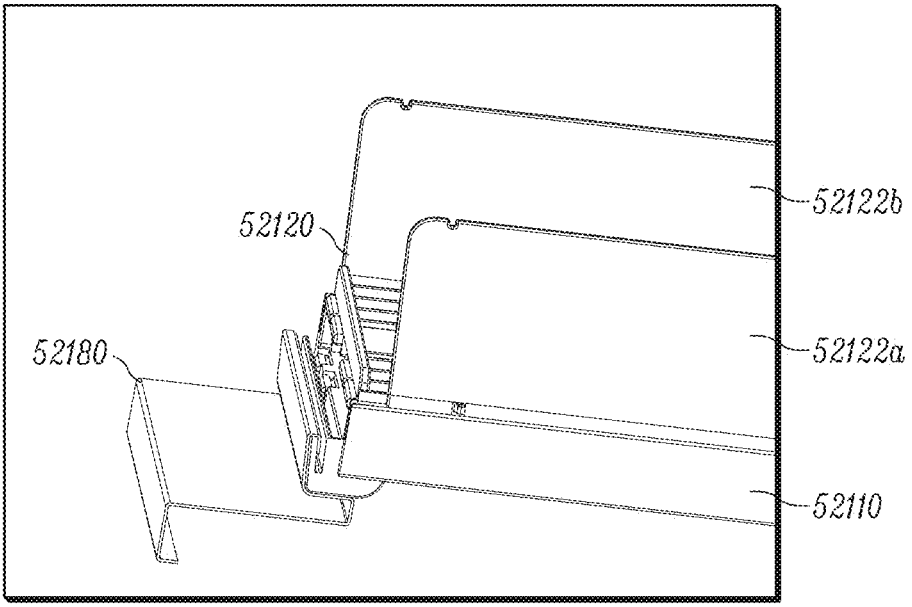
Figure 52E:
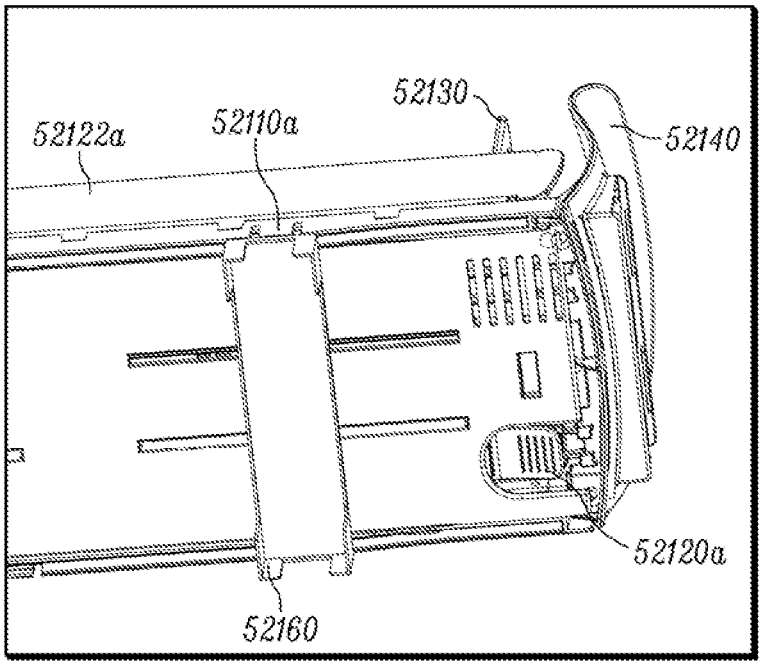
Figure 52F:
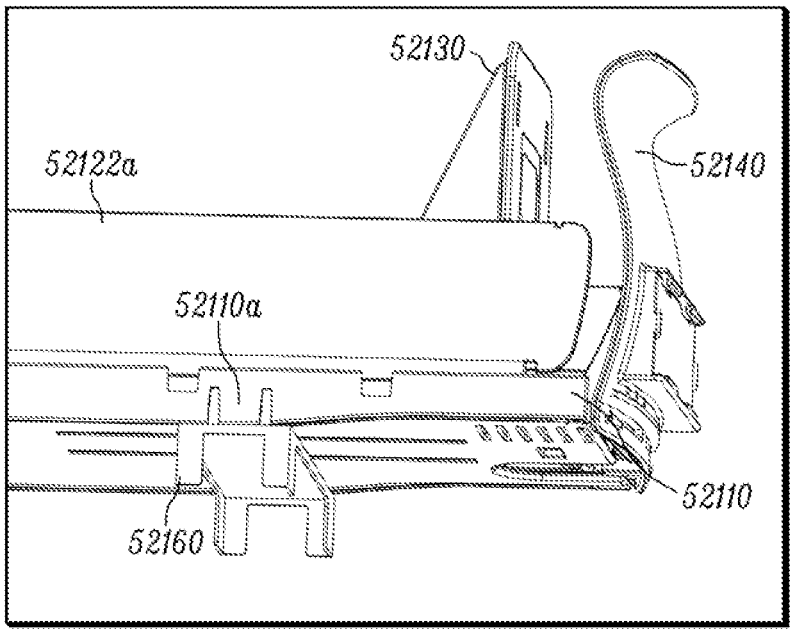

In order to make the riser accessory 52160 usable with respect to the tray assembly 52100 without requiring the tray assembly 52100 to take on a different shape or form (which would require additional tooling or molds, or at least changes to same), the riser is configured with mating recesses located on opposite sides of the riser 52160 that receive the male mating members existing on the tray assembly 52100, best seen in FIGS. 52E-F. The left male mating member 52110*a* is a hook or prong that is deformable and capable of moving between a first normally biased position and a second flexed position to allow a solid portion of riser 52160 to pass inside of the male member 52110*a*, but once the hook of the male member 52110*a* is aligned with the recess formed in the side of the riser 52160, the male mating member moves back towards its first normally biased position to engage the riser 52160 and secure it to the base 52110. A similar male mating member is located on the right side of the base 52110 and a similar recess is located on the right side of the riser 52160, however, these are not visible in the illustrations shown in FIGS. 52A-F.

Figure 63:
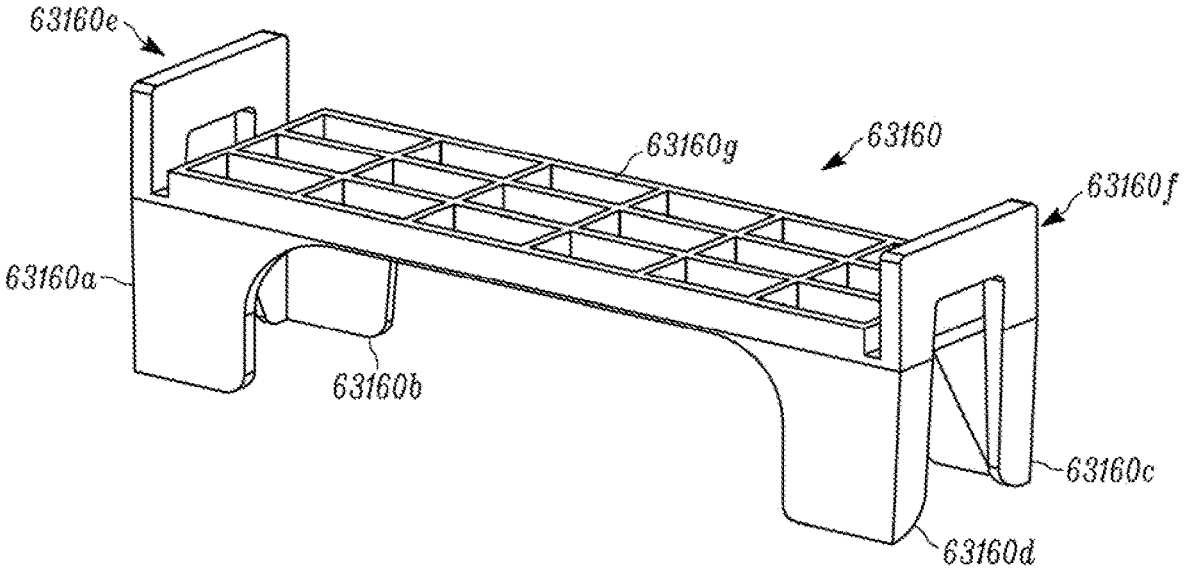
FIG. 63 is a perspective view of a shelf-mounting accessory for a pull-out tray in accordance with other embodiments of the invention.

In a preferred form, the riser 52160 will take the form of riser 63160 in FIG. 63. As illustrated in that drawing, the riser has four legs 63160*a*, 63160*b*, 63160*c* and 63160*d* (e.g., left front leg, left rear leg, right rear leg and right front leg, respectively), which extend down from opposite sides 63160*e*, 63160*f* of a main body member 63160*g*. The sides 63160*e* and 63160*f* further define the above-mentioned recesses in the upper portion thereof for receiving the male mating member 52110*a* from base 52110. Riser 63160 is preferably made of an injection molded plastic and, thus, has a design that is easier to mold (e.g., rounded edges or gentle curves instead of sharp edges, tapering or draft to assist in removal from mold, etc.).

In addition to the riser accessory 52160, the shelf mounting accessory of assembly 52100 in FIGS. 52A-F further includes a rear member, such as bracket 52180, which extends from a rear of the tray assembly 52100 and secures the tray assembly 52100 to a rear portion of the shelf the tray assembly 52100 is mounted on. In the form illustrated, the bracket 52180 both secures the tray assembly 52100 to the rear of the shelf and serves to space the rear of the tray assembly 52100 from the upper surface of the shelf (such as riser 52160 does for the forward portion of the tray assembly 52100). In the form illustrated, the bracket 52180 includes a mating member 52180*a* for mating the bracket 52180 to the rear of the base 52110 of tray assembly 52100. The bracket 52180 extends down from the mating member 52180*a* and forms a shelf 52180*b*. From there the bracket extends down again to form a spacer portion 52180*c* and a shelf engaging portion or foot 52180*d* that extends back toward the rear portion of the shelf. The bracket 52180 then extends down again to form a rear portion or rear bracket portion 52180*e* of bracket 52180 and bends back forward to form a return portion 52180*f*. Together the foot 52180*d*, end portion 52180*e* and return portion 52180*f* form a generally U-shaped structure rotated ninety degrees so as to have an open side face which extends around a rear portion of conventional gondola shelving in order to secure the tray assembly 52100 to the shelf or shelf assembly.

Figure 53:
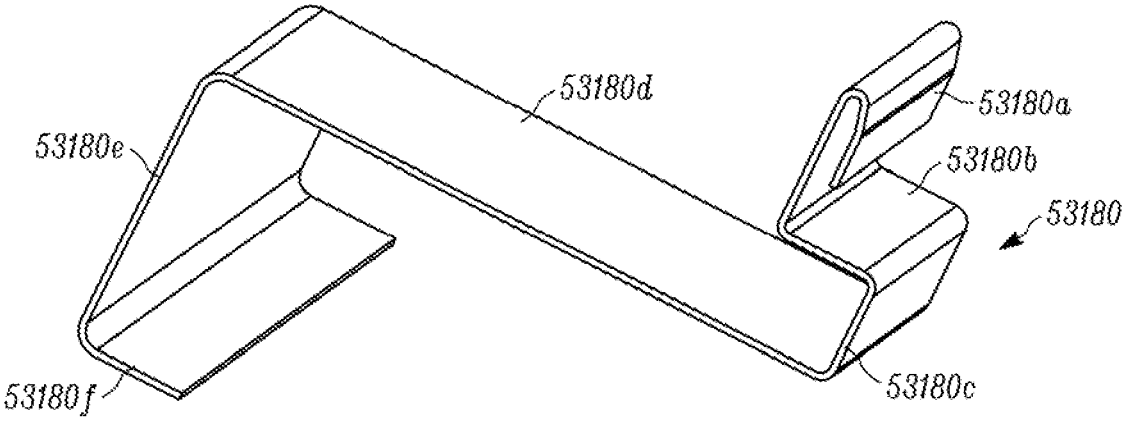
FIG. 53 is a side perspective view of the rear bracket illustrated in FIG. 52A for securing the merchandiser to a shelf.
Figure 54A:
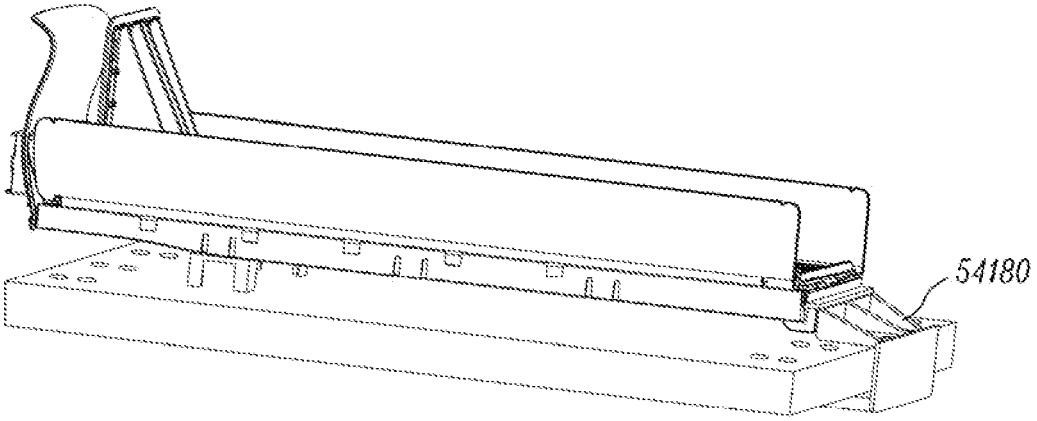
FIGS. 54A-E are right-side perspective, rear-right perspective, bottom rear-left perspective, front left-side perspective and bottom front perspective views, respectively, of another embodiment of a shelf-mounted pull-out tray merchandiser in accordance with other aspects of the invention, illustrating the merchandiser connected to a side of the shelf (instead of the usual rear of the shelf) for illustrative purposes.
Figure 54B:
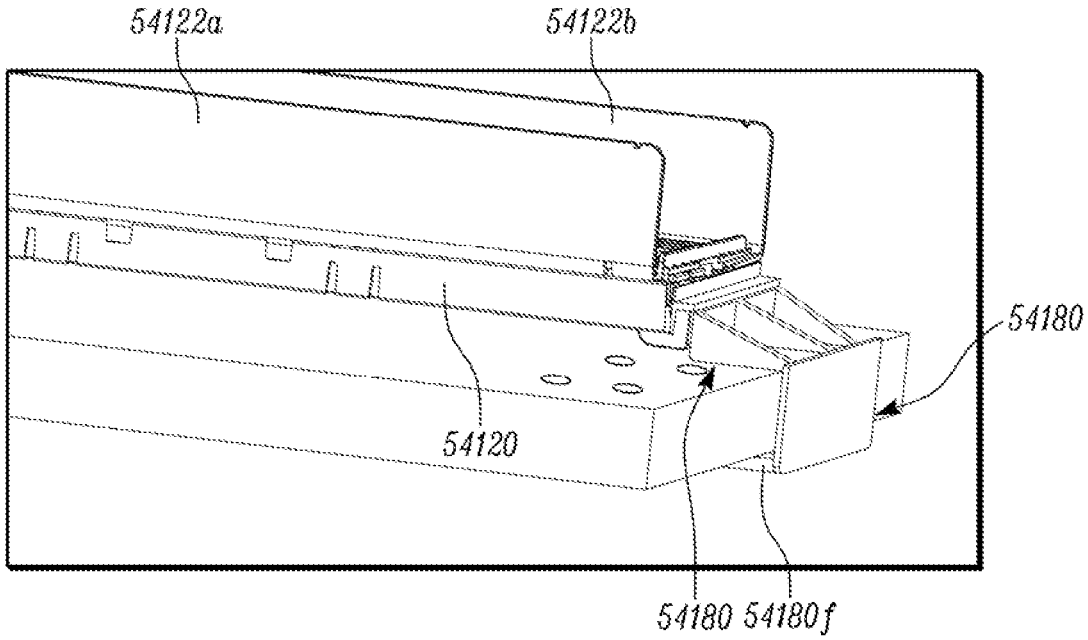
Figure 54C:
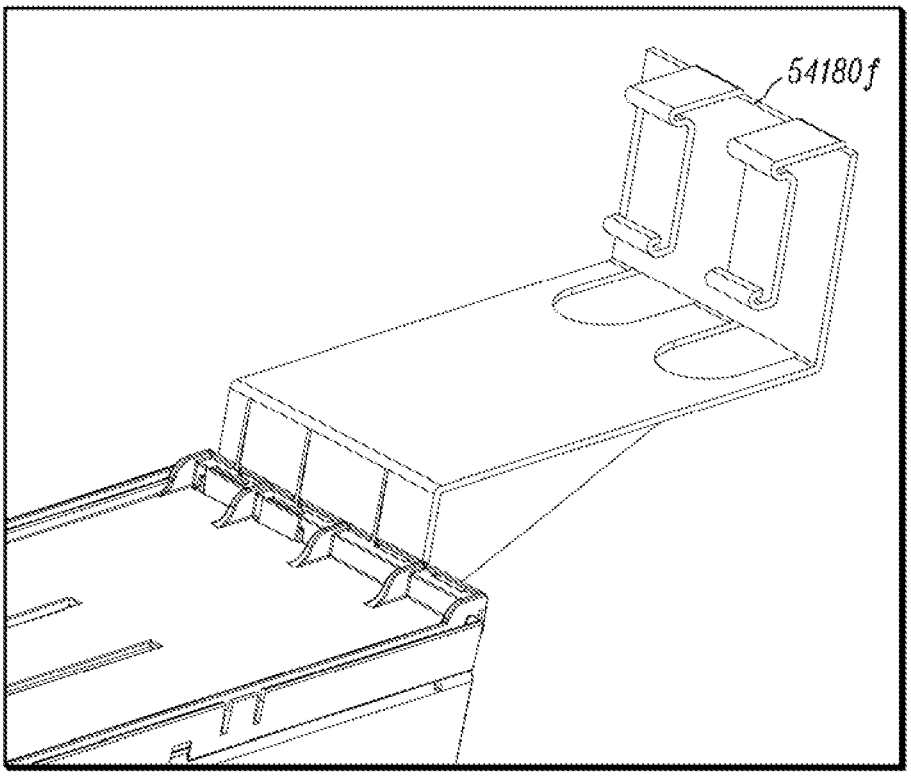
Figure 54D:
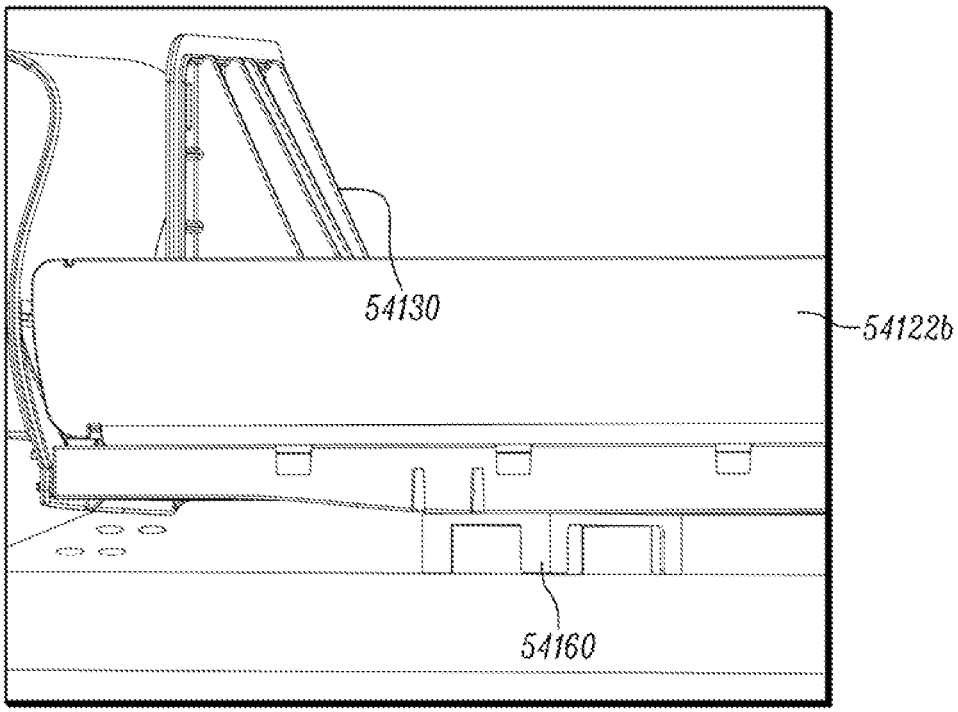
Figure 54E:
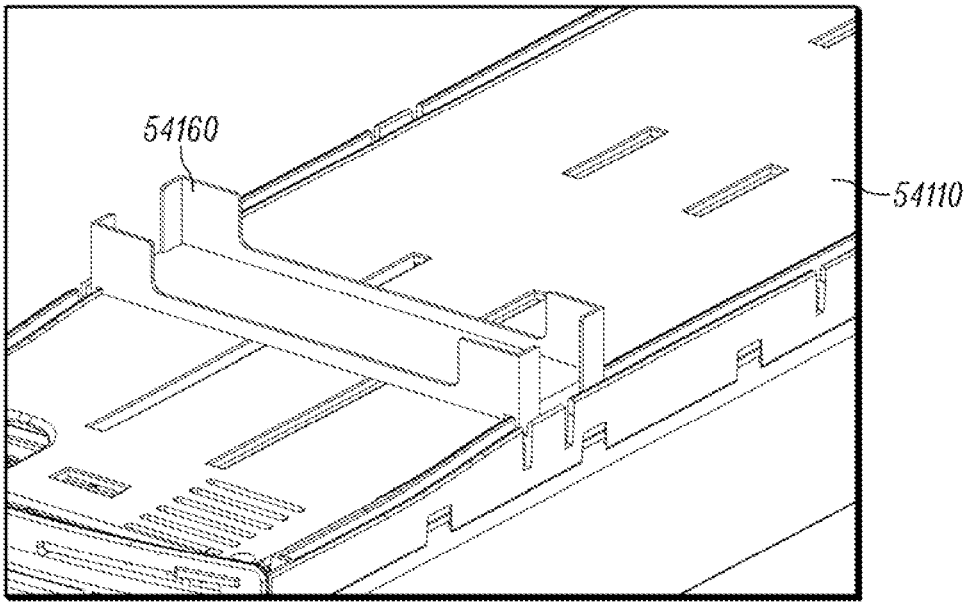
Figure 55A:
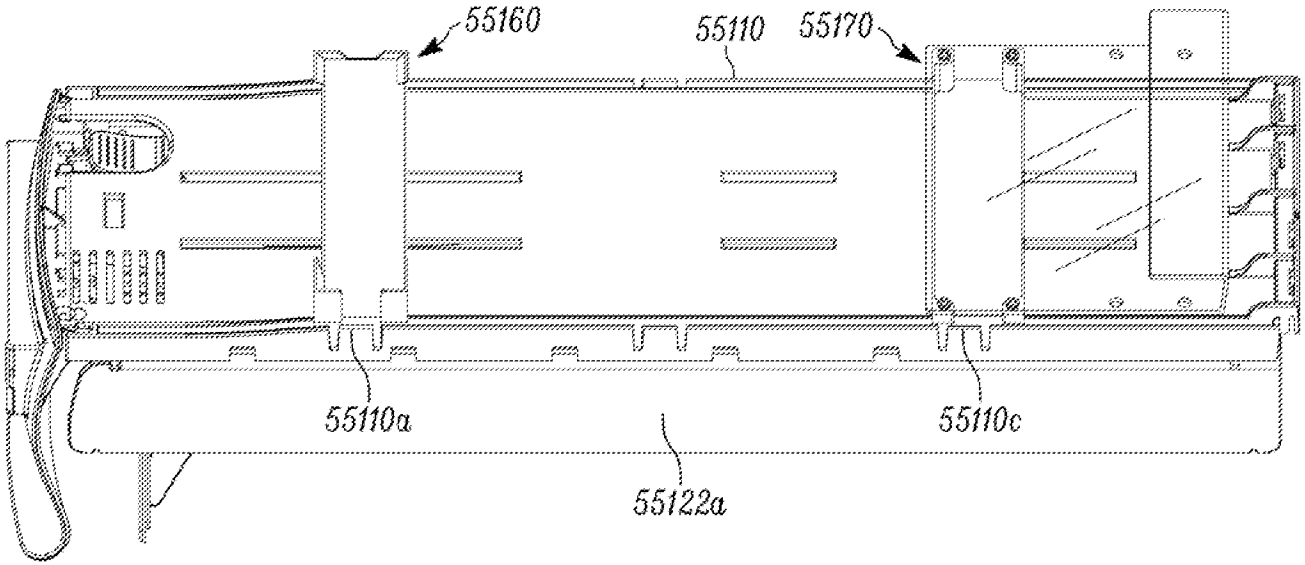
FIGS. 55A-E are additional views of an alternate embodiment of a shelf-mounted pull-out tray merchandiser in accordance with aspects of the invention, with FIGS. 55A-B being bottom side perspective and bottom rear perspective views, respectively, and FIGS. 55C-E being side perspective, front perspective and side close-up views of the rear spacer accessory illustrated in FIGS. 55A-B and illustrating a rear bracket that does not extend beyond the rear end of the merchandiser.
Figure 55B:
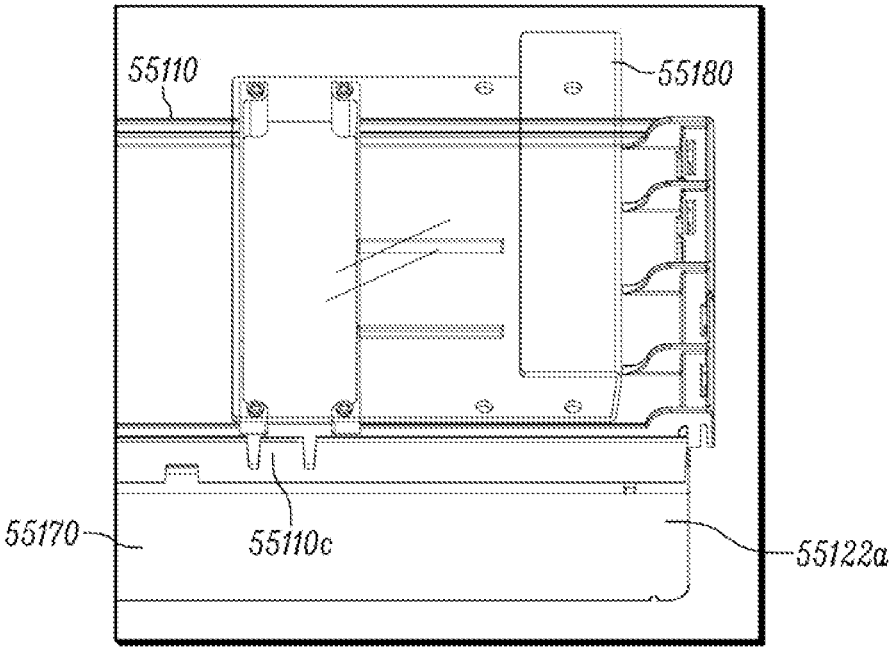
Figure 55C:
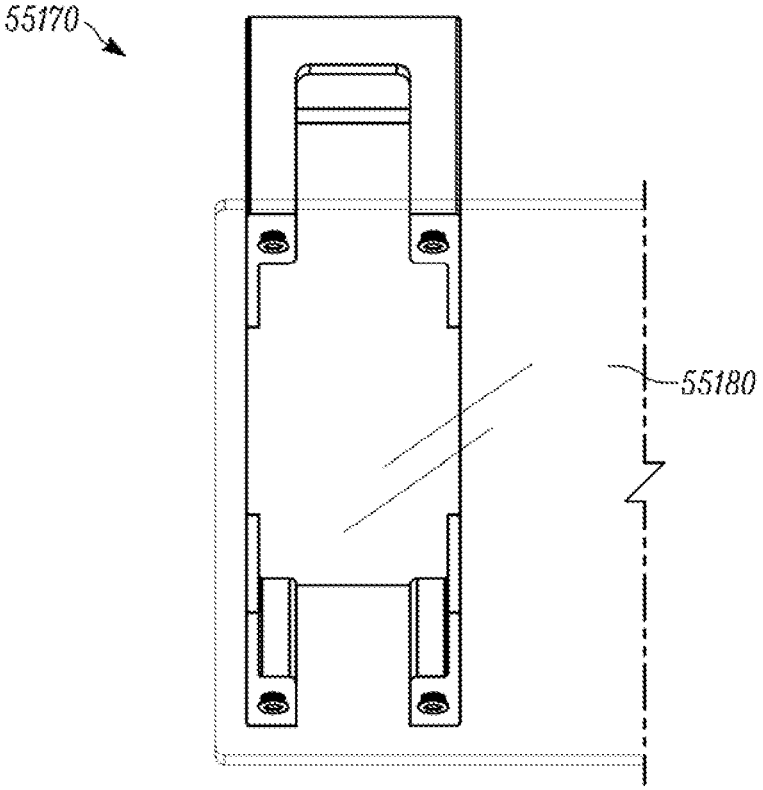
Figure 55D:
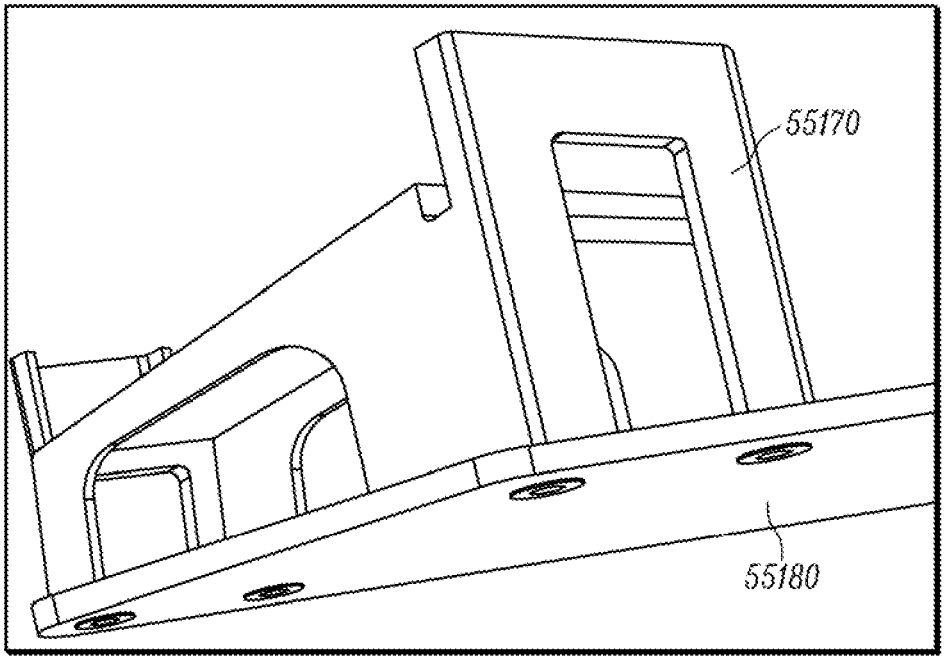
Figure 55E:
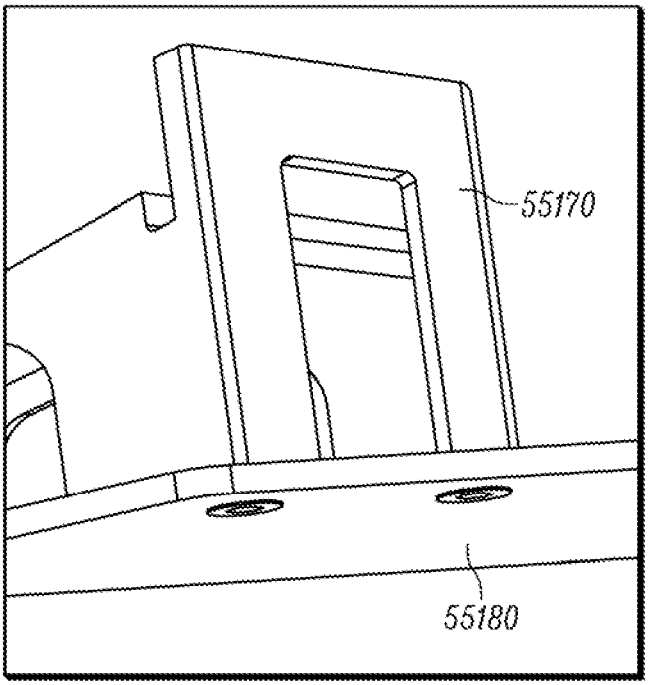

In a preferred form, the bracket 52180 will take the shape of bracket 53180 illustrated in FIG. 53. As can be seen in this illustration, the mating structure 53180*a* is preferably an inverted U-shaped structure formed from a bend in the bracket 53180. In one form, mating structure 53180*a* engages a lip formed by a recess at the rear of the tray base 52110. More particularly, the distal end of mating structure 53180*a* is disposed within a channel formed in the rear of base 52110 (similar to the channels discussed above and illustrated in FIGS. 22A-C above, e.g., 2249A and 2249B). The bracket 53180 then bends forward to form shelf 53180*b*, down to form riser portion 53180*c*, back to form foot 53180*d*, down to form rear portion 53180*e* and back forward to form return portion 53180*f*.

An alternate tray assembly embodiment 54100 is illustrated in FIGS. 54A-E, which includes many of the same features as tray assembly 52100, including having a base 54110, tray 54120 movable about the base 54110, a pusher 54130 for front facing product in the product channel defined by left wing 54122*a* and right wing 54122*b*, and a lens or fence 54140. The tray assembly 54100 further includes a riser 54160 that is similar to riser 52160 discussed above, however, unlike the embodiment of FIGS. 52A-F, tray assembly 54100 includes an alternate rear bracket 54180. In the form shown, bracket 54180 is made of an injection molded plastic instead of a metal and includes a smaller return portion 54180*f* that has a non-linear edge (e.g., as illustrated the return is comprised of a plurality of rounded tabs). For convenience, items in alternate embodiments discussed herein from at least FIGS. 52A-E on that are similar to those already discussed, will use the same latter three digit reference numeral but use the prefix of the drawing figure number (e.g., 52, 53, 54, etc.) to distinguish one embodiment from others.

Yet another alternate embodiment is illustrated in FIGS. 55A-E. In this embodiment, the tray assembly 55100 includes a base 55110, tray 55120 movable about the base (e.g., extensible or extendible along the base) with left and right wings, 55122*a*, 55122*b*, respectively, a pusher 55130 and lens or fence 55140. However, unlike prior embodiments, the shelf mounting accessory includes a first riser 55160 and a second riser 55170. The second riser 55170 is connected to mating structures on the base 55110 similar to how the first riser 55160 is connected to base 55110 (e.g., male protrusion or mating hook member 55110*a*). Like first riser 55160, second riser 55170 includes first and second recesses on opposite sides of the riser 55170 that mate with mating members on opposite sides of base 55110. Since only the left side is visible, only mating structures 55110*a* and 55110*c* are illustrated.

In the embodiment of FIGS. 55A-E, the shelf mounting accessory further includes a bracket 55180 which is connected to the second riser 55170. In a preferred form, the bracket 55180 is connected to the second riser 55170 via a fastener (e.g., screw, bolt, rivet, adhesive, hook and loop structures, etc.), however, in alternate forms, it should be understood that the second riser 55170 and bracket 55180 could be formed as an integral structure. It also should be understood that with all of the components discussed herein, while they may be shown in a preferred form such as bended metal, molded plastic, etc. It should also be understood that different shapes and sizes of these components may be used to perform the same function to accommodate different end uses and/or needs or constraints relating to the desired end use.

Figure 56A:
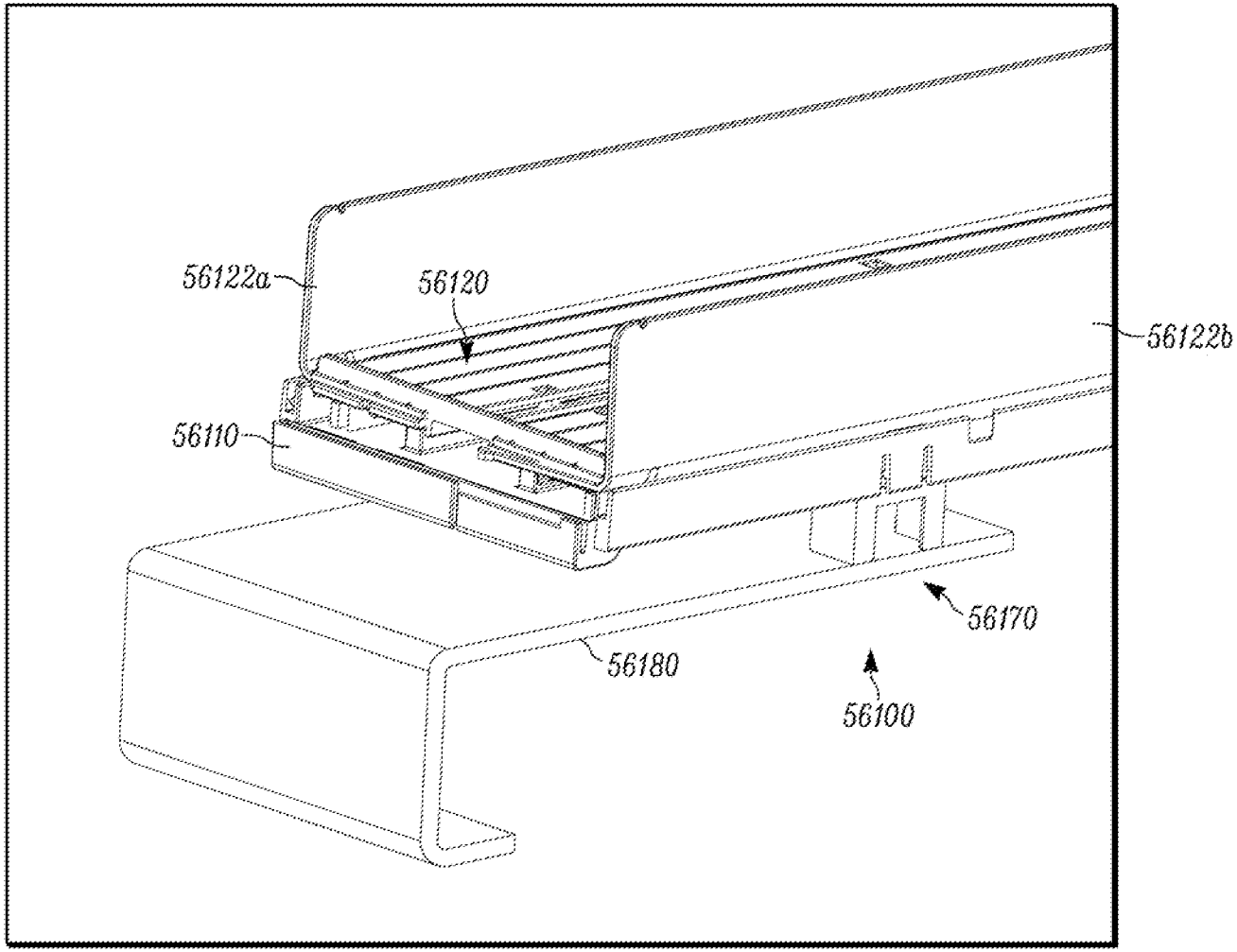
FIGS. 56A-B are rear side perspective and perspective views, respectively, of an alternate rear spacer accessory in accordance with other embodiments of the invention and illustrating a rear spacer accessory with a bracket that extends beyond the rear end of the merchandiser.
Figure 56B:
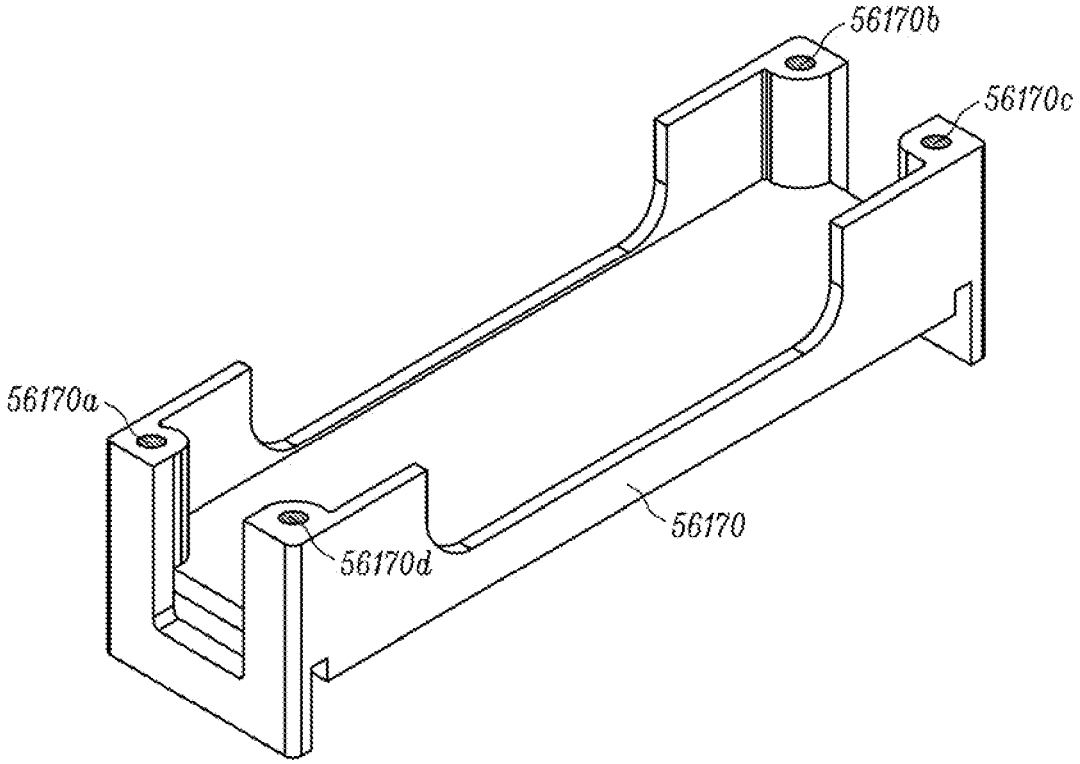

In the embodiment of FIGS. 55A-E, the bracket 55180 does not extend beyond the rear of the tray assembly 55100. This may be desirable in some situations where a short or non-deep shelf is to be connected to and it is desired for the merchandiser 55100 to extend beyond the rear of the shelf to increase the amount of product that may be displayed in each product channel. In alternate embodiments, however, there may not be sufficient space for the tray assembly 55100 to extend beyond the rear of the shelf to which it is connected. Thus, in such instances, the tray assembly may be configured as is illustrated in FIGS. 52A-F or in the alternate embodiment illustrated in FIGS. 56A-B in which the bracket extends beyond the back of the tray assembly 52100 and 56100, respectively. Again, the second riser 56170 could be integrally formed with the bracket 56180 or it could be fastened thereto as is illustrated in FIGS. 56A-B. In FIG. 56B, internally threaded bores are illustrated as being formed in or proximate the legs 56170*a-d* of riser 56170.

Figure 57A:
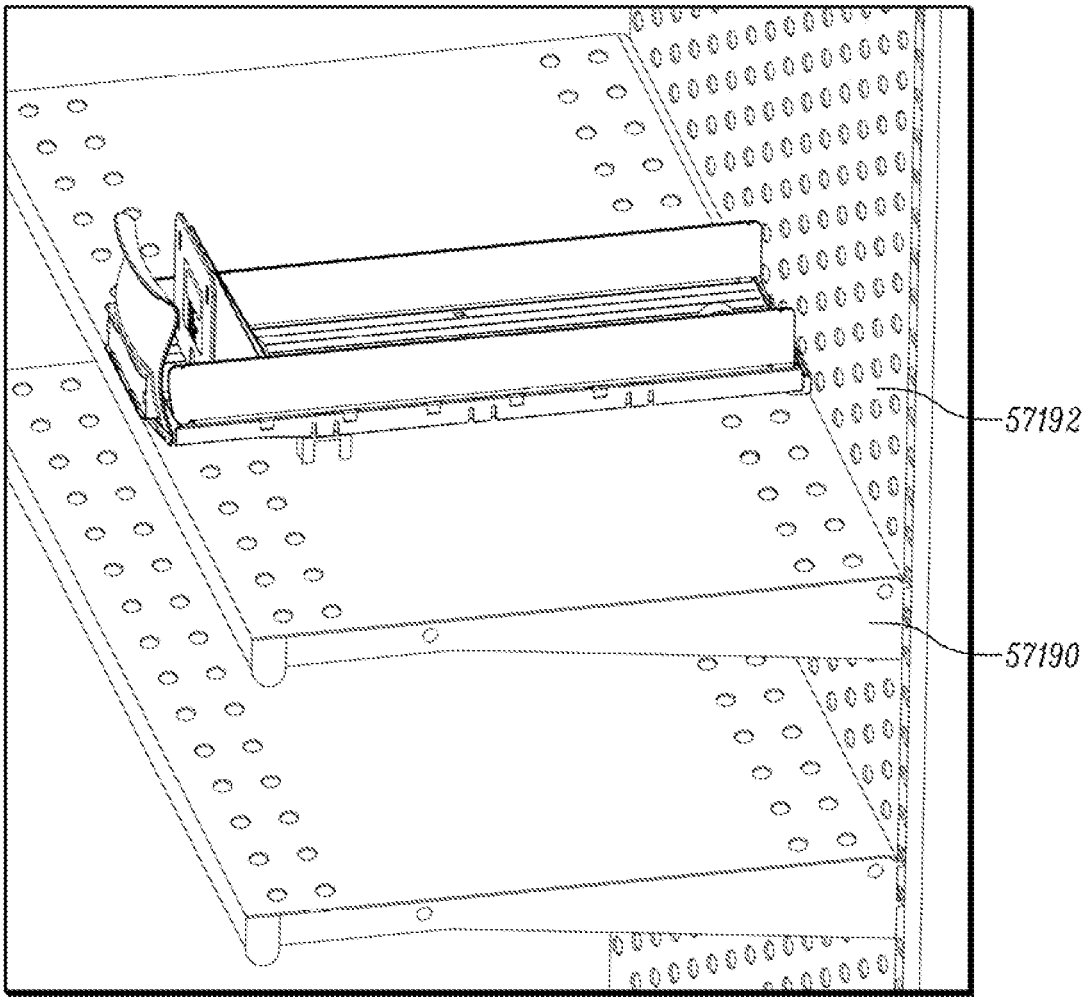
FIGS. 57A-B are perspective and enlarged perspective views of a conventional retail store gondola shelf illustrating existing circular openings in the surfaces thereof and traditional gaps that exist between the rear of the horizontal shelf portion and the vertical upright portion of the gondola.
Figure 57B:
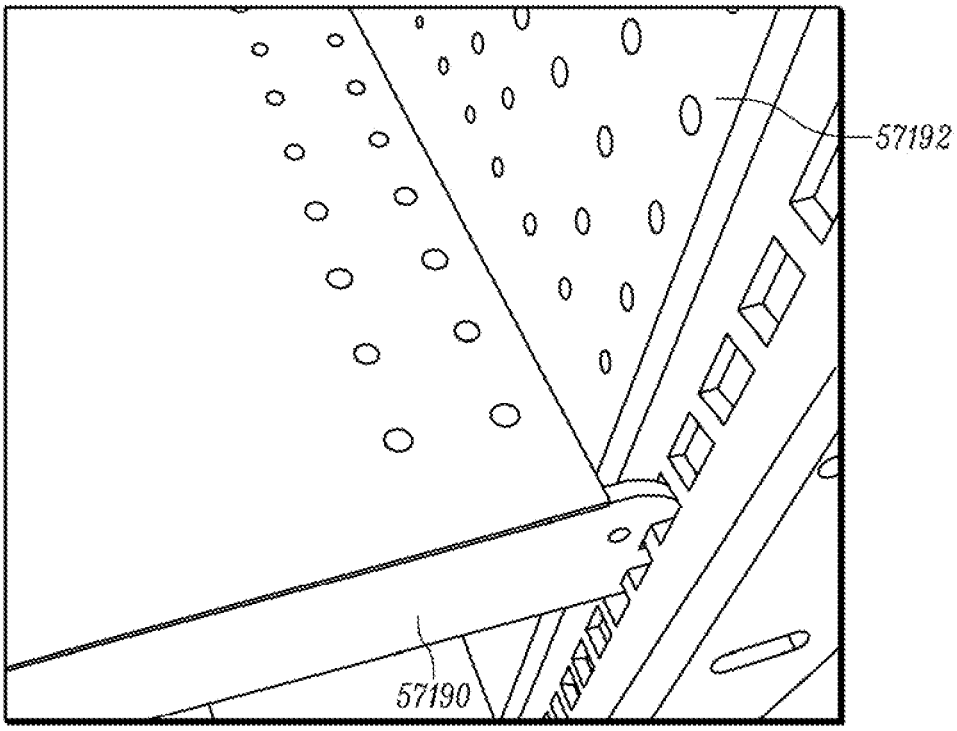
Figure 58A:
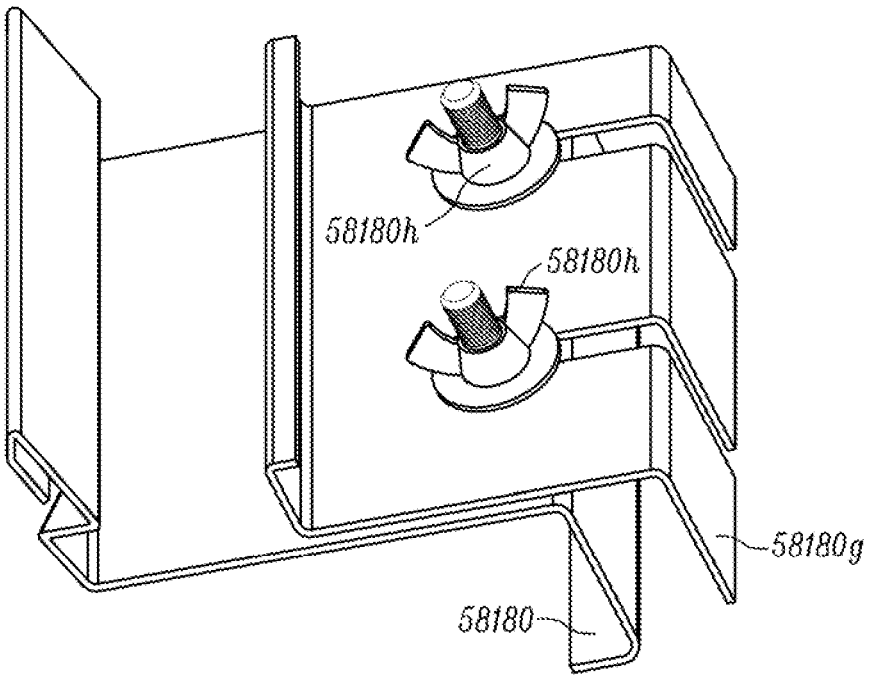
FIGS. 58A-B are top-right perspective and right-side perspective views of an alternate shelf-mounting accessory for a pull-out tray merchandiser in accordance with other embodiments of the invention illustrating a rear bracket with an optional spacer mechanism for filling the gap illustrated in FIGS. 57A-B to securely hold a shelf-mounted tray to the shelving unit.
Figure 58B:
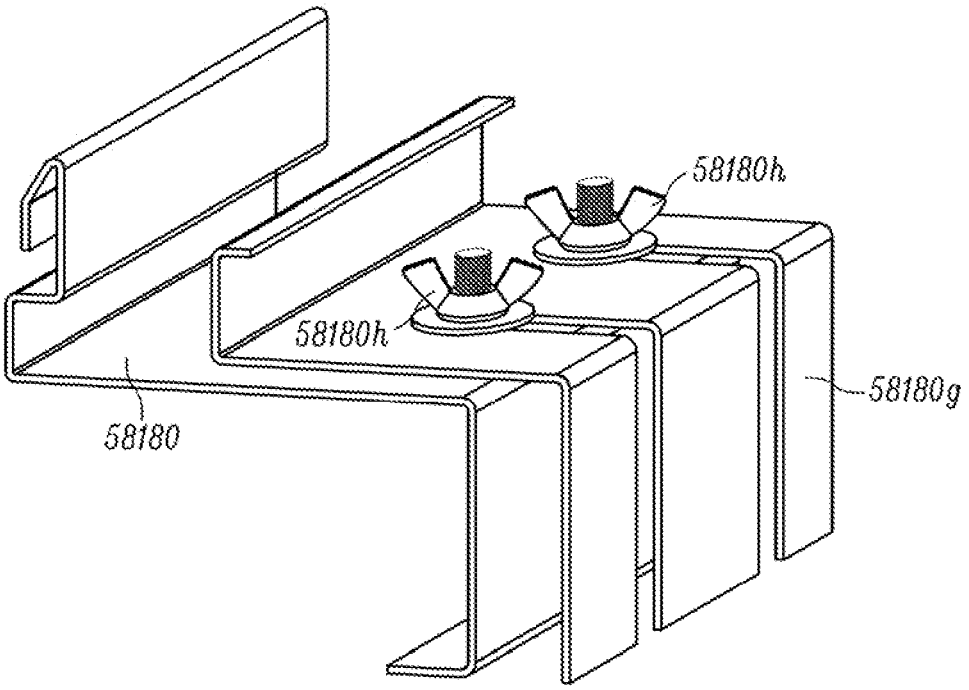
Figure 59A:
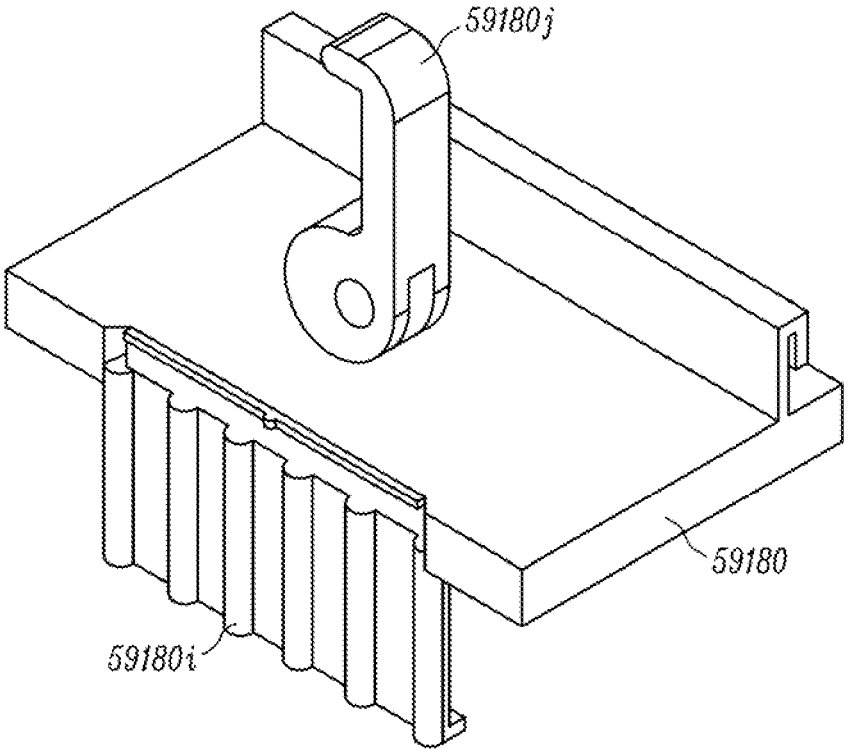
FIGS. 59A-E are top rear perspective, top, rear elevation, right side elevation and cross-sectional views, respectively, of another shelf-mounting accessory in accordance with embodiments of the invention, with the cross-section of FIG. 59E being taken along line 59E-59E in FIG. 59C.
Figure 59B:
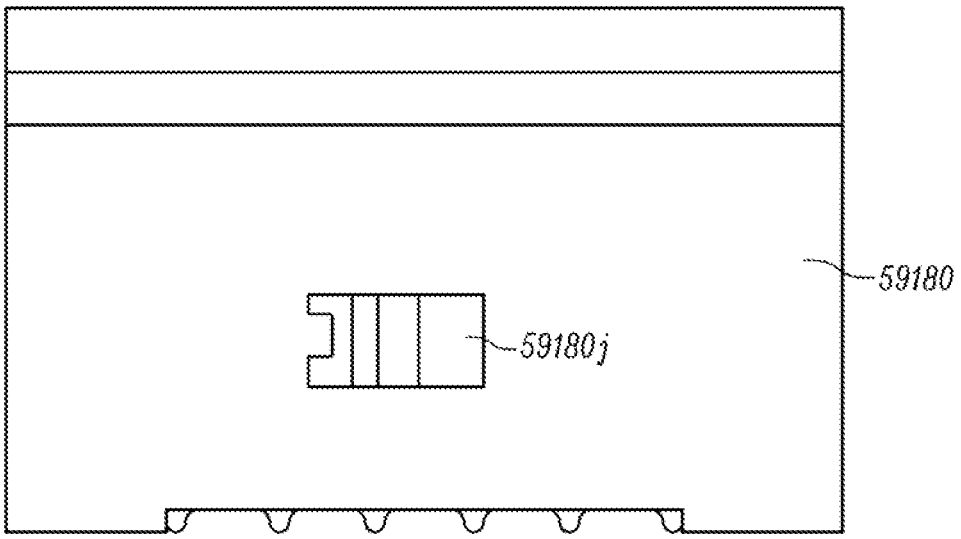
Figure 59C:
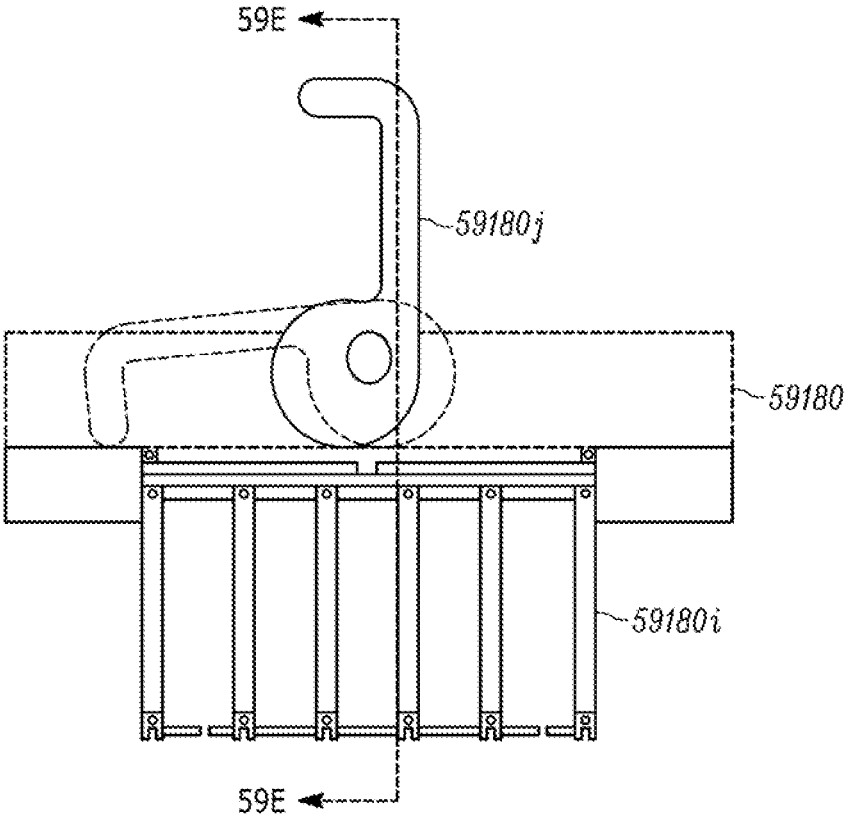
Figure 59D:
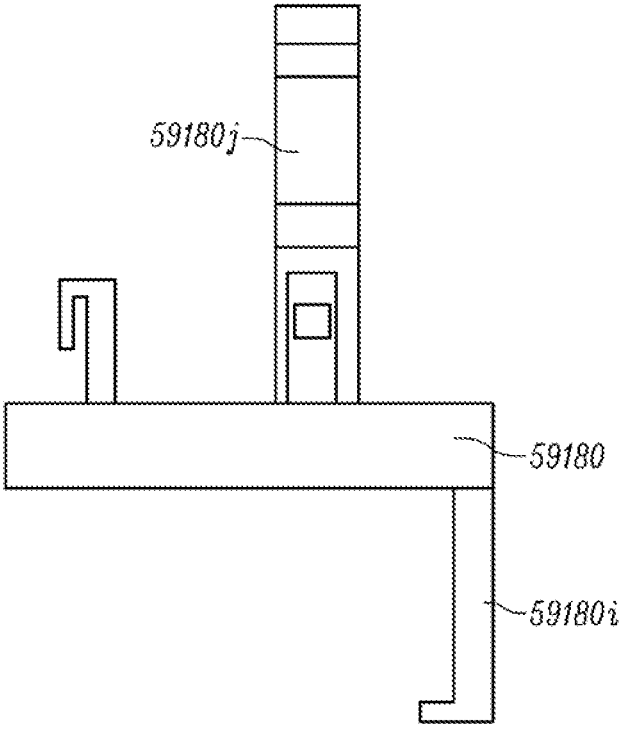
Figure 59E:
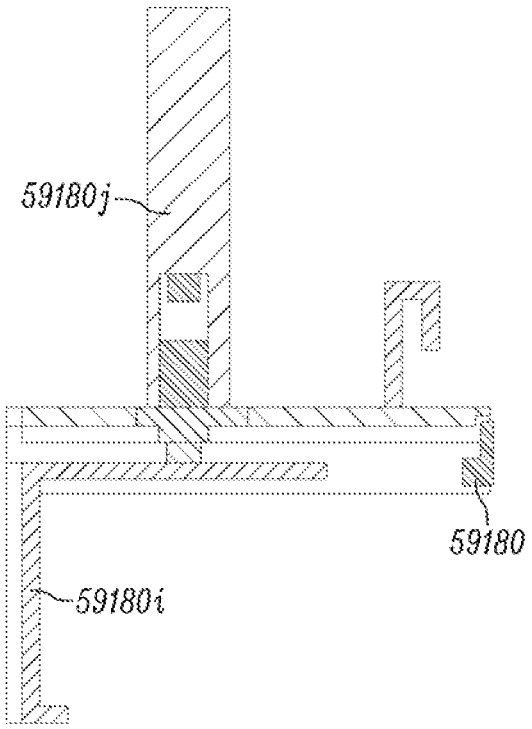

In conventional gondola shelving, the shelf and vertical upright to which is connects typically have a gap therebetween which allows sufficient space for placing the rear brackets discussed herein. An example of this gap is illustrated in the conventional shelving unit illustrated in FIGS. 57A-B, with the shelf identified by reference numeral 5790 and the vertical upright identified by reference numeral 5792. One problem with having such a gap, however, is that it provides space for the tray assembly to move with respect to the shelving unit (e.g., the shelf itself, the vertical upright, or both). In particular, this gap can result in the tray assembly being movable back and forth laterally (or yaw) as well as pivotally along a horizontal axis (or pitch). In FIGS. 58A-B, an alternate bracket or bracket attachment is illustrated which helps prevent unwanted movement of the tray assembly 58100 and helps secure the tray assembly 58100 to the shelving unit. In the form illustrated, the bracket 58180 includes a movable spacer plate 58180*g* which is movable toward and away from the bracket 58180. In practice, this spacer plate may be extended out away from the bracket 58180 to fill the gap illustrated in FIG. 57B to prevent such unwanted movement. Once the spacer plate is positioned in the desired position, it can be fastened to bracket 58180 via fasteners 58180*h*. In the form illustrated, the spacer plate 58180*g* and bracket 58180 operate as a spreader to spread apart from one another and exert force on the rear edge of the shelf and the forward edge of the vertical upright.

Yet another embodiment for securing the rear bracket to the shelving unit is illustrated in FIGS. 59A-E. In this form, however, the bracket 59180 includes a clamp member 59180*i* and a cam actuator 59180*j* for moving the clamp member 59180*i* between limits of travel. In the form illustrated, the clamp 59180*i* and cam actuator 59180*j* are situated to cause a clamping effect between the upper and lower surfaces of the shelf. Thus, once the rear bracket 59180 is positioned where desired, the cam operator or actuator 59180*j* may be moved to exert a clamping force on the shelf with clamp member or jaw member 59180*i*. It should be understood, however, that a similar configuration could be used to cause a clamping force between the rear edge of the shelf and the rear of the tray assembly (instead of the top and bottom surfaces of the shelf).

Figure 60:
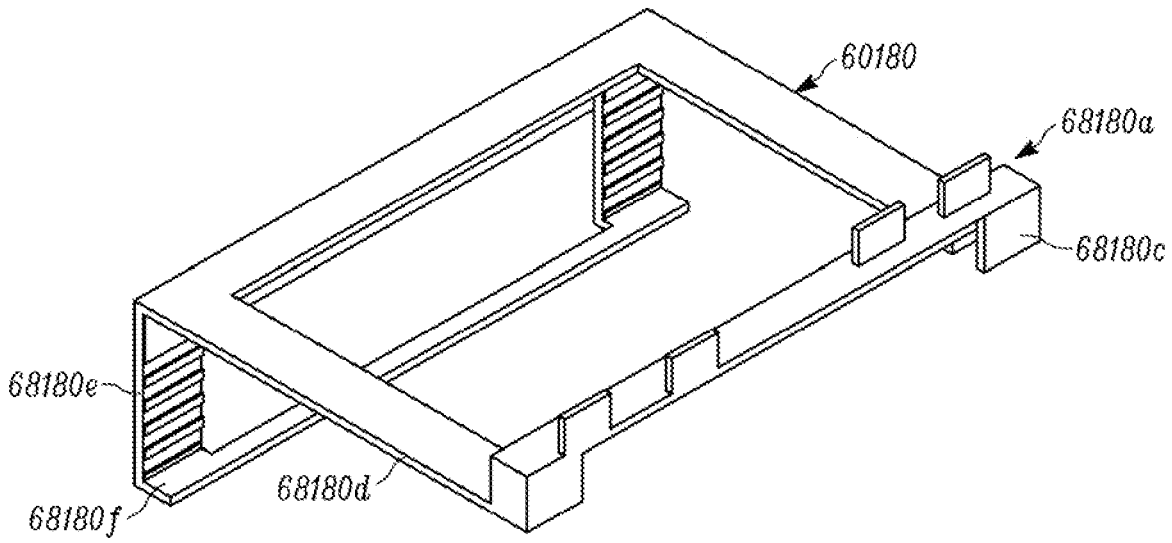
FIG. 60 is a left-front perspective view of an alternate shelf-mounting accessory in accordance with the invention illustrating a rear bracket that has male mating members for mating with existing female structures in a pull-out tray and a lower return portion that can be adjusted to different positions in order to accommodate shelves of different thicknesses.
Figure 61:
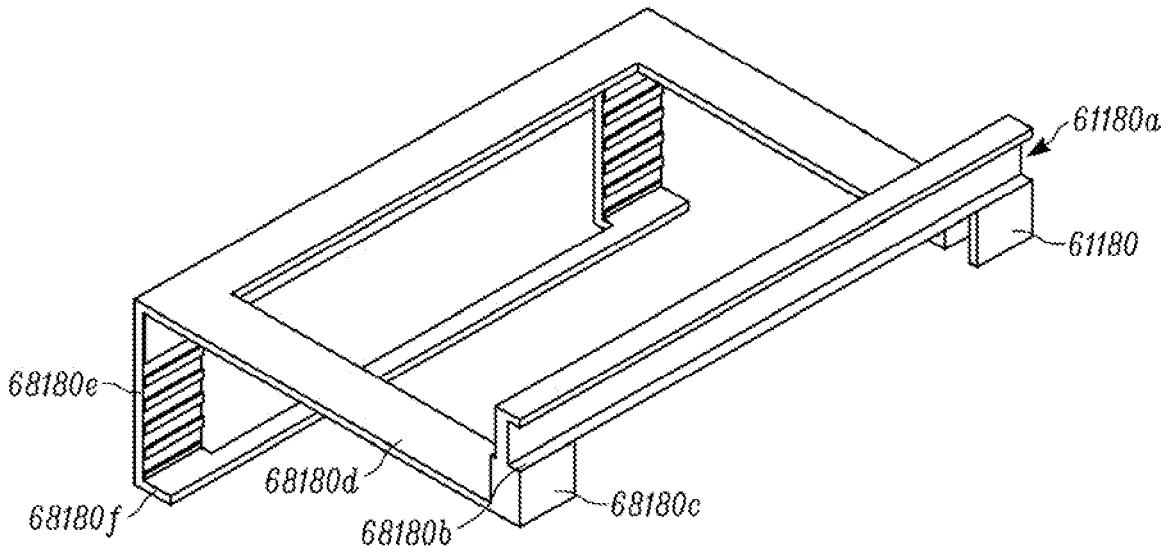
FIG. 61 is a left-front perspective view of an alternate shelf-mounting accessory in accordance with the invention illustrating a rear bracket that has an alternate mating structure for engaging the rear of the pull-out tray merchandiser and having a lower return portion that can be adjusted to different positions in order to accommodate shelves of different thicknesses.

Two additional alternative embodiments of rear brackets are illustrated in FIGS. 60 and 61. In FIG. 60, the rear bracket 60180 has an alternate mating member 68180*a* that has a plurality of male protrusions that mate with existing female recesses located on the bottom surface of the base of a tray assembly. Thus, instead of bending downward over a wall of the rear of the tray assembly base like with prior embodiments, bracket 68180*a* simply gets inserted into the bottom of the base and forms a riser portion 68180*c*, foot portion 68180*d*, rear portion 68180*e* and return portion 68180*f*. Unlike prior embodiments, however, the return portion 68180*f* is removable and repositionable on the vertical portion 68180*e* so that the return portion 68180*f* can be adjusted to different depths to accommodate shelves of different thickness. This allows the bracket 68180 to be more securely attached to the shelf (or more customizable to the specific shelf it is attached to). In the form illustrated, the return portion 68180*f* mates with the vertical rear portion 68180*e* via a dove-tail configuration (mortise & tenon configuration), but other interlocking arrangements or connectors may be used to form this connection.

In FIG. 61, the bracket 61180 has a similar mating relationship between the return portion 68180*f* and the vertical rear portion 68180*e*, however, in this form, the mating portion 68180*a* takes on a different shape and is preferably configured to slide on from the side of the tray assembly at its rear. In the form illustrated, the mating portion 68180*a* forms a mortis and the rear of the tray assembly will have a corresponding tenon for connecting the bracket 68180 to the tray assembly.

Figure 62A:
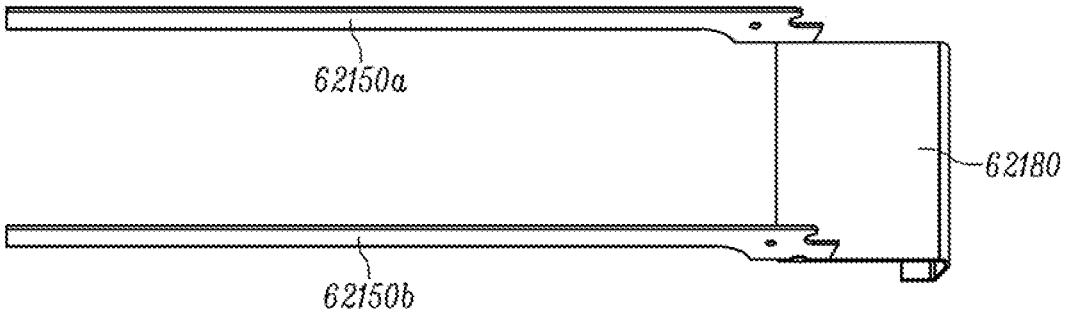
FIGS. 62A-C are top perspective, bottom rear perspective and bend pattern views of an alternate shelf-mounting accessory in accordance with embodiments of the invention illustrating a metal bracket that mounts to a pull-out tray via metal support arms similar to those used to mount the tray to a bar/grid/vertical gondola upright wall.
Figure 62B:
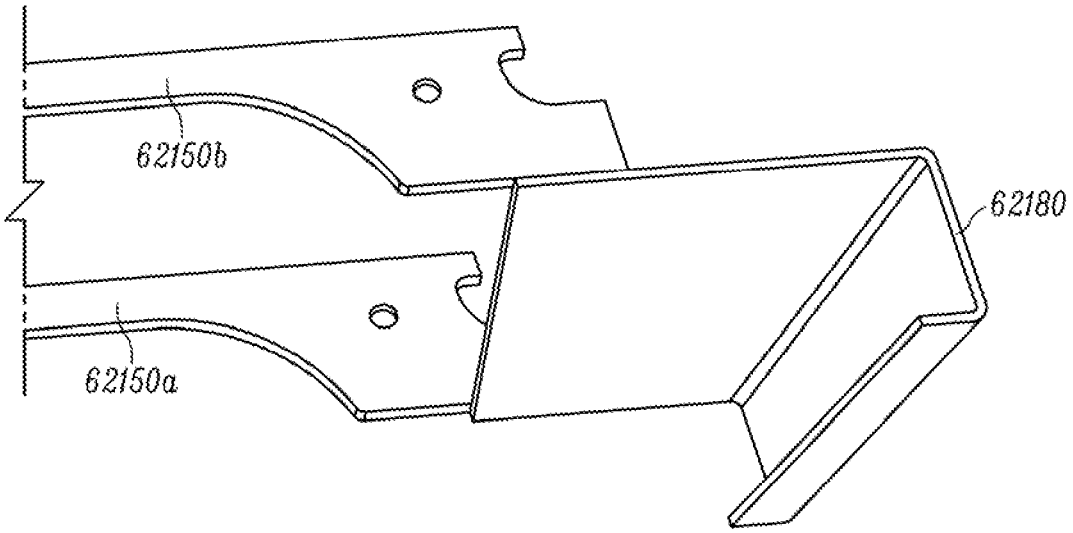
Figure 62C:
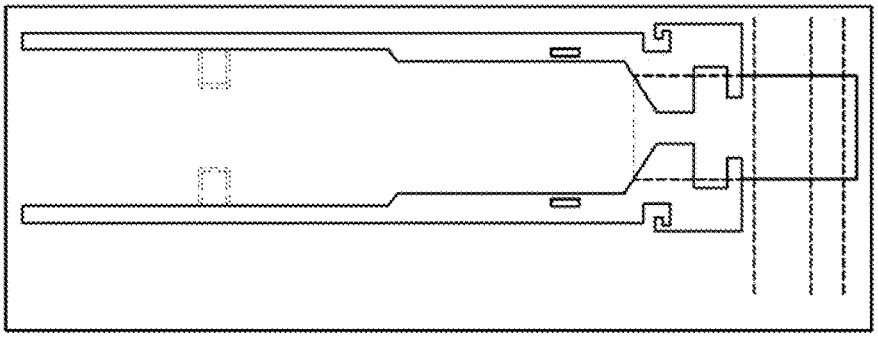

In FIGS. 62A-C, an alternate mechanism for spacing the tray assembly up off of the shelf surface is illustrated using metal support arms very similar to those already used on conventional trays to mount same to bars or grids, however, in the form illustrated, the metal support arms simply perform a riser function and a rear bracket function for securing the tray to the shelving unit. Specifically, a metal blank such as that illustrated in FIG. 62C may be formed via stamping, pressing, casting or the like and then bent into the configuration illustrated in FIGS. 62A-B. Specifically, the structure is formed into an integral structure having left arm 62150*a*, right arm 62150*b* and rear bracket 62180.

Figure 64:
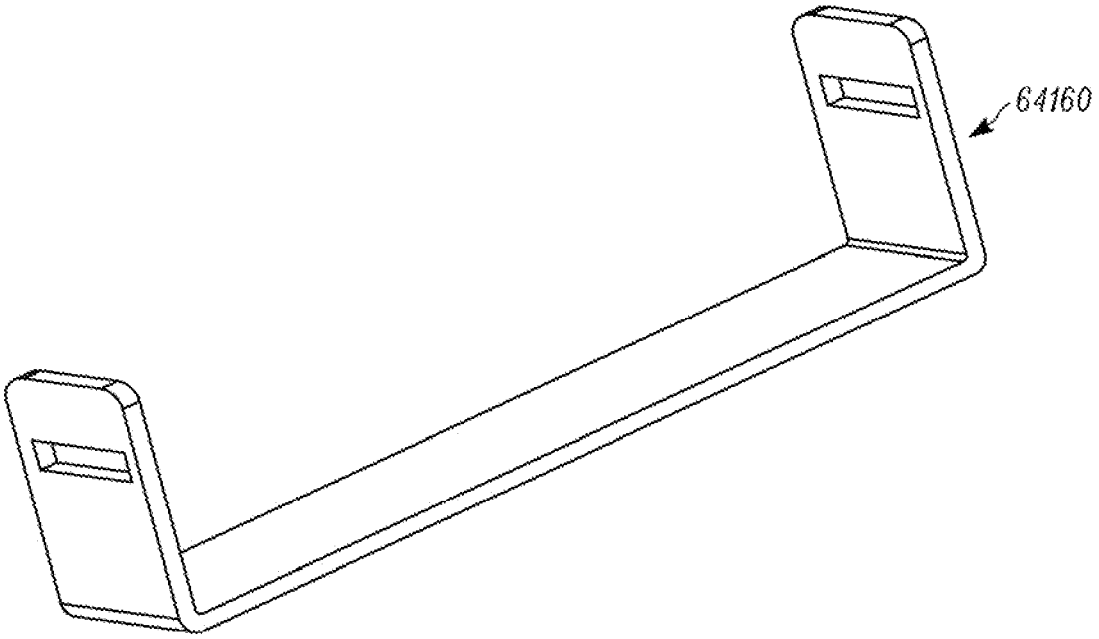
FIG. 64 is a perspective view of an alternate shelf-mounting accessory for a pull-out tray in accordance with other embodiments of the invention.
Figure 65:
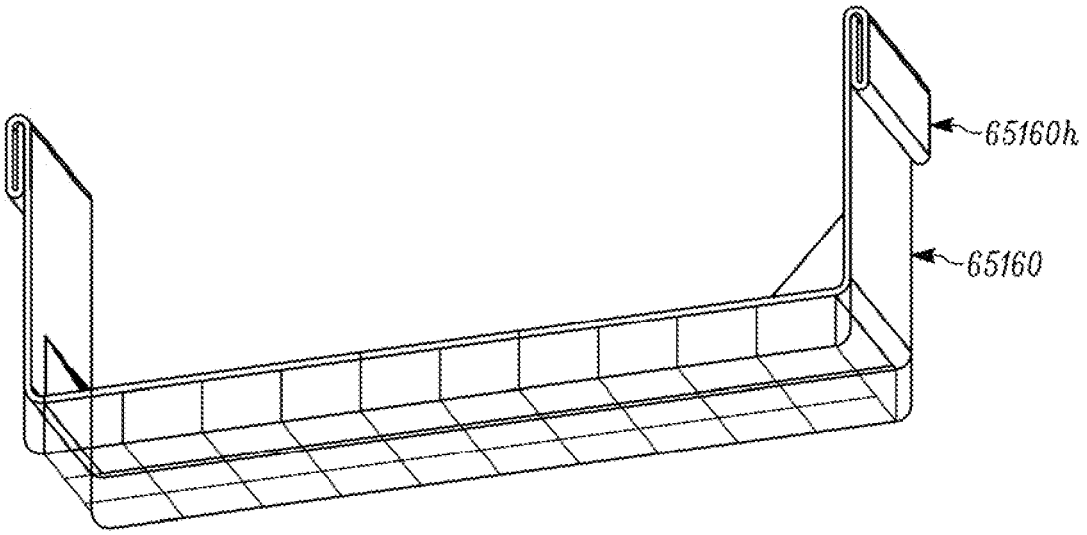
FIG. 65 is a perspective view of an alternate shelf-mounting accessory for a pull-out tray in accordance with other embodiments of the invention.
Figure 66:
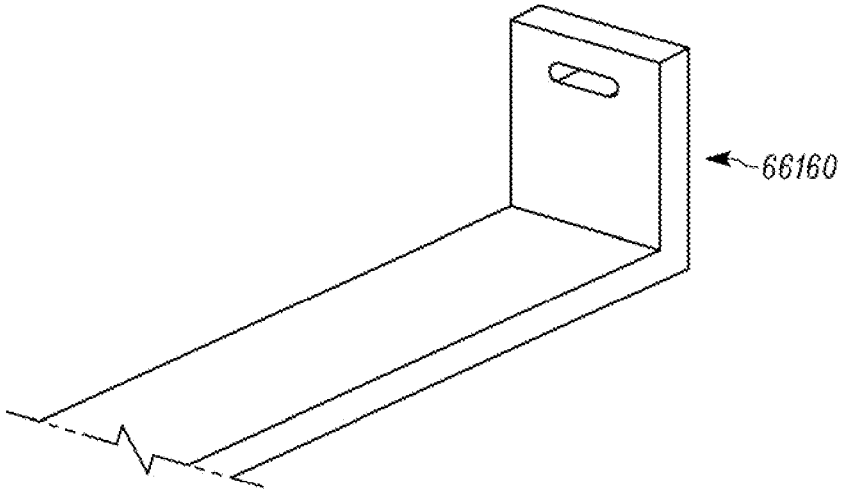
FIG. 66 is a perspective view of one end of an alternate shelf-mounting accessory for a pull-out tray in accordance with other embodiments of the invention.
Figure 67:
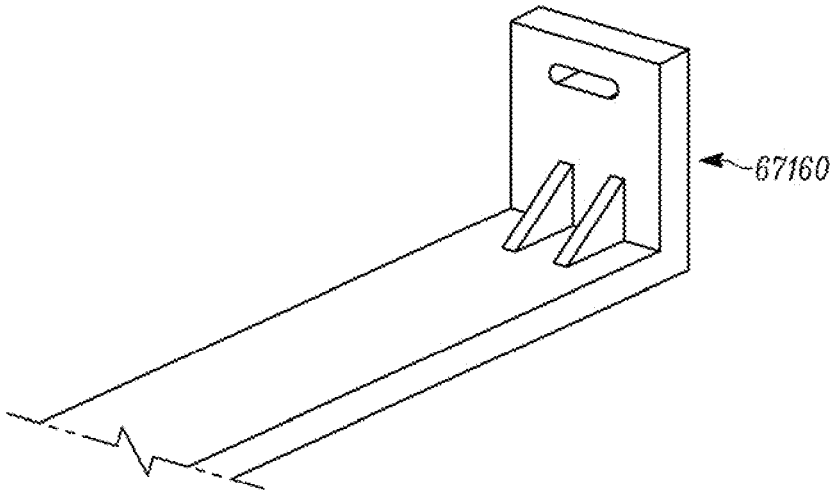
FIG. 67 is a perspective view of one end of an alternate shelf-mounting accessory for a pull-out tray in accordance with other embodiments of the invention.

Alternate riser shapes are illustrated in FIGS. 64, 65, 66, 67 and 68A-B and 72. In FIG. 64, an alternate bent metal riser is shown and referred to generally as riser 64160. In alternate forms, this too could be made of molded plastic, if desired. Another metal riser is illustrated in FIG. 65 and referred to generally as riser 65160. Unlike prior risers, however, riser 65160 does not define recesses or openings for receiving the mating male projection of the tray assembly base, but rather simply bends distal ends of the riser 65160 back over itself (e.g., upon itself) in order to create a downward facing ledge, shelf or shoulder 65160*h* that the mating male projection can engage to secure the riser 65160 to the base of the tray assembly. As is indicated in FIG. 65, this same general design could be produced via a plastic molding process if it is desired to make the riser 65160 out of plastic. Rather than folding the distal ends upon themselves to make ledge 65160*h*, however, the mold would simply be designed with this step or ledge in there to form a gripping or engaging surface 65160*h* for the tray assembly's mating male member to engage. Some benefits to using bent metal as the riser is that it can be formed with sharper corners, such as the one illustrated in FIG. 66, and is more resistant to fatigue overtime if the riser is attached and removed from the tray assembly repeatedly over its lifetime (which is not likely). Since any bend can weaken metal at that location, the corner can be reinforced or bolstered via a support such as the buttresses illustrated in FIG. 67. However, such a design is better suited for a plastic molded version of the riser if it is determined such support is needed (e.g., due to the weight of the goods to be supported by the tray merchandiser).

Figure 68A:
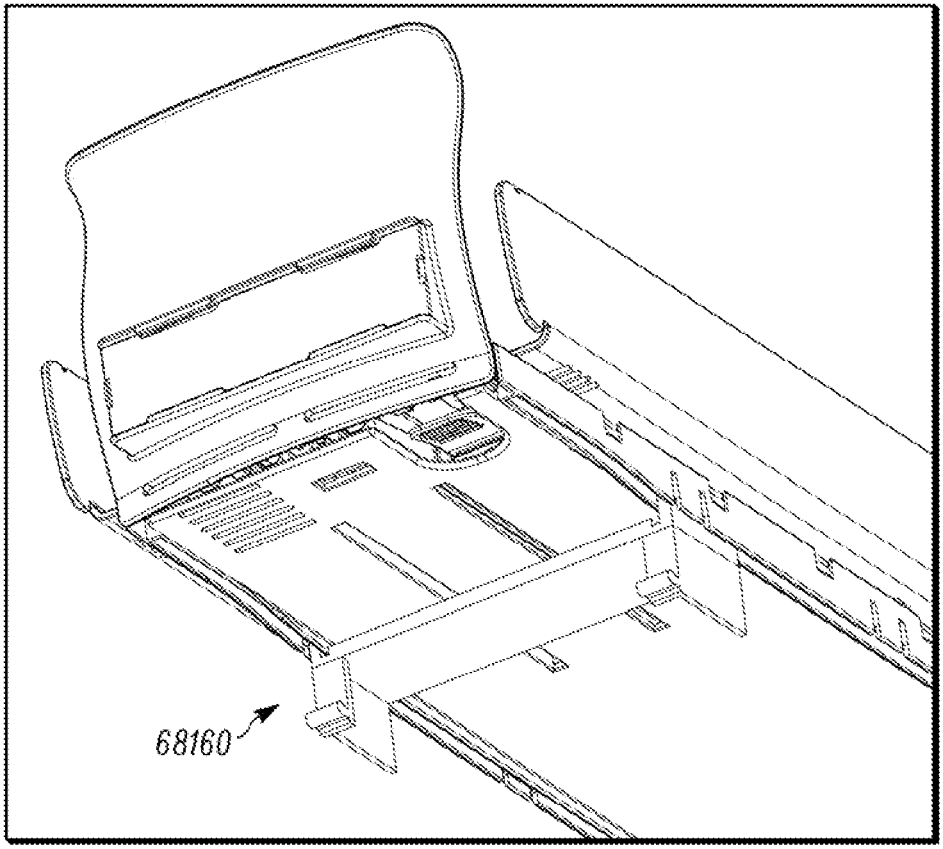
FIG. 68A is a perspective view of a front portion of a product display merchandiser with a pull out tray having an alternate shelf-mounting accessory in accordance with other embodiments of the invention.
Figure 68B:
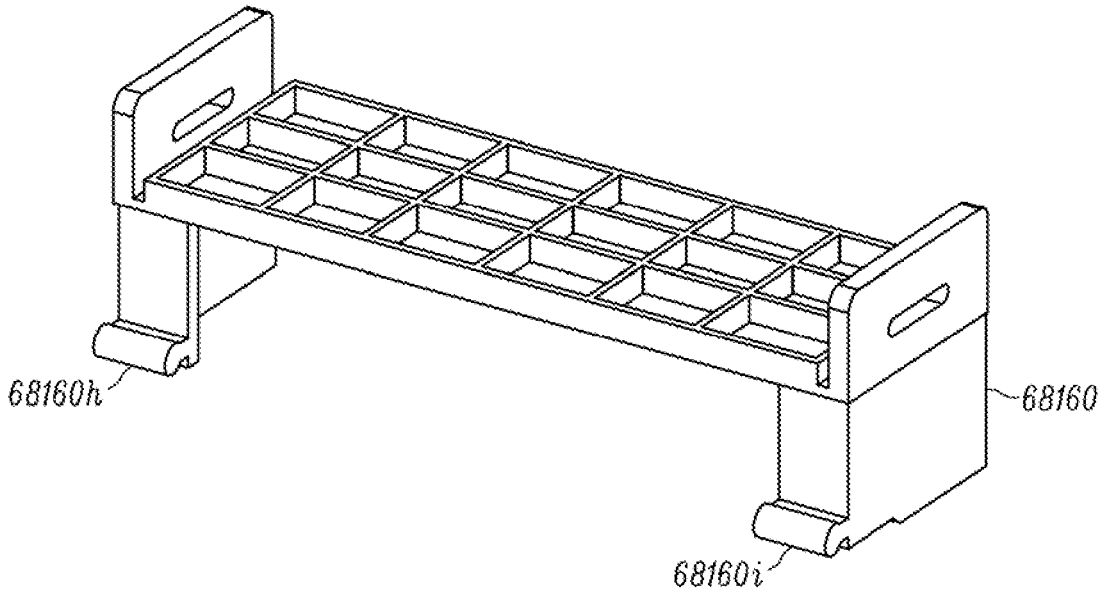
FIG. 68B is a perspective view of the shelf-mounting accessory of FIG. 68A.
Figure 69A:
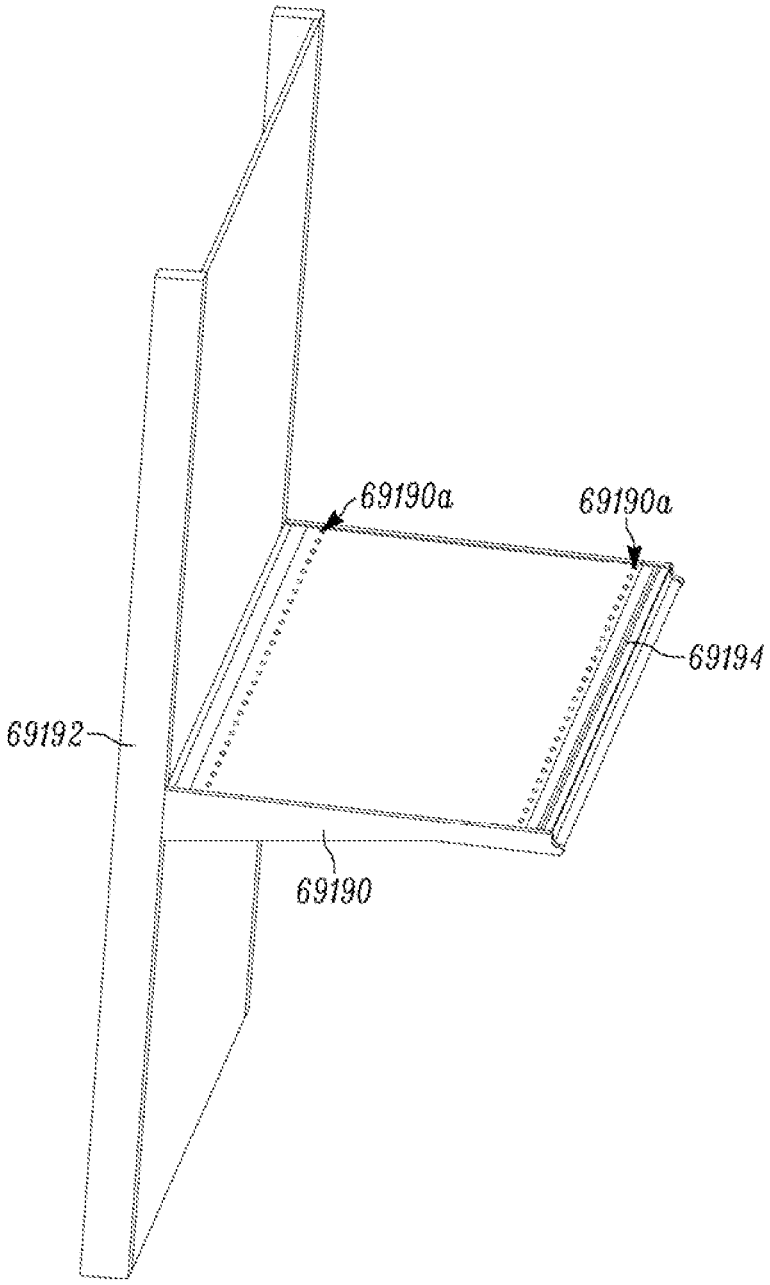
FIG. 69A is a perspective view of a shelving unit having a shelf having an alternate shelf-mounting accessory in accordance with other embodiments of the invention.
Figure 69B:
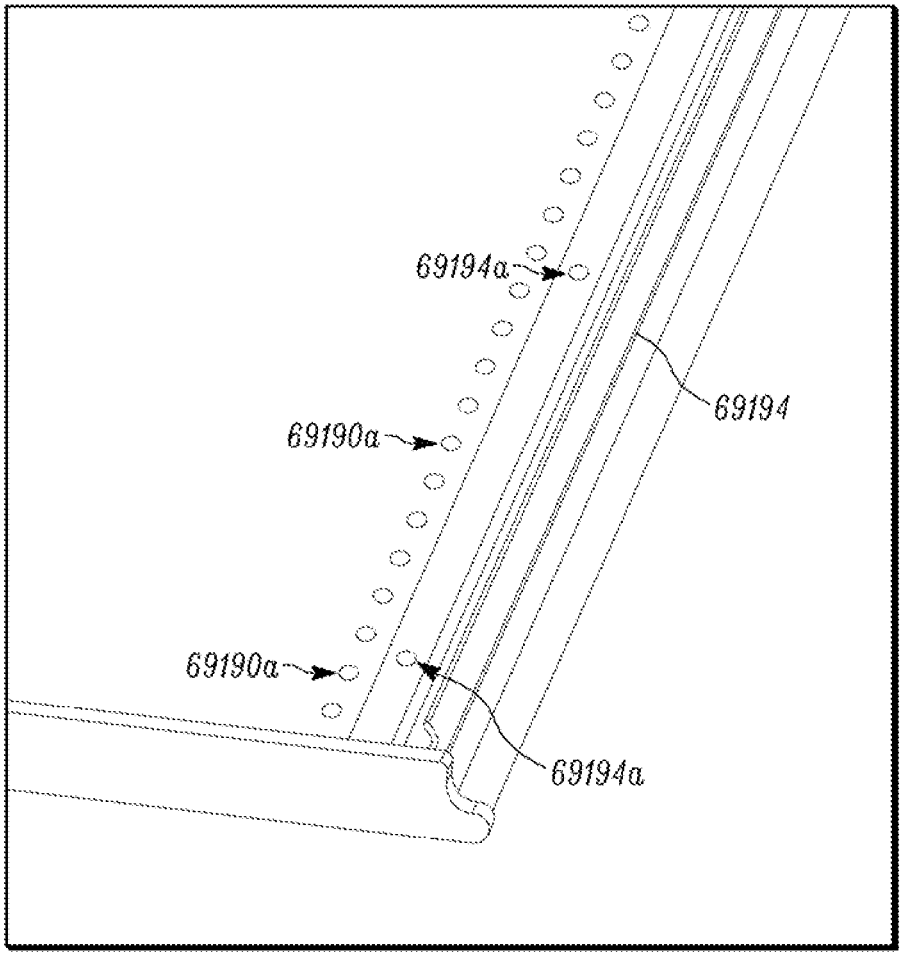
FIG. 69B is an expanded view of the shelf of FIG. 69A showing the shelf-mounting accessory.
Figure 69C:
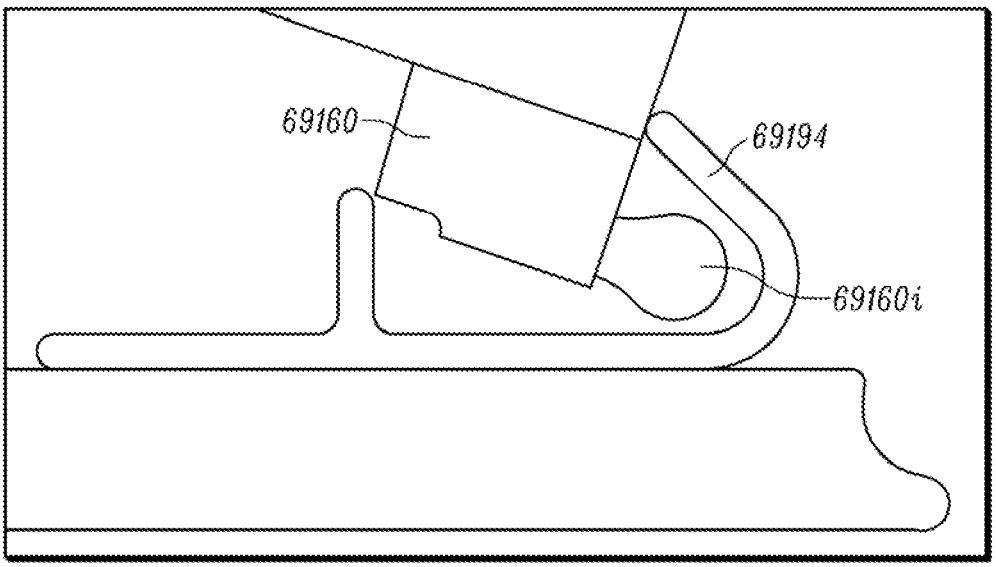
FIG. 69C is an end view of the shelf-mounting accessory of FIGS. 69A-69B showing a cooperating shelf-mounting accessory for a pull-out tray.

However, in addition to these alternate riser shapes, another attachment mechanism is illustrated in the embodiment of FIGS. 68A-B, which has a protrusion 68160*i* extending from one or more of the legs of the riser 68160 which can be used to connect the riser 68160 to a conventional rail structure like that illustrated in FIGS. 69A-C in order to secure the riser (and thus the tray assembly) in position on the shelf via the rail. In FIG. 69A, a conventional retail store gondola upright 69192 and shelf 69190 system are illustrated, showing how such shelving units typically include openings 69190*a* spaced at regular intervals along at least the front and rear boundary of the shelf (normally in a plurality of rows at the front and rear portions of the shelf). The above-mentioned shelf management systems, typically have front and/or rear rails that are connected to the shelf using the front and/or rear holes 69190*a* in the shelving surface, respectively. An enlarged view of the gondola shelving system is shown in FIG. 69B and, in the form illustrated, the rail 69194 defines openings 69194*a* that fasteners, such as friction-fit or press-fit pins are inserted into to secure the rail 69194 to the front of the shelf 69190 using the openings 69190*a* that exist in the shelving surface. In other forms, the rail may have projections extending from the bottom surface thereof that are designed to friction-fit or press-fit into the existing openings in the shelf surface (e.g., press-fit dowels, etc.). In still other forms, the rail 69194 may be connected to the shelf via other fasteners, such as adhesive, hook and loop structures, magnets, etc.

Figure 70:
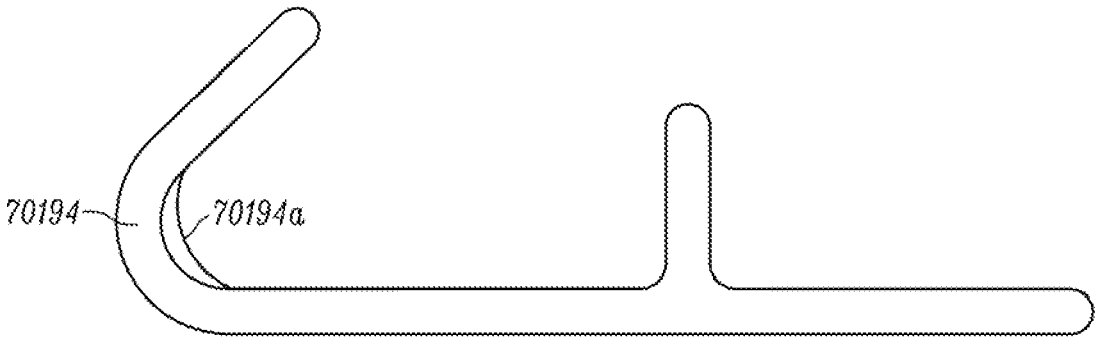
FIG. 70 is an end view of an alternate shelf-mounting accessory for a shelf surface in accordance with other embodiments of the invention.
Figure 71:
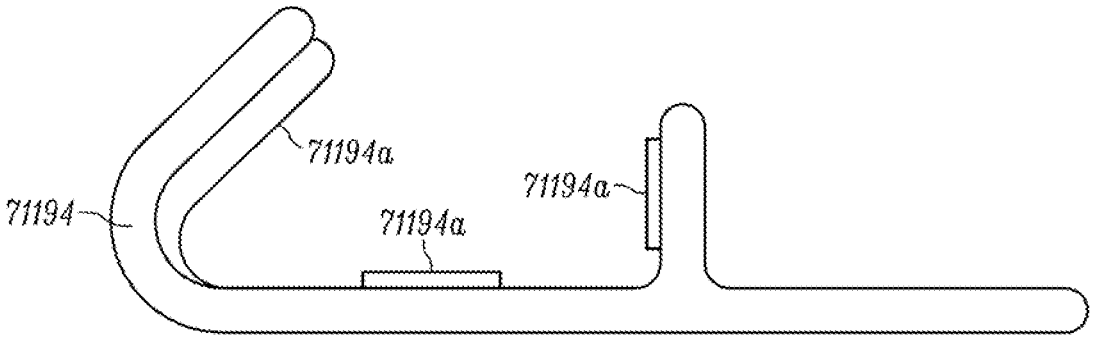
FIG. 71 is an end view of an alternate shelf-mounting accessory for a shelf surface in accordance with other embodiments of the invention.

A benefit of the rail assembly is that the tray assembly may be tilted forward, thereby tilting the riser 69160 forward (see FIG. 69C) in order to allow it to be moved laterally within the channel defined by the rail assembly (without full removal from the rail 69194) and then rested back down on the shelf 69190 to fully engage the rail assembly 69194 more securely and prevent unintentional lateral movement of the tray assembly. Such a configuration allowing for easy intentional lateral movement of the trays may be desirable for re-planograming a display and/or inserting cut-ins into a display. Additional frictional members, surfaces and/or materials 70194*a*, 71194*a* can be added to the rail as illustrated in FIGS. 70-71 to further hinder unintentional lateral movement of the tray assembly once connected to rail 71194 (and in particular movement of the riser protrusions 69160*i*, 72160*i* when disposed in the channel of rails 69194, 70194, 71194). Again, such rail systems are used in shelf organization systems, but not with tray merchandisers and further disclosure of such rails can be found in U.S. Patent Application No. 61/910,941 (filed Dec. 2, 2013), Ser. No. 14/558,448 (filed Dec. 2, 2014), Ser. No. 29/510,619 (filed Dec. 1, 2014) and Ser. No. 62/430,227 (filed Dec. 5, 2016) which are all incorporated herein by reference in their entirety.

Figure 72:
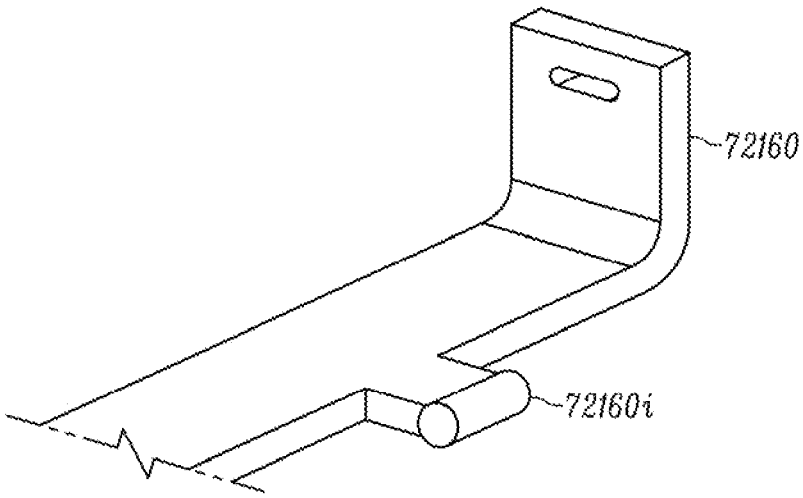
FIG. 72 is a perspective view of one end of an alternate shelf-mounting accessory for a pull-out tray in accordance with other embodiments of the invention.

FIG. 72 illustrates an alternate riser 72160 that engages a rail assembly like those discussed above in similar fashion. More particularly, the protrusion 72160*i* extending from the riser 72160 engages with the rail to secure the tray assembly into a desired position on the shelf of a conventional retail store shelving system. In the form illustrated, riser 72160 is formed with gentle curves in order to more easily be molded via a plastic molding process.

Thus, it should be understood that the above disclosure illustrates examples of ways in which pull-out tray merchandisers can be mounted to or connected to a shelf without requiring alteration of the tray itself. In some forms, shelf mounting accessories have been disclosed that allow for trays to be retrofitted to mount to a shelf without requiring changes to the tray. In some forms, the shelf mounting accessories include use of a spacer or riser (e.g., 54160, 55160, etc.). In other forms, the accessories include use of a rear bracket (e.g., 54180, 55180, etc.). In still other forms, the accessories include use of one or more risers (e.g., 55160, 55170, etc.). In yet other forms, the accessories include use of one or more of any of the risers (e.g., 54160, 55160, 55170, etc.) or brackets (e.g., 54180, 55180, 56180, 58180, etc.). Lastly, alternative mounting members such as metal support arms may be utilized to connect the trays to the shelf. For example, metal support arms such as 62150*a*, 62150*b* may be used that are very similar to the arms used to mount conventional trays to bars and grids, and connect to the trays in the same manner, but having different configurations to provide adequate spacing for the pull-out tray to operate (e.g., sufficient spacing to allow the tray to move from its first or normal retracted position wherein it front faces product on the shelf to a second extended position where the tray extends from the shelf to make it easier to stock or re-stock the tray with product.

Figure 73A:
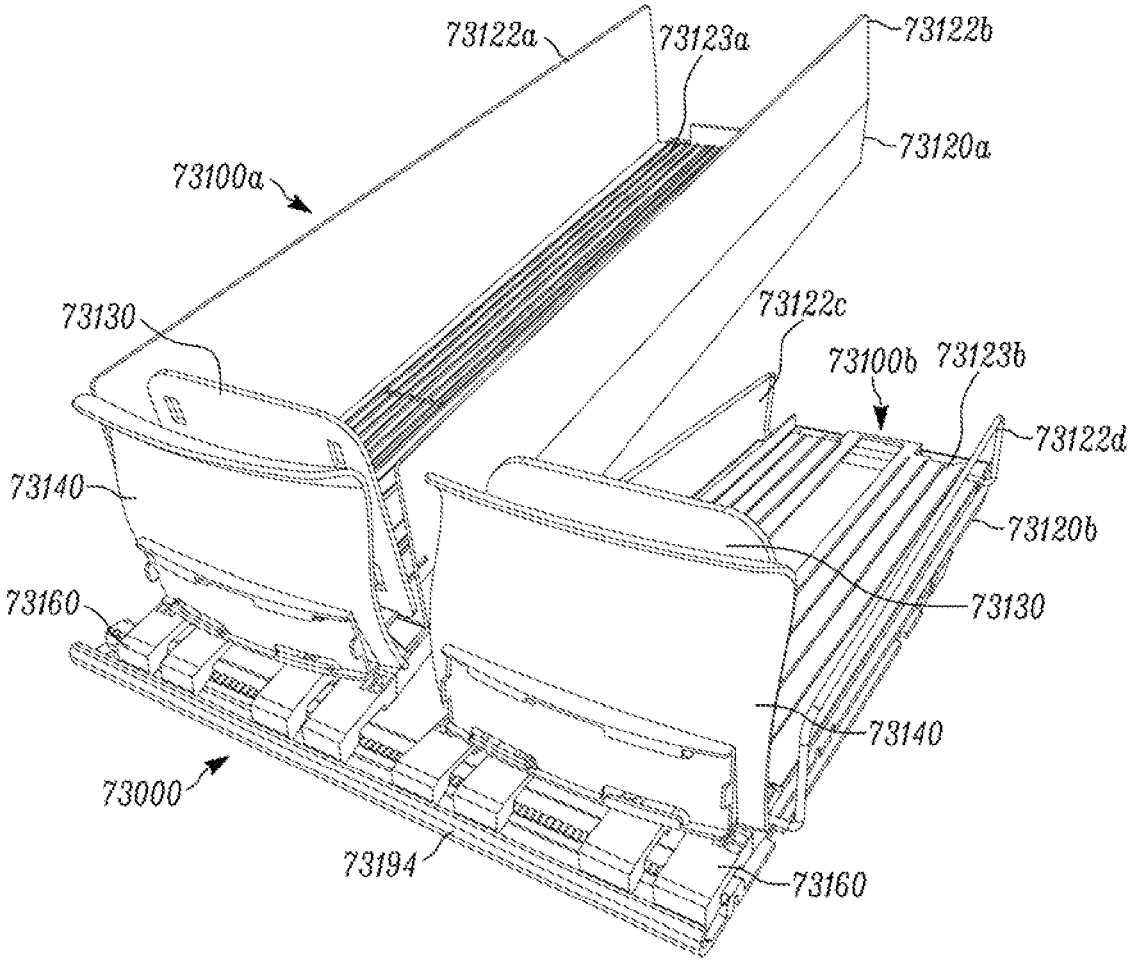
FIG. 73A is a perspective view of a product display having a shelf mounting accessory in accordance with other embodiments of the invention.
Figure 73B:
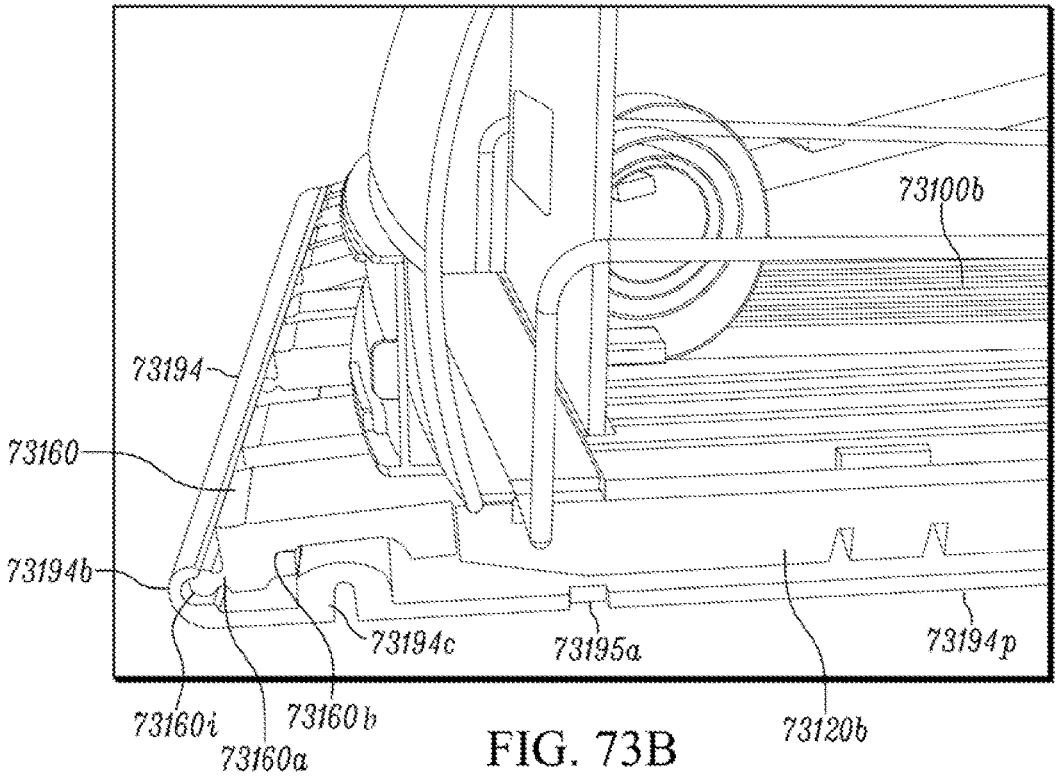
FIGS. 73B-73C are left and right perspective views of the product display of FIG. 73A.
Figure 73C:
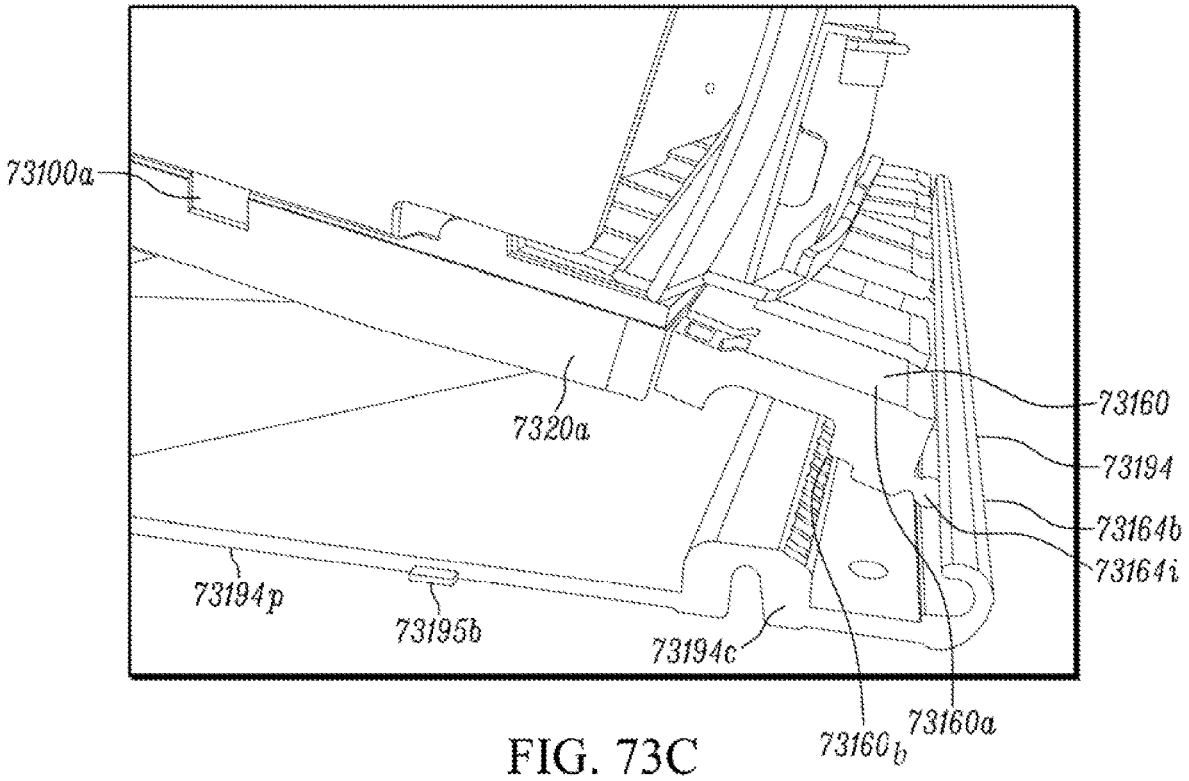
Figure 73D:
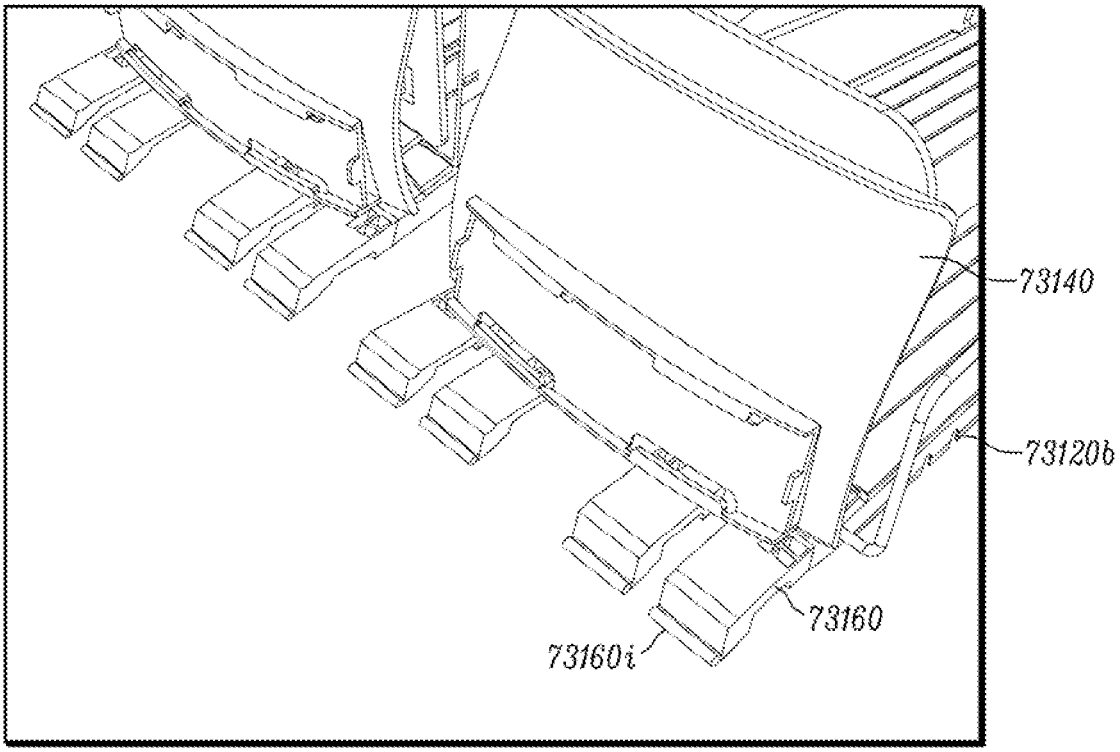
FIG. 73D is a perspective view of the product display of FIGS. 73A-73C with the shelf-mounting accessory for a shelf surface removed to better illustrate the shelf-mounting accessories for the trays.

FIG. 73A illustrates a product display 73000 having a pair of tray assemblies 73100*a*, 73100*b*. Each tray assembly 73100*a*, 73100*b* includes one or more engagement portions 73160. As shown in FIGS. 73B-73D, the engagement portions 73160 includes protrusions 73160*i*. The protrusions 73160*i* are sized and configured to be received within the channel of a rail 73194. The engagement portions 73160 frictionally engage the rail 73194 so as to restrict lateral movement of the tray assemblies 73100*a*, 73100*b* along the longitudinal axis of the rail 73194.

The tray assembly 73100*a* includes a pair of sidewalls 73122*a*, 73122*b*. The sidewalls 73122*a*, 73122*b* are solid plastic. The sidewalls 73122*a*, 73122*b* along with the product support surface 73123*a* of the tray 73120*a* form a product channel in which products are displayed. One or both of the sidewalls 73122*a*, 73122*b* are movable between a first retracted position (as shown) and a second extended position relative to the product support surface 73123*a*. Moving one or both of the sidewalls 73122*a*, 73122*b* to the extended position widens the area in which products are displayed in order to accommodate products of different sizes. In some forms, the sidewalls 73122*a*, 73122*b* are infinitely adjustable between the full extended and fully retracted position in order to accommodate a wide variety of product sizes.

A spring biased pusher 73130 urges products resting on the product support surface 73123*a* forward towards the front end of the tray assembly 73100*a*. A lens 73140 is positioned proximate the front end of the tray assembly 73100*a* to act as a product stop to prevent the pusher 73130 from pushing products off of the tray assembly 73100*a*. In some forms, the tray assembly 73100*a* includes locking structure for releasably locking the pusher 73130 in a position proximate the rear end of the tray assembly 73100*a*. Locking the pusher 73130 aids in restocking of the tray assembly 73100*a*. A pusher release is used to unlock the pusher 73130. In some forms, the pusher release includes an actuated positioned proximate the front end of the tray assembly 73100*a*.

Similarly, the tray assembly 73100*b* includes a pair of sidewalls 73122*c*, 73122*d* and a product support surface 73123*b* of the tray 73120*b* that form a channel in which products are displayed. A spring biased pusher 73130 is used to face products within the channel towards a lens 73140. The sidewalls 73122*c*, 73122*d* are wireframe. One or both of the sidewalls 73122*c*, 73122*d* are movable between a first retracted position (as shown) and a second extended position relative to the product support surface 73123*b*. Moving one or both of the sidewalls 73122*c*, 73122*d* to the extended position widens the area in which products are displayed in order to accommodate products of different sizes. In some forms, the sidewalls 73122*c*, 73122*d* are infinitely adjustable between the full extended and fully retracted position in order to accommodate a wide variety of product sizes.

The tray assemblies 73100*a*, 73100*b* are rotatable about the engagement portions 73160 between a first, secured position (see tray assembly 73100*b*) and a second, released position (see tray assembly 73100*a*). In both positions, the protrusions 73160*i* extend at least partially into the channel of the rail 73194. In the secured position, the engagement portion 73160 engages the rail 73194 so as to restrict movement therein, as shown in FIG. 73B. The rail 73194 is engaged by the protrusions 73160*i* as well as a rearward facing surface 73160*b*, which is defined within a notch on the underside of the engagement portion 73160, rearward of the protrusions 73160*i*. The insertion portion 73160*a* of the engagement portion 73160 is sized to tightly fit between the nose 73194*b* and a forward facing surface of the rear wall 73194*c* of the channel of the rail 73194 so as to frictionally engage each. As described above, one or both of the rail 73194 and engagement portion 73160 may have high friction materials to further restrict relative movement.

In the released position, the rear end of the tray assembly 73100*a* is pivoted upward such that the surface 73160*b* no longer engages the wall 73194*c*. This enables the protrusion 73160*i* to separate from the nose 73194*b* so that the tray assembly 73100*a* can be moved laterally along the longitudinal axis of the rail 73194. The tray assemblies 73100*a*, 73100*b* are infinitely adjustable along the length of the rail 73194 allowing the planogram of the product display 73000 to be continuously adjusted to fit different combinations of products.

Figure 76A:
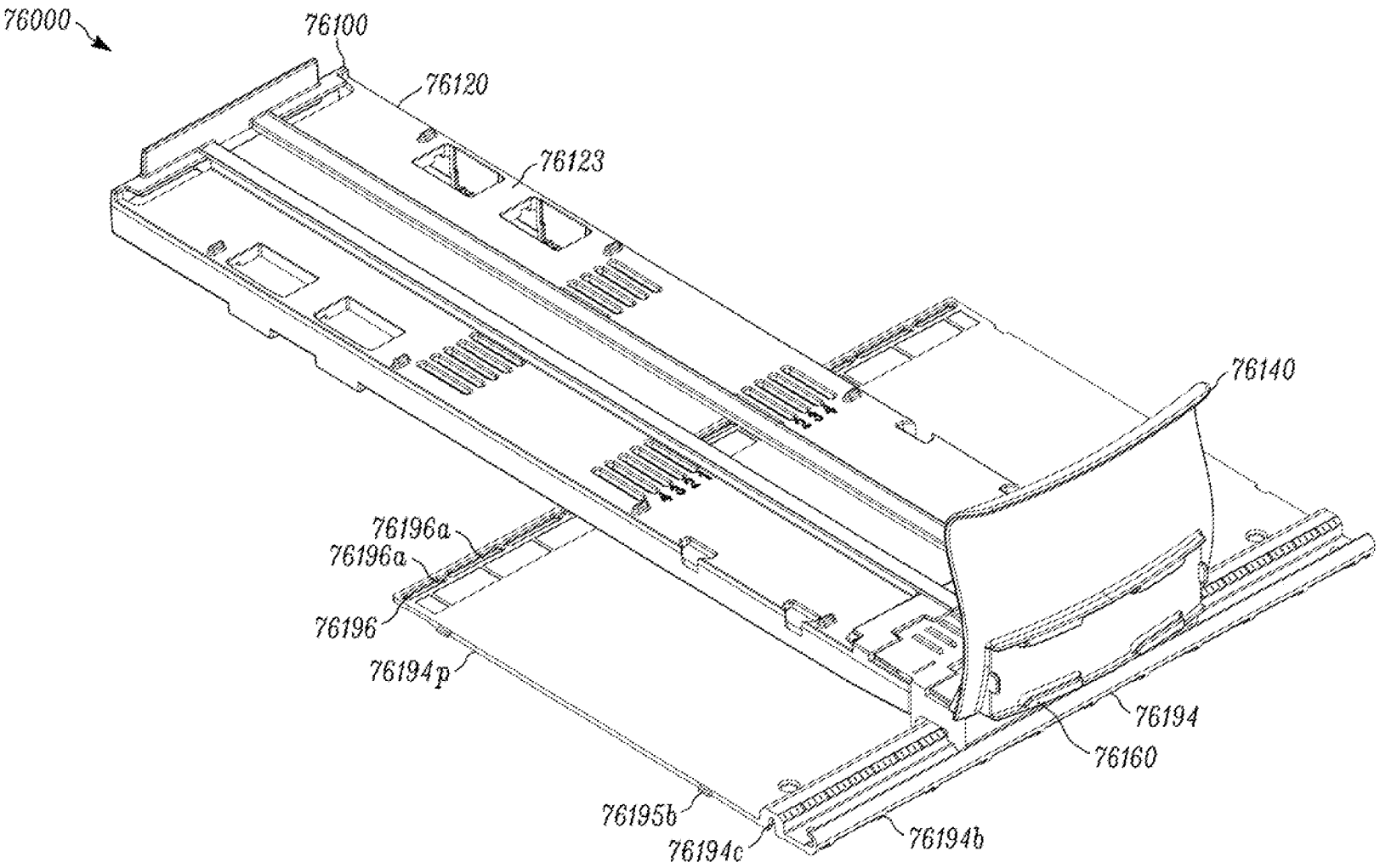
FIG. 76A is a perspective view of a product display having a shelf mounting accessory in accordance with other embodiments of the invention.
Figure 76B:
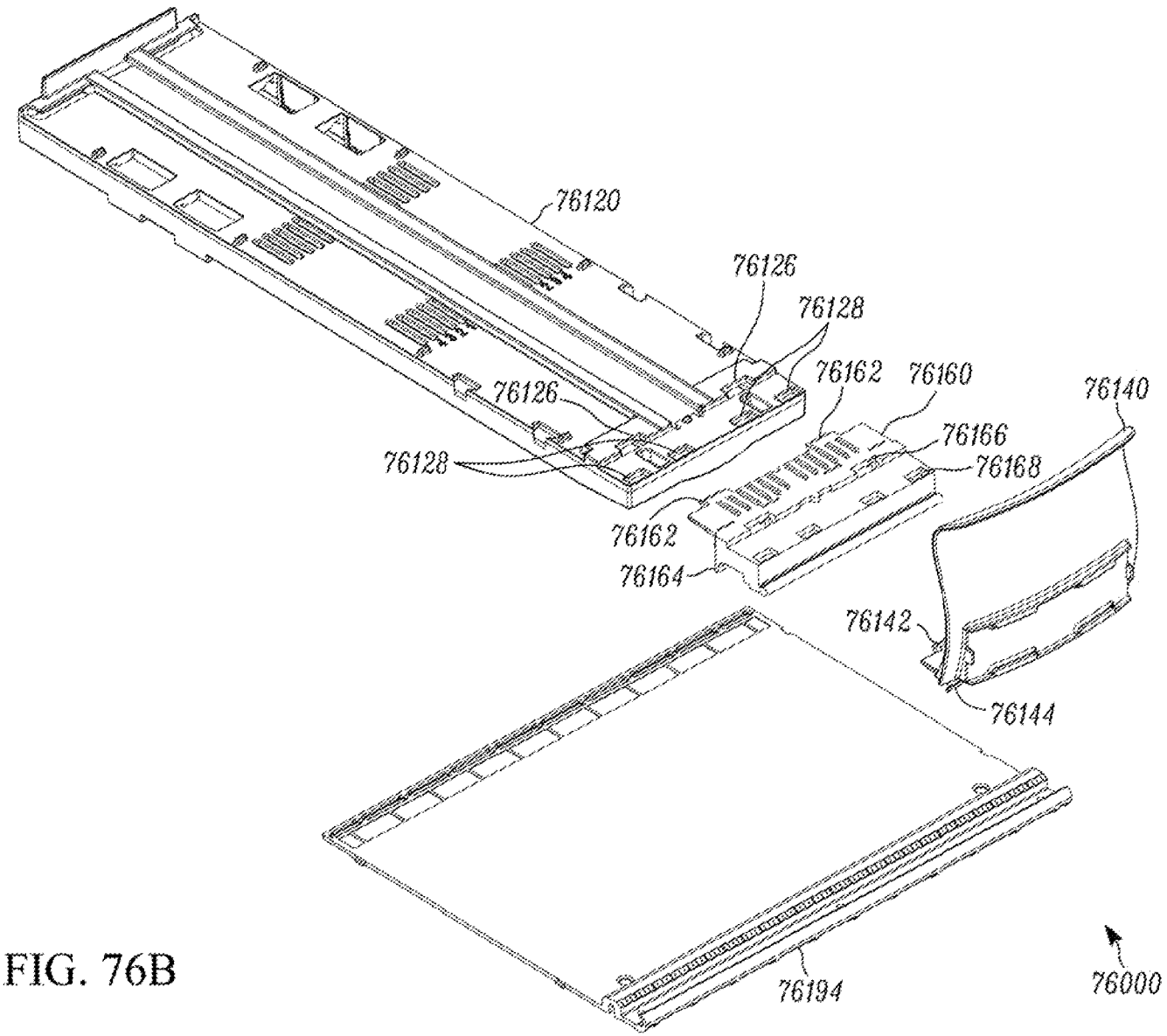
FIGS. 76B-76C are exploded views of the product display of FIG. 76A.
Figure 76C:
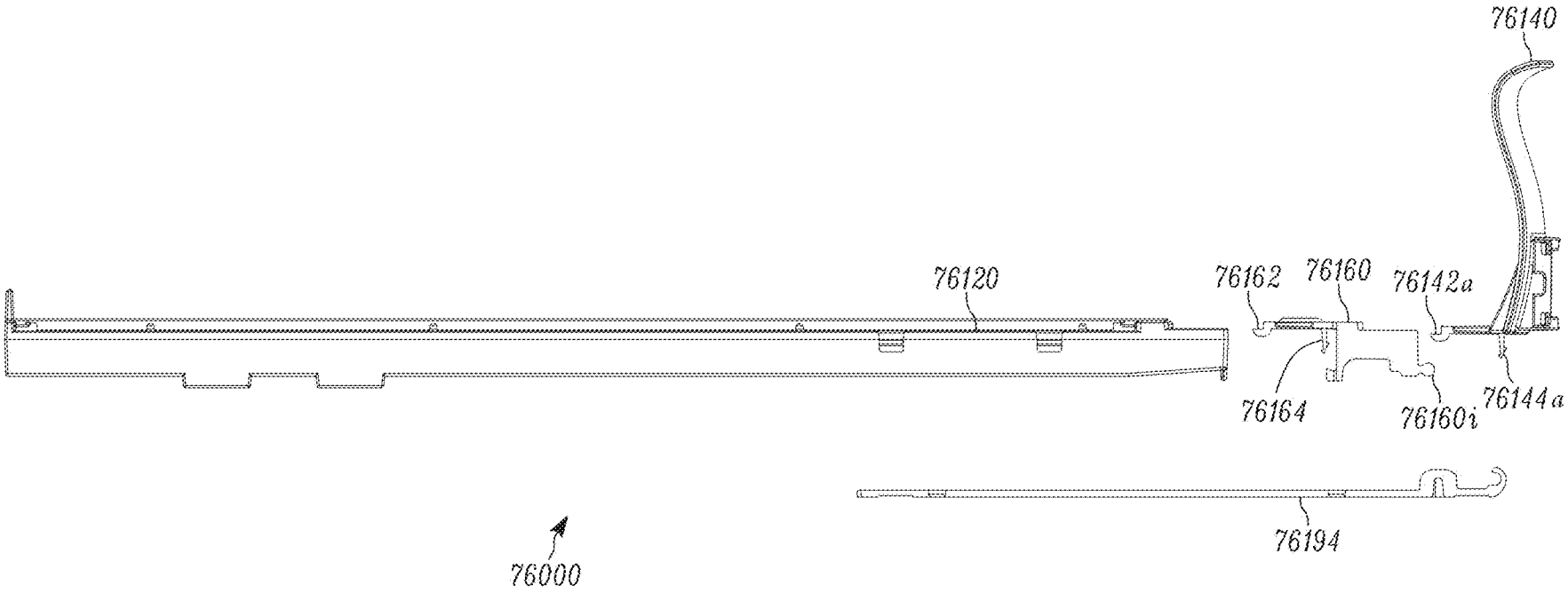
Figure 76D:
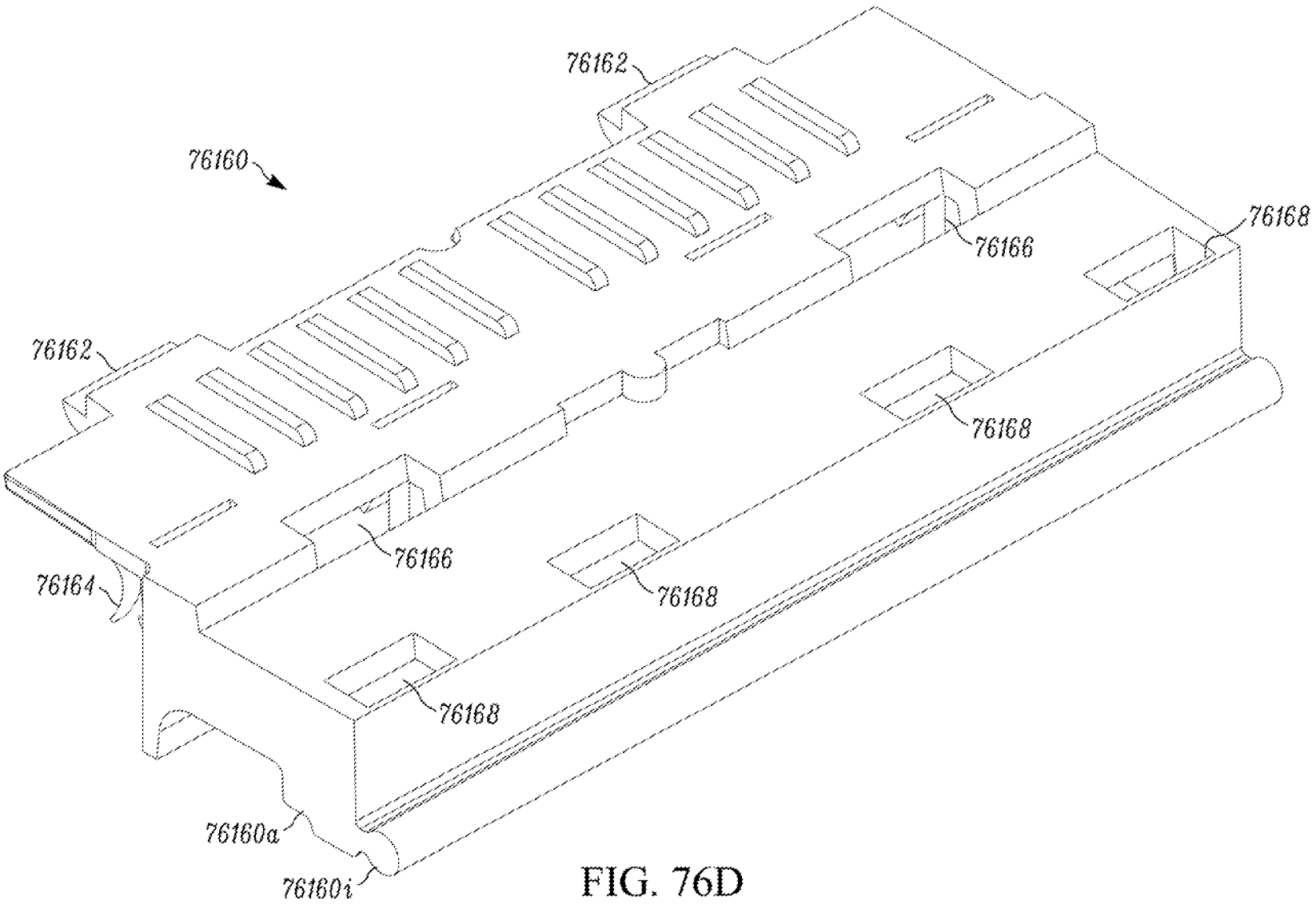
Figure 76E:
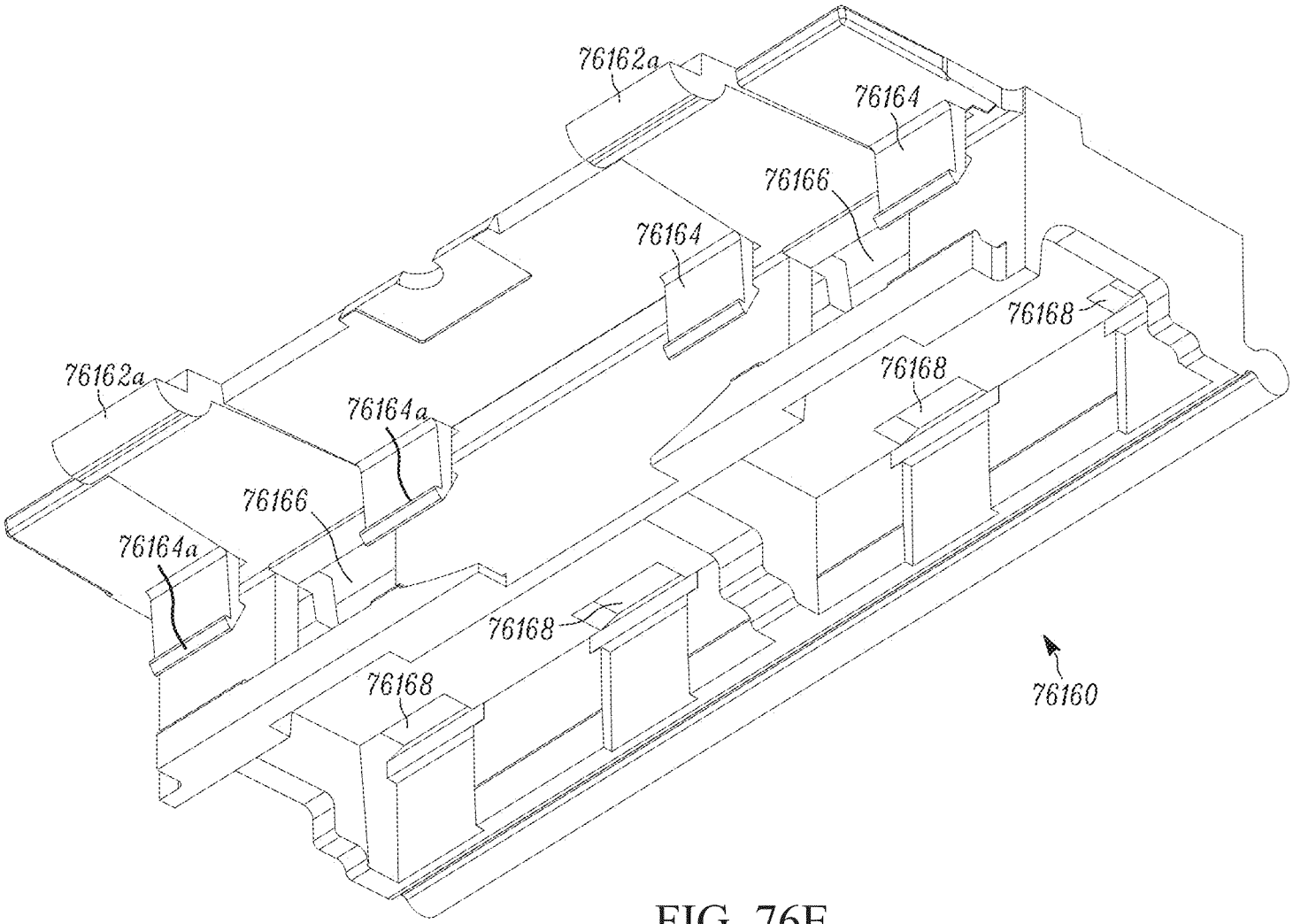

The rail 73194 includes a plate portion 73194*p* that extends rearward of the wall 73194*c*. The plate portion 73194*p* extends along at least a portion of the length of the tray assemblies 73100*a*, 73100*b*. In one form, the plate portion 73194*p* has a depth giving the rail 73194 a total depth of between 8 inches and 24 inches. The plate portion 73194*p* includes interlocking members 73195*a*, 73195*b* for coupling a plurality of adjacent rails 73194. When a plurality of rail sections 73194 are positioned along the length of a shelf, the interlocking members 73195*a*, 73195*b* align adjacent rails 73194 such that the channel portions line up to form one continuous channel. As shown in FIGS. 76A-76C and described below, the plate portion 73194*p* includes a rear stabilizer. The rear stabilizer includes one or more recesses or apertures into which a projection or protrusion of the tray assemblies 73100*a*, 73100*b* is received when the tray assemblies 73100*a*, 73100*b* is in a secured position. The cooperation of the rear stabilizer with the protrusion restricts lateral movement of the rear end of the tray assemblies 73100*a*, 73100*b* relative to the front ends thereof, keeping the tray assemblies 73100*a*, 73100*b* straight. The rail 73194 includes structure for coupling to the top surface of a shelf. Exemplary structure includes adhesive, adhesive strips, high friction materials, magnets, apertures for receiving bolts, screws, or lugs, clamps, or combinations thereof.

In some forms, the tray assemblies 73100*a*, 73100*b* are extendable to aid in restocking. To extend, the product support surface 73123*a*, 73123*b* slides forward relative to the engagement portions 73160 from a retracted, display position (as shown) to an extended stocking position. In some forms, the tray assemblies 73100*a*, 73100*b* may include a tray actuator or release button, such as the release button 52120*a* described above. Alternatively or additionally, the product support surfaces 73123*a*, 73123*b* may be rotatable about a vertical axis relative to the engagement portion 73160. Rotating the product support surfaces provides side access or rear access to the product display channel during restocking.

In FIGS. 73A-73D, the engagement portions 73160 are separate components from the trays 73120*a*, 73120*b*. The engagement portions 73160 are optional or auxiliary components of the tray assemblies 73100*a*, 73100*b*. As such, the same trays 73120*a*, 73120*b* can be utilized in a plurality of tray assemblies configured to attach to different types of shelf units. The engagement portions 73160 are attached to the trays 73120*a*, 73120*b* configured to attach to the top surface of a shelf. The engagement portion 73160 includes one or more protrusions configured to be received within recesses or apertures in the trays 73120*a*, 73120*b* and/or lens 73140. In a preferred form, the protrusions form a snap fit with the trays 73120*a*, 73120*b*. Alternatively or additionally, the engagement portion 73160 includes one or more recesses or apertures configured to receive protrusions of the trays 73120*a*, 73120*b* and/or lens 73140. In some forms, the attachment is detachable. Alternatively, once attached the engagement portion 73160 cannot be detached from the tray assemblies 73100*a*, 73100*b* without breaking the engagement portion 73160, tray 73120*a/b*, or lens 73140. The attachment structure of the engagement portion 73160 may be configured to cooperate with structure of existing trays or lenses so as to retrofit existing tray assemblies for mounting to shelf top rails 73194.

Figure 74:
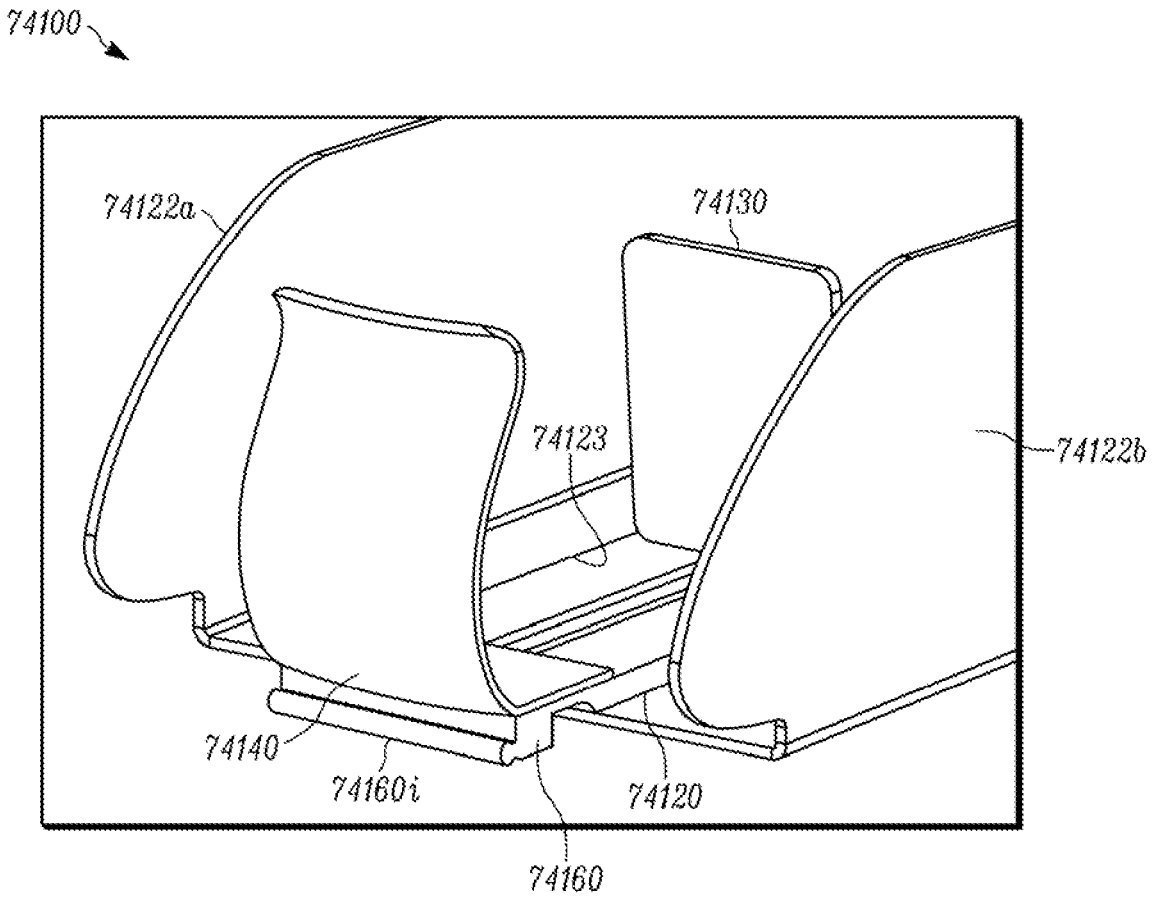
FIG. 74 is a perspective view of a product display having a shelf mounting accessory in accordance with other embodiments of the invention.

In alternative embodiments, the engagement portion is integral with at least one of the tray and the lens. FIG. 74 illustrates a tray assembly 74100 having an integral engagement portion 74160. The engagement portion 74160 includes a forward protrusion 74160*i* sized and configured to be received within a rail, such as the rail 73194 described above. The tray assembly 74100 further includes a pair of opposing sidewalls 74122*a*, 74122*b* and a tray 74120 having a product support surface 74123. The sidewalls 74122*a*, 74122*b* and product support surface 74123 define a channel in which products are displayed. A pusher 74130 is spring biased to face products towards a front lens 74140.

In some forms, one or both sidewalls 74122*a*, 74122*b* are infinitely adjustable relative to the tray 74120 between a fully retracted position and a fully extended position to adjust the width of the product display channel.

Figure 75:
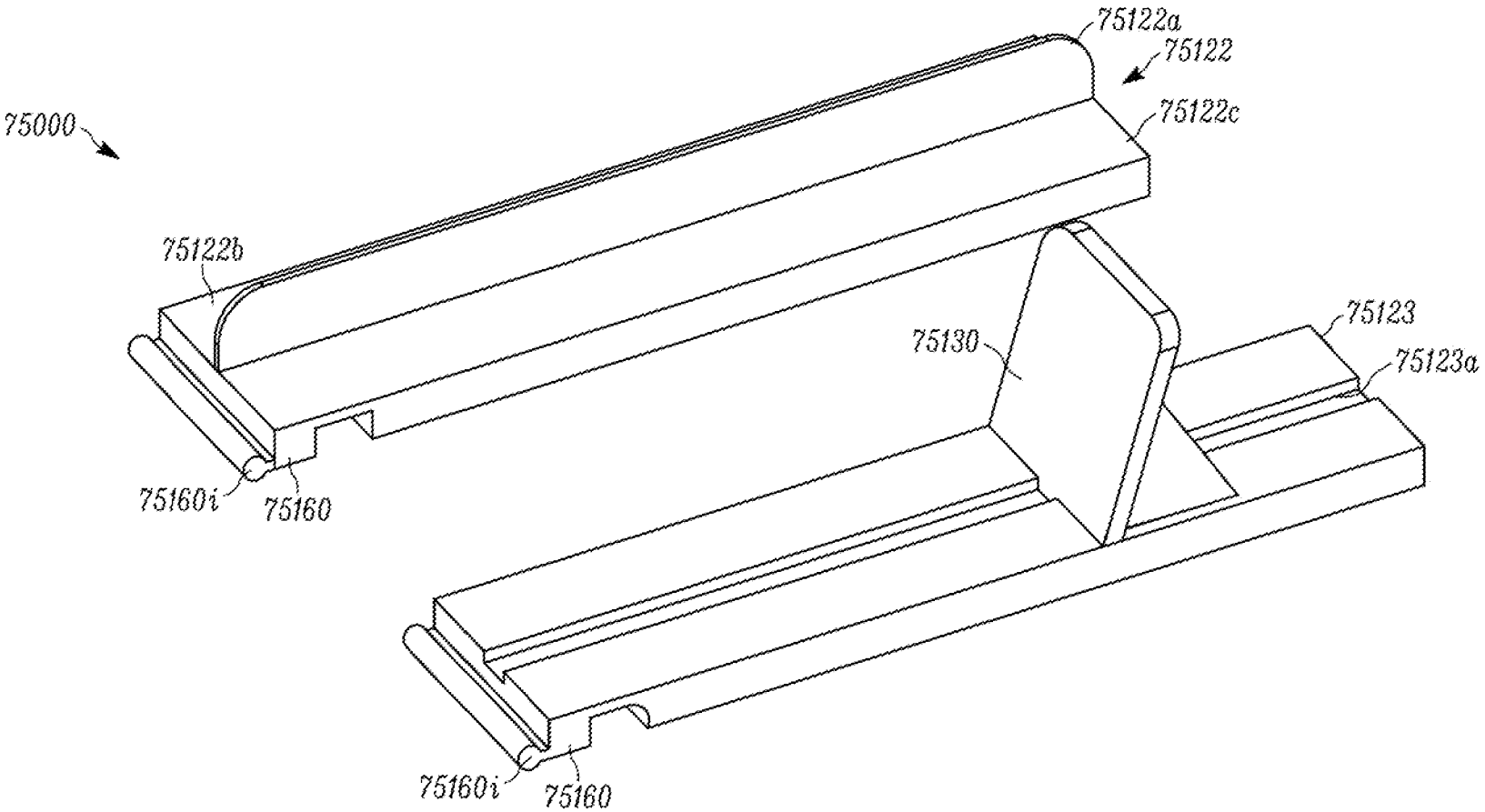
FIG. 75 is a perspective view of a product display having a shelf mounting accessory in accordance with other embodiments of the invention.

FIG. 75 illustrates a product display 75000 having a product support 75123 having an integral engagement portion 75160 and a separate divider 75122 having an integral engagement portion 75160. The engagement portions 75160 are substantially similar to the engagement portions described above, having a protrusion 75160*i* sized and configured to be received in and engage with a shelf top rail. The divider 75122 includes a pair of product support surfaces 75122*b*, 75122*c* disposed on either side of a wall 75122*a*. Products span the distance between the support surface 75122*c* and the product support 75123 so as to be supported by both. The divider 75122 is movable independently of the product support 75123 so as to infinitely adjust the width of the product channel formed thereby. The product support 75123 includes an integral pusher track 75123*a* along which a spring biased pusher 75130 travels. The product support 75123 and divider 75122 each have a downward protrusion (not shown) configured to cooperate with the rear stabilizer of the rail.

FIGS. 76A-76E illustrate a product display 76000. The product display 76000 includes a tray assembly 76100 having a tray 76120 with a product display surface 76123. The tray 76120 is configured to receive a pair of opposing sidewalls and a spring biased pusher, such as those shown above. The sidewalls and pusher have been removed from this embodiment to more clearly show the attachment structure between the tray 76120, lens 76140, and engagement portion 76160.

The product display 76000 further includes a rail 76194. The rail 76194 includes a front channel defined by a front nose 76194*b* and wall 76194*c*. A plate portion 76194*p* with interlocking members 76195*b*, 76195*a* extends rearward from the wall 76194*c*. Proximate the rear end of the rail 76194 is a rear stabilizer 76196. The rear stabilizer 76196 comprises a plurality of slots 76196*a* configured to receive downward protrusions of the tray 76120. The rail 76194 has a depth of at least half the depth of the tray 76120. In some forms, the rail 79194 has a depth of between 8 inches and 24 inches. In a preferred form, the downward protrusion of the tray 76120 is detachable from or movable relative to the tray 76120 such that trays 76120 can be used with rails 76194 of different depths. Alternatively, the protrusion is a set distance from the front end of the tray 76120 such that trays of different lengths are each configured to couple to the same rail 76194. As such, one tray 76194 is usable with a plurality of different depth shelves.

The engagement portion 76160 includes an insertion portion 76160*a* having a forward protrusion 76160*i*. The insertion portion 76160*a* is sized and configured to be received within the channel of the rail 76194 with the protrusion 76160*i* being received within the nose 76194*b*.

The lens 76140, engagement portion 76160, and tray 76120 are configured to detachably couple via snap fit connections. As shown in FIGS. 76B-76C, the lens has one or more rearward extending projections 76142 and one or more downward extending projections 76144. The rearward projections 76142 have a rounded bottom surface 76142*a*. The downward extending projections 76144 have an arrow shaped or barb shaped end 76144*a*. The engagement portion 76160 has one or more upward and forward opening apertures 76166 sized and configured to receive the rearward extending projections 76142. The engagement portion 76160 further includes one or more upward opening apertures 76168 sized and configured to receive the downward extending projections 76144.

In operation, the lens 76140 is tilted or rotated backwards (the top of the lens 76140 is moved rearward relative to the bottom of the lens 76140). With the lens 76140 tilted, the rearward extending projections 76142 are inserted into the corresponding apertures 76166 of the engagement portion. The lens 76140 is then rotated forward about the rearward extending projections 76142, which causes the downward extending projections 76144 to be inserted into the apertures 76168. During insertion, the angled or cam surface of the arrow shaped ends 76144*a* cooperate with the structure of the engagement portion 76160 defining the apertures 76168 which causes the downward extending projections 76144 to deform. When fully inserted, the arrow shaped ends 76144*a* have passed fully through the apertures 76168, enabling them to resiliently return to their non-deformed shape. The arrow shaped ends 76144*a* and the adjacent portion of the engagement portion 76160 form a snap lock or interference lock securing the lens 76140 in position relative to the engagement portion 76160. In order to decouple the lens 76140 from the engagement portion 76160, the downward extending projections 76144 must be deformed out of interference with the engagement portion 76160 such that the lens can be rotated backward to reverse the process described above.

Similarly, the engagement portion 76160 includes one or more rearward extending projections 76162 and one or more downward extending projections 76164. The rearward projections 76162 have a rounded bottom surface 76162*a*. The downward extending projections 76164 have an arrow shaped or barb shaped end 76164*a*. The tray 76120 has one or more upward and/or forward opening apertures 76126 sized and configured to receive the rearward extending projections 76162. The tray 76120 further includes one or more upward opening apertures 76128 sized and configured to receive the downward extending projections 76164.

In operation, the engagement portion 76160 is tilted or rotated backwards. With the engagement portion 76160 tilted, the rearward extending projections 76162 are inserted into the corresponding apertures 76126 of the tray 76120. The engagement portion 76160 is then rotated forward about the rearward extending projections 76162, which causes the downward extending projections 76164 to be inserted into the apertures 76128. During insertion, the angled or cam surface of the arrow shaped ends 76164*a* cooperate with the structure of the tray 76120 defining the apertures 76128 which causes the downward extending projections 76164 to deform. When fully inserted, the arrow shaped ends 76164*a* have passed fully through the apertures 76128, enabling them to resiliently return to their non-deformed shape. The arrow shaped ends 76164*a* and the adjacent portion of the tray 76120 form a snap lock or interference lock securing the engagement portion 76160 in position relative to the tray 76120. In order to decouple the engagement portion 76160 from the tray 76120, the downward extending projections 76164 must be deformed out of interference with the tray 76120 such that the engagement portion can be rotated backward to reverse the process described above.

While FIGS. 76A-76E illustrate a display in which projections of the lens are inserted into the engagement portion and projections of the engagement portion are inserted into the tray, it is understood that other orders are also considered. For example, the lens and engagement portion may each have projections similar to those described above which are inserted into corresponding apertures in the tray. Alternatively, the position of the apertures and projections may be reversed such that the tray has projections that are inserted into the engagement portion which in turn has projections that are inserted into the lens. In still further alternatives, two structures (such as the engagement portion and tray) are attached to each other using projections on each structure which are inserted into corresponding apertures in the other.

In one example, a tray accessory 76000 for mounting a tray 76120 to a shelf comprises a first mount 76160 to connect the tray 76120 to a shelf, the first mount having a first mating structure 76162/76164 for mating the first mount 76160 to at least a portion of the tray at a front or forward portion of the tray 76120, and a second mating structure 76160*a* for mating the first mount 76160 to the shelf at a front or forward portion of the shelf.

The first mating structure 76162/76164 connects onto or is inserted into the front or forward portion of the tray 76120, and the second mating 76160*a* structure comprises a protrusion 76160*i* for mating with a corresponding structure 76194 on the front or forward portion of the shelf.

The second mating structure 76160*a* indirectly mates the first mount 76160 to the shelf via an interconnecting member 76194.

The interconnecting member 76194 includes a rail or channel that the protrusion 76160*i* of the second mating structure connects to.

The interconnecting member 76194 forms a base that may be fastened to the shelf via a fastener including at least one of an adhesive, magnet, pin, bolt, screw or rivet, and the rail or channel formed by the interconnecting member forms an uninterrupted rail or channel that allows for continuous adjustment of the second mating structure along the rail or channel to allow for unlimited positioning over that span.

In some forms, there is a second mount to connect the tray to the shelf, the second mount having a third mating structure for mating the second mount to at least a portion of the tray at a side or intermediate portion of the tray, and a fourth mating structure for mating the second mount to the shelf at an intermediate portion of the shelf. As described above, in one form the second mount comprises a structure configured to movably or removably couple to the bottom of the tray. The structure has a downward protrusion for cooperating with the stabilizer 76196.

The fourth mating structure indirectly mates the second mount to the shelf via the interconnecting member 76194 and the interconnecting member 76194 defines a fifth mating structure 76196 that mates with the fourth mating structure to connect the tray to the shelf.

FIGS. 73A-76E disclose trays having a single product channel. It is understood that the engagement portions described therein can be used with any of the trays described above in the application, such as the tray 100 which has a plurality of product channels.

The pushers described herein are shown as one piece, vertical planes. In alternative embodiments, the pushers include one or more additional portions which are detachable from or movable relative to the pushers to adjust the size of the pushing surface. In some forms, the pusher extends rearward from its engagement point with the tray so as to increase the depth of the product display channel when the pusher is in its rearward most position.

In some embodiments, the lenses described herein are illuminated to better highlight the products being displayed. Alternatively or additionally, the product displays may include indicators, such as mechanical indicators or electrical indicators like lights, for alerting a user when restocking is required.

One advantage to the retrofit structures used herein is that they can connect to existing structures either on the trays themselves (e.g., mating male member 54110*a*, 55110*a*, etc.) and/or on the shelves themselves (e.g., shelf openings 69190*a*, rails 69194, etc.). Some of the accessories further may be customized or adjusted to fit specific shelves. For example, adjustable brackets 58180, 59180, 60180, 61180 may all be adjusted to better fit the shelf mounting accessory and tray assembly to a specific shelving unit. This may mean the brackets are adjustable in height, width, depth and may further mean they exert some form of force on the neighboring structures (e.g., shelf, upright, etc.) in order to secure the tray assembly to the shelf. For example, in some forms clamping forces are used to secure the tray assembly to the shelf, while in other forms, spreading forces are used to secure the tray assembly to the shelf. In some instances, a spacing bracket is used to exert a spreading force and/or to fill a gap between the rear of the shelf and the neighboring upright. In other instances, a cam lever may be operated to exert a clamping force to secure the bracket and tray assembly to a shelving unit.

Thus, both active and passing connectivity is disclosed herein. Passive connectivity may be utilized by supplying a rigid bracket that simply loops or hooks around the rear of the shelf. Other passive connectivity forms may include the use of projections or protrusions (e.g., dowels, bench dog, etc.) from the risers, brackets or support arms to simply engage existing structure on the shelves, such as the existing shelf openings or holes. Conversely, active connectivity may be used by employing the spreader or clamping mechanisms discussed herein, or adding a rail system to the shelf to use such a feature to help connect one or more tray assemblies to the shelf. The active connectivity solutions may be configured to secure the tray assembly or portions thereof (e.g., bracket, riser, etc.) to a shelf in any of the x, y or z directions (e.g., a vertical clamp, horizontal clamp, vertical spreader, horizontal spreader, etc.). In addition, one or more of any of these points of connection may be used to connect the tray assembly to the shelf (e.g., passive only, active only, a combination of both passive and active, etc.). Thus, this may include simple insertion of dowels in one area of the tray assembly and assertion of clamping and/or spreading forces in another area of the tray assembly. In addition, use of features such as a rail connection may further allow for more functionality with respect to the trays, such as the ability to perform intentional lateral movement of same for adjustments of the display planogram (e.g., initial setup, replanogram, cut-ins, etc.), and yet still hinder unintentional movement during use or operation of the tray merchandiser.

The embodiments disclosed herein further provide examples for mounting trays to shelving systems using single and multiple points of connection. For example, metal support bars may be used with a rear bracket that offers a single point of connection to the shelf (single point connectivity). Other embodiments use two point connectivity, such as by using a riser and a rear bracket, two risers, or a riser and an integral riser and rear bracket. Yet other embodiments may use multi-point connectivity such as by using multiple risers and a rear bracket or other examples in which an adjustable rear bracket may be used to provide itself multiple points of connectivity. In yet other forms, the trays disclosed herein may be integrated with one or more of these features to make them a shelf-mounted specific tray (for example, if it is desired to offer two distinct tray product lines with one targeting shelf-mounted applications and the other targeting bar/grid/upright applications).

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims. It is understood that the features of each of the embodiments described herein can be interchanged and/or combined. For example, the product display of FIGS. 76A-76E may include features of the tray of FIGS. 1A-1M.

The invention claimed is:

1. A product display comprising:

a rail having a channel;

a tray comprising a horizontal first product support surface and a first engagement portion having at least one protrusion configured to engage the channel; and a divider comprising a vertical wall and a horizontal second product support surface disposed on one side of the wall, the divider further comprising a second engagement portion having at least one protrusion configured to engage the channel;

wherein the first and second product support surfaces together define at least part of a product channel for supporting products;

wherein the divider is infinitely positionable along the rail independently of the tray to adjust a width of the product channel;

wherein the channel comprises a nose with a rearward-facing opening, and the at least one protrusion on each of the first and second engagement portions projects forwardly and is sized and shaped to fit within the nose by way of the opening;

wherein the rail further comprises a rear wall spaced rearward of the channel, and each of the first and second engagement portions is sized and shaped to frictionally engage the nose with the at least one protrusion, and to frictionally engage a forward facing surface on the rear wall with a rearward facing surface on each of the first and second engagement portions located rearward of the at least one protrusion, so as to mount the respective tray and divider on the rail;

wherein the rear wall extends upwardly from an upper surface of the rail;

wherein the rearward facing surface on each of the first and second engagement portions is defined within a notch on an underside of the respective first or second engagement portion; and wherein the tray and divider are each pivotable upwardly about the at least one protrusion to disengage the respective rearward facing surface on the first or second engagement portion from the forward facing surface on the rear wall, after which the tray and divider can be moved laterally with respect to the rail.

2. The product display of claim 1 wherein the first engagement portion extends substantially forward from the tray.

3. The product display of claim 1, the tray further comprising a spring biased pusher, wherein the spring biased pusher is configured to push products towards a front end of the tray.

4. The product display of claim 1, the rail further having a stabilizer spaced rearward of the channel.

5. The product display of claim 4 wherein the stabilizer comprises at least one elongated slot configured to receive a projection of the tray.

6. The product display of claim 1 wherein the rail includes an attachment structure for coupling to a shelf.

7. The product display of claim 6 wherein the attachment structure includes one or more of a post, an aperture sized to receive a bolt, a high friction material, an adhesive, and a magnet.

8. The product display of claim 1 wherein the tray is detachable from the rail.

9. The product display of claim 1 wherein the first engagement portion is integral with the tray.

10. The product display of claim 1 wherein the second engagement portion is integral with the divider.

11. The product display of claim 1 wherein the divider further comprises a horizontal third product support surface disposed on an opposite side of the wall from the second product support surface.

12. The product display of claim 1 wherein the second engagement portion extends substantially forward from the divider.

* * * * *